US008852397B2

(12) United States Patent
Super et al.

(10) Patent No.: US 8,852,397 B2
(45) **Date of Patent: *Oct. 7, 2014**

(54) METHODS OF MAKING A BELT-CREPED ABSORBENT CELLULOSIC SHEET PREPARED WITH A PERFORATED POLYMERIC BELT

(71) Applicant: Georgia-Pacific Consumer Products LP, Atlanta, GA (US)

(72) Inventors: Guy H. Super, Menasha, WI (US); Paul J. Ruthven, Neenah, WI (US); Stephen J. McCullough, Mount Calvary, WI (US); Daniel H. Sze, Appleton, WI (US); Greg A. Wendt, Neenah, WI (US); Joseph H. Miller, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/933,249

(22) Filed: Jul. 2, 2013

(65) Prior Publication Data

US 2013/0327488 A1 Dec. 12, 2013

Related U.S. Application Data

(60) Continuation of application No. 13/488,597, filed on Jun. 5, 2012, which is a division of application No.

(Continued)

(51) Int. Cl.
*B31F 1/16* (2006.01)
*B31F 1/12* (2006.01)

(Continued)

(52) U.S. Cl.
CPC ..... *B31F 1/16* (2013.01); *D21F 11/006* (2013.01); *D21F 1/0027* (2013.01); *B31F 1/126* (2013.01); *D21H 27/002* (2013.01); *D21H 27/02* (2013.01)
USPC ..... 162/111; 162/109; 162/117

(58) Field of Classification Search
CPC ..... B31F 1/126; B31F 1/16; D21H 27/002; D21H 27/02; D21F 11/006
USPC ..... 162/109, 111, 117, 123; 428/152–153, 428/156, 172; 156/183; 284/282–284
See application file for complete search history.

(56) References Cited

U.S. PATENT DOCUMENTS 2,926,116 A 2/1960 Keim
3,058,873 A 10/1962 Keim et al.

(Continued)

FOREIGN PATENT DOCUMENTS

CA 1002359 A1 12/1976
CA 2053505 4/1992

(Continued)

OTHER PUBLICATIONS

Notification of and Transmittal of International Search Report and the Written Opinion of the International Searching Authority, or the Declaration mailed May 6, 2010, in International Application No. PCT/US2010/022369.

(Continued)

*Primary Examiner* — Jose A Fortuna
(74) *Attorney, Agent, or Firm* — Laura L. Bozek

(57) ABSTRACT

A method of making a belt-creped absorbent cellulosic sheet. The method includes compactively dewatering a papermaking furnish to form a dewatered web having an apparently random distribution of papermaking fiber orientation. The dewatered web is applied to a translating transfer. The web from the transfer surface is belt-creped at a consistency of from about 30% to about 60%, utilizing a generally planar polymeric creping belt having a plurality of perforations. The belt-creping step occurs under pressure in a belt creping nip defined between the transfer surface and the creping belt. The belt travels at a belt speed that is slower than the speed of the transfer surface, and the web is creped from the transfer surface and redistributed on the creping belt to form a web having a plurality of interconnected regions of different local basis weights.

36 Claims, 73 Drawing Sheets

Related U.S. Application Data

12/694,650, filed on Jan. 27, 2010, now Pat. No. 8,293,072.

(60) Provisional application No. 61/206,146, filed on Jan. 28, 2009.

(51) Int. Cl.

| | |
|---|---|
| ***B31F 1/07*** | (2006.01) |
| ***D21F 11/00*** | (2006.01) |
| ***D21F 1/00*** | (2006.01) |
| ***D21H 27/00*** | (2006.01) |
| ***D21H 27/02*** | (2006.01) |

(56) References Cited

U.S. PATENT DOCUMENTS

| | | | |
|---|---|---|---|
| 3,432,936 | A | 3/1969 | Cole et al. |
| 3,545,705 | A | 12/1970 | Hodgson |
| 3,549,742 | A | 12/1970 | Benz |
| 3,556,932 | A | 1/1971 | Coscia et al. |
| 3,556,933 | A | 1/1971 | Williams et al. |
| 3,692,622 | A | 9/1972 | Dunning |
| 3,700,623 | A | 10/1972 | Keim |
| 3,772,076 | A | 11/1973 | Keim |
| 3,858,623 | A | 1/1975 | Lefkowitz |
| 3,926,716 | A | 12/1975 | Bates |
| 3,974,025 | A | 8/1976 | Ayers |
| 3,994,771 | A | 11/1976 | Morgan, Jr. et al. |
| 4,041,989 | A | 8/1977 | Johansson et al. |
| 4,064,213 | A | 12/1977 | Lazorisak et al. |
| 4,071,050 | A | 1/1978 | Codorniu |
| 4,102,737 | A | 7/1978 | Morton |
| 4,112,982 | A | 9/1978 | Bugge et al. |
| 4,149,571 | A | 4/1979 | Burroughs |
| 4,157,276 | A | 6/1979 | Wandel et al. |
| 4,161,195 | A | 7/1979 | Khan |
| 4,182,381 | A | 1/1980 | Gisbourne |
| 4,184,519 | A | 1/1980 | McDonald et al. |
| 4,225,382 | A | 9/1980 | Kearney et al. |
| 4,239,065 | A | 12/1980 | Trokhan |
| 4,314,589 | A | 2/1982 | Buchanan et al. |
| 4,359,069 | A | 11/1982 | Hahn |
| 4,376,455 | A | 3/1983 | Hahn |
| 4,379,735 | A | 4/1983 | MacBean |
| 4,420,372 | A | 12/1983 | Hostetler |
| 4,440,597 | A | 4/1984 | Wells et al. |
| 4,445,638 | A | 5/1984 | Connell et al. |
| 4,448,638 | A | 5/1984 | Klowak |
| 4,453,573 | A | 6/1984 | Thompson |
| 4,468,254 | A | 8/1984 | Yokoyama et al. |
| 4,482,429 | A | 11/1984 | Klowak |
| 4,490,925 | A | 1/1985 | Smith |
| 4,528,239 | A | 7/1985 | Trokhan |
| 4,528,316 | A | 7/1985 | Sorens |
| 4,529,480 | A | 7/1985 | Trokhan |
| 4,533,437 | A | 8/1985 | Curran et al. |
| 4,543,156 | A | 9/1985 | Cheshire et al. |
| 4,546,052 | A | 10/1985 | Nicoll |
| 4,551,199 | A | 11/1985 | Weldon |
| 4,552,709 | A | 11/1985 | Koger, II et al. |
| 4,556,450 | A | 12/1985 | Chuang et al. |
| 4,592,395 | A | 6/1986 | Borel |
| 4,603,176 | A | 7/1986 | Bjorkquist et al. |
| 4,605,585 | A | 8/1986 | Johansson |
| 4,605,702 | A | 8/1986 | Guerro et al. |
| 4,611,639 | A | 9/1986 | Bugge |
| 4,614,679 | A | 9/1986 | Farrington, Jr. et al. |
| 4,637,859 | A | 1/1987 | Trokhan |
| 4,640,741 | A | 2/1987 | Tsuneo |
| 4,675,394 | A | 6/1987 | Solarek et al. |
| 4,689,119 | A | 8/1987 | Weldon |
| 4,709,732 | A | 12/1987 | Kinnunen |
| 4,720,383 | A | 1/1988 | Drach et al. |
| 4,759,391 | A | 7/1988 | Waldvogel et al. |
| 4,759,976 | A | 7/1988 | Dutt |
| 4,795,530 | A | 1/1989 | Soerens et al. |
| 4,803,032 | A | 2/1989 | Schulz |
| 4,804,769 | A | 2/1989 | Solarek et al. |
| 4,834,838 | A | 5/1989 | Klowak |
| 4,849,054 | A | 7/1989 | Klowak |
| 4,866,151 | A | 9/1989 | Tsai et al. |
| 4,942,077 | A | 7/1990 | Wendt et al. |
| 4,967,085 | A | 10/1990 | Bryan et al. |
| 4,973,512 | A | 11/1990 | Stanley et al. |
| 4,981,557 | A | 1/1991 | Bjorkquist |
| 4,983,748 | A | 1/1991 | Tsai et al. |
| 4,998,568 | A | 3/1991 | Vohringer |
| 5,008,344 | A | 4/1991 | Bjorkquist |
| 5,016,678 | A | 5/1991 | Borel et al. |
| 5,023,132 | A | 6/1991 | Stanley et al. |
| 5,048,589 | A | 9/1991 | Cook et al. |
| 5,054,525 | A | 10/1991 | Vohringer |
| 5,066,532 | A | 11/1991 | Gaisser |
| 5,073,235 | A | 12/1991 | Trokhan |
| 5,085,736 | A | 2/1992 | Bjorkquist |
| 5,087,324 | A | 2/1992 | Awofeso et al. |
| 5,098,519 | A | 3/1992 | Ramasubramanian et al. |
| 5,098,522 | A | 3/1992 | Smurkoski et al. |
| 5,103,874 | A | 4/1992 | Lee |
| 5,114,777 | A | 5/1992 | Gaisser |
| 5,129,988 | A | 7/1992 | Farrington, Jr. |
| 5,137,600 | A | 8/1992 | Barnes et al. |
| 5,138,002 | A | 8/1992 | Bjorkquist |
| 5,167,261 | A | 12/1992 | Lee |
| 5,182,164 | A | 1/1993 | Eklund et al. |
| 5,199,261 | A | 4/1993 | Baker |
| 5,199,467 | A | 4/1993 | Lee |
| 5,211,815 | A | 5/1993 | Ramasubramanian et al. |
| 5,215,617 | A | 6/1993 | Grupe |
| 5,217,756 | A | 6/1993 | Shinzawa |
| 5,219,004 | A | 6/1993 | Chiu |
| 5,223,096 | A | 6/1993 | Phan et al. |
| 5,225,269 | A | 7/1993 | Bohlin |
| 5,240,562 | A | 8/1993 | Phan et al. |
| 5,245,025 | A | 9/1993 | Trokhan et al. |
| 5,262,007 | A | 11/1993 | Phan et al. |
| 5,264,082 | A | 11/1993 | Phan et al. |
| 5,277,761 | A | 1/1994 | Van Phan et al. |
| 5,312,522 | A | 5/1994 | Van Phan et al. |
| 5,314,584 | A | 5/1994 | Grinnell et al. |
| 5,314,585 | A | 5/1994 | Ward |
| 5,328,565 | A | 7/1994 | Rasch et al. |
| 5,336,373 | A | 8/1994 | Scattolino et al. |
| 5,338,807 | A | 8/1994 | Espy et al. |
| 5,348,620 | A | 9/1994 | Hermans et al. |
| 5,366,785 | A | 11/1994 | Sawdai |
| 5,368,696 | A | 11/1994 | Cunnane, III et al. |
| 5,372,876 | A | 12/1994 | Johnson et al. |
| 5,379,808 | A | 1/1995 | Chiu |
| 5,411,636 | A | 5/1995 | Hermans et al. |
| 5,415,737 | A | 5/1995 | Phan et al. |
| 5,431,840 | A | 7/1995 | Soldanski et al. |
| 5,449,026 | A | 9/1995 | Lee |
| 5,451,353 | A | 9/1995 | Rezai et al. |
| 5,492,598 | A | 2/1996 | Hermans et al. |
| 5,494,554 | A | 2/1996 | Edwards et al. |
| 5,501,768 | A | 3/1996 | Hermans et al. |
| 5,503,715 | A | 4/1996 | Trokhan et al. |
| 5,505,818 | A | 4/1996 | Hermans et al. |
| 5,508,818 | A | 4/1996 | Hamma |
| 5,510,001 | A | 4/1996 | Hermans et al. |
| 5,510,002 | A | 4/1996 | Hermans et al. |
| 5,549,790 | A | 8/1996 | Van Phan |
| 5,556,509 | A | 9/1996 | Trokhan et al. |
| 5,593,545 | A | 1/1997 | Rugowski et al. |
| 5,601,871 | A | 2/1997 | Krzysik et al. |
| 5,607,551 | A | 3/1997 | Farrington, Jr. et al. |
| 5,609,725 | A | 3/1997 | Van Phan |
| 5,614,293 | A | 3/1997 | Krzysik et al. |
| 5,618,612 | A | 4/1997 | Gstrein |
| H1672 | H | 8/1997 | Hermans et al. |
| 5,656,132 | A | 8/1997 | Farrington, Jr. et al. |
| 5,657,797 | A | 8/1997 | Townley et al. |

(56) References Cited

U.S. PATENT DOCUMENTS 5,667,636 A 9/1997 Engel et al.
5,672,248 A 9/1997 Wendt et al.
5,674,590 A 10/1997 Anderson et al.
5,674,663 A 10/1997 McFarland et al.
5,690,149 A 11/1997 Lee
5,695,607 A 12/1997 Oriaran et al.
5,709,775 A 1/1998 Trokhan et al.
5,725,734 A 3/1998 Herman et al.
5,746,887 A 5/1998 Wendt et al.
5,772,845 A 6/1998 Farrington, Jr. et al.
5,776,312 A 7/1998 Trokhan et al.
5,814,190 A 9/1998 Van Phan
5,830,321 A 11/1998 Lindsay et al.
5,837,103 A 11/1998 Trokhan et al.
5,840,403 A 11/1998 Trokhan et al.
5,840,404 A 11/1998 Graff
5,851,353 A 12/1998 Fiscus et al.
5,871,887 A 2/1999 Trokhan et al.
5,888,347 A 3/1999 Engel et al.
5,897,745 A 4/1999 Ampulski et al.
5,932,068 A 8/1999 Farrington, Jr. et al.
5,935,381 A 8/1999 Trokhan et al.
5,935,681 A 8/1999 Paulett
5,961,782 A 10/1999 Luu et al.
6,017,417 A 1/2000 Wendt et al.
6,027,611 A 2/2000 McFarland et al.
6,033,736 A 3/2000 Perlman et al.
6,036,820 A 3/2000 Schiel et al.
6,036,909 A 3/2000 Baum
6,080,279 A 6/2000 Hada et al.
6,083,346 A 7/2000 Hermans et al.
6,093,284 A 7/2000 Hada et al.
6,096,169 A 8/2000 Hermans et al.
6,117,525 A 9/2000 Trokhan et al.
6,133,405 A 10/2000 Allen
6,136,146 A 10/2000 Phan et al.
6,139,686 A 10/2000 Trokhan et al.
6,143,135 A 11/2000 Hada et al.
6,146,499 A 11/2000 Lin et al.
6,149,769 A 11/2000 Mohammadi et al.
6,161,303 A 12/2000 Beck
6,162,327 A 12/2000 Batra et al.
6,171,442 B1 1/2001 Farrington, Jr. et al.
6,187,137 B1 2/2001 Druecke et al.
6,190,506 B1 2/2001 Beck
6,197,154 B1 3/2001 Chen et al.
6,200,419 B1 3/2001 Phan
6,207,011 B1 3/2001 Luu et al.
6,210,528 B1 4/2001 Wolkowicz
6,228,220 B1 5/2001 Hada et al.
6,245,197 B1 6/2001 Oriaran et al.
6,248,203 B1 6/2001 Beck
6,261,679 B1 7/2001 Chen et al.
6,274,042 B1 8/2001 Beck
6,280,573 B1 8/2001 Lindsay et al.
6,287,426 B1 9/2001 Edwards et al.
6,287,427 B1 9/2001 Beck
6,306,257 B1 10/2001 Hada et al.
6,306,258 B1 10/2001 Lange et al.
6,315,864 B2 11/2001 Anderson et al.
6,318,727 B1 11/2001 Hada
6,321,963 B1 11/2001 Gracyalny et al.
6,331,230 B1 12/2001 Hermans et al.
6,350,349 B1 2/2002 Hermans et al.
6,379,496 B2 4/2002 Edwards et al.
6,381,868 B1 5/2002 Grabscheid et al.
6,412,678 B2 7/2002 Gracyalny et al.
6,413,368 B1 7/2002 Dwiggins et al.
6,416,631 B1 7/2002 Beck
6,419,793 B1 7/2002 Beck
6,420,013 B1 7/2002 Vinson et al.
6,432,267 B1 8/2002 Watson
6,432,270 B1 8/2002 Liu et al.
6,436,234 B1 8/2002 Chen et al.
6,447,640 B1 9/2002 Watson et al.
6,447,641 B1 9/2002 Wolkowicz et al.
6,454,904 B1 9/2002 Hermans et al.
6,461,474 B1 10/2002 Lindsay et al.
6,464,829 B1 10/2002 Chen et al.
6,478,927 B1 11/2002 Chen et al.
6,497,789 B1 12/2002 Hermans et al.
6,500,302 B2 12/2002 Dwiggins et al.
6,514,382 B1 2/2003 Kakiuchi et al.
6,534,151 B2 3/2003 Merker
6,540,879 B2 4/2003 Marinack et al.
6,547,924 B2 4/2003 Klerelid et al.
6,551,461 B2 4/2003 Hermans et al.
6,562,198 B2 5/2003 Beck et al.
6,565,707 B2 5/2003 Behnke et al.
6,579,418 B2 6/2003 Lindsay et al.
6,585,855 B2 7/2003 Drew et al.
6,589,394 B2 7/2003 Beck
6,592,067 B2 7/2003 Denen et al.
6,607,638 B2 8/2003 Drew et al.
6,610,173 B1 8/2003 Lindsay et al.
6,616,812 B2 9/2003 Beck
6,645,420 B1 11/2003 Beck
6,660,362 B1 12/2003 Lindsay et al.
6,669,821 B2 12/2003 Edwards et al.
6,673,210 B2 1/2004 Beck
6,692,008 B2 2/2004 Beck
6,698,681 B1 3/2004 Guy et al.
6,701,637 B2 3/2004 Lindsay et al.
6,702,924 B2 3/2004 Beck
6,709,548 B2 3/2004 Marinack et al.
6,746,558 B2 6/2004 Hoeft et al.
6,749,723 B2 6/2004 Linden
6,752,907 B2 6/2004 Edwards et al.
6,766,977 B2 7/2004 Denen et al.
6,793,170 B2 9/2004 Denen et al.
6,797,115 B2 9/2004 Klerelid et al.
6,827,819 B2 12/2004 Dwiggins et al.
6,838,887 B2 1/2005 Denen et al.
6,871,815 B2 3/2005 Moody et al.
6,964,117 B2 11/2005 Parent
6,986,932 B2 1/2006 Zink et al.
6,998,017 B2 2/2006 Lindsay et al.
6,998,022 B2 2/2006 Hultcrantz
7,070,678 B2 7/2006 Allen et al.
7,094,320 B1 8/2006 Phan
7,122,235 B2 10/2006 Bourdelais et al.
7,160,418 B2 1/2007 Edwards et al.
7,300,543 B2 11/2007 Mullally et al.
7,320,743 B2 1/2008 Freidbauer et al.
7,351,307 B2 4/2008 Scherb et al.
7,387,706 B2 6/2008 Herman et al.
7,399,378 B2 7/2008 Edwards et al.
7,416,637 B2 8/2008 Murray et al.
7,435,312 B2 10/2008 Lindsay et al.
7,442,278 B2 10/2008 Murray et al.
7,476,293 B2 1/2009 Herman et al.
7,494,563 B2 2/2009 Edwards et al.
7,503,998 B2 3/2009 Murray et al.
7,510,631 B2 3/2009 Scherb et al.
7,563,344 B2 7/2009 Beuther et al.
7,584,017 B2 9/2009 Sugano et al.
7,585,388 B2 9/2009 Yeh et al.
7,585,389 B2 9/2009 Yeh et al.
7,585,392 B2 9/2009 Kokko et al.
7,588,660 B2 9/2009 Edwards et al.
7,588,661 B2 9/2009 Edwards et al.
7,591,925 B2 9/2009 Scherb et al.
7,608,164 B2 10/2009 Chou et al.
7,651,589 B2 1/2010 Murray et al.
7,662,255 B2 2/2010 Murray et al.
7,662,257 B2 2/2010 Edwards et al.
7,670,457 B2 3/2010 Murray et al.
7,686,923 B2 3/2010 Scherb et al.
7,691,228 B2 4/2010 Edwards et al.
7,704,349 B2 4/2010 Edwards et al.
7,726,349 B2 6/2010 Mullally et al.
7,785,443 B2 8/2010 Hermans et al.
7,789,995 B2 9/2010 Super et al.
7,811,418 B2 10/2010 Klerelid et al.

(56) References Cited

U.S. PATENT DOCUMENTS

| | | | | |
|---|---|---|---|---|
| 7,820,008 | B2 | 10/2010 | Edwards et al. | |
| 7,828,931 | B2 | 11/2010 | Edwards et al. | |
| 7,850,823 | B2 | 12/2010 | Chou et al. | |
| 7,871,493 | B2 | 1/2011 | Hermans et al. | |
| 7,918,964 | B2 | 4/2011 | Edwards et al. | |
| 7,927,456 | B2 | 4/2011 | Murray et al. | |
| 7,931,781 | B2 | 4/2011 | Scherb et al. | |
| 7,935,220 | B2 | 5/2011 | Edwards et al. | |
| 7,951,269 | B2 | 5/2011 | Herman et al. | |
| 7,959,761 | B2 | 6/2011 | Boettcher et al. | |
| 7,985,319 | B2 | 7/2011 | Pringle et al. | |
| 8,075,739 | B2 | 12/2011 | Scherb et al. | |
| 8,092,652 | B2 | 1/2012 | Scherb et al. | |
| 8,118,979 | B2 | 2/2012 | Herman et al. | |
| 8,142,612 | B2 | 3/2012 | Murray et al. | |
| 8,152,957 | B2 | 4/2012 | Edwards et al. | |
| 8,152,958 | B2 | 4/2012 | Super et al. | |
| 8,177,938 | B2 | 5/2012 | Sumnicht | |
| 8,226,797 | B2 | 7/2012 | Murray et al. | |
| 8,236,140 | B2 | 8/2012 | Scherb et al. | |
| 8,257,552 | B2 | 9/2012 | Edwards et al. | |
| 8,293,072 | B2 | 10/2012 | Super et al. | |
| 8,328,985 | B2 | 12/2012 | Edwards et al. | |
| 8,388,803 | B2 | 3/2013 | Super et al. | |
| 8,388,804 | B2 | 3/2013 | Super et al. | |
| 8,394,236 | B2 | 3/2013 | Edwards et al. | |
| 8,398,818 | B2 | 3/2013 | Edwards et al. | |
| 8,398,820 | B2 | 3/2013 | Edwards et al. | |
| 8,435,381 | B2 | 5/2013 | Murray et al. | |
| 8,608,909 | B2 | 12/2013 | Scherb et al. | |
| 8,632,658 | B2 * | 1/2014 | Miller et al. | 162/129 |
| 8,652,300 | B2 * | 2/2014 | Super et al. | 162/111 |
| 2001/0008180 | A1 | 7/2001 | Anderson et al. | |
| 2002/0062936 | A1 | 5/2002 | Klerelid et al. | |
| 2002/0088577 | A1 | 7/2002 | Watson et al. | |
| 2002/0134520 | A1 | 9/2002 | Behnke et al. | |
| 2002/0148584 | A1 | 10/2002 | Edwards et al. | |
| 2002/0187307 | A1 | 12/2002 | Tanaka et al. | |
| 2002/0189773 | A1 | 12/2002 | Marinack et al. | |
| 2003/0000664 | A1 | 1/2003 | Drew et al. | |
| 2003/0021952 | A1 | 1/2003 | Zink et al. | |
| 2003/0040574 | A1 | 2/2003 | Schertz et al. | |
| 2003/0056919 | A1 | 3/2003 | Beck | |
| 2003/0056921 | A1 | 3/2003 | Beck et al. | |
| 2003/0056922 | A1 | 3/2003 | Beck | |
| 2003/0056923 | A1 | 3/2003 | Beck | |
| 2003/0056925 | A1 | 3/2003 | Beck | |
| 2003/0059563 | A1 | 3/2003 | Bourdelais et al. | |
| 2003/0098134 | A1 | 5/2003 | Scherb et al. | |
| 2003/0102098 | A1 | 6/2003 | Allen et al. | |
| 2003/0111195 | A1 | 6/2003 | Hu | |
| 2003/0121626 | A1 | 7/2003 | Hultzcrantz | |
| 2003/0131959 | A1 | 7/2003 | Marinack et al. | |
| 2003/0146581 | A1 | 8/2003 | Beck | |
| 2003/0153443 | A1 | 8/2003 | Beck | |
| 2003/0201579 | A1 * | 10/2003 | Gordon et al. | 264/441 |
| 2003/0203196 | A1 * | 10/2003 | Trokhan et al. | 428/364 |
| 2004/0050514 | A1 | 3/2004 | Shannon et al. | |
| 2004/0089168 | A1 | 5/2004 | Beck | |
| 2004/0211534 | A1 | 10/2004 | Clungeon et al. | |
| 2004/0226673 | A1 | 11/2004 | Edwards et al. | |
| 2004/0238135 | A1 | 12/2004 | Edwards et al. | |
| 2004/0241786 | A1 | 12/2004 | Procop | |
| 2005/0006040 | A1 | 1/2005 | Boettcher et al. | |
| 2005/0217814 | A1 | 10/2005 | Super et al. | |
| 2005/0236122 | A1 | 10/2005 | Mullally et al. | |
| 2005/0241786 | A1 | 11/2005 | Edwards et al. | |
| 2005/0241787 | A1 | 11/2005 | Murray et al. | |
| 2005/0268274 | A1 | 12/2005 | Beuther et al. | |
| 2005/0279471 | A1 | 12/2005 | Murray et al. | |
| 2006/0000567 | A1 | 1/2006 | Murray et al. | |
| 2006/0061016 | A1 * | 3/2006 | Gordon et al. | 264/465 |
| 2006/0085998 | A1 | 4/2006 | Herman et al. | |
| 2006/0088696 | A1 | 4/2006 | Manifold et al. | |
| 2006/0237154 | A1 | 10/2006 | Edwards et al. | |
| 2006/0289133 | A1 | 12/2006 | Yeh et al. | |
| 2006/0289134 | A1 | 12/2006 | Yeh et al. | |
| 2007/0062656 | A1 | 3/2007 | Murray et al. | |
| 2007/0107863 | A1 | 5/2007 | Edwards et al. | |
| 2007/0137807 | A1 | 6/2007 | Schulz et al. | |
| 2007/0137814 | A1 | 6/2007 | Gao | |
| 2007/0144694 | A1 | 6/2007 | Pringle et al. | |
| 2007/0204966 | A1 | 9/2007 | Chou et al. | |
| 2008/0008860 | A1 | 1/2008 | Murray et al. | |
| 2008/0008865 | A1 | 1/2008 | Luu et al. | |
| 2008/0029235 | A1 | 2/2008 | Edwards et al. | |
| 2008/0035288 | A1 | 2/2008 | Mullally et al. | |
| 2008/0047675 | A1 | 2/2008 | Murray et al. | |
| 2008/0083519 | A1 | 4/2008 | Kokko et al. | |
| 2008/0099169 | A1 | 5/2008 | Beuther et al. | |
| 2008/0135195 | A1 | 6/2008 | Hermans et al. | |
| 2008/0156450 | A1 | 7/2008 | Klerelid et al. | |
| 2008/0173419 | A1 | 7/2008 | Sumnicht | |
| 2008/0236772 | A1 | 10/2008 | Edwards et al. | |
| 2008/0245492 | A1 | 10/2008 | Edwards et al. | |
| 2008/0264589 | A1 | 10/2008 | Chou et al. | |
| 2009/0038768 | A1 | 2/2009 | Murray et al. | |
| 2009/0120598 | A1 | 5/2009 | Edwards et al. | |
| 2009/0159223 | A1 | 6/2009 | Edwards et al. | |
| 2009/0294079 | A1 | 12/2009 | Edwards et al. | |
| 2009/0301675 | A1 | 12/2009 | Edwards et al. | |
| 2009/0321027 | A1 | 12/2009 | Hermans et al. | |
| 2010/0126682 | A1 | 5/2010 | Murray et al. | |
| 2010/0170647 | A1 | 7/2010 | Edwards et al. | |
| 2010/0282423 | A1 | 11/2010 | Super et al. | |
| 2011/0155337 | A1 | 6/2011 | Murray et al. | |
| 2012/0021178 | A1 | 1/2012 | Miller et al. | |
| 2012/0145341 | A1 | 6/2012 | Super et al. | |
| 2012/0145343 | A1 | 6/2012 | Edwards et al. | |
| 2012/0152474 | A1 | 6/2012 | Murray et al. | |
| 2012/0152475 | A1 | 6/2012 | Edwards et al. | |
| 2012/0160434 | A1 | 6/2012 | Murray et al. | |
| 2012/0160435 | A1 | 6/2012 | Edwards et al. | |
| 2012/0164407 | A1 | 6/2012 | Edwards et al. | |
| 2012/0180965 | A1 | 7/2012 | Super et al. | |
| 2012/0180966 | A1 | 7/2012 | Super et al. | |
| 2012/0180967 | A1 | 7/2012 | Edwards et al. | |
| 2012/0211186 | A1 | 8/2012 | Murray et al. | |
| 2012/0211187 | A1 | 8/2012 | Murray et al. | |
| 2012/0216972 | A1 | 8/2012 | Murray et al. | |
| 2012/0241113 | A1 | 9/2012 | Super et al. | |
| 2012/0247698 | A1 * | 10/2012 | Murray et al. | 162/111 |
| 2013/0153164 | A1 | 6/2013 | Miller et al. | |
| 2013/0186581 | A1 * | 7/2013 | Super et al. | 162/111 |

FOREIGN PATENT DOCUMENTS

| | | | |
|---|---|---|---|
| EP | 0 098 683 | A2 | 1/1984 |
| EP | 0 399 522 | A2 | 11/1990 |
| EP | 0 972 876 | A2 | 1/2000 |
| EP | 1 036 880 | A1 | 9/2000 |
| EP | 1 201 796 | A1 | 5/2002 |
| EP | 1 985 754 | A2 | 10/2008 |
| GB | 2 319 537 | A | 5/1998 |
| GB | 2 380 977 | A | 4/2003 |
| JP | 57-66193 | U | 4/1982 |
| JP | 5-506893 | A | 10/1993 |
| JP | 8003890 | A | 1/1996 |
| JP | 2002-504196 | A | 2/2002 |
| JP | 2002-525455 | A | 8/2002 |
| JP | 2007-519834 | A | 7/2007 |
| RU | 2143508 | C1 | 12/1999 |
| RU | 2226231 | C1 | 3/2004 |
| WO | 85/03962 | A1 | 9/1985 |
| WO | 91/16492 | A1 | 10/1991 |
| WO | 96/06223 | A1 | 2/1996 |
| WO | 97/03247 | A1 | 1/1997 |
| WO | 97/43484 | A1 | 11/1997 |
| WO | 99/49131 | A1 | 9/1999 |
| WO | 00/14330 | A1 | 3/2000 |
| WO | 00/19014 | A1 | 4/2000 |
| WO | 00/36212 | A2 | 6/2000 |
| WO | 00/40405 | A1 | 7/2000 |
| WO | 01/85109 | A1 | 11/2001 |

(56) References Cited

FOREIGN PATENT DOCUMENTS

| | | | |
|---|---|---|---|
| WO | 02/40769 | A2 | 5/2002 |
| WO | 2004/033793 | A2 | 4/2004 |
| WO | 2005/103375 | A1 | 11/2005 |
| WO | 2005/106117 | A1 | 11/2005 |
| WO | 2006/009833 | A1 | 1/2006 |
| WO | 2006/113025 | A2 | 10/2006 |
| WO | 2006/115817 | A2 | 11/2006 |
| WO | 2007/001837 | A2 | 1/2007 |
| WO | 2007/139726 | A1 | 12/2007 |
| WO | 2008/045770 | A2 | 4/2008 |
| WO | 2010/088359 | A1 | 8/2010 |

OTHER PUBLICATIONS

Written Opinion mailed May 6, 2010, in International Application No. PCT/US2010/022369.

International Search Report completed Apr. 22, 2010, and mailed May 6, 2010, in International Application No. PCT/US2010/022369.

EPO Communication mailed Jul. 22, 2013, including an Extended European Search Report completed Jul. 12, 2013, issued in European Patent Application No. 13002824.4-1308.

Cresson, Thierry M., Hiroshi Tomimasu and Phillip Luner, "Characterization of paper formation Part 1: sensing paper formation," Tappi Journal, Jul. 1990. pp. 153-159.

Egan, R. R., "Cationic Surface Active Agents as Fabric Softeners," J. Am. Oil Chemists' Soc., Jan. 1978, vol. 55. pp. 118-121.

Espy, Herbert H., "Chapter 2 Alkaline-Curing Polymeric Amine-Epichlorohydrin Resins," Wet Strength Resins and Their Application. L. Chan, Editor (1994). pp. 13-44.

Evans, W. P., "Cationic fabric softeners," Chemistry and Industry, Jul. 5, 1969. pp. 893-903.

Keller, D.S., and J. J. Pawlak, "[Beta]-Radiographic Imaging of Paper Formation Using Storage Phosphor Screens," Journal of Pulp and Paper Science, vol. 27, No. 4, Apr. 2001. pp. 117-123.

Klerelid, Ingvar, and Ola Thomasson, "Advantage (TM) NTT (TM): low energy, high quality," Tissue World, Oct./Nov. 2008. pp. 49-52.

Sung, Y.J., C. H. Ham, O. Kwon, H. L. Lee, and D. S. Keller, "Applications of Thickness and Apparent Density Mapping by Laser Profilometry," 13th Fundamental Research Symposium, Cambridge, Sep. 2005. pp. 961-1007.

Trivedi, B. C., et al., "Quaternization of Imidazoline: Unequivocal Structure Proof," J. Am. Oil Chemists' Soc., Jun. 1981. pp. 754-756.

Westfeld, Lars, "Chemistry of Paper West Strength. I. A Survey of Mechanisms of Wet-Strength Development," Cellulose Chemistry and Technology, vol. 13, 1979. pp. 813-825.

Egyptian Office Action issued May 14, 2014, in counterpart Egyptian Patent Application No. 2011071262, with an English translation.

Communication including an extended European Search Report dated Jun. 5, 2014, which issued in counterpart European Patent Application No. 14001119.8-1308.

* cited by examiner

18" Hg VACUUM, CALENDERED, BELT 50, BELT SIDE, 10x

23" Hg VACUUM, UNCALENDERED, BELT 50, BELT SIDE, 40x

23" Hg VACUUM, UNCALENDERED, BELT 50, 45° BELT SIDE, 50x

23" Hg VACUUM, UNCALENDERED, BELT 50, YANKEE SIDE, 40x

23" Hg VACUUM, UNCALENDERED, BELT 50, 45° YANKEE SIDE, 50x

NO VACUUM, UNCALENDERED, BELT 50

MEAN WT = 18.52(lbs/3000ft$^2$), AREA = |1.5" x 1.5"|

MICRO BASIS WEIGHT PROFILE

LEADING EDGE

BELT 50

BELT 50

BELT 50 CD SLICE

BELT 50 CD SLICE

BELT 100

BELT 100

VACUUM OFF, UNCALENDERED, BELT 50, BELT SIDE, 10x

VACUUM OFF, UNCALENDERED, BELT 50, YANKEE SIDE, 10x

VACUUM OFF, UNCALENDERED, BELT 50, MD

VACUUM OFF, UNCALENDERED, BELT 50, MD

VACUUM OFF, UNCALENDERED, BELT 50, CD

VACUUM OFF, UNCALENDERED, BELT 50, BELT SIDE

VACUUM OFF, UNCALENDERED, BELT 50, YANKEE SIDE

18" Hg VACUUM, UNCALENDERED, BELT 50, BELT SIDE, 10x

18" Hg VACUUM, UNCALENDERED, BELT 50, YAKEE SIDE, 10x

18" Hg, VACUUM, UNCALENDERED, BELT 50, MD

18" Hg VACUUM, UNCALENDERED, BELT 50, MD

18" Hg VACUUM, UNCALENDERED, BELT 50, CD

18" Hg VACUUM, UNCALENDERED, BELT 50, BELT SIDE

18" Hg VACUUM, UNCALENDERED, BELT 50, YANKEE SIDE

18" Hg VACUUM, CALENDERED, BELT 50, BELT SIDE, 10x

18" Hg VACUUM, CALENDERED, BELT 50, YANKEE SIDE, 10x

18" Hg VACUUM, CALENDERED, BELT 50, MD

700

720

740

758

760

18" Hg VACUUM, CALENDERED, BELT 50, MD

18" Hg VACUUM, CALENDERED, BELT 50, CD

18" Hg VACUUM, CALENDERED, BELT 50, BELT SIDE

18" VACUUM, CALENDERED, BELT 50, YANKEE SIDE

FABRIC SIDE, MULTILAYER FABRIC

YANKEE SIDE, MULTILAYER FABRIC

SURFACE TEXTURE MEAN FORCE

SURFACE TEXTURE MEAN FORCE

18" VACUUM, CALENDERED, BELT 50

MEAN WT= 15.9(lbs/3000ft$^2$), AREA = |1.5" x 1.5"|

MICRO BASIS WEIGHT PROFILE

23" Hg VACUUM, UNCALENDERED, BELT 50, BELT SIDE
MEAN Wt = 16.91 (lbs/3000ft$^2$), AREA = |1.5" x 1.5"|

MICRO BASIS WEIGHT PROFILE

NO VACUUM, UNCALENDERED, BELT 50
MEAN WT = 18.52(lbs/3000ft$^2$), AREA = |1.5" x 1.5"|

MICRO BASIS WEIGHT PROFILE

18" Hg VACUUM, UNCALENDERED, BELT 50
MEAN WT = 15.2(lbs/3000ft$^2$), AREA = |1.5" x 1.5"|

MICRO BASIS WEIGHT PROFILE

FABRIC CREPED MEAN WT = 15.41(lbs/3000ft$^2$), AREA = |1.5" x 1.5"|

MICRO BASIS WEIGHT PROFILE

COMMERCIAL TISSUE MEAN WT = 11.72(lbs/3000ft$^2$), AREA = |1.5" x 1.5"|

MICRO BASIS WEIGHT PROFILE

COMMERCIAL TOWEL MEAN WT = 13.04(lbs/3000ft$^2$), AREA = |1.5" x 1.5"|

MICRO BASIS WEIGHT PROFILE

STARTING IMAGE
(β-RADIOGRAPHY)

2D FFT,
CREATE FILTER MASK

REVERSE 2D
FFT WITH MASK

IMAGE SUBSTRACTION
24(A) - 24(C)

BELT SIDE

YANKEE SIDE

BELT SIDE

YANKEE SIDE

BELT SIDE AT 45 DEGREE TILT

YANKEE SIDE AT 45 DEGREE TILT

CROSS SECTION CUT ALONG THE MD THROUGH "DOMES"

CROSS SECTION CUT ALONG THE MD THROUGH "DOMES"

CROSS SECTION CUT ALONG THE CD THROUGH "DOMES"

BELT SIDE (10x)

YANKEE SIDE (10x)

BELT SIDE (20x)

YANKEE SIDE (20x)

BELT SIDE (64x)

YANKEE SIDE (64x)

PHOTOGRAPH 10.0

STRENGTH VS. PANEL SOFTNESS

X-RAY TOMOGRAPHY XY SLICE (TOP VIEW) OF AN eTAD DOME (SAMPLE 19682)

CROSS SECTION 1

CROSS SECTION 2

CROSS SECTION 3

METHODS OF MAKING A BELT-CREPED ABSORBENT CELLULOSIC SHEET PREPARED WITH A PERFORATED POLYMERIC BELT

CROSS-REFERENCE TO RELATED APPLICATIONS

This application is a continuation application of U.S. patent application Ser. No. 13/488,597, filed Jun. 5, 2012, and published on Sep. 27, 2012, as U.S. Patent Application Publication No. 2012/0241113 A1, which is a divisional application of U.S. Patent Application Ser. No. 12/694,650, filed Jan. 27, 2010, now U.S. Pat. No. 8,293,072 which was published as U.S. Patent Application Publication No. 2010/0186913 A1 on Jul. 29, 2010, and claims priority of U.S. Provisional Patent Application No. 61/206,146 filed Jan. 28, 2009. This application also relates to the following U.S. Patent Applications and U.S. Patents: U.S. patent application Ser. No. 11/804,246, entitled "Fabric Creped Absorbent Sheet with Variable Local Basis Weight", filed May 16, 2007, Publication No. 2008/0029235, now U.S. Pat. No. 7,494,563, which was based upon U.S. Provisional Patent Application No. 60/808,863,filed May 26, 2006; U.S. patent application Ser. No. 10/679,862, entitled "Fabric Crepe Process for Making Absorbent Sheet", filed Oct. 6, 2003, Publication No. 2004/0238135, now U.S. Pat. No. 7,399,378; U.S. patent application Ser. No.11/108,375, entitled "Fabric Crepe/Draw Process for Producing Absorbent Sheet", filed Apr. 18, 2005, Publication No. 2005/0217814, now U.S. Pat. No. 7,789,995, which application is a continuation-in-part of U.S. patent application Ser. No. 10/679,862, entitled "Fabric Crepe Process for Making Absorbent Sheet", filed Oct. 6, 2003, Publication No. 2004/0238135, now U.S. Pat. No. 7,399,378; U.S. patent application Ser. No 11/108,458, entitled "Fabric Crepe and In Fabric Drying Process for Producing Absorbent Sheet", filed Apr. 18, 2005, Publication No. 2005/0241787, now U.S. Pat. No. 7,442,278, which application was based upon U.S. Provisional Patent Application No. 60/563,519, filed Apr. 19, 2004; U.S. patent application Ser. No. 11/151,761, entitled "High Solids Fabric Crepe Process for Producing Absorbent Sheet With In-Fabric Drying", filed Jun. 14, 2005, Publication No. 2005/0279471, now U.S. Pat. No. 7,503,998, which was based upon U.S. Provisional Patent Application No. 60/580,847 filed Jun. 18, 2004; U.S. patent application Ser. No. 11/402,609, entitled "Multi-Ply Paper Towel With Absorbent Core", filed Apr. 12, 2006, Publication No. 2006/0237154, now U.S. Pat. No. 7,662,257, which application was based upon U.S. Provisional Patent Application No. 60/673,492, filed Apr. 21, 2005; U.S. patent application Ser. No. 11/104,014, entitled "Wet-Pressed Tissue and Towel Products With Elevated CD Stretch and Low Tensile Ratios Made With a High Solids Fabric Crepe Process", filed Apr. 12, 2005, Publication No. 2005/0241786, now U.S. Pat. No. 7,588,660, which application was based upon U.S, Provisional Patent Application No. 60/562,025, filed Apr. 14, 2004; and U.S. patent application Ser. No. 11/451,111, entitled "Method of Making Fabric-Creped Sheet for Dispensers", filed Jun. 12, 2006, Publication No. 2006/0289134, now U.S. Pat. No. 7,585,389, which application was based upon U.S. Provisional Patent Application No. 60/693,699, filed Jun. 24, 2005; U.S. patent application Ser. No. 11/678,669, entitled "Method of Controlling Adhesive Build-Up on a Yankee Dryer", filed Feb. 26, 2007, Publication No. 2007/0204966, now U.S. Pat. No. 7,850,823; U.S. patent application Ser. No. 11/901,599, entitled "Process for Producing Absorbent Sheet", filed Sep. 18, 2007, Publication No. 2008/0047675, now U.S. Pat. No. 7,651,589, which application is a divisional of the application that matured into U.S. Pat. No. 7,442,278, discussed above; U.S. patent application Ser. No. 11/901,673, entitled "Absorbent Sheet", filed Sep. 18, 2007, Publication No. 2008/0008860, now U.S. Pat. No. 7,662,255, which application is a divisional of the application that matured into U.S. Pat. No. 7,442,278, discussed above; U.S. patent application Ser. No. 12/156,820, entitled "Fabric Crepe Process for Making Absorbent Sheet", filed Jun. 5, 2008, Publication No. 2008/0236772, now U.S. Pat. No. 7,588,661, which application is a divisional of the application that matured into U.S. Pat. No. 7,399,378, discussed above; U.S. patent application Ser. No. 12/156,834, entitled "Fabric Crepe Process for Makin Absorbent Sheet", filed Jun. 5, 2008, Publication No. 2008/0245492, now U.S. Pat. No. 7,704,349, which application is a divisional of the application that matured into U.S. Pat. No. 7,399,378, discussed above; and U.S. patent application Ser. No. 12/286,435, entitled "Process for Producing Absorbent Sheet", filed Sep. 30, 2008, Publication No. 2009/0038768, now U.S. Pat. No. 7,670,457, which application is a divisional of the application that matured into U.S. Pat. No. 7,442,278, discussed above. The disclosures of the foregoing patents and patent applications are incorporated herein by reference in their entireties.

TECHNICAL FIELD

This application relates to methods of making a belt-creped absorbent cellulosic sheet prepared with a perforated polymeric belt. Typical products for tissue and towel include a plurality of arched or domed regions interconnected by a generally planar, densified fibrous network including at least some areas of consolidated fiber bordering the domed areas. The domed regions have a leading edge with a relatively high local basis weight and, at their lower portions, transition sections that include upwardly and inwardly inflected sidewall areas of consolidated fiber.

BACKGROUND

Methods of making paper tissue, towel, and the like, are well known, including various features such as Yankee drying, through-air drying (TAD), fabric creping, dry creping, wet creping, and so forth. Wet pressing processes have certain advantages over through-air drying (TAD) processes including: (1) lower energy costs associated with the mechanical removal of water rather than transpiration drying with hot air, and (2) higher production speeds, which are more readily achieved with processes that utilize wet pressing to form a web. See, Klerelid et al., Advantage™ *NTT™: low energy, high quality*, pages 49-52, Tissue World, October/November, 2008. On the other hand, through-air drying processes have become the method of choice for new capital investment, particularly, for the production of soft, bulky, premium quality towel products.

U.S. Pat. No. 7,435,312 to Lindsay et al. suggests a method of making a through-air dried product including rush-transferring the web followed by structuring the web on a deflection member and applying a latex binder. The patent also suggests a variation in basis weight between dome and network areas in the sheet. See col. 28, lines 55+. U.S. Pat. No. 5,098,522 to Smurkoski et al. describes a deflection member or belt with holes therethrough for making a textured web structure. The backside, or machine side of the belt has an irregular, textured surface that is reported to reduce fiber accumulation on equipment during manufacturing. U.S. Pat. No. 4,528,239 to Trokhan discusses a through-air dry process using a deflection fabric with deflection conduits to produce an absorbent sheet with a domed structure. The deflection member is made using photopolymer lithography. U.S. Patent Application Publication No. 2006/0088696 suggests a fibrous sheet that includes domed areas and cross machine direction (CD) knuckles having a product of caliper and a CD modulus of at least 10,000. The sheet is prepared by forming the sheet on a wire, transferring the sheet to a deflection member, throughdrying the sheet and imprinting the sheet on a Yankee dryer. The nascent web is dewatered by noncompressive means; See ¶156, page 10. U.S. Patent Application Publication No. 2007/0137814 of Gao describes a throughdrying process for making an absorbent sheet that includes rush-transferring a web to a transfer fabric and transferring the web to a through drying fabric with raised portions. The throughdrying fabric may be travelling at the same or a different speed than that of the transfer fabric. See ¶39. Note also U.S. Patent Application Publication No. 2006/0088696 of Manifold et al.

Fabric creping has also been referred to in connection with papermaking processes that include mechanical or compactive dewatering of the paper web as a means to influence products properties. See, US. Pat. No. 5,314,584 to Grinnell et al.; No. 4,689,119 and No. 4,551,199 to Weldon; No. 4,849,054 to Klowak; and No. 6,287,426 to Edwards et al. In many cases, operation of fabric creping processes has been hampered by the difficult of effectively transferring a web of high or intermediate consistency to a dryer. Further patents relating to fabric creping include the following: Nos. 4,834,838; 4,482,429 as well as No. 4,448,638. Note also U.S. Pat. No. 6,350,349 to Hermans et al., which discloses wet transfer of a web from a rotating transfer surface to a fabric. See also U.S. Patent Application Publication No. 2008/0135195 of Hermans et al., now U.S. Pat. No. 7,785,443, which discloses an additive resin composition that can be used in a fabric crepe process to increase strength. Note FIG. 7. U.S. Patent Application Publication No. 2008/0156450 of Klerelid et al., now U.S. Pat. No. 7,811,418, discloses a papermaking process with a wet press nip followed by transfer to a belt with microdepressions followed by downstream transfer to a structuring fabric.

In connection with papermaking processes, fabric molding as a means to provide texture and bulk is reported in the literature. U.S. Pat. No. 5,073,235 to Trokhan discloses a process for making absorbent sheet using a photopolymer belt which is stabilized by application of anti-oxidants to the belt. The web is reported to have a networked, domed structure that may have a variation in basis weight. See Col. 17, lines 48+ and FIG. 1E. There is seen in U.S. Pat. No. 6,610,173 to Lindsay et al. a method of imprinting a paper web during a wet pressing event that results in asymmetrical protrusions corresponding to the deflection conduits of a deflection member. The '173 patent reports that a differential velocity transfer during a pressing event serves to improve the molding and imprinting of a web with a deflection member. The tissue webs produced are reported as having particular sets of physical and geometrical properties, such as a pattern densified network and a repeating pattern of protrusions having asymmetrical structures. U.S. Pat. No. 6,998,017 to Lindsay et al. discloses a method of imprinting a paper web by pressing the web with a deflection member onto a Yankee dryer and/or by wet-pressing the web from a forming fabric onto the deflection member. The deflection member may be formed by laser-drilling the terephthalate copolymer (PETG) sheet and affixing the sheet to a throughdrying fabric. See Example 1, Col. 44. The sheet is reported to have asymmetric domes in some embodiments. Note FIGS. 3A and 3B.

U.S. Pat. No. 6,660,362 to Lindsay et al. enumerates various constructions of deflection members for imprinting tissue. In a typical construction, a patterned photopolymer is utilized. See Col. 19, line 39 through Col. 31, line 27. With respect to wet-molding of a web using textured fabrics, see also, the following U.S. Pat. Nos. 6,017,417 and 5,672,248 both to Wendt et al.; No. 5,505,818 to Hermans et al. and No. 4,637,859 to Trokhan. U.S. Pat. No. 7,320,743 to Freidbauer et al. discloses a wet-press process using a patterned absorbent papermaking felt with raised projections for imparting texture to a web while pressing the web onto a Yankee dryer. The process is reported to decrease tensiles. See Col. 7. With respect to the use of fabrics used to impart texture to a mostly dry sheet, see U.S. Pat. No. 6,585,855 to Drew et al., as well as U.S. Patent Application Publication No. 2003/0000664, now U.S. Pat. No. 6,607,638.

U.S. Pat. No. 5,503,715 to Trokhan et al. refers to a cellulosic fibrous structure having multiple regions distinguished from one another by basis weight. The structure is reported as having an essentially continuous higher basis weight network, and discrete regions of lower basis weight that circumscribe discrete regions of intermediate basis weight. The cellulosic fibers forming the low basis weight regions may be radially oriented relative to the centers of the regions. The paper is described as being formed by using a forming belt having zones with different flow resistances. The basis weight of a region of the paper is said to be generally inversely proportional to the flow resistance of the zone of the forming belt, upon which such a region was formed. See also, U.S. Pat. No. 7,387,706 to Herman et al. A similar structure is reported in U.S. Pat. No. 5,935,381, also to Trokhan et al., where the use of different fiber types is described. See also U.S. Pat. No. 6,136,146 to Phan et al. Also noteworthy in this regard is U.S. Pat. No. 5,211,815 to Ramasubramanian et al. which discloses a wet-press process for making absorbent sheet using a layered forming fabric with pockets. The product is reported to have high bulk and fiber alignment where many fiber segments or fiber ends are "on end" and substantially parallel to one another within the pockets forming on the sheet, which are interconnected with a network region substantially in the plane of the sheet. See also, U.S. Pat. No. 5,098,519 to Ramasubramanian et al.

Through-air dried (TAD), creped products are also disclosed in the following patents: U.S. Pat. No. 3,994,771 to Morgan, Jr. et al.; U.S. Pat. No. 4,102,737 to Morton; U.S. Pat. No. 4,440,597 to Wells et al. and U.S. Pat. No. 4,529,480 to Trokhan. The processes described in these patents comprise, very generally, forming a web on a foraminous support, thermally pre-drying the web, applying the web to a Yankee dryer with a nip defined, in part, by an impression fabric, and creping the product from the Yankee dryer. Transfer to the Yankee typically takes place at web consistencies of from about 60% to about 70%. A relatively uniformly permeable web is typically required.

Through-air dried products tend to provide desirable product attributes such as enhanced bulk and softness; however, thermal dewatering with hot air tends to be energy intensive and requires a relatively uniformly permeable substrate, necessitating the use of virgin fiber or virgin equivalent recycle fiber. More cost effective, environmentally preferred and readily available recycle furnishes with elevated fines content, for example, tend to be far less suitable for throughdry processes. Thus, wet-press operations wherein the webs are mechanically dewatered are preferable from an energy perspective and are more readily applied to furnishes containing recycle fiber which tends to form webs with permeability which is usually lower and less uniform than webs formed with virgin fiber. A Yankee dryer can be more easily employed because a web is transferred thereto at consistencies of 30% or so which enables the web to be firmly adhered for drying. In one proposed method of improving wet-pressed products, U.S. Patent Application Publication No. 2005/0268274 of Beuther et al. discloses an air-laid web combined with a wet-laid web. This layering is reported to increase softness, but would no doubt be expensive and difficult to operate efficiently.

Despite the many advances in the art, improvements in absorbent sheet qualities such as bulk, softness and tensile strength generally involve compromising one property in order to gain advantage in another or involve prohibitive expense and/or operating difficulty. Moreover, existing premium products generally use limited amounts of recycle fiber or none at all, despite the fact that the use of recycle fiber is beneficial to the environment and is much less expensive as compared with virgin kraft fiber.

SUMMARY OF THE INVENTION

In accordance with this invention, an improved variable basis weight product exhibits, among other preferred properties, surprising caliper or bulk. A typical product has a repeating structure of arched raised portions that define hollow areas on their opposite side. The raised arched portions or domes have a relatively high local basis weight interconnected with a network of densified fiber. Transition areas bridging the connecting regions and the domes include upwardly and optionally inwardly inflected consolidated fiber. Generally speaking, the furnish is selected and the steps of belt creping, applying a vacuum and drying are controlled such that a dried web is formed having a plurality of fiber-enriched hollow domed regions protruding from the upper surface of the sheet, the hollow domed regions having a sidewall of relatively high local basis weight formed along at least a leading edge thereof, and connecting regions forming a network interconnecting the fiber-enriched hollow domed regions of the sheet, wherein consolidated groupings of fibers extend upwardly from the connecting regions into the sidewalls of the fiber-enriched hollow domed regions along at least the leading edge thereof. Preferably, such consolidated groupings of fibers are present at least at the leading and trailing edges of the domed areas. In many cases, the consolidated groupings of fibers form saddle shaped regions extending at least partially around the domed areas. These regions appear to be especially effective in imparting bulk accompanied by high roll firmness to the absorbent sheet.

In other preferred aspects of the invention, the network regions form a densified (but not so highly densified as to be consolidated) reticulum imparting enhanced strength to the web.

This invention is directed, in part, to absorbent products produced by way of belt-creping a web from a transfer surface with a perforated creping belt formed from a polymer material, such as polyester. In various aspects, the products are characterized by a fiber matrix that is rearranged by belt creping from an apparently random wet-pressed structure to a shaped structure with fiber-enriched regions and/or a structure with fiber orientation and shape that defines a hollow dome-like repeating pattern in the web. In still further aspects of the invention, non-random CD orientation bias in a regular pattern is imparted to the fiber in the web.

Belt creping occurs under pressure in a creping nip while the web is at a consistency between about 30 and 60 percent. Without intending to be bound by theory, it is believed that the velocity delta in the belt-creping nip, the pressure employed and the belt and nip geometry cooperate with the nascent web of 30 to 60 percent consistency to rearrange the fiber, while the web is still labile enough to undergo structural change and re-form hydrogen bonds between rearranged fibers in the web due to Campbell's interactions when the web is dried. At consistencies above about 60 percent, it is believed there is insufficient water present to provide for sufficient reformation of hydrogen bonds between fibers as the web dries to impart the desired structural integrity to the microstructure of the web, while below about 30 percent, the web has too little cohesion to retain the features of the high solids fabric-creped structure provided by way of the belt-creping operation.

The products are unique in numerous aspects, including smoothness, absorbency, bulk and appearance.

The process can be more efficient than TAD processes using conventional fabrics, especially with respect to the use of energy and vacuum, which is employed in production to enhance caliper and other properties. A generally planar belt can more effectively seal off a vacuum box with respect to the solid areas of the belt, such that the airflow due to the vacuum is efficiently directed through the perforations in the belt and through the web. So also, the solid portions of the belt, or "lands" between perforations, are much smoother than a woven fabric, providing a better "hand" or smoothness on one side of the sheet and texture in the form of domes when suction is applied on the other side of the sheet, which increases caliper, bulk, and absorbency. Without suction or vacuum applied, "slubbed" regions include arched or domed structures adjacent to pileated regions that are fiber-enriched as compared with other areas of the sheet.

In yarn production, fiber-enriched texture or "slubs" are produced by including uneven lengths of fiber in spinning, providing a pleasing, bulky texture with fiber-enriched areas in the yarn. In accordance with the invention, "slubs" or fiber-enriched regions are introduced onto the web by redistributing fiber into perforations of the belt to form local fiber-enriched regions defining a pileated, hollow dome repeating structure that provides surprising caliper, especially, when a vacuum is applied to the web while the web is held in the creping belt. The domed regions in the sheet appear to have fiber with an inclined, partially erect orientation that is upwardly inflected and consolidated or very highly densified in wall areas, which is believed to contribute substantially to the surprising caliper and roll firmness observed. Fiber orientation on the sidewalls of the arched or domed regions is biased in the cross-machine direction (CD) in some regions, while fiber orientation is biased toward the cap in some regions as is seen in the photomicrographs, the scanning electron micrographs (SEM's) and the β-radiograph images attached. Also provided is a densified, but not necessarily, consolidated, generally planar, network interconnecting the domed or arched regions, also of variable local basis weight.

The belt-creping operation may be effective to tessellate the sheet into distinct adjacent areas of like and/or interfitting repeating shapes, if so desired, as will be appreciated from the following description and appended Figures.

In one aspect, our invention provides a method of making a belt-creped absorbent cellulosic sheet. The method includes (a) compactively dewatering a papermaking furnish to form a dewatered web having an apparently random distribution of papermaking fiber orientation, (b) applying the dewatered web having the apparently random distribution of fiber orientation to a translating transfer surface that is moving at a transfer surface speed, (c) belt-creping the web from the transfer surface at a consistency of from about 30% to about 60% utilizing a generally planar polymeric creping belt provided with a plurality of perforations through the belt, the belt-creping step occurring under pressure in a belt creping nip defined between the transfer surface and the creping belt, wherein the belt is traveling at a belt speed that is slower than the speed of the transfer surface, the belt geometry, nip parameters, velocity delta and web consistency being selected such that the web is creped from the transfer surface and redistributed on the creping belt to form a web having a plurality of interconnected regions of different local basis weights including at least (i) a plurality of fiber-enriched regions of a relatively high local basis weight, interconnected by way of (ii) a plurality of connecting regions having a relatively low local basis weight, and (d) drying the web.

The unique aspects of our invention are better understood with reference to FIGS. 1A to E, 2A and 2B, and FIG. 3.

Referring to FIG. 1A, a plan view photomicrograph (10×) shows a portion of the belt-side of an absorbent sheet 10 produced in accordance with the invention. Sheet 10 has on its belt-side surface, a plurality of fiber-enriched domed regions 12, 14, 16, and so forth, arranged in a regular repeating pattern corresponding to the pattern of a perforated polymer belt used to make it. Regions 12, 14, 16 are spaced from each other and interconnected by a plurality of surround areas 18, 20, 22 that form a consolidated network and have less texture, but nevertheless exhibit minute folds, as can be seen in FIGS. 1B to 1E and 3. It will be seen in the various Figures that the minute folds form ridges on the "dome" side of the sheet and furrows or sulcations on the side opposite the dome side of the sheet. In other photomicrographs, as well as radiographs presented herein, it will be apparent that basis weight in the domed regions can vary considerably from point-to-point.

Referring to FIG. 1B, a plan view photomicrograph (at higher magnification, 40×) shows another sheet 10 produced in accordance with the present invention. The uncalendered sheet of FIGS. 1B to 1E was produced on a papermachine of the class shown in FIGS. 10B and 10D with a creping belt of the type shown in FIGS. 4 to 7 wherein a 23" Hg (77.9 kPa) vacuum was applied to the web while it was on belt 50 (FIGS. 10B and 10D). FIG. 1B shows the belt side of sheet 10 with the upper surfaces of the dome regions such as seen at 12 adjacent to flatter network areas as seen at area 18. FIG. 1C is a 45° inclined view of the sheet of FIG. 1B at slightly higher magnification (50×). CD fiber orientation bias is seen along the leading and trailing edges of the domes areas as well as along leading edges and trailing areas of ridges, such as ridge 19 in the network areas. Note the CD orientation bias at 11, 13, 15, and 17, for example (FIGS. 1B and 1C).

FIG. 1D is a plan view photomicrograph (40×) of the Yankee side of the sheet of FIGS. 1B, 1C, and FIG. 1E is a 45° inclined view of the Yankee side. It is seen in these photomicrographs that the hollow regions 12 have fiber orientation bias in the CD at their leading and trailing edges, as well as high basis weight at these areas. Note also, the region 12, particularly at the location indicated at 21, has been so highly densified as to be consolidated, and is deflected upwardly into the dome leading to greatly enhanced bulk. Note also, fiber orientation in the cross machine direction at 23.

The elevated local basis weight at the leading edge of the domed areas is perhaps seen best in FIG. 1E at 25. Sulcations in the Yankee side of the sheet in the network area are relatively shallow as seen at 27.

Still another noteworthy feature of the sheet is the upward or "on end" fiber orientation at the leading and trailing edges of the domed areas, especially at the leading areas as is seen, for example at 29. This orientation does not appear on the "CD" edges of the domes where the orientation appears more random.

FIG. 2A is a β-radiograph image of a basesheet of the invention, the calibration for basis weight also appearing on the right. The sheet of FIG. 2A was produced on a papermachine of the class shown in FIGS. 10B, 10D using a creping belt of the geometry illustrated in FIGS. 4 to 7. This sheet was produced without applying a vacuum to the creping belt and without calendaring. It is also seen in FIG. 2B that there is a substantial, regularly recurring basis weight variation in the sheet.

FIG. 2B is a micro basis weight profile of the sheet of FIG. 2A over a distance of 40 mm along line 5-5 of FIG. 2A, which is along the machine direction (MD). It is seen in FIG. 2B that the local basis weight variation is of a regular frequency, exhibiting minima and maxima about a mean value of about 18.5 lbs/3000 $ft^2$ (30.2 $g/m^2$) with pronounced peaks every 2-3 mm, roughly twice as frequent as the sheet of FIGS. 17A and 17B, discussed hereafter. This is consistent with the photomicrographs of FIG. 11A and following, discussed later in this application, wherein it is seen that a sheet without a vacuum applied has more high basis weight pileated regions apparent adjacent to domed areas. In FIG. 2B, the basis weight profile variation appears substantially monomodal in the sense that the mean basis weight remains relatively constant and the variation of basis weight is regularly recurring about the mean value.

It is seen in FIGS. 2A and 2B that the sheet exhibits a micro basis weight profile showing an extremely regular pattern and a large variation, typically, wherein the high basis weight regions exhibit a local basis weight that is at least 25% higher, 35% higher, 45% higher or more than adjacent low basis weight regions of the sheet.

FIG. 3 is a scanning electron micrograph (SEM) along the machine direction of a sheet, such as sheet 10 of FIG. 1A, showing a cross section of a domed region, such as region 12 and its surrounding area 18. Area 18 has minute folds 24, 26 that appear to be of a relatively high local basis weight as compared to densified regions 28, 30. The high basis weight regions appear to have fiber orientation bias in the cross-machine direction (CD) as evidenced by the number of fiber "end cuts" seen in FIG. 3, as well as the SEM's and the photomicrographs discussed hereinafter.

Domed region 12 has a somewhat asymmetric, hollow dome shape with a cap 32, which is fiber-enriched with a relatively high local basis weight, particularly, at the "leading" edge toward right hand side 35 of FIG. 3 where the dome and sidewalls 34, 36 are formed on belt perforations as discussed hereafter. Note that the sidewall at 34 is very highly densified and has an upwardly and inwardly inflected consolidated structure that extends inwardly and upwardly from the surrounding generally planar network region, forming transition areas with upwardly and inwardly inflected consolidated fiber that transition from the connecting regions to the domed regions. The transition areas may extend completely around and circumscribe the bases of the domes or may be densified in a horseshoe or bowed shape around, or only partly around, the bases of the domes, such as mostly on one side of the dome. The sidewalls again curve inwardly at ridge line 40, for example, towards an apex region or raised portion of the dome.

Without intending to be bound by any theory, it is believed this unique, hollow dome structure contributes substantially to the surprising caliper values seen with the sheet, as well as the roll compression values seen with the products of the invention.

In other cases, the fiber-enriched hollow domed regions project from the upper side of the sheet and have both relatively high local basis weight and consolidated caps, the consolidated caps having the general shape of a portion of a spheroidal shell, more preferably, having the general shape of an apical portion of a spheroidal shell.

Further details and attributes of the inventive products and process for making them are discussed below.

BRIEF DESCRIPTION OF THE DRAWINGS

The invention is described in detail below with reference to the various Figures, wherein like numerals designate similar parts. The file of this patent contains at least one drawing executed in color. Copies of this patent or patent application publication with color drawings will be provided in the U.S. Patent and Trademark Office upon request and payment of the necessary fee. In the Figures:

FIG. 29G is an optical photomicrograph of the belt used to belt crepe the toweling shown in FIGS. 29A to 29F, while

Figure 1A:
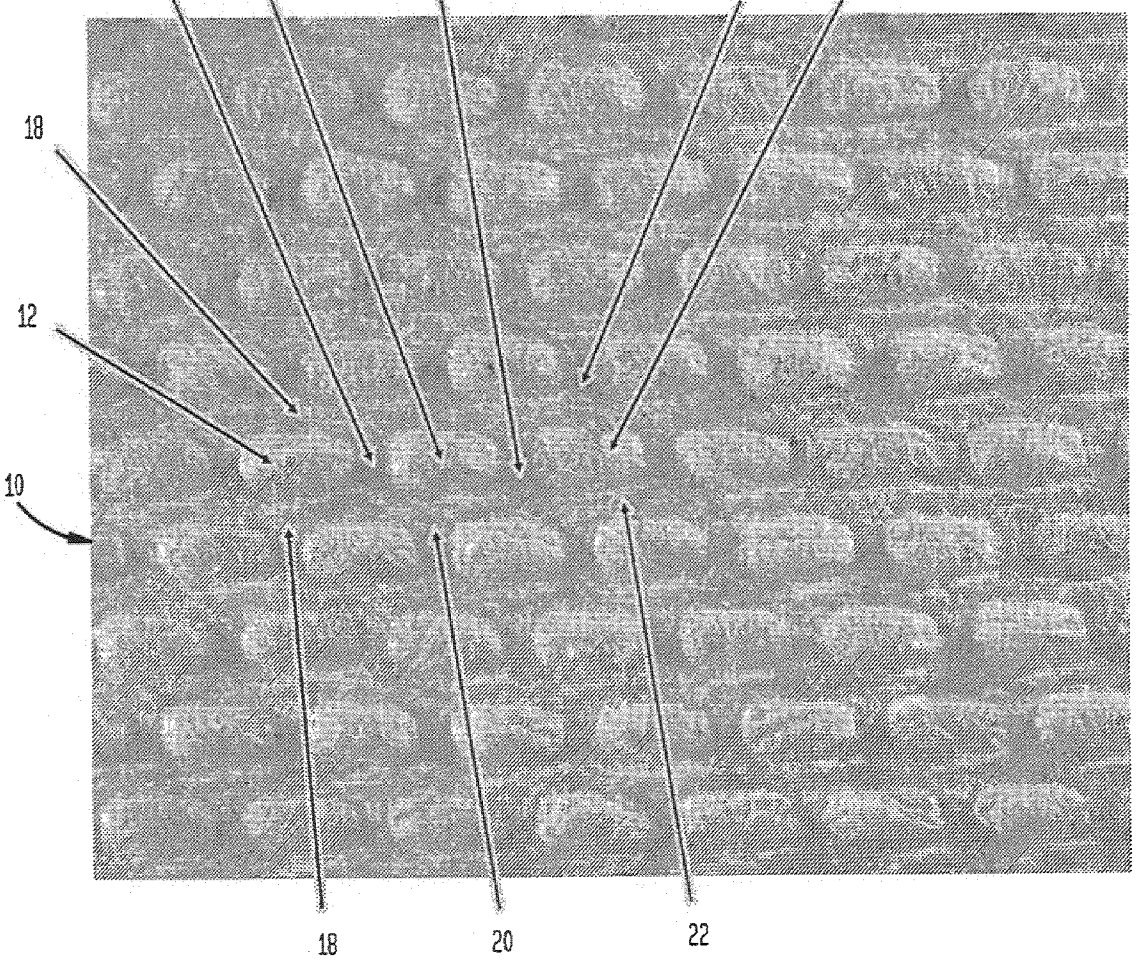
FIG. 1A is a plan view photomicrograph (10×) of the belt-side of a calendered absorbent basesheet produced with the belt of FIG. 4 to FIG. 7 utilizing 18" Hg (60.9 kPa) of vacuum applied after transfer to the belt.
Figure 1B:
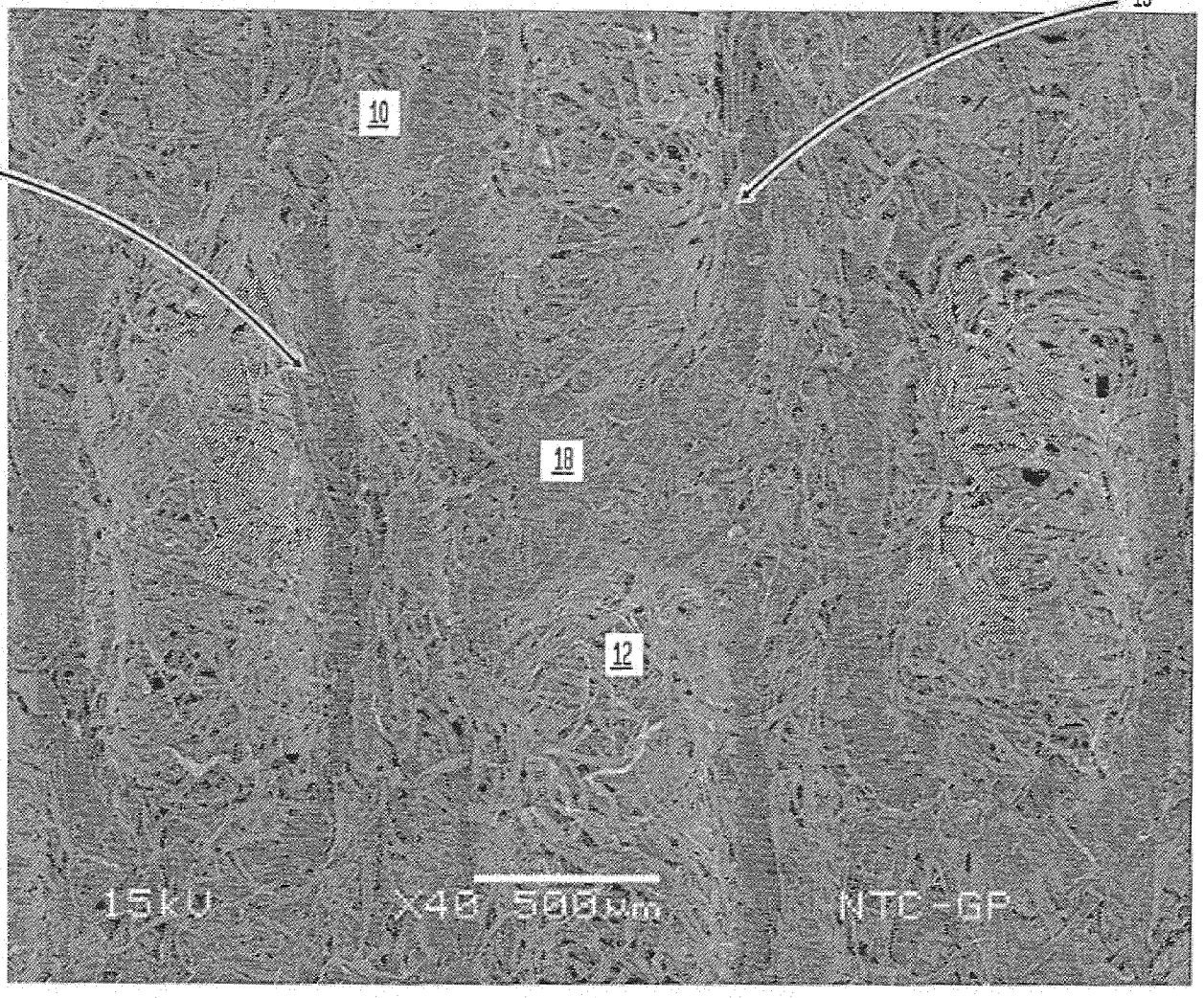
FIG. 1B is a plan view photomicrograph (40×) of a belt-creped uncalendered basesheet prepared with a perforated belt having the structure shown in FIG. 4 to FIG. 7 to which 23" Hg (77.9 kPa) vacuum was applied after transfer to the belt, showing the belt side of the sheet.
Figure 1C:
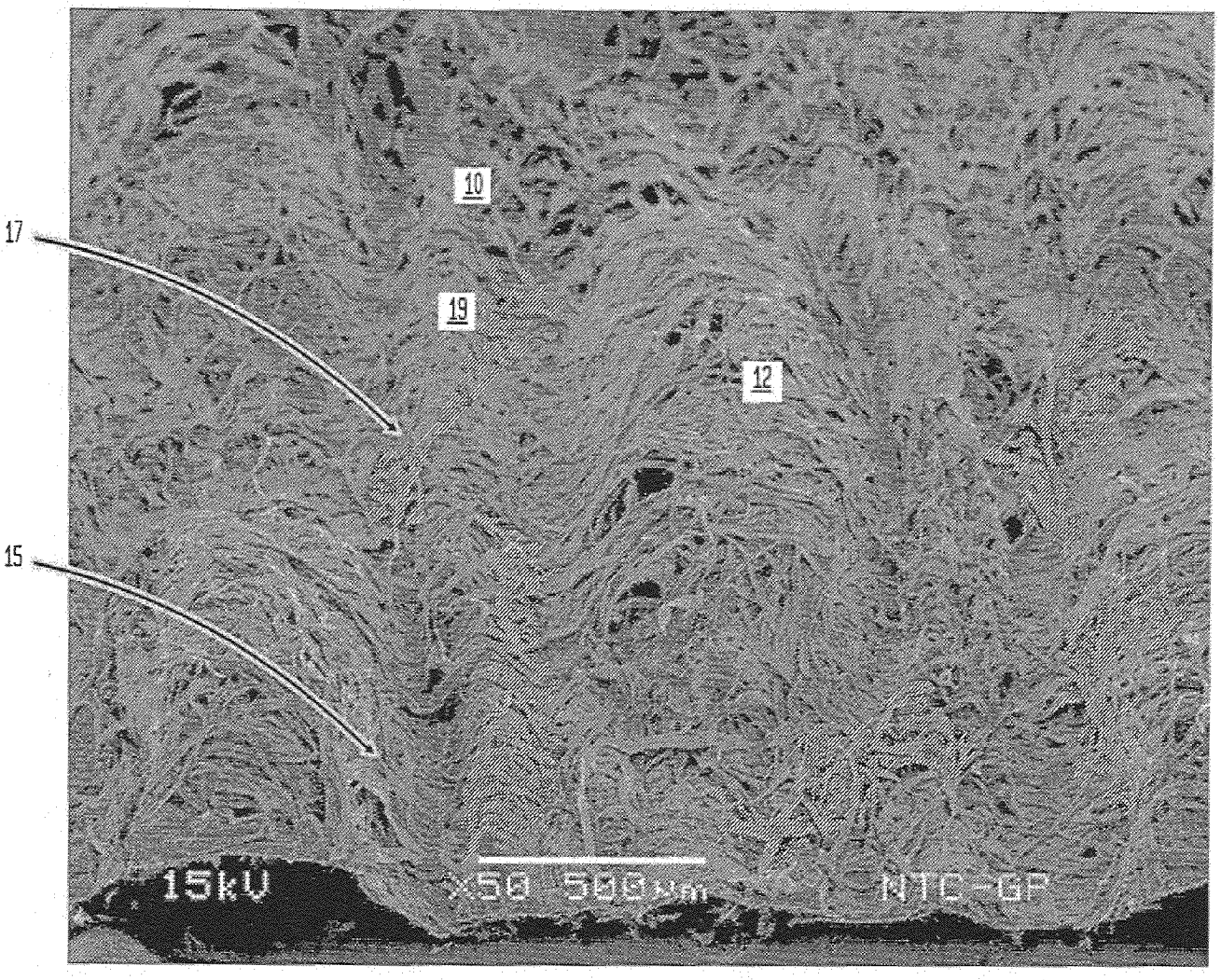
FIG. 1C is a 45° inclined view (50×) photomicrograph of the belt side of the sheet of FIG. 1B.
Figure 1D:
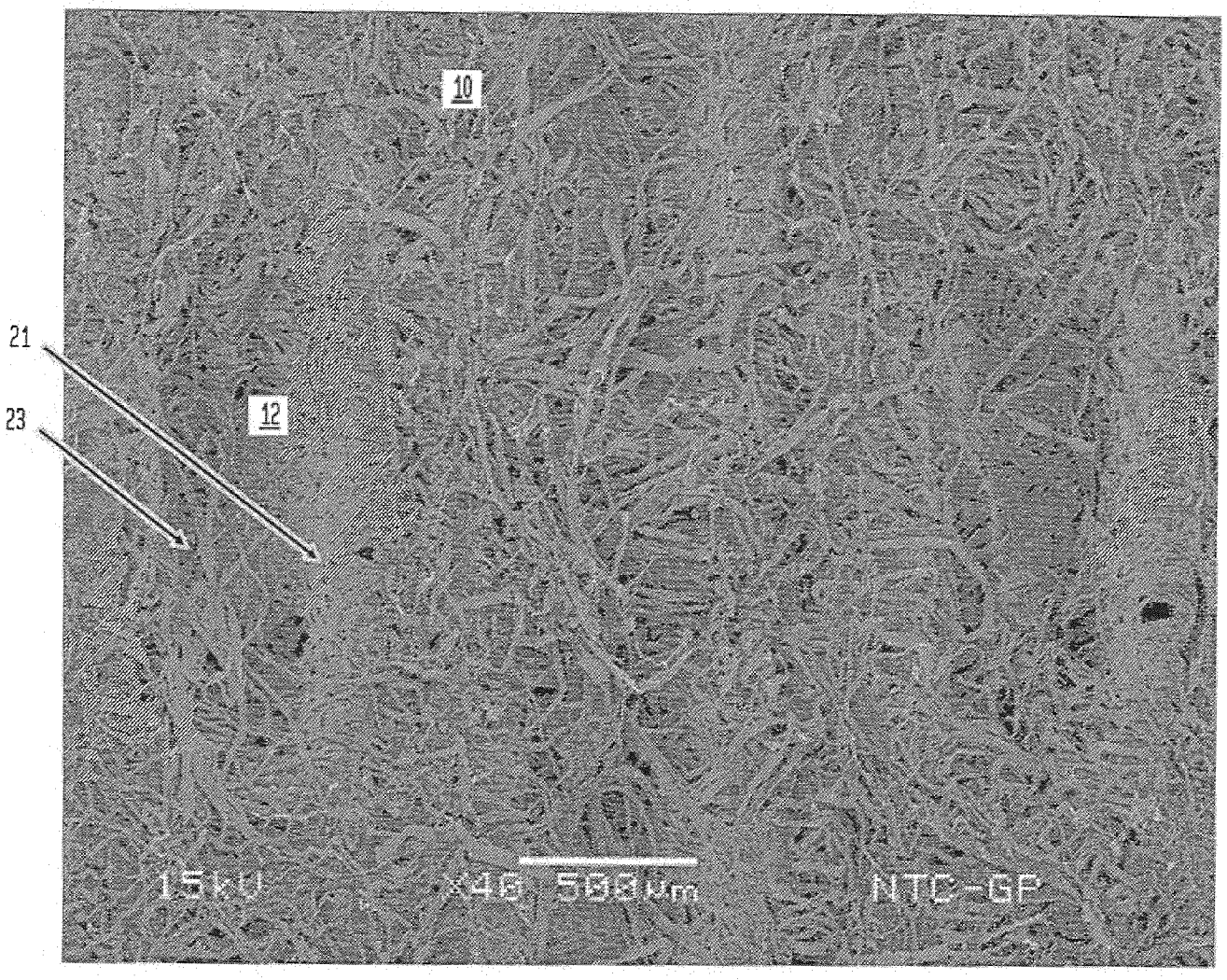
FIG. 1D is a plan view photomicrograph (40×) of the Yankee side of the sheet of FIGS. 1B and 1C.
Figure 1E:
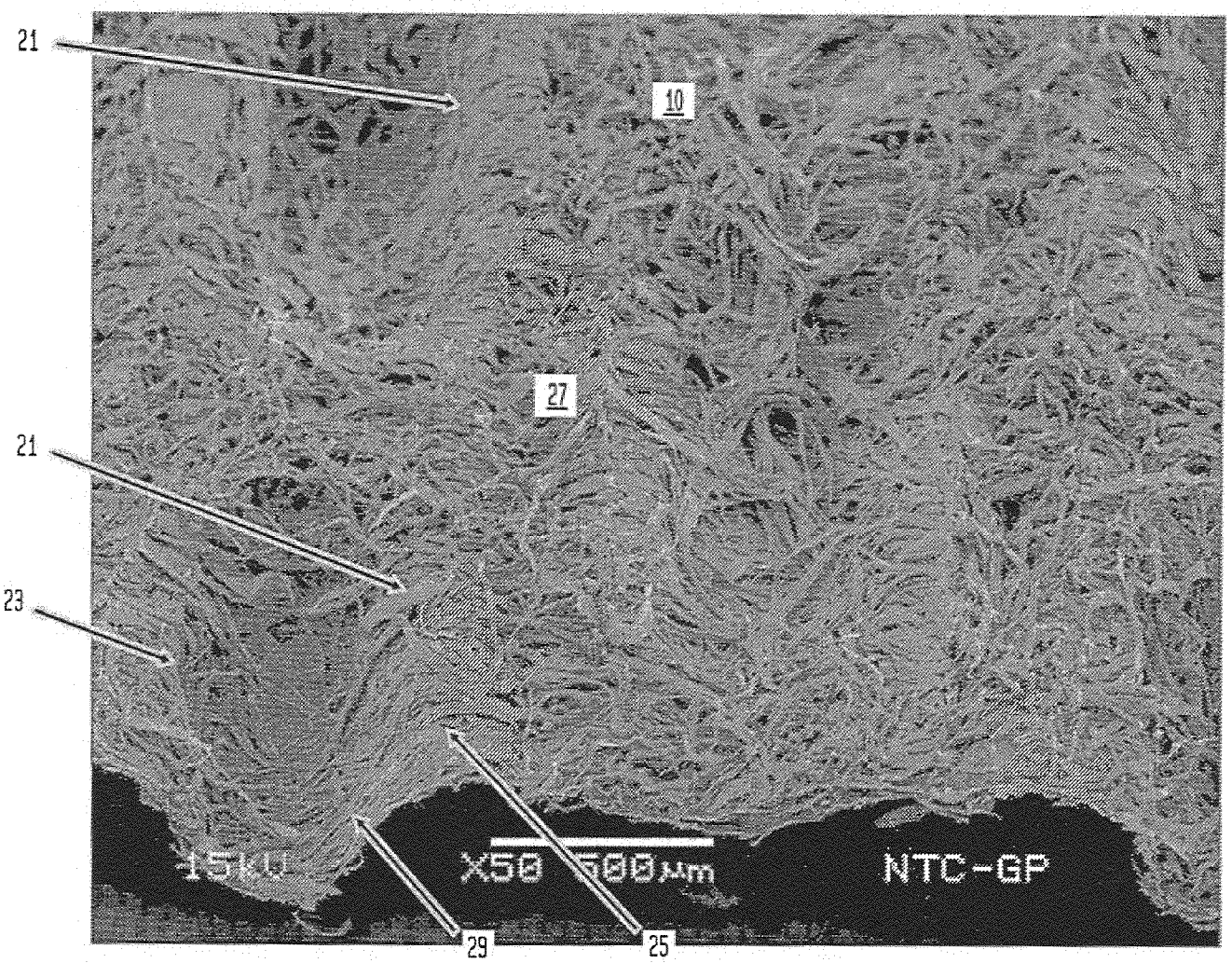
FIG. 1E is a 45° inclined view photomicrograph (50×) of the Yankee side of the sheet of FIGS. 1B, 1C, and 1D.

In connection with photomicrographs, magnifications reported herein are approximate except when presented as part of a scanning electron micrograph where an absolute scale is shown. In many cases, where sheets were sectioned, artifacts may be present along this cut edge, but we have only referenced and described structures that we have observed away from the cut edge or were not altered by the cutting process.

DETAILED DESCRIPTION

The invention is described below with reference to numerous embodiments. Such discussion is for purposes of illustration only. Modifications to particular examples within the spirit and scope of the present invention, set forth in the appended claims, will be readily apparent to one of skill in the art.

Terminology used herein is given its ordinary meaning consistent with the exemplary definitions set forth immediately below; mg refers to milligrams and $m^2$ refers to square meters, and so forth.

The creping adhesive "add-on" rate is calculated by dividing the rate of application of adhesive (mg/min) by surface area of the drying cylinder passing under a spray applicator boom ($m^2$/min). The resinous adhesive composition most preferably consists essentially of a polyvinyl alcohol resin and a polyamide-epichlorohydrin resin wherein the weight ratio of polyvinyl alcohol resin to polyamide-epichlorohydrin resin is from about 2 to about 4. The creping adhesive may also include a modifier sufficient to maintain good transfer between the creping belt and the Yankee cylinder, generally, less than 5% by weight modifier and, more preferably, less than about 2% by weight modifier, for peeled products. For blade creped products, from about 5%-25% modifier or more may be used.

Throughout this specification and claims, when we refer to a nascent web having an apparently random distribution of fiber orientation (or use like terminology), we are referring to the distribution of fiber orientation that results when known forming techniques are used for depositing a furnish on the forming fabric. When examined microscopically, the fibers give the appearance of being randomly oriented even though, depending on the jet to wire speed ratio, there may be a significant bias toward a machine direction orientation, making the machine direction tensile strength of the web exceed the cross-direction tensile strength.

Unless otherwise specified, "basis weight", BWT, bwt, BW, and so forth, refers to the weight of a 3000 square-foot (278.7 $m^2$) ream of product (basis weight is also expressed in $g/m^2$ or gsm). Likewise, "ream" means 3000 square-foot (278.7 $m^2$) ream, unless otherwise specified. Local basis weights and differences therebetween are calculated by measuring the local basis weight at two or more representative low basis weight areas within the low basis weight regions, and comparing the average basis weight to the average basis weight at two or more representative areas within the relatively high local basis weight regions. For example, if the representative areas within low basis weight regions have an average basis weight of 15 lbs/3000 $ft^2$ (24.5 $g/m^2$) ream and the average measured local basis weight for the representative areas within the relatively high local basis regions is 20 lbs/3000 $ft^2$ ream (32.6 $g/m^2$), the representative areas within high local basis weight regions have a characteristic basis weight of ((20−15)/15)×100% or 33% higher than the representative areas within the low basis weight regions. Preferably, the local basis weight is measured using a beta particle attenuation technique as referenced herein.

"Belt crepe ratio" is an expression of the speed differential between the creping belt and the forming wire and, typically, is calculated as the ratio of the web speed immediately before belt creping and the web speed immediately following belt creping, the forming wire and transfer surface being typically, but not necessarily, operated at the same speed:

$$\text{Belt crepe ratio} = \text{transfer cylinder speed} \div \text{creping belt speed}$$

Belt crepe can also be expressed as a percentage calculated as:

$$\text{Belt crepe} = [\text{Belt crepe ratio} - 1] \times 100.$$

A web creped from a transfer cylinder with a surface speed of 750 fpm (3.81 m/s) to a belt with a velocity of 500 fpm (2.54 m/s) has a belt crepe ratio of 1.5 and a belt crepe of 50%.

For reel crepe, the reel crepe ratio is typically calculated as the Yankee speed divided by reel speed. To express reel crepe as a percentage, 1 is subtracted from the reel crepe ratio and the result multiplied by 100%.

The belt crepe/reel crepe ratio is calculated by dividing the belt crepe by the reel crepe.

The line or overall crepe ratio is calculated as the ratio of the forming wire speed to the reel speed and a % total crepe is:

$$\text{Line Crepe} = [\text{Line Crepe Ratio} - 1] \times 100.$$

A process with a forming wire speed of 2000 fpm (10.2 m/s) and a reel speed of 1000 fpm (5.08 m/s) has a line or total crepe ratio of 2 and a total crepe of 100%.

"Belt side" and like terminology refers to the side of the web that is in contact with the creping belt. "Dryer-side" or "Yankee-side" is the side of the web in contact with the drying cylinder, typically, opposite to the belt-side of the web.

Calipers and or bulk reported herein may be measured at 8 or 16 sheet calipers as specified. The sheets are stacked and the caliper measurement taken about the central portion of the stack. Preferably, the test samples are conditioned in an atmosphere of 23°±1.0° C. (73.4°±1.8° F.) at 50% relative humidity for at least about 2 hours and then measured with a Thwing-Albert Model 89-II-JR or Progage Electronic Thickness Tester with 2-in (50.8-mm) diameter anvils, 539±10 grams dead weight load, and 0.231 in/sec (5.87 mm/sec) descent rate. For finished product testing, each sheet of product to be tested must have the same number of plies as the product as sold. For testing in general, eight sheets are selected and stacked together. For napkin testing, napkins are unfolded prior to stacking. For base sheet testing off of winders, each sheet to be tested must have the same number of plies as produced off of the winder. For base sheet testing off of the papermachine reel, single plies must be used. Sheets are stacked together and aligned in the MD. Bulk may also be expressed in units of volume/weight by dividing caliper by basis weight.

The term "cellulosic", "cellulosic sheet," and the like, is meant to include any wet-laid product incorporating papermaking fiber having cellulose as a major constituent. "Papermaking fibers" include virgin pulps or recycle (secondary) cellulosic fibers or fiber mixes comprising cellulosic fibers. Fibers suitable for making the webs of this invention include: nonwood fibers, such as cotton fibers or cotton derivatives, abaca, kenaf, sabai grass, flax, esparto grass, straw, jute hemp, bagasse, milkweed floss fibers, and pineapple leaf fibers; and wood fibers such as those obtained from deciduous and coniferous trees, including softwood fibers, such as northern and southern softwood kraft fibers; hardwood fibers, such as eucalyptus, maple, birch, aspen, or the like. Papermaking fibers can be liberated from their source material by any one of a number of chemical pulping processes familiar to one experienced in the art including sulfate, sulfite, polysulfide, soda pulping, etc. The pulp can be bleached if desired by chemical means including the use of chlorine, chlorine dioxide, oxygen, alkaline peroxide, and so forth. The products of the present invention may comprise a blend of conventional fibers (whether derived from virgin pulp or recycle sources) and high coarseness lignin-rich tubular fibers, and mechanical pulps such as bleached chemical thermomechanical pulp (BCTMP). "Furnishes" and like terminology refers to aqueous compositions including papermaking fibers, optionally, wet strength resins, debonders, and the like, for making paper products. Recycle fiber is typically more than 50% by weight hardwood fiber and may be 75% to 80% or more hardwood fiber.

As used herein, the term compactively dewatering the web or furnish refers to mechanical dewatering by overall wet pressing such as on a dewatering felt, for example, in some embodiments, by use of mechanical pressure applied continuously over the web surface as in a nip between a press roll and a press shoe, wherein the web is in contact with a papermaking felt. The terminology "compactively dewatering" is used to distinguish from processes wherein the initial dewatering of the web is carried out largely by thermal means as is the case, for example, in U.S. Pat. No. 4,529,480 to Trokhan and U.S. Pat. No. 5,607,551 to Farrington et al. Compactively dewatering a web thus refers, for example, to removing water from a nascent web having a consistency of less than 30% or so by application of pressure thereto and/or increasing the consistency of the web by about 15% or more by application of pressure thereto; that is, increasing the consistency, for example, from 30% to 45%.

Consistency refers to % solids of a nascent web, for example, calculated on a bone dry basis. "Air dry" means including residual moisture, by convention, up to about 10% moisture for pulp and up to about 6% for paper. A nascent web having 50% water and 50% bone dry pulp has a consistency of 50%.

Consolidated fibrous structures are those that have been so highly densified that the fibers therein have been compressed to ribbon-like structures and the void volume is reduced to levels approaching or perhaps even exceeding those found in flat papers, such as are used for communications purposes. In preferred structures, the fibers are so densely packed and closely matted that the distance between adjacent fibers is typically less than the fiber width, often less than half or even less than a quarter of the fiber width. In the most preferred structures, the fibers are largely collinear and strongly biased in the MD direction. The presence of consolidated fiber or consolidated fibrous structures can be confirmed by examining thin sections which have been embedded in resin, then microtomed in accordance with known techniques. Alternatively, if SEM's of both faces of a region are so heavily matted as to resemble flat paper, then that region can be considered consolidated. Sections prepared by focused ion beam cross-section polishers, such as those offered by JEOL, are especially suitable for observing densification to determine whether regions in the tissue products of the present invention have been so highly densified as to become consolidated.

Creping belt and like terminology refers to a belt that bears a perforated pattern suitable for practicing the process of the present invention. In addition to perforations, the belt may have features such as raised portions and/or recesses between perforations, if so desired. Preferably, the perforations are tapered, which appears to facilitate transfer of the web, especially, from the creping belt to a dryer, for example. In some embodiments, the creping belt may include decorative features such as geometric designs, floral designs, and so forth, formed by rearrangement, deletion, and/or a combination of perforations having varying sizes and shapes.

"Domed", "dome-like," and so forth, as used in the description and claims, refer generally to hollow, arched protuberances in the sheet of the class seen in the various Figures and is not limited to a specific type of dome structure. The terminology refers to vaulted configurations, generally, whether symmetric or asymmetric about a plane bisecting the domed area. Thus, "domed" refers generally to spherical domes, spheroidal domes, elliptical domes, oval domes, domes with polygonal bases and related structures, generally including a cap and sidewalls, preferably, inwardly and upwardly inclined, that is, the sidewalls being inclined toward the cap along at least a portion of their length.

Fpm refers to feet per minute: while fps refers to feet per second.

MD means machine direction and CD means cross-machine direction.

When applicable, MD bending length (cm) of a product is determined in accordance with ASTM test method D 1388-96, cantilever option. Reported bending lengths refer to MD bending lengths unless a CD bending length is expressly specified. The MD bending length test was performed with a Cantilever Bending Tester available from Research Dimensions, 1720 Oakridge Road, Neenah, Wis., 54956, which is substantially the apparatus shown in the ASTM test method, item 6. The instrument is placed on a level stable surface, horizontal position being confirmed by a built in leveling bubble. The bend angle indicator is set at 41.5° below the level of the sample table. This is accomplished by setting the knife edge appropriately. The sample is cut with a one inch (25.4 mm) JD strip cutter available from Thwing-Albert Instrument Company, 14 Collins Avenue, W. Berlin, N.J. 08091. Six (6) samples are cut into 1 inch×8 inch (25.4 mm×203 mm) machine direction specimens. Samples are conditioned at 23° C.±1° C. (73.4° F.±1.8° F.) at 50% relative humidity for at least two hours. For machine direction specimens, the longer dimension is parallel to the machine direction. The specimens should be flat, free of wrinkles, bends or tears. The Yankee-side of the specimens is also labeled. The specimen is placed on the horizontal platform of the tester aligning the edge of the specimen with the right hand edge. The movable slide is placed on the specimen, being careful not to change its initial position. The right edge of the sample and the movable slide should be set at the right edge of the horizontal platform. The movable slide is displaced to the right in a smooth, slow manner at approximately 5 inches/minute (127 mm/minute) until the specimen touches the knife edge. The overhang length is recorded to the nearest 0.1 cm. This is done by reading the left edge of the movable slide. Three specimens are preferably run with the Yankee-side up and three specimens are preferably run with the Yankee-side down on the horizontal platform. The MD bending length is reported as the average overhang length in centimeters divided by two to account for bending axis location.

Nip parameters include, without limitation, nip pressure, nip width, backing roll hardness, creping roll hardness, belt approach angle, belt takeaway angle, uniformity, nip penetration and velocity delta between surfaces of the nip.

Nip width (or length as the context indicates) means the MD length over which the nip surfaces are in contact.

PLI or pli means pounds of force per linear inch. The process employed is distinguished from other processes, in part, because belt creping is carried out under pressure in a creping nip. Typically, rush transfers are carried out using suction to assist in detaching the web from the donor fabric and, thereafter, attaching it to the receiving or receptor fabric. In contrast, suction is not required in a belt creping step, so accordingly, when we refer to belt creping as being "under pressure" we are referring to loading of the receptor belt against the transfer surface, although suction assist can be employed at the expense of further complication of the system, so long as the amount of suction is not sufficient to undesirably interfere with rearrangement or redistribution of the fiber.

Pusey and Jones (P&J) hardness (indentation) is measured in accordance with ASTM D 531, and refers to the indentation number (standard specimen and conditions).

"Predominantly" means more than 50% of the specified component, by weight unless otherwise indicated.

Roll compression is measured by compressing the roll under a 1500 g flat platen. Sample rolls are conditioned and tested in an atmosphere of 23.0°±1.0° C. (73.4°±1.8° F.). A suitable test apparatus with a movable 1500 g platen (referred to as a Height Gauge) is available from:

Research Dimensions
1720 Oakridge Road
Neenah, Wis. 54956
920-722-2289
920-725-6874 (FAX).

The test procedure is generally as follows:

(a) Raise the platen and position the roll or sleeve to be tested on its side, centered under the platen, with the tail seal to the front of the gauge and the core parallel to the back of the gauge.

(b) Slowly lower the platen until it rests on the roll or sleeve.

(c) Read the compressed roll diameter or sleeve height from the gauge pointer to the nearest 0.01 inch (0.254 mm).

(d) Raise the platen and remove the roll or sleeve.

(e) Repeat for each roll or sleeve to be tested.

To calculate roll compression in percent, the following formula is used:

$$100\times[(\text{initial roll diameter}-\text{compressed roll diameter})/\text{initial roll diameter}].$$

Dry tensile strengths (MD and CD), stretch, ratios thereof, modulus, break modulus, stress and strain are measured with a standard Instron test device or other suitable elongation tensile tester which may be configured in various ways, typically, using 3 inch (76.2 mm) or 1 inch (25.4 mm) wide strips of tissue or towel, conditioned in an atmosphere of 23°±1° C. (73.4°±1° F.) at 50% relative humidity for 2 hours. The tensile test is run at a crosshead speed of 2 in/min (50.8 mm/min). Break modulus is expressed in grams/3 inches/% strain or its SI equivalent of g/mm/% strain. % strain is dimensionless and need not be specified. Unless otherwise indicated, values are break values. GM refers to the square root of the product of the MD and CD values for a particular product. Tensile energy absorption (TEA), which is defined as the area under the load/elongation (stress/strain) curve, is also measured during the procedure for measuring tensile strength. Tensile energy absorption (TEA) is related to the perceived strength of the product in use. Products having a higher TEA may be perceived by users as being stronger than similar products that have lower TEA values, even if the actual tensile strength of the two products are the same. In fact, having a higher tensile energy absorption may allow a product to be perceived as being stronger than one with a lower TEA, even if the tensile strength of the high-TEA product is less than that of the product having the lower tensile energy absorption. When the term "normalized" is used in connection with a tensile strength, it simply refers to the appropriate tensile strength from which the effect of basis weight has been removed by dividing that tensile strength by the basis weight. In many cases, similar information is provided by the term "breaking length".

Tensile ratios are simply ratios of the values determined by way of the foregoing methods. Unless otherwise specified, a tensile property is a dry sheet properly.

"Upper", "upwardly" and like terminology is used purely for convenience, and refers to position or direction toward the caps of the dome structures, that is, the belt side of the web, which is generally opposite to the Yankee side, unless the context clearly indicates otherwise.

The wet tensile of the tissue of the present invention is measured using a three-inch (76.2 mm) wide strip of tissue that is folded into a loop, clamped in a special fixture termed a Finch Cup, then immersed in water. A suitable Finch cup, 3-in. (76.2 mm), with base to fit a 3-in. (76.2 mm) grip, is available from:

High-Tech Manufacturing Services, Inc.
3105-B NE 65$^{th}$ Street
Vancouver, Wash. 98663
360-696-1611
360-696-9887 (FAX).

For fresh basesheet and finished product (aged 30 days or less for towel product; aged 24 hours or less for tissue product) containing wet strength additive, the test specimens are placed in a forced air oven heated to 105° C. (221° F.) for five minutes. No oven aging is needed for other samples. The Finch cup is mounted onto a tensile tester equipped with a 2.0 pound (8.9 Newton) load cell with the flange of the Finch cup clamped by the tester's lower jaw and the ends of tissue loop clamped into the upper jaw of the tensile tester. The sample is immersed in water that has been adjusted to a pH of 7.0±0.1 and the tensile is tested after a 5 second immersion time using a crosshead speed of 2 inches/minute (50.8 mm/minute). The results are expressed in g/3" or (g/mm), dividing the readout by two to account for the loop as appropriate.

A translating transfer surface refers to the surface from which the web is creped onto the creping belt. The translating transfer surface may be the surface of a rotating drum as described hereafter, or may be the surface of a continuous smooth moving belt or another moving fabric that may have surface texture, and so forth. The translating transfer surface needs to support the web and facilitate the high solids creping, as will be appreciated from the discussion which follows.

Velocity delta means a difference in linear speed.

The void volume and/or void volume ratio, as referred to hereafter, are determined by saturating a sheet with a nonpolar POROFIL™ liquid and measuring the amount of liquid absorbed. The volume of liquid absorbed is equivalent to the void volume within the sheet structure. The percent weight increase (PWI) is expressed as grams of liquid absorbed per gram of fiber in the sheet structure one hundred times, as noted hereafter. More specifically, for each single-ply sheet sample to be tested, select 8 sheets and cut out a 1 inch by 1 inch (25.4 mm by 25.4 mm) square (1 inch (25.4 mm) in the machine direction and 1 inch (25.4 mm) in the cross machine direction). For multi-ply product samples, each ply is measured as a separate entity. Multiple samples should be separated into individual single plies and 8 sheets from each ply position used for testing. Weigh and record the dry weight of each test specimen to the nearest 0.0001 gram. Place the specimen in a dish containing POROFIL™ liquid having a specific gravity of about 1.93 grams per cubic centimeter, available from Coulter Electronics Ltd., Northwell Drive, Luton, Beds, England, Part No. 9902458. After 10 seconds, grasp the specimen at the very edge (1-2 millimeters in) of one corner with tweezers and remove from the liquid. Hold the specimen with that corner uppermost and allow excess liquid to drip for 30 seconds. Lightly dab (less than ½ second contact) the lower corner of the specimen on #4 filter paper (Whatman Lt. Maidstone, England) in order to remove any excess of the last partial drop. Immediately weigh the specimen, within 10 seconds, recording the weight to the nearest 0.0001 gram. The PWI for each specimen, expressed as grams of POROFIL™ liquid per gram of fiber, is calculated as follows:

$$PWI=[(W2-W1)/W1]\times 100$$

wherein

"W1" is the dry weight of the specimen, in grams; and

"W2" is the wet weight of the specimen, in grams.

The PWI for all eight individual specimens is determined as described above and the average of the eight specimens is the PWI for the sample.

The void volume ratio is calculated by dividing the PWI by 1.9 (density of fluid) to express the ratio as a percentage, whereas the void volume (gms/gm) is simply the weight increase ratio, that is, PWI divided by 100.

Water absorbency rate, or WAR, is measured in seconds and is the time it takes for a sample to absorb a 0.1 gram droplet of water disposed on its surface by way of an automated syringe. The test specimens are preferably conditioned at 23° C.±1° C. (73.4±1.8° F.) at 50% relative humidity for 2 hours. For each sample, 4 3×3 inch (76.2×76.2 mm) test specimens are prepared. Each specimen is placed in a sample holder such that a high intensity lamp is directed toward the specimen. 0.1 ml of water is deposited on the specimen surface and a stopwatch is started. When the water is absorbed, as indicated by lack of further reflection of light from the drop, the stopwatch is stopped and the time recorded to the nearest 0.1 seconds. The procedure is repeated for each specimen and the results averaged for the sample. WAR is measured in accordance with TAPPI method T 432 cm-99.

The creping adhesive composition used to secure the web to the Yankee drying cylinder is preferably a hygroscopic, re-wettable, substantially non-crosslinking adhesive. Examples of preferred adhesives are those that include poly (vinyl alcohol) of the general class described in U.S. Pat. No. 4,528,316 to Soerens et al. Other suitable adhesives are disclosed in copending U.S. patent application Ser. No. 10/409,042, filed Apr. 9, 2003, entitled "Creping Adhesive Modifier and Process for Producing Paper Products", Publication No. 2005/0006040, now U.S. Pat. No. 7,959,761. The disclosures of the '316 patent and the '042 application are incorporated herein by reference. Suitable adhesives are optionally provided with crosslinkers, modifiers, and so forth, depending upon the particular process selected.

Creping adhesives may comprise a thermosetting or non-thermosetting resin, a film-forming semi-crystalline polymer and, optionally, an inorganic cross-linking agent, as well as modifiers. Optionally, the creping adhesive of the present invention may also include other components, including, but not limited to hydrocarbons oils, surfactants, or plasticizers. Further details as to creping adhesives useful in connection with the present invention are found in copending U.S. patent application Ser. No. 11/678,669, entitled "Method of Controlling Adhesive Build-Up on a Yankee Dryer", filed Feb. 26, 2007, Publication No. 2007/0204966, now U.S. Pat. No. 7,850,823, the disclosure of which is incorporated herein by reference.

The creping adhesive may be applied as a single composition or may be applied in its component parts. More particularly, the polyamide resin may be applied separately from the polyvinyl alcohol (PVOH) and the modifier.

In connection with the present invention, an absorbent paper web is made by dispersing papermaking fibers into aqueous furnish (slurry) and depositing the aqueous furnish onto the forming wire of a papermaking machine. Any suitable forming scheme might be used. For example, an extensive, but non-exhaustive, list in addition to Fourdrinier formers includes a crescent former, a C-wrap twin wire former, an S-wrap twin wire former, or a suction breast roll former. The forming fabric can be any suitable foraminous member including single layer fabrics, double layer fabrics, triple layer fabrics, photopolymer fabrics, and the like. Non-exhaustive background art in the forming fabric area includes U.S. Pat. Nos. 4,157,276; 4,605,585; 4,161,195; 3,545,705; 3,549,742; 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,261; 5,199,467; 5,211,815; 5,219,004; 5,245,025; 5,277,761; 5,328,565; and 5,379,808, all of which are incorporated herein by reference in their entirety. One forming fabric particularly useful with the present invention is Voith Fabrics Forming Fabric 2164 made by Voith Fabrics Corporation, Shreveport, La.

Foam-forming of the aqueous furnish on a forming wire or fabric may be employed as a means for controlling the permeability or void volume of the sheet upon belt-creping. Foam-forming techniques are disclosed in U.S. Pat. Nos. 6,500,302; 6,413,368; 4,543,156 and Canadian Patent No. 2053505, the disclosures of which are incorporated herein by reference. The foamed fiber furnish is made up from an aqueous slurry of fibers mixed with a foamed liquid carrier just prior to its introduction to the headbox. The pulp slurry supplied to the system has a consistency in the range of from about 0.5 to about 7 weight % fibers, preferably, in the range of from about 2.5 to about 4.5 weight %. The pulp slurry is added to a foamed liquid comprising water, air and surfactant containing 50 to 80% air by volume forming a foamed fiber furnish having a consistency in the range of from about 0.1 to about 3 weight % fiber by simple mixing from natural turbulence and mixing inherent in the process elements. The addition of the pulp as a low consistency slurry results in excess foamed liquid recovered from the forming wires. The excess foamed liquid is discharged from the system and may be used elsewhere or treated for recovery of surfactant therefrom.

The furnish may contain chemical additives to alter the physical properties of the paper produced. These chemistries are well understood by the skilled artisan and may be used in any known combination. Such additives may be surface modifiers, softeners, debonders, strength aids, latexes, opacifiers, optical brighteners, dyes, pigments, sizing agents, barrier chemicals, retention aids, insolubilizers, organic or inorganic crosslinkers, or combinations thereof, said chemicals optionally comprising polyols, starches. PPG esters, PEG esters, phospholipids, surfactants, polyamines, HMCP (Hydrophobically Modified Cationic Polymers). HMAP (Hydrophobically Modified Anionic Polymers), or the like.

The pulp can be mixed with strength adjusting agents such as wet strength agents, dry strength agents and debonders/softeners, and so forth. Suitable wet strength agents are known to the skilled artisan. A comprehensive, but non-exhaustive, list of useful strength aids include urea-formaldehyde resins, melamine formaldehyde resins, glyoxylated polyacrylamide resins, polyamide-epichlorohydrin resins, and the like. Thermosetting polyacrylamides are produced by reacting acrylamide with diallyl dimethyl ammonium chloride (DADMAC) to produce a cationic polyacrylamide copolymer, which is ultimately reacted with glyoxal to produce a cationic cross-linking wet strength resin, glyoxylated polyacrylamide. These materials are generally described in U.S. Pat. Nos. 3,556,932 to Coscia et al. and 3,556,933 to Williams et al., both of which are incorporated herein by reference in their entirety. Resins of this type are commercially available under the trade name of PAREZ 63INC by Bayer Corporation. Different mole ratios of acrylamide/-DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorohydrin wet strength resins, an example of which is sold under the trade names Kymene 557LX and Kymene 557H by Hercules Incorporated of Wilmington, Del. and Amres® from Georgia-Pacific Resins, Inc. These resins and the processes for making the resins are described in U.S. Pat. No. 3,700,623 and U.S. Pat. No. 3,772,076, each of which is incorporated herein by reference in its entirety. An extensive description of polymeric-epihalohydrin resins is given in Chapter 2: Alkaline-Curing Polymeric Amine-Epichlorohydrin by Espy in *Wet Strength Resins and Their Application* (L. Chan, Editor, 1994), herein incorporated by reference in its entirety. A reasonably comprehensive list of wet strength resins is described by Westfelt in *Cellulose Chemistry and Technology* Volume 13, page 813, 1979, which is also incorporated herein by reference.

Suitable temporary wet strength agents may likewise be included, particularly, in applications where disposable towel, or more typically, tissue with permanent wet strength resin is to be avoided. A comprehensive, but non-exhaustive, list of useful temporary wet strength agents includes aliphatic and aromatic aldehydes including glyoxal, malonic dialdehyde, succinic dialdehyde, glutaraldehyde and dialdehyde starches, as well as substituted or reacted starches, disaccharides, polysaccharides, chitosan, or other reacted polymeric reaction products of monomers or polymers having aldehyde groups, and optionally, nitrogen groups. Representative nitrogen containing polymers, which can suitably be reacted with the aldehyde containing monomers or polymers, includes vinyl-amides, acrylamides and related nitrogen containing polymers. These polymers impart a positive charge to the aldehyde containing reaction product. In addition, other commercially available temporary wet strength agents, such as, PAREZ FJ98, manufactured by Kemira can be used, along with those disclosed, for example, in U.S. Pat. No. 4,605,702.

The temporary wet strength resin may be any one of a variety of water-soluble organic polymers comprising aldehydic units and cationic units used to increase dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769 and 5,217,576. Modified starches sold under the trademarks CO-BOND® 1000 and CO-BOND® 1000 Plus, by National Starch and Chemical Company of Bridgewater, N.J. may be used. Prior to use, the cationic aldehydic water soluble polymer can be prepared by preheating an aqueous slurry of approximately 5% solids maintained at a temperature of approximately 240° F. (116° C.) and a pH of about 2.7 for approximately 3.5 minutes. Finally, the slurry can be quenched and diluted by adding water to produce a mixture of approximately 1.0% solids at less than about 130° F. (54.4° C.).

Other temporary wet strength agents, also available from National Starch and Chemical Company are sold under the trademarks CO-BOND® 1600 and CO-BOND® 2300. These starches are supplied as aqueous colloidal dispersions and do not require preheating prior to use.

Suitable dry strength agents include starch, guar gum, polyacrylamides, carboxymethyl cellulose, and the like. Of particular utility is carboxymethyl cellulose, an example of which is sold under the trade name Hercules CMC, by Hercules Incorporated of Wilmington, Del. According to one embodiment, the pulp may contain from about 0 to about 15 lb/ton (0.0075%) of dry strength agent. According to another embodiment, the pulp may contain from about 1 (0.0005%) to about 5 lbs/ton (0.0025%) of dry strength agent.

Suitable debonders are likewise known to the skilled artisan. Debonders or softeners may also be incorporated into the pulp or sprayed upon the web after its formation. The present invention may also be used with softener materials including, but not limited to, the class of amido amine salts derived from partially neutralized amines. Such materials are disclosed in U.S. Pat. No. 4,720,383. Evans, *Chemistry and Industry,* 5 Jul. 1969, pages 893-903; Egan, *J. Am. Oil Chemist's Soc.* Vol. 55 (1978), pages 118 to 121; and Trivedi et al., *J. Am. Oil Chemist's Soc.*, June 1981, pages 754 to 756, incorporated by reference in their entireties, indicate that softeners are often available commercially only as complex mixtures rather than as single compounds. While the following discussion will focus on the predominant species, it should be understood that commercially available mixtures would generally be used in practice.

Hercules TQ 218 or equivalent is a suitable softener material, which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these materials are quaternary ammonium compounds, the compositions as a whole are pH-sensitive. Therefore, in the practice of the present invention with this class of chemicals, the pH in the head box should be approximately 6 to 8, more preferably, from about 6 to about 7, and most preferably, from about 6.5 to about 7.

Quaternary ammonium compounds, such as dialkyl dimethyl quaternary ammonium salts are also suitable, particularly when the alkyl groups contain from about 10 to 24 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entireties. The compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

In some embodiments, a particularly preferred debonder composition includes a quaternary amine component, as well as a nonionic surfactant.

The nascent web may be compactively dewatered on a papermaking felt. Any suitable felt may be used. For example, felts can have double-layer base weaves, triple-layer base weaves, or laminated base weaves. Preferred felts are those having the laminated base weave design. A wet-press-felt, which may be particularly useful with the present invention, is Vector 3 made by Voith Fabric. Background art in the press felt area includes U.S. Pat. Nos. 5,657,797; 5,368,696; 4,973,512; 5,023,132; 5,225,269; 5,182,164; 5,372,876; and 5,618,612. A differential pressing felt as is disclosed in U.S. Pat. No. 4,533,437 to Curran et al. may likewise be utilized.

The products of this invention are advantageously produced in accordance with a wet-press or compactively dewatering process wherein the web is belt creped after dewatering at a consistency of from 30-60%, as described hereafter. The creping belt employed is a perforated polymer belt of the class shown in FIGS. 4 through 9.

Figure 4:
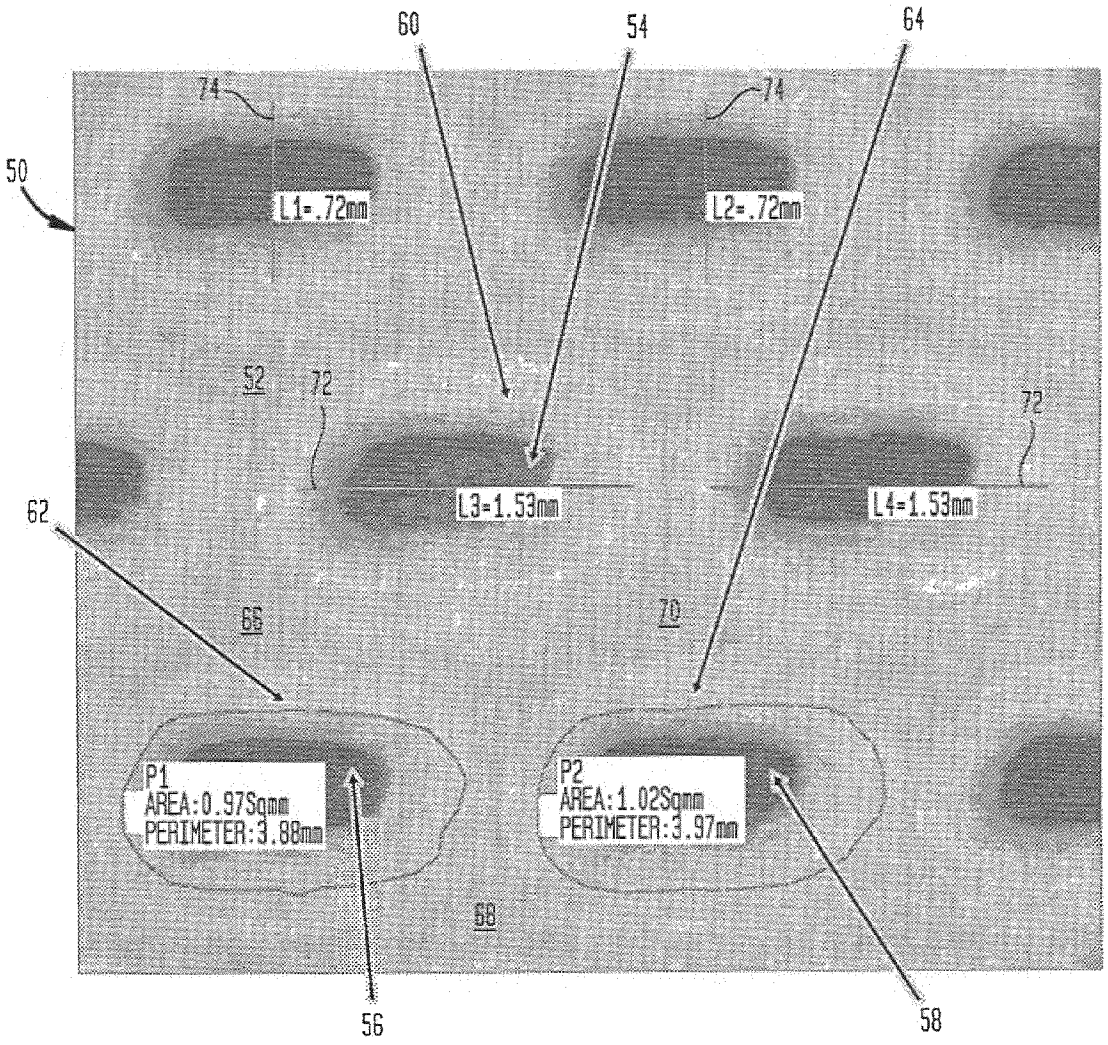
FIGS. 4 and 5 are plan photomicrographs (20×) of the top and bottom of a creping belt used to make the absorbent sheet shown, for example, in FIGS. 1A and 2A.

FIG. 4 is a plan view photograph (20×) of a portion of a first polymer belt 50 having an upper surface 52, which is generally planar and a plurality of tapered perforations 54, 56 and 58. The belt has a thickness of about 0.2 mm to 1.5 mm and each perforation has an upper lip such as lips 60, 62, 64, which extend upwardly from surface 52 around the upper periphery of the tapered perforations as shown. The perforations on the upper surface are separated by a plurality of flat portions or lands 66, 68 and 70 therebetween, which separate the perforations. In the embodiment shown in FIG. 4, the upper portions of the perforations have an open area of about 1 square mm or so, and are oval in shape with a length of about 1.5 mm along a longer axis 72 and a width of about 0.7 mm or so along a shorter axis 74 of the openings.

In the process of the invention, upper surface 52 of belt 50 is normally the "creping" side of this belt; that is, the side of the belt contacting the web, while the opposite or lower surface 76 shown in FIG. 5 and described below is the "machine" side of the belt contacting the belt supporting surfaces. The belt of FIGS. 4 and 5 is mounted such that the longer axes, 72, of the perforations are aligned with the CD of the papermachine.

Figure 5:
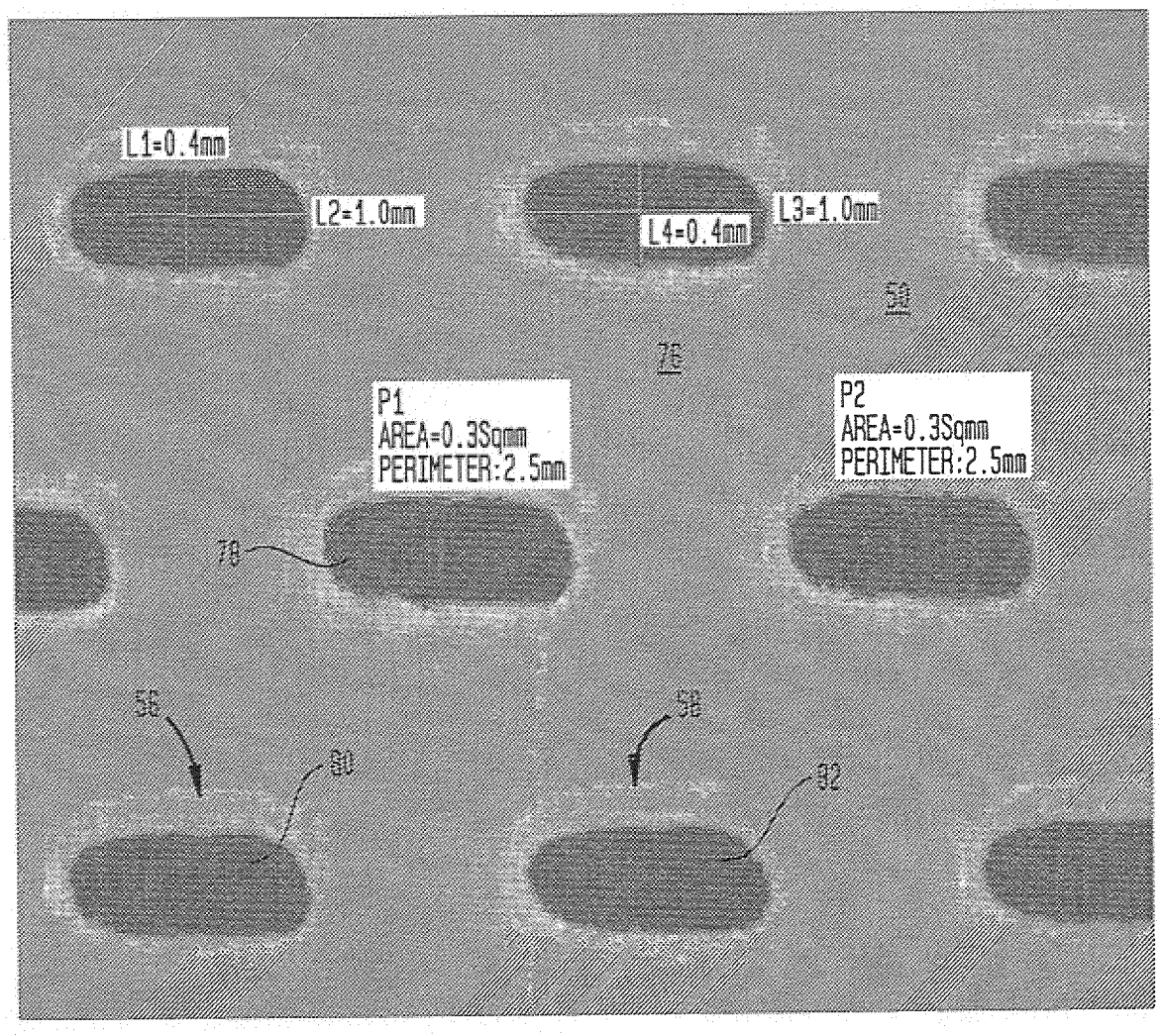

FIG. 5 is a plan view photograph of the polymer belt of FIG. 4 showing a lower surface 76 of belt 50. Lower surface 76 defines the lower openings 78, 80 and 82 of the perforations 54, 56, and 58. The lower openings of the tapered perforations are also oval in shape, but smaller than corresponding upper openings of the perforations. The lower openings have a longer axis length of about 1.0 mm, and a shorter width of about 0.4 mm or so, and an area of about 0.3 square mm, or about 30% of the open area of the upper openings. While there appears to be a slight lip around the lower openings, the lip is much less pronounced, as seen in FIG. 5 and better appreciated by reference to FIGS. 6 and 7. The tapered construction of the perforation is believed to facilitate separation of the web from the belt after belt-creping in connection with the processes described herein.

Figure 6:
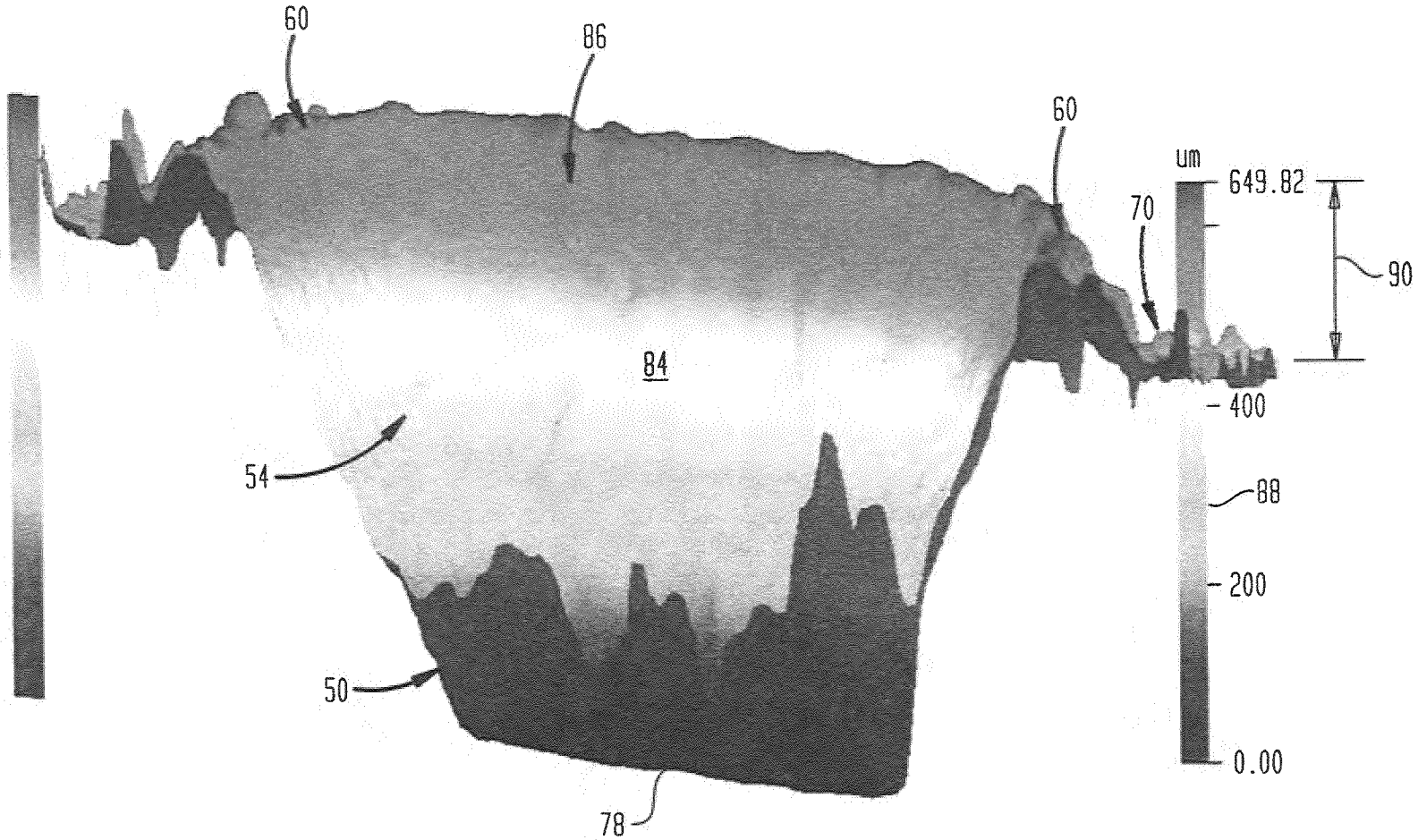
FIGS. 6 and 7 are laser profilometry analyses, in section, of the perforated belt of FIGS. 4 and 5.
Figure 7:
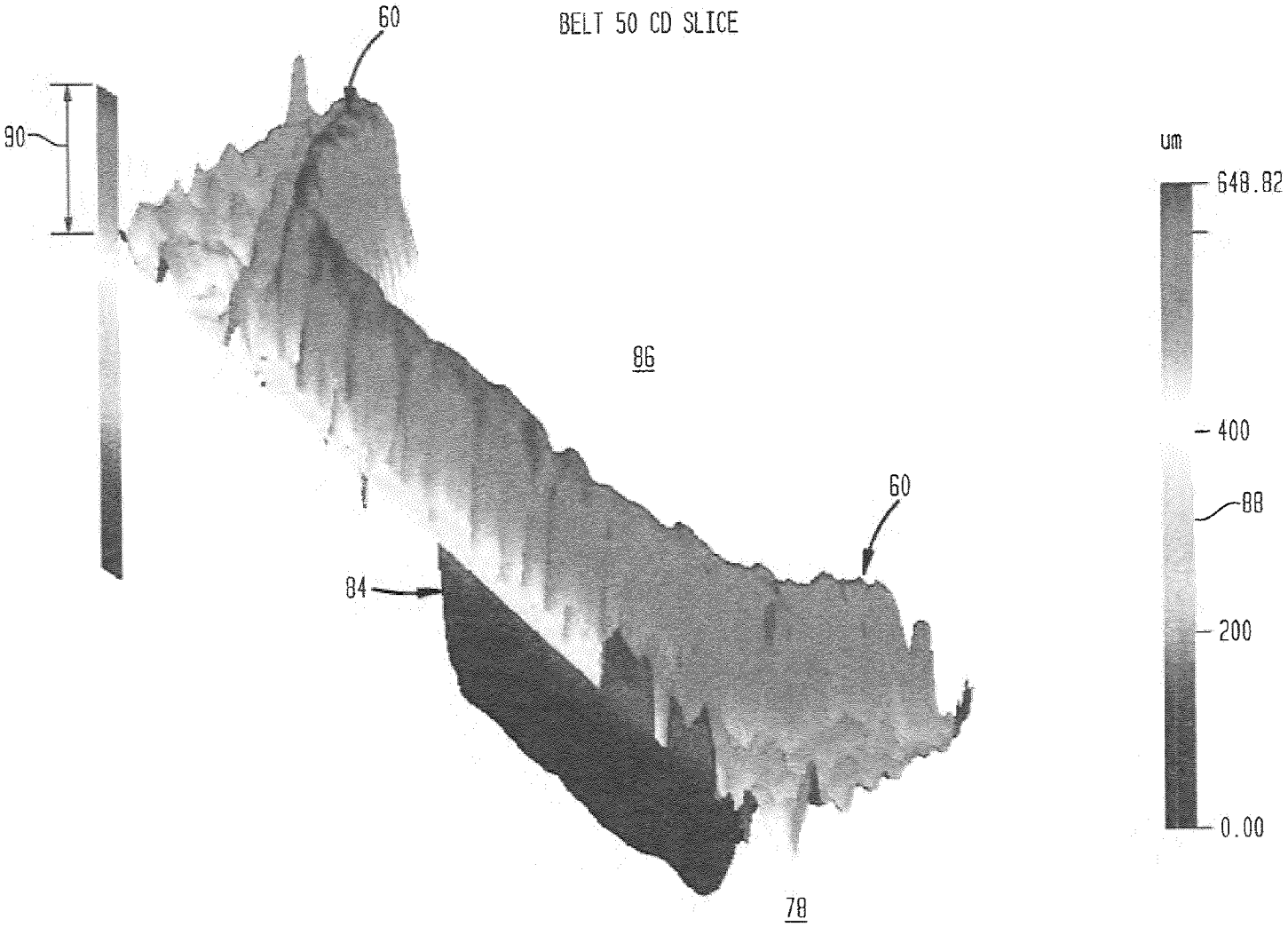

FIGS. 6 and 7 are laser profilometer analyses of a perforation such as perforation 54 of the belt 50 taken along line 72 of FIG. 4 through the longer axis of perforation 54, showing the various features. Perforation 54 has a tapered inner wall 84 which extends from upper opening 86 to lower opening 78 over a height 88 of about 0.65 mm or so, which includes a lip height 90 as is appreciated from the color legend which indicates approximate height. The lip height extends from the uppermost portion of the lip to the adjacent land such as land 70 and is in the range of 0.15 mm or so.

It will be appreciated from FIGS. 4 and 5 that belt 50 has a relatively "closed" structure on the bottom of the belt, less than 50% of the projected area constituting perforation openings, while the upper surface of the belt has a relatively "open" area, constituting the upper perforation area. The benefits of this construction in the inventive process are at least three-fold. For one, the taper of the perforations facilitates retrieval of the web from the belt. For another, a polymer belt with tapered perforations has more polymer material at its lower portion, which can provide necessary strength and toughness to survive the rigors of the manufacturing process. For still yet another benefit, the relatively "closed" bottom, generally planar structure of the belt can be used to "seal" a vacuum box and permit flow-through perforations in the belt, concentrating air flow and vacuuming effectiveness to vacuum-treat the web in order to enhance the structure and to provide additional caliper as described hereafter. This sealing effect is obtained even with the minor ridges noted on the machine side of the belt.

Figure 8:
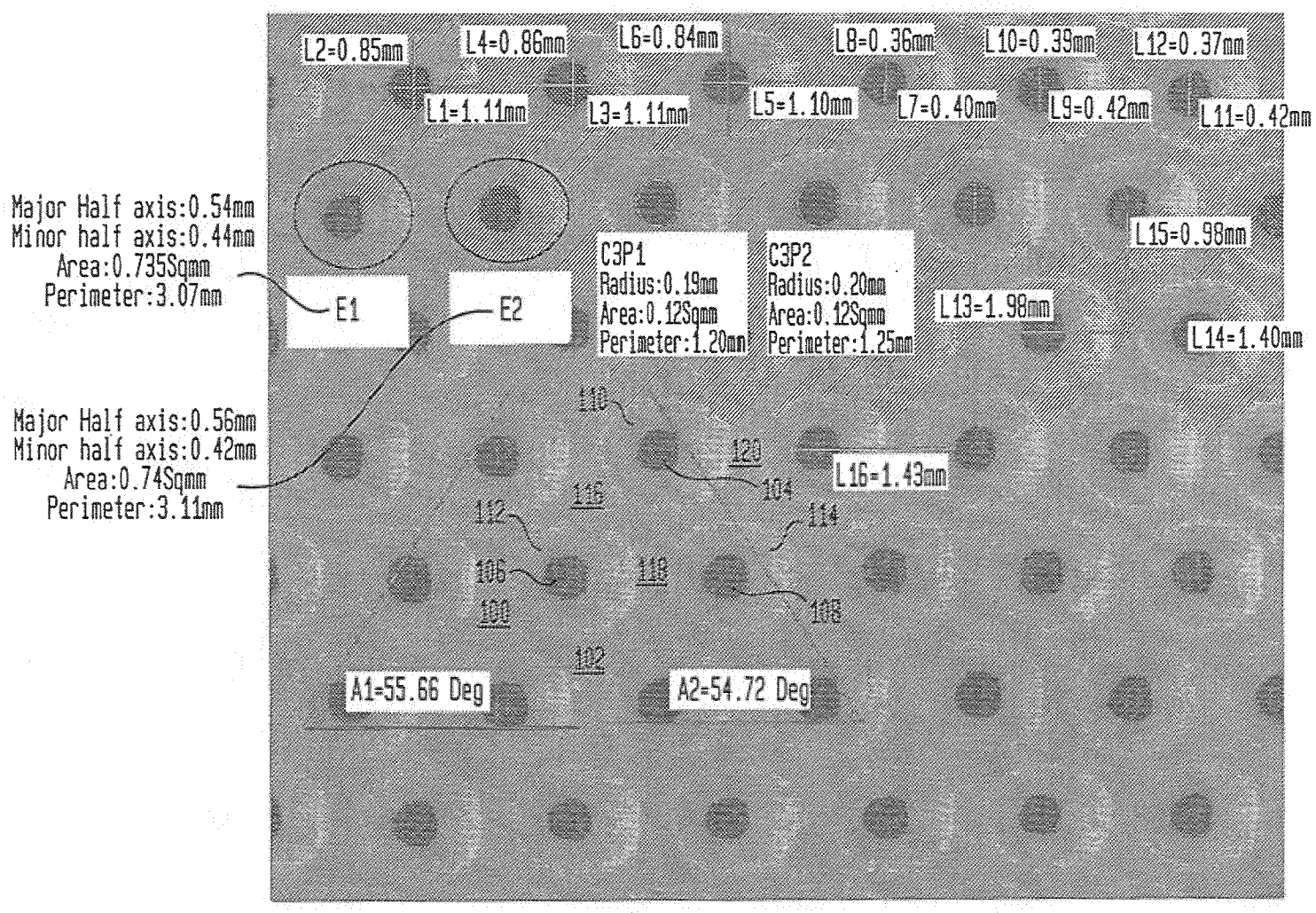
FIGS. 8 and 9 are photomicrographs (10×) of the top and bottom of another creping belt useful in the practice of the present invention.
Figure 9:
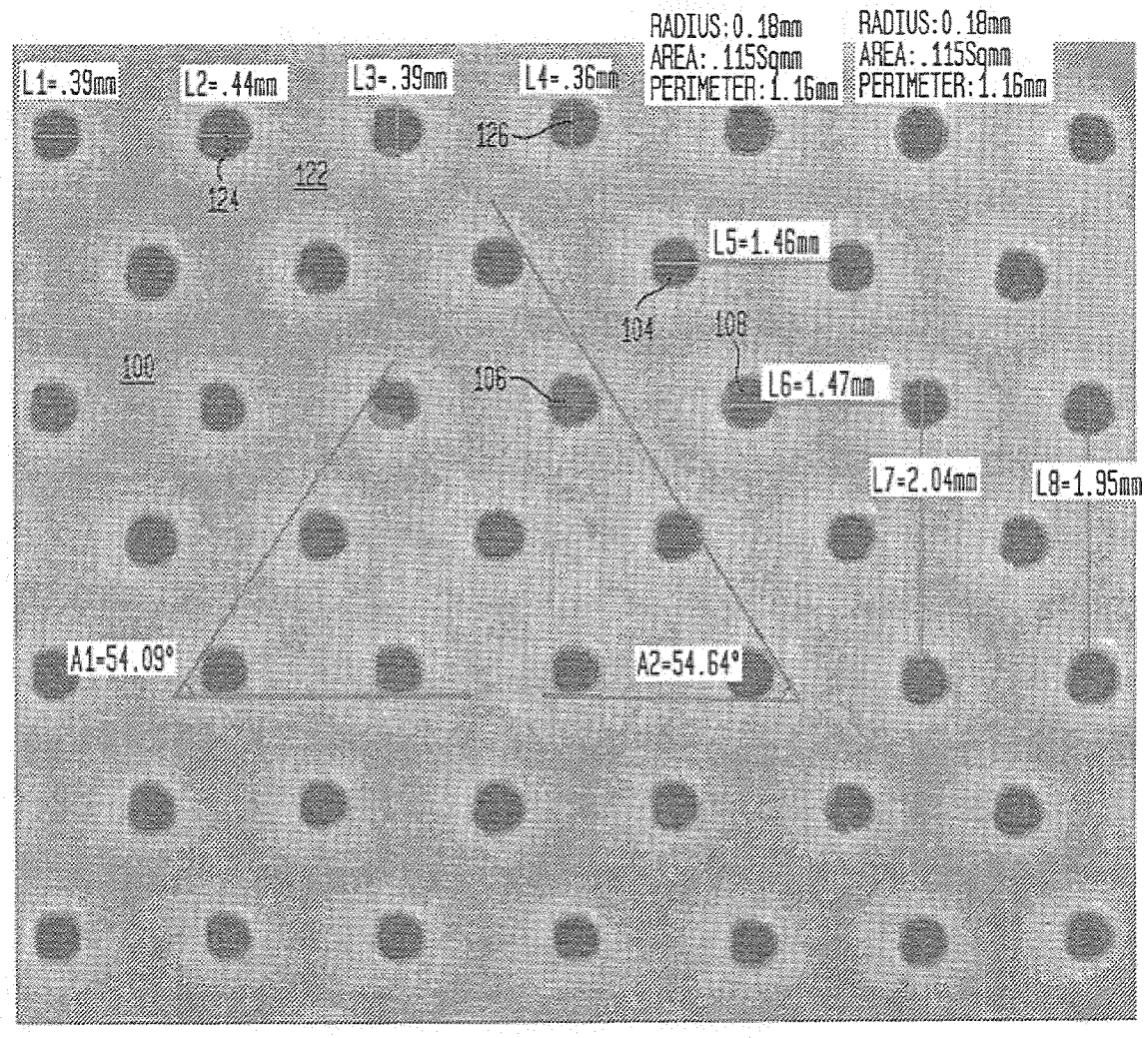

Shapes of the tapered perforations through the belt may be varied to achieve particular structures in the product. Exemplary shapes are shown in FIGS. 8 and 9 illustrating a portion of another belt 100 which can be used to make the inventive products. Circular and ovaloid perforations having major and minor diameters over a wide range of sizes may be used, and the invention should neither be construed as being limited to the specific sizes depicted in the drawings nor to the specific perforation per $cm^2$ illustrated.

FIG. 8 is a plan view photograph (10×) of a portion of a polymer belt 100 having an upper (creping) surface 102 and a plurality of tapered perforations of slightly ovate, mostly circular cross section 104, 106, and 108. This belt also has a thickness of from about 0.2 to 1.5 mm., and each perforation has an upper lip such as lips 110, 112, and 114, which extend upwardly around the upper periphery of the perforation as shown. The perforations on the upper surface are likewise separated by a plurality of flat portions or lands 116, 118, and 120 therebetween which separate the perforations. In the embodiment shown in FIGS. 8 and 9, the upper portions of the perforations have an open area of about 0.75 square mm or so, while the lower openings of the tapered perforations are much smaller, about 0.12 square mm or so, about 20% of the area of the upper openings. The upper openings have a major axis of length 1.1 mm or thereabouts and a slightly shorter axis having a width of 0.85 mm or so.

FIG. 9 is a plan view photograph (10×) of a lower (machine side) surface 122 of belt 100 where it is seen that the lower openings have major and minor axes 124 and 126 of about 0.37 and 0.44 mm, respectively. Here again, the bottom of the belt has much less "open" area than the topside of the belt (where the web is creped). The lower surface of the belt has substantially less than 50% open area, while the upper surface appears to have at least about 50% open area and more.

Belts 50 or 100 may be made by any suitable technique, including photopolymer techniques, molding, hot pressing or perforation by any means. Use of belts having a significant ability to stretch in the machine direction without buckling, puckering or tearing can be particularly beneficial; as, if the path length around all of the rolls defining the path of a translating fabric or belt in a paper machine is measured with precision, in many cases, that path length varies significantly across the width of the machine. For example, on a paper machine having a trim width of 280 inches (7.11 meters), a typical fabric or belt run might be approximately 200 feet (60.96 meters). However, while the rolls defining the belt or fabric run are close to cylindrical in shape, they often vary significantly from cylindrical, having slight crowns, warps, tapers or bows, either induced deliberately or resulting from any of a variety of other causes. Further, as many of these rolls are to some extent cantilevered as supports on the tending side of the machine are often removable, even if the rolls could be considered to be perfectly cylindrical, the axes of these cylinders would not in general be precisely parallel to each other. Thus, the path length around all of these rolls might be 200 feet (60.96 meters) precisely along the center line of the trim width but 199'6" (60.8 meters) on the machine side trim line and 201'4" (61.4 meters) on the tending side trim line with a rather non-linear variation in length occurring in-between the trim lines. Accordingly, we have found that it is desirable for the belts to be able to give slightly to accommodate this variation. In conventional paper-making, as well as in fabric creping, woven fabrics have the ability to contract transversely to the machine direction to accommodate strains or to stretch in the machine direction, so that non-uniformities in the path length are almost automatically adjusted. We have found that many polymeric belts formed by joining a large number of monolithically formed belt sections are unable to adapt easily to the variations in path length across the width of the machine without tearing, buckling or puckering. However, such a variation can often be accommodated by a belt that can stretch significantly in the machine direction by contracting in the cross direction without tearing, buckling or puckering. One particular advantage of belts formed by encapsulating a woven conventional fabric in a polymer is that such belts can have a significant capacity to resolve the variance in path length by contracting slightly in the cross-machine direction where the path length is longer, particularly, if polymer regions are free to follow the fabric. In general, we prefer that the belts have the capacity to adapt to variations of between about 0.01% and 0.2% in length without tearing, puckering or buckling.

Figure 41:
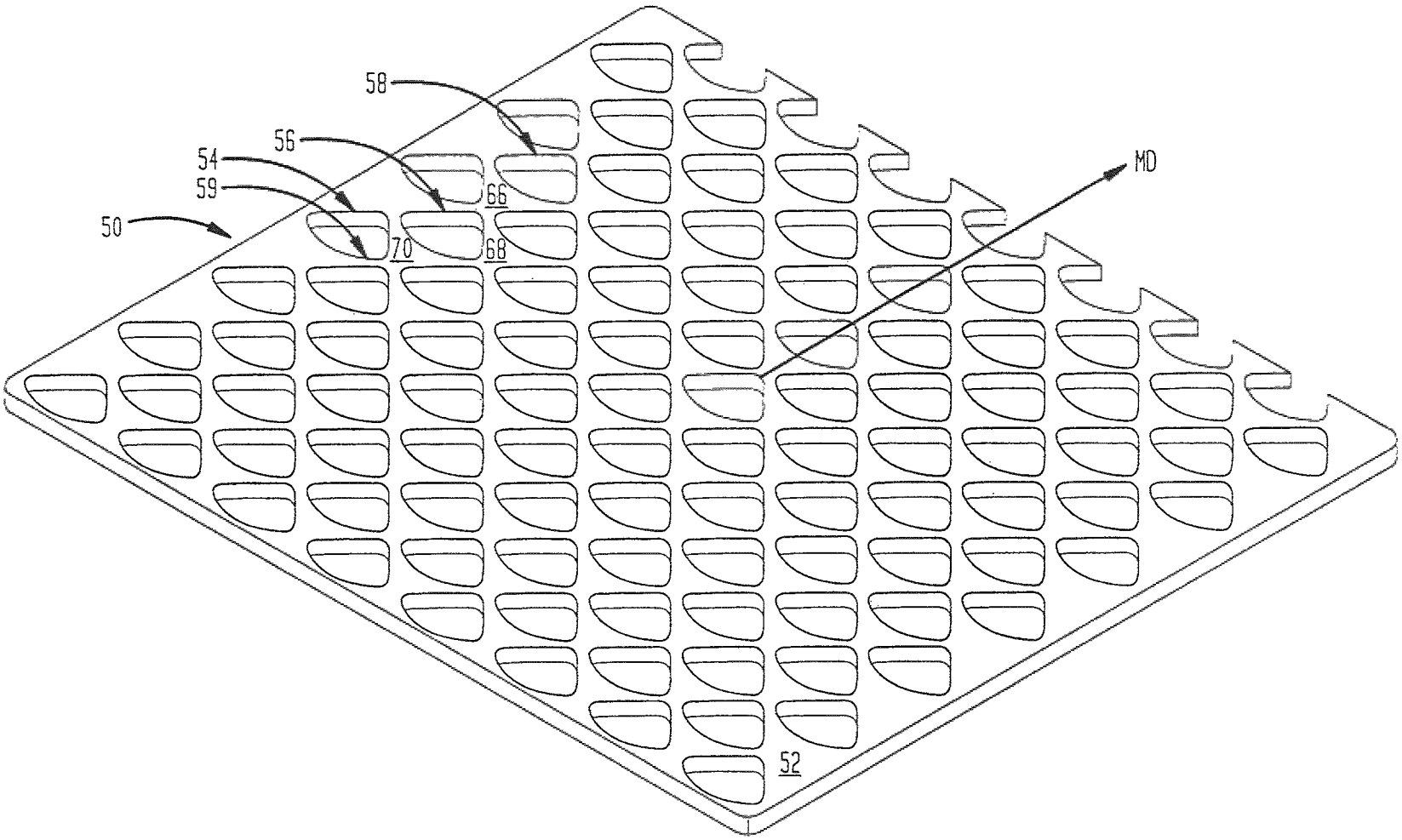
FIG. 41 is a schematic isometric perspective of a belt for use in accordance with the present invention having a staggered interpenetrating array of generally triangular perforations having an arcuate rear wall for impacting the sheet.

FIG. 41 is an isometric schematic of a belt having an interpenetrating staggered array of perforations allowing the belt to stretch more freely in response to such variations in the path length, in which perforations 54, 56, and 58 have a generally triangular shape with arcuate rear wall 59 impacting the sheet during the belt creping step.

To form the perforations through the belt, we particularly prefer to use laser engraving or drilling a polymer sheet. The sheet may be a layered, monolithic solid or optionally, a filled or reinforced polymer sheet material with suitable microstructure and strength. Suitable polymeric materials for forming the belt include polyesters, copolyesters, polyamides, copolyamides and other polymers suitable for sheet, film or fiber forming. The polyesters that may be used are generally obtained by known polymerization techniques from aliphatic or aromatic dicarboxylic acids with saturated aliphatic and/or aromatic diols. Aromatic diacid monomers include the lower alkyl esters, such as the dimethyl esters of terephthalic acid or isophthalic acid. Typical aliphatic dicarboxylic acids include adipic, sebacic, azelaic, dodecanedioic acid or 1,4-cyclohexanedicarboxylic acid. The preferred aromatic dicarboxylic acid or its ester or anhydride is esterified or trans-esterified and polycondensed with the saturated aliphatic or aromatic diol. Typical saturated aliphatic diols preferably include the lower alkane-diols such as ethylene glycol. Typical cycloaliphatic diols include 1,4-cyclohexane diol and 1,4-cyclohexane dimethanol. Typical aromatic diols include aromatic diols such as hydroquinone, resorcinol and the isomers of naphthalene diol (1,5-; 2,6-; and 2,7-). Various mixtures of aliphatic and aromatic dicarboxylic acids and saturated aliphatic and aromatic diols may also be used. Most typically, aromatic dicarboxylic acids are polymerized with aliphatic diols to produce polyesters, such as polyethylene terephthalate (terephthalic acid+ethylene glycol, optionally including some cycloaliphatic diol). Additionally, aromatic dicarboxylic acids can be polymerized with aromatic diols to produce wholly aromatic polyesters, such as polyphenylene terephthalate (terephthalic acid+hydroquinone). Some of these wholly aromatic polyesters form liquid crystalline phases in the melt and thus, are referred to as "liquid crystal polyesters" or LCPs.

Examples of polyesters include polyethylene terephthalate; poly(1,4-butylene) terephthalate; and 1,4-cyclohexylene dimethylene terephthalate/isophthalate copolymer and other linear homopolymer esters derived from aromatic dicarboxylic acids, including isophthalic acid, bibenzoic acid, naphthalene-dicarboxylic acid including the 1,5-; 2,6-; and 2,7-naphthalene-dicarboxylic acids; 4,4,-diphenylene-dicarboxylic acid; bis(p-carboxyphenyl)methane acid; ethylene-bis-p-benzoic acid: 1,4-tetramethylene bis(p-oxybenzoic) acid; ethylene bis(p-oxybenzoic) acid; 1,3-trimethylene bis(p-oxybenzoic) acid; and diols selected from the group consisting of 2,2-dimethyl-1,3-propane diol; cyclohexane dimethanol and aliphatic glycols of the general formula $HO(CH_2)_nOH$ where n is an integer from 2 to 10, e.g., ethylene glycol; 1,4-tetramethylene glycol; 1,6-hexamethylene glycol; 1,8-octamethylene glycol; 1,10-decamethylene glycol; and 1,3-propylene glycol; and polyethylene glycols of the general formula $HO(CH_2CH_2O)_nH$ where n is an integer from 2 to 10,000, and aromatic diols such as hydroquinone, resorcinol and the isomers of naphthalene diol (1,5-; 2,6-; and 2,7). There can also be present one or more aliphatic dicarboxylic acids, such as adipic, sebacic, azelaic, dodecanedioic acid or 1,4-cyclohexanedicarboxylic acid.

Also included are polyester containing copolymers such as polyesteramides, polyesterimides, polyesteranhydrides, polyesterethers, polyesterketones, and the like.

Polyamide resins, which may be useful in the practice of the invention, are well-known in the art and include semi-crystalline and amorphous resins, which may be produced, for example, by condensation polymerization of equimolar amounts of saturated dicarboxylic acids containing from 4 to 12 carbon atoms with diamines, by ring opening polymerization of lactams, or by copolymerization of polyamides with other components. e.g., to form polyether polyamide block copolymers. Examples of polyamides include polyhexamethylene adipamide (nylon 66), polyhexamethylene azelaamide (nylon 69), polyhexamethylene sebacamide (nylon 610), polyhexamethylene dodecanoamide (nylon 612), polydodecamethylene dodecanoamide (nylon 1212), polycaprolactam (nylon 6), polylauric lactam, poly-11-aminoundecanoic acid, and copolymers of adipic acid, isophthalic acid, and hexamethylene diamine.

If a Fourdrinier former or other gap former is used, the nascent web may be conditioned with suction boxes and a steam shroud until it reaches a solids content suitable for transferring to a dewatering felt. The nascent web may be transferred with suction assistance to the felt. In a crescent former, use of suction assist is generally unnecessary, as the nascent web is formed between the forming fabric and the felt.

Figure 10A:
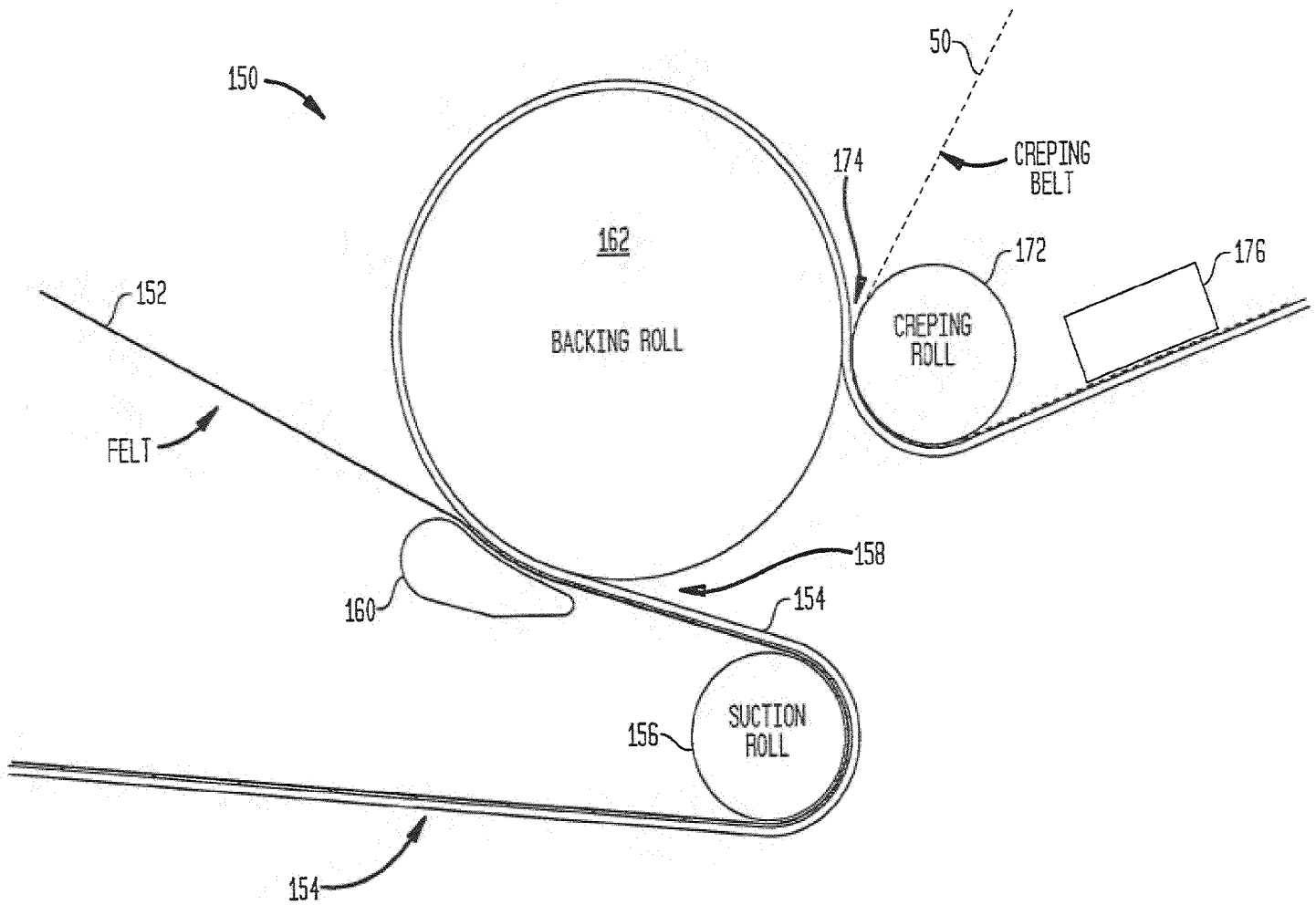
FIG. 10A is a schematic view illustrating wet-press transfer and belt creping as practiced in connection with the present invention.

A preferred mode of making the inventive products involves compactively dewatering a papermaking furnish having an apparently random distribution of fiber orientation and belt creping the web so as to redistribute the furnish in order to achieve the desired properties. Salient features of a typical apparatus for producing the inventive products are shown in FIG. 10A. Press section 150 includes a papermaking felt 152, a suction roll 156, a press shoe 160, and a backing roll 162. In all embodiments in which a backing roll is used, backing roll 162 may be optionally heated, preferably, internally, by steam. There is further provided a creping roll 172, a creping belt 50 having the geometry described above, as well as an optional suction box 176.

In operation, felt 152 conveys a nascent web 154 around a suction roll 156 into a press nip 158. In press nip 158, the web is compactively dewatered and transferred to a backing roll 162 (sometimes referred to as a transfer roll hereafter) where the web is conveyed to the creping belt. In a creping nip 174, web 154 is transferred into belt 50 (top side) as discussed in more detail hereafter. The creping nip is defined between backing roll 162 and creping belt 50, which is pressed against backing roll 162 by creping roll 172, which may be a soft covered roll as is also discussed hereafter. After the web is transferred onto belt 50, a suction box 176 may optionally be used to apply suction to the sheet in order to at least partially draw out minute folds, as will be seen in the vacuum-drawn products described hereafter. That is, in order to provide additional bulk, a wet web is creped onto a perforated belt and expanded within the perforated belt by suction, for example.

Figure 10B:
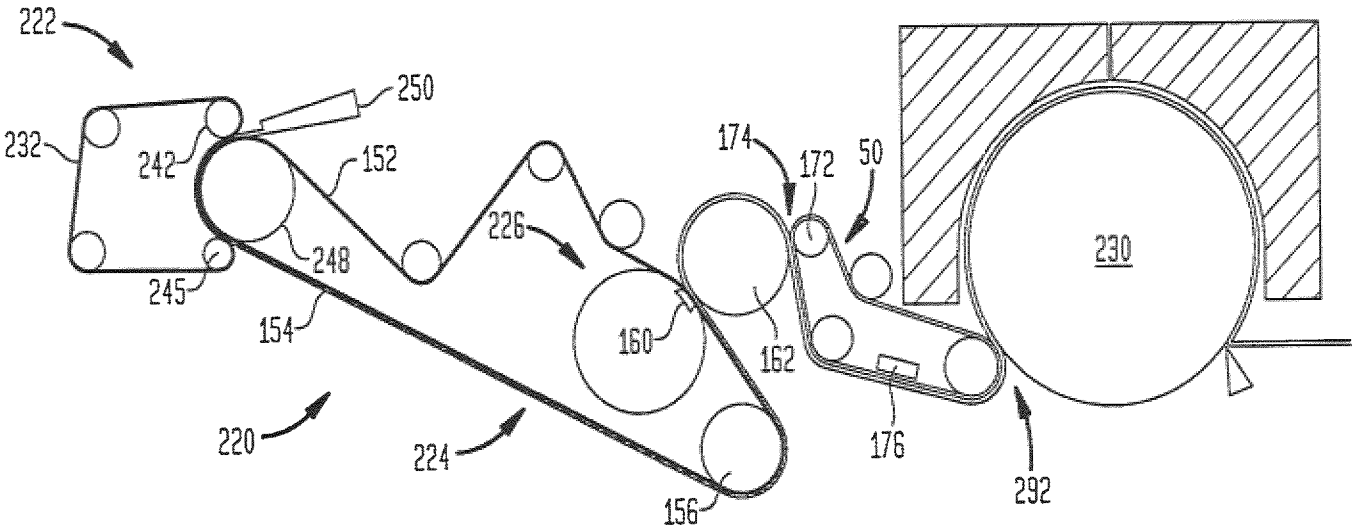
FIG. 10B is a schematic diagram of a paper machine that may be used to manufacture products of the present invention.
Figure 10C:
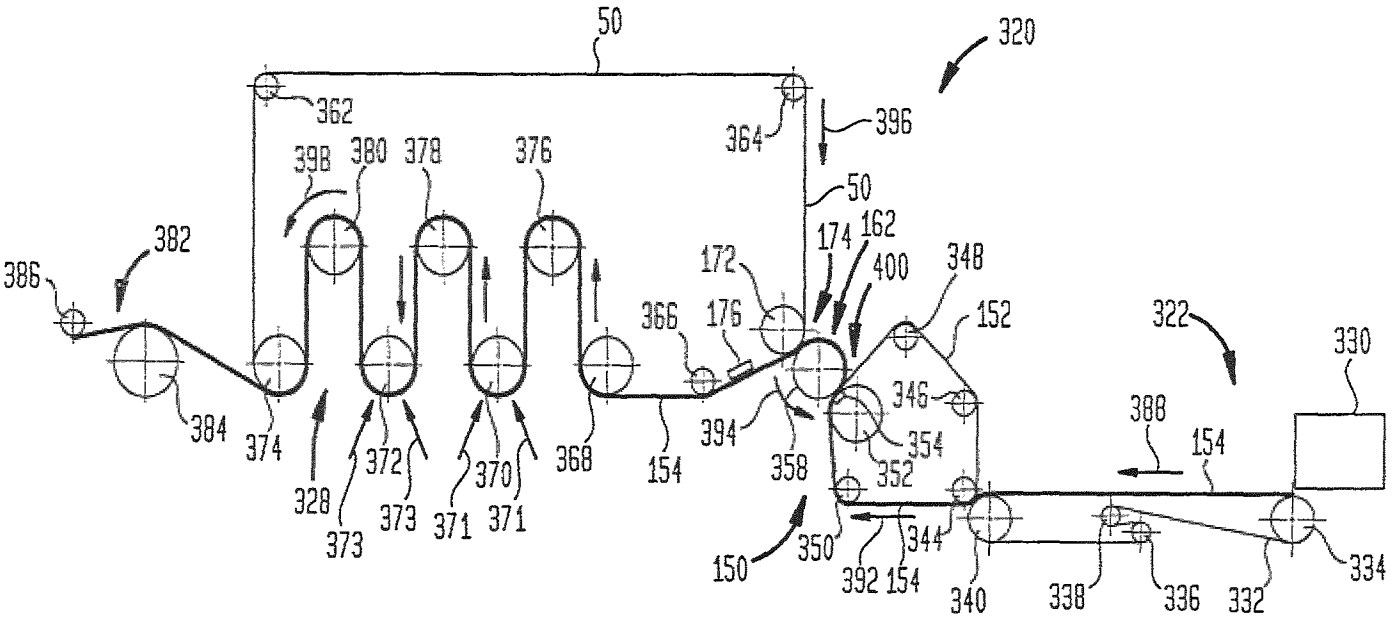
FIG. 10C is a schematic view of another paper machine that may be used to manufacture products of the present invention.
Figure 10D:
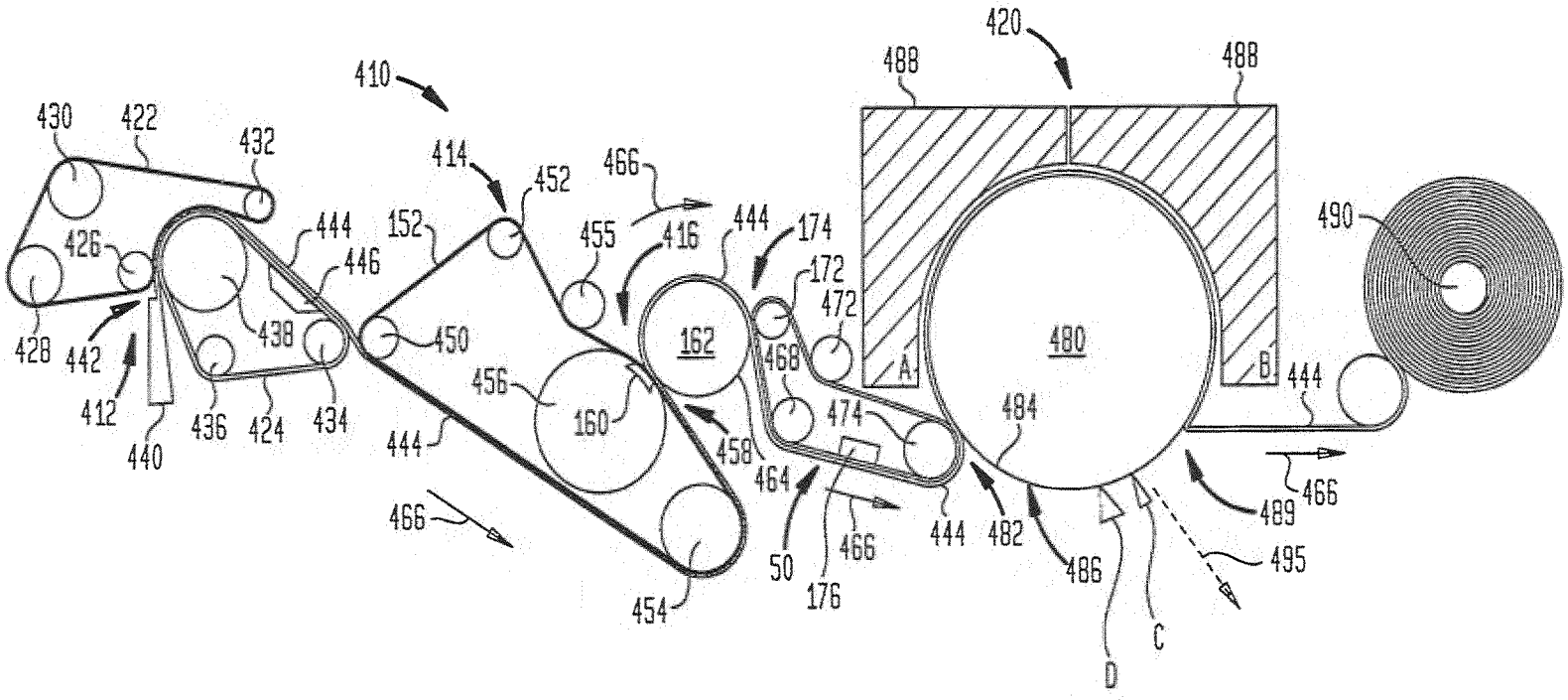
FIG. 10D is a schematic diagram of yet another paper machine useful for practicing the present invention.

A papermachine suitable for making the product of the invention may have various configurations as is seen in FIGS. 10B, 10C, and 10D discussed below.

There is shown in FIG. 10B, a papermachine 220 for use in connection with the present invention. Papermachine 220 is a three fabric loop machine having a forming section 222, generally referred to in the art as a crescent former. Forming section 222 includes headbox 250 depositing a furnish on forming wire 232 supported by a plurality of rolls, such as rolls 242, 245. The forming section also includes a forming roll 248, which supports papermaking felt 152, such that web 154 is formed directly on felt 152. Felt run 224 extends to a shoe press section 226 wherein the moist web is deposited on a backing roll 162 and wet-pressed concurrently with the transfer. Thereafter, web 154 is creped onto belt 50 (top side large openings) in belt crepe nip 174 before being optionally vacuum drawn by suction box 176 and then deposited on Yankee dryer 230 in another press nip 292 using a creping adhesive, as noted above. Transfer to a Yankee from the creping belt differs from conventional transfers in a conventional wet press (CWP) from a felt to a Yankee. In a CWP process, pressures in the transfer nip may be 500 PLI (87.6 kN/meter) or so, and the pressured contact area between the Yankee surface and the web is close to or at 100%. The press roll may be a suction roll which may have a P&J hardness of 25-30. On the other hand, a belt crepe process of the present invention typically involves transfer to a Yankee with 4-40% pressured contact area between the web and the Yankee surface at a pressure of 250-350 PLI (43.8-61.3 kN/meter). No suction is applied in the transfer nip, and a softer pressure roll is used, P&J hardness 35-45. The system includes a suction roll 156, in some embodiments; however, the three loop system may be configured in a variety of ways wherein a turning roll is not necessary. This feature is particularly important in connection with the rebuild of a papermachine inasmuch as the expense of relocating associated equipment, i.e., the headbox, pulping or fiber processing equipment and/or the large and expensive drying equipment, such as the Yankee dryer or plurality of can dryers, would make a rebuild prohibitively expensive, unless the improvements could be configured to be compatible with the existing facility.

Referring to FIG. 10C, there is shown schematically a paper machine 320, which may be used to practice the present invention. Paper machine 320 includes a forming section 322, a press section 150, a crepe roll 172, as well as a can dryer section 328. Forming section 322 includes: a head box 330, a forming fabric or wire 332, which is supported on a plurality of rolls to provide a forming table of section 322. There is thus provided forming roll 334, support rolls 336, 338, as well as a transfer roll 340.

Press section 150 includes a papermaking felt 152 supported on rollers 344, 346, 348, 350 and shoe press roll 352. Shoe press roll 352 includes a shoe 354 for pressing the web against transfer drum or backing roll 162. Transfer drum or backing roll 162 may be heated if so desired. In one preferred embodiment, the temperature is controlled so as to maintain a moisture profile in the web so a sided sheet is prepared, having a local variation in sheet moisture which does not extend to the surface of the web in contact with backing roll 162. Typically, steam is used to heat backing roll 162, as is noted in U.S. Pat. No. 6,379,496 to Edwards et al. Backing roll 162 includes a transfer surface 358, upon which the web is deposited during manufacture. Crepe roll 172 supports, in part, a creping belt 50, which is also supported on a plurality of rolls 362, 364 and 366.

Dryer section 328 also includes a plurality of can dryers 368, 370, 372, 374, 376, 378, and 380, as shown in the diagram, wherein cans 376, 378, and 380 are in a first tier, and cans 368, 370, 372, and 374 are in a second tier. Cans 376, 378, and 380 directly contact the web, whereas cans in the other tier contact the belt. In this two tier arrangement where the web is separated from cans 370 and 372 by the belt, it is sometimes advantageous to provide impingement air dryers at cans 370 and 372, which may be drilled cans, such that air flow is indicated schematically at 371 and 373.

There is further provided a reel section 382, which includes a guide roll 384 and a take up reel 386, shown schematically in the diagram.

Paper machine 320 is operated such that the web travels in the machine direction indicated by arrows 388, 392, 394, 396, and 398, as is seen in FIG. 10C. A papermaking furnish at low consistency, less than 5%, typically, 0.1% to 0.2%, is deposited on fabric or wire 332 to from a web 154 on forming section 322, as is shown in the diagram. Web 154 is conveyed in the machine direction to press section 150 and transferred onto a press felt 152. In this connection, the web is typically dewatered to a consistency of between about 10 and 15% on fabric or wire 332 before being transferred to the felt. So also, roller 344 may be a suction roll to assist in transfer to the felt 152. On felt 152, web 154 is dewatered to a consistency typically of from about 20 to about 25% prior to entering a press nip indicated at 400. At nip 400, the web is pressed onto backing roll 162 by way of shoe press roll 352. In this connection, the shoe 354 exerts pressure where upon the web is transferred to surface 358 of backing roll 162, preferably, at a consistency of from about 40 to 50% on the transfer roll. Transfer drum 162 translates in the machine direction indicated by 394 at a first speed.

Belt 50 travels in the direction indicated by arrow 396 and picks up web 154 in the creping nip indicated at 174 on the top, or more open side of the belt. Belt 50 is traveling at a second speed slower than the first speed of the transfer surface 358 of backing roll 162. Thus, the web is provided with a Belt Crepe, typically, in an amount of from about 10 to about 100% in the machine direction.

The creping belt defines a creping nip over the distance in which creping belt 50 is adapted to contact surface 358 of backing roll 162, that is, applies significant pressure to the web against the transfer cylinder. To this end, creping roll 172 may be provided with a soft deformable surface, which will increase the width of the creping nip and increase the belt creping angle between the belt and the sheet at the point of contact, or a shoe press roll or similar device could be used as backing roll 162 or 172, to increase effective contact with the web in high impact belt creping nip 174 where web 154 is transferred to belt 50 and advanced in the machine-direction. By using known configurations of existing equipment, it is possible to adjust the belt creping angle or the takeaway angle from the creping nip. A cover on creping roll 172 having a Pusey and Jones hardness of from about 25 to about 90 may be used. Thus, it is possible to influence the nature and amount of redistribution of fiber, delamination/debonding which may occur at belt creping nip 174 by adjusting these nip parameters. In some embodiments, it may by desirable to restructure the z-direction interfiber characteristics, while in other cases, it may be desired to influence properties only in the plane of the web. The creping nip parameters can influence the distribution of fiber in the web in a variety of directions, including inducing changes in the z-direction, as well as the MD and CD. In any case, the transfer from the transfer cylinder to the creping belt is high impact in that the belt is traveling slower than the web, and a significant velocity change occurs. Typically, the web is creped anywhere from 5 to 60% and even higher during transfer from the transfer cylinder to the belt. One of the advantages of the invention is that high degrees of crepe can be employed, approaching or even exceeding 100%.

Creping nip 174 generally extends over a belt creping nip distance or width of anywhere from about ⅛" to about 2" (3.18 mm to 50.8 mm), typically, ½" to 2" (12.7 mm to 50.8 mm).

The nip pressure in nip 174, that is, the loading between creping roll 172 and transfer drum 162 is suitably 20 to 100 (3.5 to 17.5 kN/meter), preferably, 40 to 70 pounds per linear inch (PLI) (7 to 12.25 kN/meter). A minimum pressure in the nip of 10 PLI (1.75 kN/meter) or 20 PLI (3.5 kN/meter) is necessary; however, one of skill in the art will appreciate in a commercial machine, the maximum pressure may be as high as possible, limited only by the particular machinery employed. Thus, pressures in excess of 100 PLI (17.5 kN/meter), 500 PLI (87.5 kN/meter), 1000 PLI (175 kN/meter) or more may be used, if practical, and provided a velocity delta can be maintained.

Following the belt crepe, web 154 is retained on bell 50 and fed to dryer section 328. In dryer section 328, the web is dried to a consistency of from about 92 to 98% before being wound up on reel 386. Note that there is provided in the drying section a plurality of heated drying rolls 376, 378, and 380, which are in direct contact with the web on belt 50. The drying cans or rolls 376, 378, and 380 are steam heated to an elevated temperature operative to dry the web. Rolls 368, 370, 372, and 374 are likewise heated, although these rolls contact the belt directly and not the web directly. Optionally provided is a suction box 176, which can be used to expand the web within the belt perforations to increase caliper, as noted above.

In some embodiments of the invention, it is desirable to eliminate open draws in the process, such as the open draw between the creping and drying belt and reel 386. This is readily accomplished by extending the creping belt to the reel drum and transferring the web directly from the belt to the reel, as is disclosed generally in U.S. Pat. No. 5,593,545 to Rugowski et al.

The products and processes of the present invention are thus likewise suitable for use in connection with touchless automated towel dispensers of the class described in co-pending U.S. patent application Ser. No. 11/678,770, entitled "Method of Controlling Adhesive Build-Up on a Yankee Dryer", filed Feb. 26, 2007, Publication No. 2007/0204966, now U.S. Pat. No. 7,850,823, and U.S. patent application Ser. No. 11/451,111, entitled "Method of Making Fabric-Creped Sheet for Dispensers", filed Jun. 12, 2006, Publication No. 2006/0289134, now U.S. Pat. No. 7,585,389, the disclosures of which are incorporated herein by reference. In this connection, the base sheet is suitably produced on a paper machine of the class shown in FIG. 10D.

FIG. 10D is a schematic diagram of a papermachine 410 having a conventional twin wire forming section 412, a felt run 414, a shoe press section 416, a creping belt 50 and a Yankee dryer 420 suitable for practicing the present invention. Forming section 412 includes a pair of forming fabrics 422, 424 supported by a plurality of rolls 426, 428, 430, 432, 434, 436 and a forming roll 438. A headbox 440 provides papermaking furnish issuing therefrom as a jet in the machine direction to a nip 442 between forming roll 438 and roll 426 and the fabrics. The furnish forms a nascent web 444, which is dewatered on the fabrics with the assistance of suction, for example, by way of suction box 446.

The nascent web is advanced to a papermaking felt 152, which is supported by a plurality of rolls 450, 452, 454, 455, and the felt is in contact with a shoe press roll 456. The web is of a low consistency as it is transferred to the felt. Transfer may be assisted by suction, for example, roll 450 may be a suction roll if so desired, or a pickup or suction shoe as is known in the art. As the web reaches the shoe press roll, it may have a consistency of 10-25%, preferably, 20 to 25% or so as it enters nip 458 between shoe press roll 456 and transfer drum 162. Transfer drum 162 may be a heated roll if so desired. It has been found that increasing steam pressure to transfer drum 162 helps lengthen the time between required stripping of excess adhesive from the cylinder of Yankee dryer 420. Suitable steam pressure may be about 95 psig or so, bearing in mind that backing roll 162 is a crowned roll and creping roll 172 has a negative crown to match such that the contact area between the rolls is influenced by the pressure in backing roll 162. Thus, care must be exercised to maintain matching contact between rolls 162, 172 when elevated pressure is employed.

Instead of a shoe press roll, roll 456 could be a conventional suction pressure roll. If a shoe press is employed, it is desirable and preferred that roll 454 is a suction roll effective to remove water from the felt prior to the felt entering the shoe press nip, since water from the furnish will be pressed into the felt in the shoe press nip. In any case, using a suction roll at 454 is typically desirable to ensure the web remains in contact with the felt during the direction change as one of skill in the art will appreciate from the diagram.

Web 444 is wet-pressed on the felt in nip 458 with the assistance of press shoe 160. The web is thus compactively dewatered at nip 458, typically, by increasing the consistency by fifteen or more points at this stage of the process. The configuration shown at nip 458 is generally termed a shoe press. In connection with the present invention, backing roll 162 is operative as a transfer cylinder, which operates to convey web 444 at high speed, typically, 1000 fpm to 6000 fpm (5.08 m/s to 30.5 m/s), to the creping belt. Nip 458 may be configured as a wide or extended nip shoe press as is detailed, for example, in U.S. Pat. No. 6,036,820 to Schiel et al., the disclosure of which is incorporated herein by reference.

Backing roll 162 has a smooth surface 464, which may be provided with adhesive (the same as the creping adhesive used on the Yankee cylinder) and/or release agents if needed. Web 444 is adhered to transfer surface 464 of backing roll 162, which is rotating at a high angular velocity as the web continues to advance in the machine-direction indicated by arrows 466. On the cylinder, web 444 has a generally random apparent distribution of fiber orientation.

Direction 466 is referred to as the machine-direction (MD) of the web as well as that of papermachine 410; whereas the cross-machine-direction (CD) is the direction in the plane of the web perpendicular to the MD.

Web 444 enters nip 458, typically, at consistencies of 10-25% or so, and is dewatered and dried to consistencies of from about 25 to about 70 by the time it is transferred to the top side of the creping belt 50, as shown in the diagram.

Belt 50 is supported on a plurality of rolls 468, 472 and a press nip roll 474 and forms a belt crepe nip 174 with transfer drum 162 as shown.

The creping belt defines a creping nip over the distance in which creping belt 50 is adapted to contact backing roll 162; that is, applies significant pressure to the web against the transfer cylinder. To this end, creping roll 172 may be provided with a soft deformable surface that will increase the width of the creping nip and increase the belt creping angle between the belt and the sheet at the point of contact, or a shoe press toll could be used as roll 172 to increase effective contact with the web in high impact belt creping nip 174 where web 444 is transferred to bell 50 and advanced in the machine-direction.

The nip pressure in nip 174, that is, the loading between creping roll 172 and backing roll 162 is suitably 20 to 200 (3.5 to 35 kN/meter), preferably, 40 to 70 pounds per linear inch (PLI) (7 to 12.25 kN/meter). A minimum pressure in the nip of 10 PLI (1.75 kN/m) or 20 PLI (3.5 kN/m) is necessary; however, one of skill in the art will appreciate that, in a commercial machine, the maximum pressure may be as high as possible, limited only by the particular machinery employed. Thus, pressures in excess of 100 PLI (17.5 kN/n), 500 PLI (87.5 kN/m), 1000 PLI (175 kN/m) or more may be used, if practical, and provided sufficient velocity delta can be maintained between the transfer roll and creping belt.

After belt creping, the web continues to advance along MD 466 where it is wet-pressed onto Yankee cylinder 480 in transfer nip 482. Optionally, suction is applied to the web by way of a suction box 176, to draw out minute folds as well as to expand the dome structure discussed hereafter.

Transfer at nip 482 occurs at a web consistency of generally from about 25 to about 70%. At these consistencies, it is difficult to adhere the web to surface 484 of Yankee cylinder 480 firmly enough to remove the web from the belt thoroughly. This aspect of the process is important, particularly, when it is desired to use a high velocity drying hood.

The use of particular adhesives cooperate with a moderately moist web (25-70% consistency) to adhere it to the Yankee sufficiently to allow for high velocity operation of the system and high jet velocity impingement air drying, and subsequent peeling of the web from the Yankee. In this connection, a poly(vinyl alcohol)/polyamide adhesive composition as noted above is applied at any convenient location between cleaning doctor D and nip 482, such as at location 486 as needed, preferably, at a rate of less than about 40 $mg/m^2$ of sheet.

The web is dried on Yankee cylinder 480, which is a heated cylinder and by high jet velocity impingement air in Yankee hood 488. Hood 488 is capable of variable temperature. During operation, web temperature may be monitored at wet-end A of the Hood and dry end B of the hood using an infra-red detector or any other suitable means if so desired. As the cylinder rotates, web 444 is peeled from the cylinder at 489 and wound on a take-up reel 490. Reel 490 may be operated 5-30 fpm (preferably 10-20 fpm) (0.025-0.152 meters/second (preferably, 0.051-0.102 m/s)) faster than the Yankee cylinder at steady-state when the line speed is 2100 fpm (10.7 m/s), for example. Instead of peeling the sheet, a creping doctor C may be used to conventionally dry-crepe the sheet. In any event, a cleaning doctor D mounted for intermittent engagement is used to control build up. When adhesive build-up is being stripped from Yankee cylinder 480, the web is typically segregated from the product on reel 490, preferably, being fed to a broke chute at 495 for recycle to the production process.

In many cases, the belt creping techniques revealed in the following applications and patents will be especially suitable for making products: U.S. patent application Ser. No. 11/678,669, entitled "Method of Controlling Adhesive Build-Up on a Yankee Dryer", filed Feb. 26, 2007, Publication No. 2007/0204966, now U.S. Pat. No. 7,850,823; U.S. patent, application Ser. No. 11/451,112, entitled "Fabric-Creped Sheet for Dispensers", filed Jun. 12, 2006, Publication No. 2006/0289133, now U.S. Pat. No. 7,585,388; U.S. patent application Ser. No. 11/451,111, entitled "Method of Making Fabric-creped Sheet for Dispensers", filed Jun. 12, 2006, Publication No, 2006/0289134, now U.S. Pat. No. 7,585,389; U.S. patent application Ser. No. 11/402,609, entitled "Multi-Ply Paper Towel With Absorbent Core", filed Apr. 12, 2006, Publication No. 2006/0237154, now U.S. Pat. No. 7,662,257; U.S. patent application Ser. No. 11/151,761, entitled "High Solids Fabric-creped Process for Producing Absorbent Sheet with In-Fabric Drying", filed Jun. 14, 2005, Publication No. 2005/0279471, now U.S. Pat. No. 7,503,998; U.S. patent application Ser. No. 11/108,458, entitled "Fabric-Crepe and In Fabric Drying Process for Producing Absorbent Sheet", filed Apr. 18, 2005, Publication No. 2005/0241787, now U.S. Pat. No. 7,442,278; U.S. patent application Ser. No. 11/108,375, entitled "Fabric-Crepe/Draw Process for Producing Absorbent Sheet", filed Apr. 18, 2005, Publication No. 2005/0217814, now U.S. Pat. No. 7,789,995; U.S. patent application Ser. No. 11/104,014, entitled "Wet-Pressed Tissue and Towel Products With Elevated CD Stretch and Low Tensile Ratios Made With a High Solids Fabric-Crepe Process", filed Apr. 12, 2005, Publication No. 2005/0241786, now U.S. Pat. No. 7,588,660; U.S. patent application Ser. No. 10/679,862, entitled "Fabric-Crepe Process for Making Absorbent Sheet", filed Oct. 6, 2003, Publication No. 2004/0238135, now U.S. Pat. No. 7,399,378; U.S. patent application Ser. No. 12/033,207, entitled "Fabric Crepe Proccss With Prolonged Production Cycle", filed Feb. 19, 2008, Publication No. 2008/0264589, now U.S. Pat. No. 7,608,164; and U.S. patent application Ser. No. 11/804,246, entitled "Fabric-creped Absorbent Sheet with Variable Local Basis Weight", filed May 16, 2007, now U.S. Pat. No. 7,494,563, The applications and patents referred to immediately above are particularly relevant to the selection of machinery, materials, processing conditions, and so forth, as to fabric creped products of the present invention and the disclosures of these applications patents are incorporated herein by reference. Additional useful information is contained in U.S. Pat. No. 7,399,378, the disclosure of which is also incorporated herein by reference.

The products of the invention are produced with or without application of a vacuum to draw out minute folds to restructure the web and with or without calendering; however, in many cases, it is desirable to use both to promote a more absorbent and uniform product.

The processes of the present invention are especially suitable in cases where it is desired to reduce the carbon footprint of existing operations, while improving tissue quality, as the sheet will typically contact the Yankee at about 50% solids, so the water-removal requirements can be about ⅓ those of the process discussed in U.S. Patent Application Publication No. 2009/0321027 A1, now U.S. Pat. No. 7,871,493, "Environmentally-Friendly Tissue." Even though the total amount of vacuum may contribute more to the footprint than the so-called air press, the process has the potential to create carbon emissions that are far less than those mentioned above in the Environmentally-Friendly Tissue patent, suitably, in excess of ⅓ less, to even 50% less for equivalent quantities of generally equivalent tissue.

Utilizing an apparatus of the class shown in FIGS. 10A to 10D, basesheet was produced in accordance with the invention. Data as to equipment, processing conditions and materials appear in Table 1. Basesheet data appears in Table 2.

EXAMPLES 1 to 12

Figure 39:
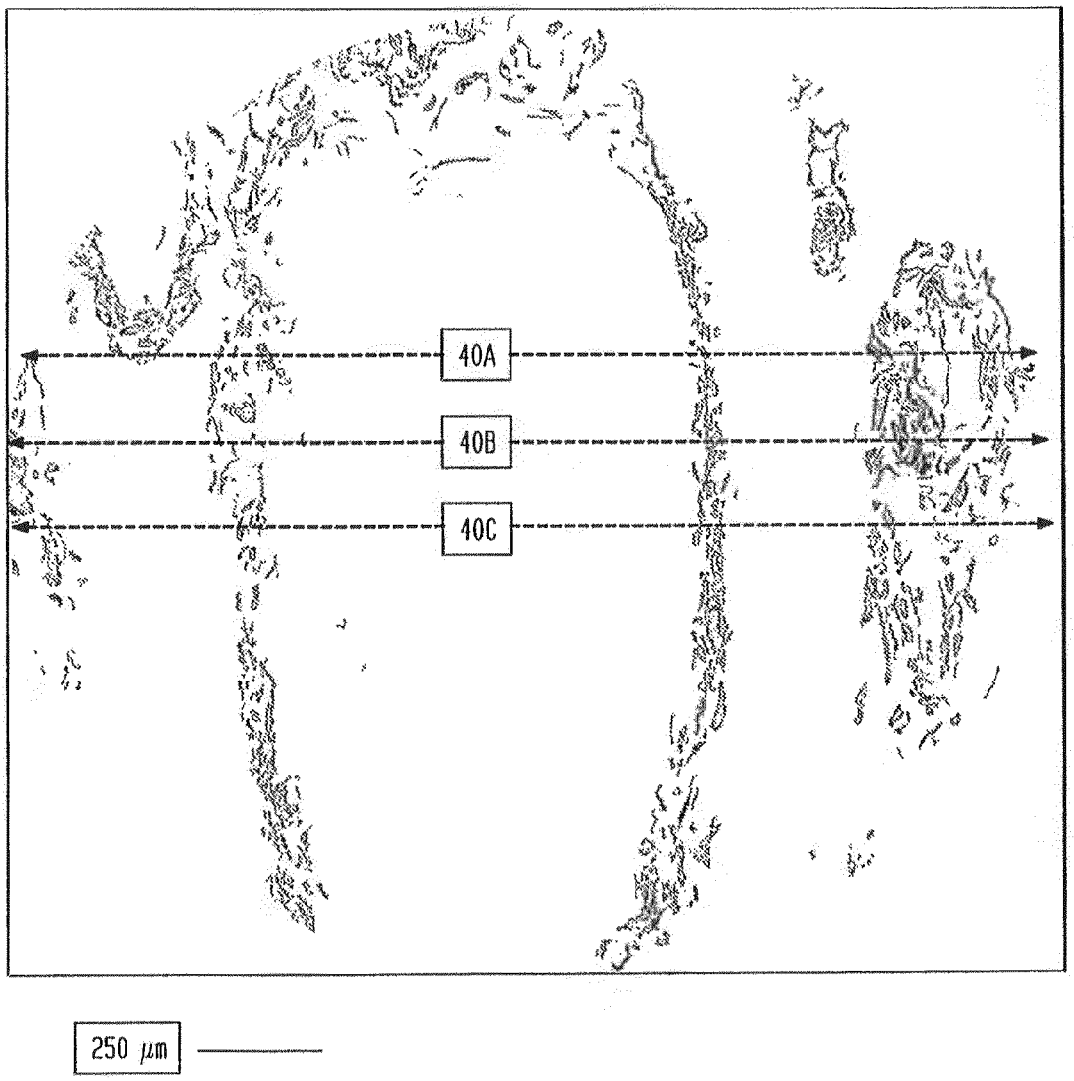
FIG. 39 is an X-ray tomograph of X-Y slice (plan view) of a dome in a sheet of the invention.
Figure 40A:
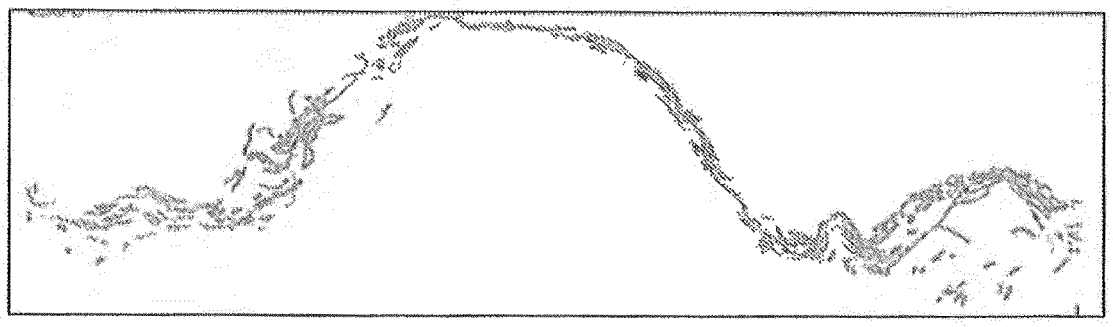
FIGS. 40A to 40C are X-ray tomographs of slices through the dome shown in FIG. 39 taken along the lines indicated in FIG. 39.
Figure 40B:
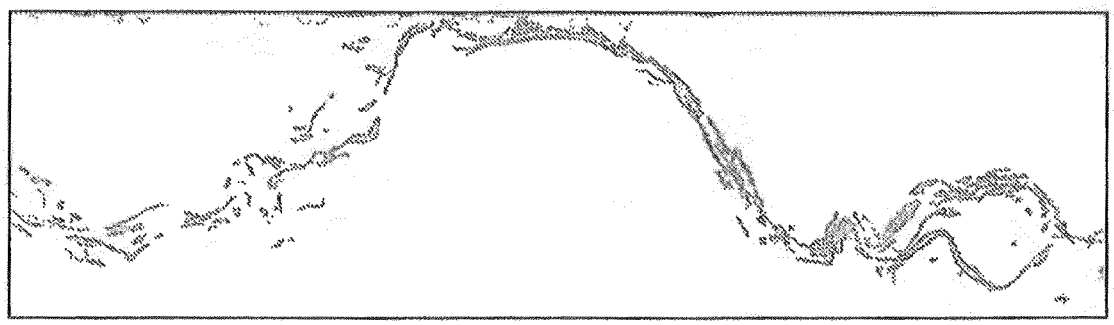
Figure 40C:
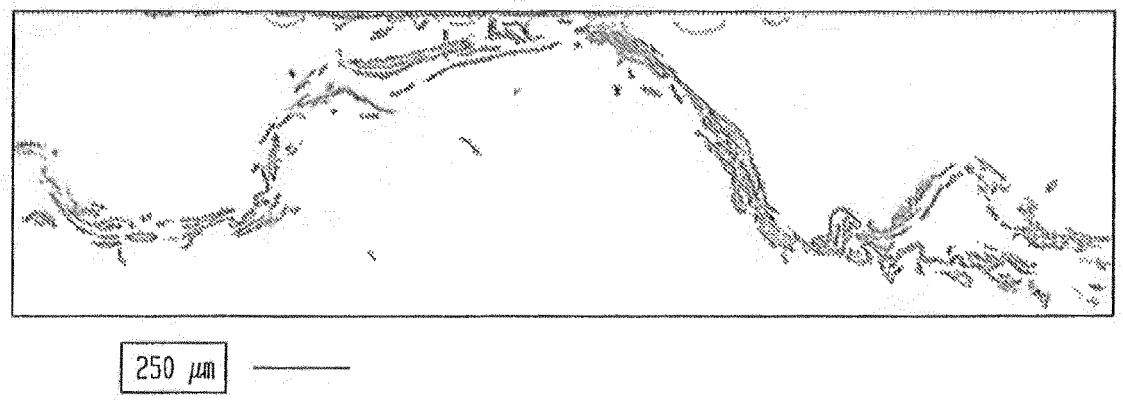

In Examples 1-4, belt 50, as shown in FIGS. 4 to 7, was used and a 50% eucalyptus, 50% northern softwood blended tissue furnish was employed. FIGS. 39 to 40C are X-ray tomography sections of a dome of sheet prepared in accordance with Example 3 in which FIG. 39 is a plan view of a section of the dome while FIGS. 40A, 40B, and 40C illustrate sections taken along the lines indicated in FIG. 39. In each of FIGS. 40A, 40B, and 40C, it can be observed that upwardly and inwardly projecting regions of the leading edge of the dome are highly consolidated.

In Examples 5 to 8, a belt similar to belt 100, but with fewer perforations was used and a 20% eucalyptus, 80% northern softwood blended towel furnish was employed.

In Examples 9 and 10, a belt similar to belt 100, but with fewer perforations, was used and an 80% eucalyptus, 20% northern softwood layered tissue furnish was employed.

In Examples 11 and 12, belt 100 was used and a 600% eucalyptus, 40% northern softwood layered tissue furnish was employed.

Hercules D-1145 is an 18% solids creping adhesive that is a high molecular weight polyaminamide-epichlorohydrin having very low thermosetting capability.

Rezosol 6601 is an 11% solids solution of a creping modifier in water; where the creping modifier is a mixture of an 1-(2-alkylenylamidoethyl)-2-alkylenyl-3-ethylimidazolinium ethyl sulfate and a polyethylene glycol.

Varisoft GP-B100 is a 100% actives ion-pair softener based on an imidazolinium quat and an anionic silicone as described in U.S. Pat. No. 6,245,197 B1.

TABLE 1

| | Example | | | | | |
|---|---|---|---|---|---|---|
| | 1 | 2 | 3 | 4 | 5 | 6 |
| Roll # | 19676 | 19680 | 19682 | 19683 | 19695 | 19696 |
| Figures and Tables | 11A-G, 18A, 19A, 24A | 2A | 12A-G, 20A | 1, 3, 13A-G, 17A | Tab. 5, col. 2 | Tab. 5, col. 2 |
| Forming | Twin Wire | Twin Wire | Twin Wire | Twin Wire | Twin Wire | Twin Wire |
| Furnish to Headbox | Blended at PULPER | Blended at PULPER | Blended at PULPER | Blended at PULPER | Blended at PULPER | Blended at PULPER |
| Felt Type | Albany Tis-Shoe 200 | Albany Tis-Shoe 200 | Albany Tis-Shoe 200 | Albany Tis-Shoe 200 | Albany Tis-Shoe 200 | Albany Tis-Shoe 200 |
| Press Type | ViscoNip | ViscoNip | ViscoNip | ViscoNip | ViscoNip | ViscoNip |
| Press Sleeve Type | VENTA-BELT | VENTA-BELT | VENTA-BELT | VENTA-BELT | VENTA-BELT | VENTA-BELT |
| Yankee Crepe Blade | 15 degree steel | 15 degree steel | 15 degree steel | 15 degree steel | 15 degree steel | 15 degree steel |
| Yankee Chem. 1 | 1145 | 1145 | 1145 | 1145 | 1145 | 1145 |
| Yankee Chem. 2 | 6601 | 6601 | 6601 | 6601 | 6601 | 6601 |
| Yankee Chem. 3 | PVOH | PVOH | PVOH | PVOH | PVOH | PVOH |
| Backing Roll Chemical 4 | GP B 100 | GP B 100 | GP B 100 | GP B 100 | GP B 100 | GP B 100 |
| Dry Strength, Wet Strength or Softener Chemical 5 | CMC | CMC | CMC | CMC | CMC | CMC |
| Wet Strength or Softener Chemical 6 | Amres | Amres | Amres | Amres | Amres | Amres |
| Chem. 5 lb/ton kg/metric ton) | 0.0 (0.0) | 0.0 (0.0) | 0.0 (0.0) | 0.0 (0.0) | 5.7 (2.85) | 5.6 (2.80) |
| Chem. 6 lb/ton (kg/metric ton) | 0.0 (0.0) | 0.0 (0.0) | 0.0 (0.0) | 0.0 (0.0) | 19.2 (9.60) | 18.6 (9.30) |
| Chem. 1 mg/m$^2$ | 8.8 | 8.6 | 9.3 | 9.4 | 9.3 | 9.3 |
| Chem. 2 mg/m$^2$ | 10.5 | 7.1 | 8.7 | 8.7 | 8.4 | 8.5 |
| Chem. 3 mg/m$^2$ | 30.0 | 26.3 | 28.0 | 28.0 | 34.4 | 34.4 |
| Chem. 4 mg/m$^2$ | 23.3 | 30.6 | 30.5 | 29.5 | 29.6 | 29.7 |
| Jet Spd fpm (m/s) | 2471 (12.55) | 1985 (10.08) | 2010 (10.21) | 2014 (10.23) | 2192 (11.14) | 2195 (11.15) |
| Form Roll Speed, fpm (m/s) | 2232 (11.34) | 1744 (8.86) | 1744 (8.86) | 1744 (8.86) | 1742 (8.85) | 1742 (8.85) |
| Small Dryer Speed, fpm (m/s) | 2239 (11.37) | 1743 (8.85) | 1743 (8.85) | 1743 (8.85) | 1744 (8.86) | 1744 (8.86) |
| Yankee Speed, fpm (m/s) | 1802 (9.15) | 1402 (7.12) | 1401 (7.12) | 1402 (7.12) | 1401 (7.12) | 1401 (7.12) |
| Reel Speed, fpm (m/s) | 1712 (8.70) | 1332 (6.77) | 1332 (6.77) | 1332 (6.77) | 1361 (6.91) | 1363 (6.92) |
| Jet/Wire Ratio | 1.11 | 1.14 | 1.15 | 1.15 | 1.26 | 1.26 |
| Fabric Crepe Ratio | 1.24 | 1.24 | 1.24 | 1.24 | 1.24 | 1.24 |
| Reel Crepe Ratio | 1.05 | 1.05 | 1.05 | 1.05 | 1.03 | 1.03 |
| Total Crepe Ratio | 1.31 | 1.31 | 1.31 | 1.31 | 1.28 | 1.28 |
| White - water pH | 5.60 | 5.62 | 5.62 | 5.62 | 7.87 | 7.87 |
| Slice Opening inches (mm) | 1.043 (26.5) | 1.061 (26.9) | 1.061 (26.9) | 1.061 (26.9) | 1.009 (25.6) | 1.009 (25.6) |
| Total HB Flow, gpm (l/m) | no data | no data | no data | no data | no data | no data |
| Refiner HP (kW) | 29.9 (22.3) | 29.1 (21.7) | 28.8 (21.5) | 28.9 (21.6) | 32.2 (24.0) | 32.1 (23.9) |
| REFINER HP-Days/Ton (kW-hrs/m ton) | 1.3 (21.1) | 1.5 (24.3) | 1.5 (24.3) | 1.6 (26.0) | 2.0 (32.5) | 1.9 (30.8) |
| WE Yankee Hood Temp., F. (° C.) | 609 (320.5) | 605 (318.3) | 562 (294.4) | 551 (288.3) | 432 (222.2) | 430 (221.1) |
| DE Yankee Hood Temp., F. (° C.) | 558 (292.2) | 550 (287.8) | 512 (266.7) | 502 (261.1) | 392 (200) | 391 (199.4) |
| Suction roll vacuum, (in. Hg) (kPa) | 10.5 (35.6) | 10.5 (35.6) | 10.5 (35.6) | 10.5 (35.6) | 10.5 (35.6) | 10.5 (35.6) |
| Pressure Roll Load, PLI (kN/meter) | 374 (65.5) | 411 (71.9) | 409 (71.6) | 408 (71.4) | 359 (62.8) | 359 (62.8) |
| VISCO - NIP C1 RATIO | 1 | 1 | 1 | 1 | 1 | 1 |
| VISCO - NIP C2 RATIO | 5 | 5 | 5 | 5 | 5 | 5 |

TABLE 1-continued

| | | | | | | |
|---|---|---|---|---|---|---|
| VISCO - NIP C3 RATIO | 19 | 19 | 19 | 19 | 19 | 19 |
| ViscoNip Load, PLI | 500 | 550 | 550 | 550 | 550 | 550 |
| (kN/meter) | (87.5) | (96.3) | (96.3) | (96.3) | (96.3) | (96.3) |
| YANKEE STEAM PSIG | 105 | 105 | 105 | 105 | 90 | 90 |
| (kPa) | (724) | (724) | (724) | (724) | (621) | (621 |
| Small Dryer Steam, PSI | 25 | 25 | 25 | 25 | 25 | 25 |
| (kPa) | (172.4) | (172.4) | (172.4) | (172.4) | (172.4) | (172.4) |
| Crepe Roll PLI from Load Cells | 74 | 75 | 75 | 75 | 62 | 62 |
| (kN/meter) | (251) | (251) | (251) | (251) | (210) | (210) |
| Molding Box Vacuum, (in. Hg) | 0.0 | 23.0 | 18.0 | 18.0 | 24.0 | 24.0 |
| (kPa) | (0) | (78.9) | (61) | (61) | (81.4) | (81.4) |
| Calender Position | open | open | open | closed | open | open |

| | Example | | | | | |
|---|---|---|---|---|---|---|
| | 7 | 8 | 9 | 10 | 11 | 12 |
| Roll # | 19699 | 19701 | 19705 | 19706 | 19771 | 19772 |
| Figures and Tables | Tab. 5, col. 3 | Tab. 5, col. 3 | Table 7, col. 3 | Table 7, col. 3 | Table 6, col. 2, 3, 4 | Table 6, col. 2, 3, 4 |
| Forming | Twin Wire | Twin Wire | Twin Wire | Twin Wire | Twin Wire | Twin Wire |
| Furnish to Headbox | Blended at PULPER | Blended at PULPER | Blended at PULPER | Blended at PULPER | Blended at PULPER | Blended at PULPER |
| Felt Type | Albany Tis-Shoe 200 | Albany Tis-Shoe 200 | Albany Tis-Shoe 200 | Albany Tis-Shoe 200 | Albany Tis-Shoe 200 | Albany Tis-Shoe 200 |
| Press Type | ViscoNip | ViscoNip | ViscoNip | ViscoNip | ViscoNip | ViscoNip |
| Press Sleeve Type | VENTA-BELT | VENTA-BELT | VENTA-BELT | VENTA-BELT | VENTA-BELT | VENTA-BELT |
| Yankee Crepe Blade | 15 degree steel | 15 degree steel | 15 degree steel | 15 degree steel | 15 degree steel | 15 degree steel |
| Yankee Chem. 1 | 1145 | 1145 | 1145 | 1145 | 1145 | 1145 |
| Yankee Chem. 2 | 6601 | 6601 | 6601 | 6601 | 6601 | 6601 |
| Yankee Chem. 3 | PVOH | PVOH | PVOH | PVOH | PVOH | PVOH |
| Backing Roll Chemical 4 | GP B 100 | GP B 100 | GP B 100 | GP B 100 | GP B 100 | GP B 100 |
| Dry Strength, Wet Strength or Softener Chemical 5 | CMC | CMC | FJ98 | FJ98 | GP B 100 | GP B 100 |
| Wet Strength or Softener Chemical 6 | Amres | Amres | Amres | Amres | FJ 98 | FJ 98 |
| Chem. 5 lb/ton | 5.5 | 5.7 | 1.7 | 1.9 | 3.1 | 3.2 |
| kg/metric ton) | (2.75) | (2.85) | (0.85) | (0.95) | (1.55) | (1.60) |
| Chem. 6 lb/ton | 19.1 | 19.2 | 0.0 | 0.0 | 2.0 | 4.1 |
| (kg/metric ton) | (9.55) | (9.60) | (0.0) | (0.0) | (1.0) | (2.05) |
| Chem. 1 mg/m$^2$ | 9.3 | 9.3 | 9.4 | 9.4 | 8.3 | 8.3 |
| Chem. 2 mg/m$^2$ | 8.6 | 8.6 | 8.6 | 8.7 | 9.2 | 9.2 |
| Chem. 3 mg/m$^2$ | 34.5 | 34.4 | 28.2 | 28.1 | 25.7 | 25.6 |
| Chem. 4 mg/m$^2$ | 29.4 | 29.9 | 30.3 | 29.9 | 25.8 | 25.9 |
| Jet Spd fpm (m/s) | 2212 | 2212 | 2132 | 2131 | 1997 | 1999 |
| | (11.24) | (11.24) | (10.83) | (10.83) | (10.14) | (10.15) |
| Form Roll Speed, fpm | 1742 | 1742 | 1742 | 1742 | 1648 | 1648 |
| (m/s) | (8.85) | (8.85) | (8.85) | (8.85) | (8.37) | (8.37) |
| Small Dryer Speed, fpm | 1745 | 1745 | 1743 | 1743 | 1642 | 1643 |
| (m/s) | (8.86) | (8.86) | (8.85) | (8.85) | (8.34) | (8.35) |
| Yankee Speed, fpm (m/s) | 1402 | 1402 | 1402 | 1402 | 1402 | 1402 |
| | (7.12) | (7.12) | (7.12) | (7.12) | (7.12) | (7.12) |
| Reel Speed, fpm (m/s) | 1363 | 1363 | 1336 | 1336 | 1305 | 1304 |
| | (6.92) | (6.92) | (6.79) | (6.79) | (6.63) | (6.62) |
| Jet/Wire Ratio | 1.27 | 1.27 | 1.22 | 1.22 | 1.21 | 1.21 |
| Fabric Crepe Ratio | 1.25 | 1.25 | 1.24 | 1.24 | 1.17 | 1.17 |
| Reel Crepe Ratio | 1.03 | 1.03 | 1.05 | 1.05 | 1.07 | 1.07 |
| Total Crepe Ratio | 1.28 | 1.28 | 1.30 | 1.30 | 1.26 | 1.26 |
| White - water pH | 7.93 | 7.85 | 6.77 | 6.76 | 7.43 | 7.43 |
| Slice Opening inches | 1.009 | 1.009 | 1.009 | 1.009 | 1.269 | 1.269 |
| (mm) | (25.6) | (25.6) | (25.6) | (25.6) | (32.2) | (32.2) |
| Total HB Flow, gpm | no data | no data | no data | no data | 2613 | 2614 |
| (l/m) | | | | | (2.613) | (2.614) |
| Refiner HP | 31.9 | 32.4 | 16.7 | 15.0 | 33.2 | 33.1 |
| (kW) | (23.8) | (24.2) | (12.5) | (11.2) | (24.8) | (24.7) |
| REFINER HP-Days/Ton | 2.0 | 2.0 | 0.4 | 0.3 | 3.2 | 3.2 |
| (kW-hrs/m ton) | (32.5) | (32.5) | (6.5) | (4.9) | (51.9) | (51.9) |

TABLE 1-continued

| | | | | | | |
|---|---|---|---|---|---|---|
| WE Yankee Hood Temp., F. (° C.) | 446 (230) | 436 (224.4) | 520 (271.1) | 535 (279.4) | 556 (291.1) | 533 (278.3) |
| DE Yankee Hood Temp., F. (° C.) | 379 (192.8) | 392 (200) | 479 (248.3) | 473 (245) | 510 (265.6) | 488 (253.3) |
| Suction roll vacuum, (in. Hg) (kPa) | 10.5 (35.6) | 10.5 (35.6) | 10.5 (35.6) | 10.5 (35.6) | 10.5 (35.6) | 10.5 (35.6) |
| Pressure Roll Load, PLI (kN/meter) | 361 (63.2) | 361 (63.2) | 352 (61.6) | 352 (61.6) | 188 (32.9) | 372 (65.1) |
| VISCO - NIP C1 RATIO | 1 | 1 | 1 | 1 | 1 | 1 |
| VISCO - NIP C2 RATIO | 5 | 5 | 5 | 5 | 5 | 5 |
| VISCO - NIP C3 RATIO | 19 | 19 | 19 | 19 | 19 | 19 |
| ViscoNip Load, PLI (kN/meter) | 550 (96.3) | 550 (96.3) | 550 (96.3) | 550 (96.3) | 500 (87.5) | 500 (87.5) |
| YANKEE STEAM PSIG (kPa) | 90 (621 | 90 (621 | 90 (621 | 90 (621 | 105 (724) | 105 (724) |
| Small Dryer Steam, PSI (kPa) | 25 (172.4) | 25 (172.4) | 25 (172.4) | 25 (172.4) | 25 (172.4) | 11 (75.8) |
| Crepe Roll PLI from Load Cells (kN/meter) | 62 (210) | 62 (210) | 65 (220) | 65 (220) | 79 (268) | 75 (251) |
| Molding Box Vacuum, (in. Hg) (kPa) | 24.0 (81.4) | 24.0 (81.4) | 24.0 (81.4) | 24.0 (81.4) | 23.6 (80) | 23.5 (79.7) |
| Calender Position | closed | closed | open | open | open | Open |

TABLE 2

| Basesheet Data | | | | | | |
|---|---|---|---|---|---|---|
| | Example | | | | | |
| | 1 | 2 | 3 | 4 | 5 | 6 |
| Sample Roll # | 27-1 19676 | 31-1 19680 | 33-1 19682 | 34-1 19683 | 44-1 19695 | 45-1 19696 |
| 8 Sheet Caliper mils/8 sht (mm/8 sht) | 70 (1.78) | 109 (2.77) | 102 (2.59) | 80 (2.03) | 110 (2.79) | 111 (2.82) |
| Basis Weight lb/3000 $ft^2$ ($g/m^2$) | 17.1 (27.9) | 17.3 (28.2) | 17.4 (28.4) | 16.7 (27.2) | 13.5 (22.0) | 13.7 (22.3) |
| Specific Bulk (mils/ 8 sht)/(lb./ ream) (mm/8 sht/gsm) | 4.09 (0.169) | 6.30 (0.261) | 5.84 (0.242) | 4.76 (0.197) | 8.15 (0.337) | 8.09 (0.335) |
| Tensile MD g/3 in, (g/mm) | 1356 (17.8) | 1491 (19.6) | 1534 (20.1) | 1740 (22.8) | 2079 (27.3) | 2047 (26.9) |
| Stretch MD, % | 32.6 | 32.6 | 33.2 | 32.4 | 31.0 | 30.4 |
| Tensile CD g/3 in, (g/mm) | 894 (11.7) | 732 (9.61) | 861 (11.3) | 899 (11.8) | 1777 (23.3) | 1889 (24.8) |
| Stretch CD, % | 6.4 | 7.5 | 7.2 | 6.9 | 8.8 | 8.7 |
| Wet Tens Finch Cured-CD g/3 in. (g/mm) | | | | | 534 (7.01) | 502 (6.59) |
| SAT Capacity $g/m^2$ | 347 | 454 | 447 | 421 | 460 | 478 |
| Tensile GM, g/3 in. (g/mm) | 1100 (14.4) | 1043 (13.7) | 1148 (15.1) | 1250 (16.4) | 1919 (25.2) | 1966 (25.8) |
| Break Mod. GM gms/% | 77 | 69 | 78 | 85 | 117 | 122 |
| Tensile Dry Ratio, % | 1.52 | 2.05 | 1.78 | 1.94 | 1.18 | 1.08 |
| Tensile GM, g/3 in. (g/mm) | 1100 (14.4) | 1043 (13.7) | 1148 (15.1) | 1250 (16.4) | 1919 (25.2) | 1966 (25.8) |

TABLE 2-continued

| Basesheet Data | | | | | | |
|---|---|---|---|---|---|---|
| Break Mod. GM gms/% | 77 | 69 | 78 | 85 | 117 | 122 |
| Tensile Dry Ratio, % | 1.52 | 2.05 | 1.78 | 1.94 | 1.18 | 1.08 |
| Void Volume Wt Inc., % | 725 | 853 | 797 | | 740 | 638 |
| Tensile Wet/Dry CD | | | | | 0.30 | 0.27 |
| TEA CD mm-g/ $mm^2$ | 0.439 | 0.432 | 0.485 | 0.481 | 1.065 | 1.165 |
| TEA MD mm-g/ $mm^2$ | 2.380 | 2.327 | 2.449 | 2.579 | 3.654 | 3.408 |
| SAT Rate $g/s^{0.5}$ | 0.0853 | 0.1593 | 0.1263 | 0.0920 | 0.1897 | 0.2150 |
| SAT Time, sec | 81 | 45 | 70 | 111 | 32 | 27 |
| Break Mod. CD, g/% | 133 | 102 | 125 | 135 | 208 | 217 |
| Break Mod. MD g/% | 45 | 47 | 49 | 54 | 65 | 69 |

| | Example | | | | | |
|---|---|---|---|---|---|---|
| | 7 | 8 | 9 | 10 | 11 | 12 |
| Sample | 48-1 | 49-1 | 52-1 | 53-1 | 60-1 | 61-1 |
| Roll # | 19699 | 19701 | 19705 | 19706 | 19771 | 19772 |
| 8 Sheet | 94 | 92 | 125 | 109 | 91 | 89 |
| Caliper mils/8 sht (mm/8 sht) | (2.39) | (2.34) | (3.18) | (2.77) | (2.31) | (2.26) |
| Basis Weight lb/3000 $ft^2$ ($g/m^2$) | 13.0 (21.2) | 13.6 (22.2) | 16.9 (27.5) | 16.1 (26.2) | 14.1 (23.0) | 13.6 (22.2) |
| Specific Bulk (mils/ 8 sht)/(lb./ ream) (mm/8 sht/gsm) | 7.20 (0.298) | 6.78 (0.281) | 7.38 (0.306) | 6.78 (0.281) | 6.50 (0.269) | 6.54 (0.271) |
| Tensile MD g/3 in, (g/mm) | 1888 (24.8) | 2072 (27.2) | 1297 (17.0) | 1157 (15.2) | 1211 (15.9) | 1064 (14.0) |
| Stretch MD, % | 31.1 | 31.6 | 30.6 | 30.3 | 28.7 | 27.9 |
| Tensile CD g/3 in, (g/mm) | 1934 (25.4) | 2034 (26.7) | 938 (12.3) | 783 (10.3) | 955 (12.5) | 840 (11.0) |
| Stretch CD, % | 9.0 | 8.2 | 7.6 | 6.8 | 5.4 | 6.4 |
| Wet Tens Finch Cured-CD g/3 in. (g/mm) | 517 (6.79) | 572 (7.51) | 97 (1.27) | 74 (0.97) | 70 (0.92) | 105 (1.38) |
| SAT Capacity $g/m^2$ | 461 | 547 | | | | |
| Tensile GM, g/3 in. (g/mm) | 1910 (25.1) | 2050 (26.9) | 1102 (14.5) | 952 (12.5) | 1075 (14.1) | 945 (12.4) |
| Break Mod. GM gms/% | 117 | 125 | 71 | 70 | 87 | 71 |
| Tensile Dry Ratio, % | 0.98 | 1.02 | 1.39 | 1.48 | 1.27 | 1.27 |
| Tensile GM, g/3 in. (g/mm) | 1910 (25.1) | 2050 (26.9) | 1102 (14.5) | 952 (12.5) | 1075 (14.1) | 945 (12.4) |
| Break Mod. GM gms/% | 117 | 125 | 71 | 70 | 87 | 71 |

TABLE 2-continued

| Basesheet Data | | | | | | |
|---|---|---|---|---|---|---|
| Tensile Dry Ratio, % | 0.98 | 1.02 | 1.39 | 1.48 | 1.27 | 1.27 |
| Void Volume Wt Inc., % | 728 | 712 | | | | |
| Tensile Wet/Dry CD | 0.27 | 0.28 | 0.10 | 0.09 | 0.07 | 0.12 |
| TEA CD mm-g/mm$^2$ | 1.164 | 1.120 | 0.512 | 0.385 | 0.372 | 0.384 |
| TEA MD mm-g/mm$^2$ | 3.165 | 3.463 | 1.483 | 1.751 | 1.414 | 1.318 |
| SAT Rate g/s$^{0.5}$ | 0.2167 | 0.2583 | | | | |
| SAT Time, sec | 27 | 104 | | | | |
| Break Mod. CD, g/% | 220 | 248 | 121 | 118 | 178 | 132 |
| Break Mod. MD g/% | 62 | 64 | 42 | 42 | 43 | 38 |

There is shown in FIGS. 11A through 11G, various SEM's, photomicrographs and laser profilometry analyses of basesheet produced on a papermachine of the class shown in FIGS. 10B and 10D using a perforated polymer belt of the type shown in FIGS. 4, 5, 6, and 7, without vacuum and without calendering.

Figure 11A:
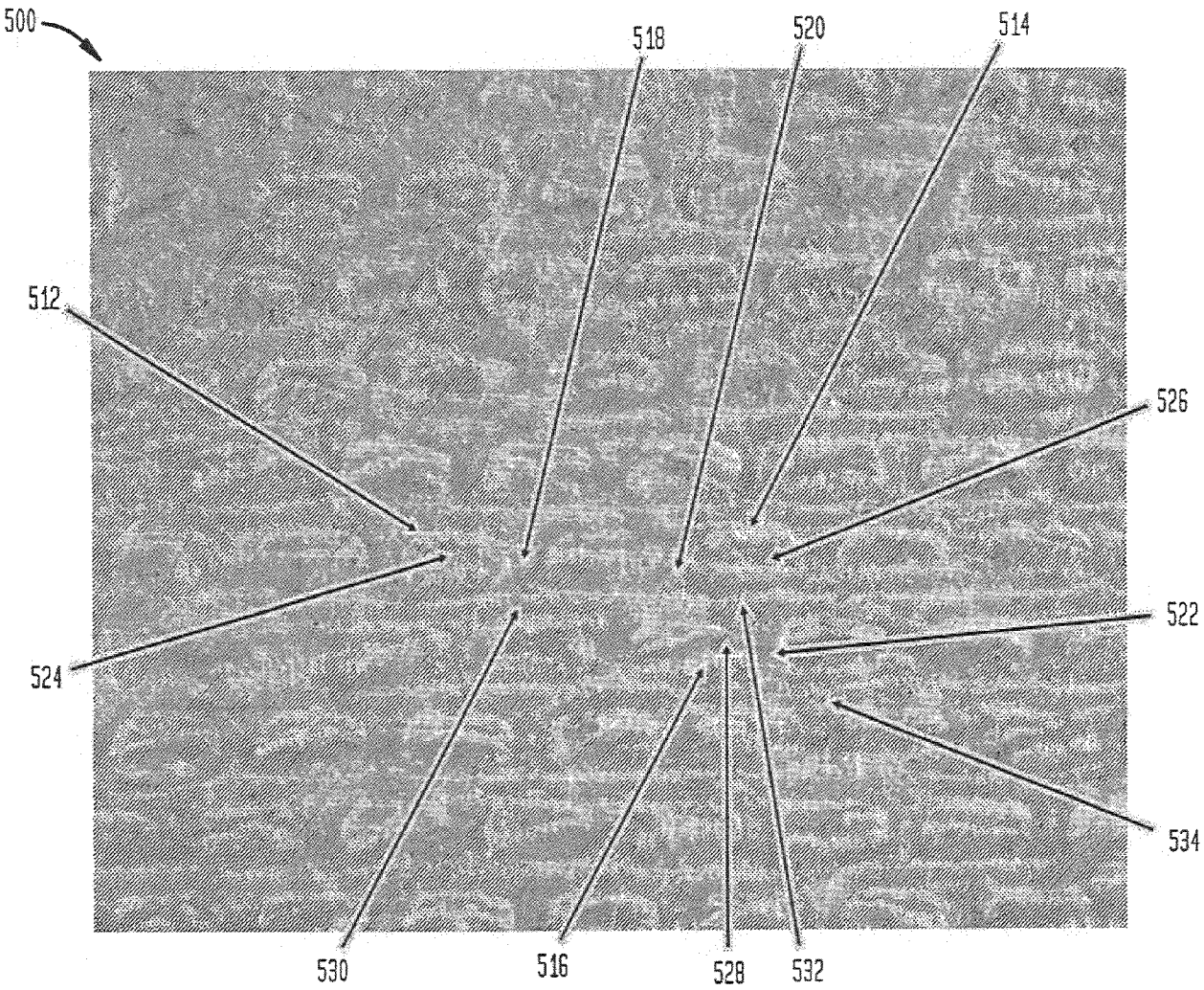
FIG. 11A is a plan view photomicrograph (10×) of the belt-side of an uncalendered absorbent basesheet produced with the belt of FIG. 4 to FIG. 7 produced without a vacuum applied on the belt.

FIG. 11A is a plan view photomicrograph (10×) of the belt-side of a basesheet 500 showing slubbed areas at 512, 514, 516 arranged in a pattern corresponding to the perforations of belt 50. Each of the slubbed or tufted areas is centrally located with respect to a surround area, such as areas 518, 520, and 522, which are much less textured. The slubbed areas have a minute fold, such as minute folds, at 524, 526, 528 that are generally pileated in conformation as shown and provide relatively high basis weight, fiber-enriched regions.

The surround areas 518, 520, and 522 also include relatively elongated minute folds at 530, 532, 534 that also extend in the cross machine direction and provide a pileated or crested structure to the sheet as will be seen from the cross sections discussed below. Note that these minute folds do not extend across the entire width of the web.

Figure 11B:
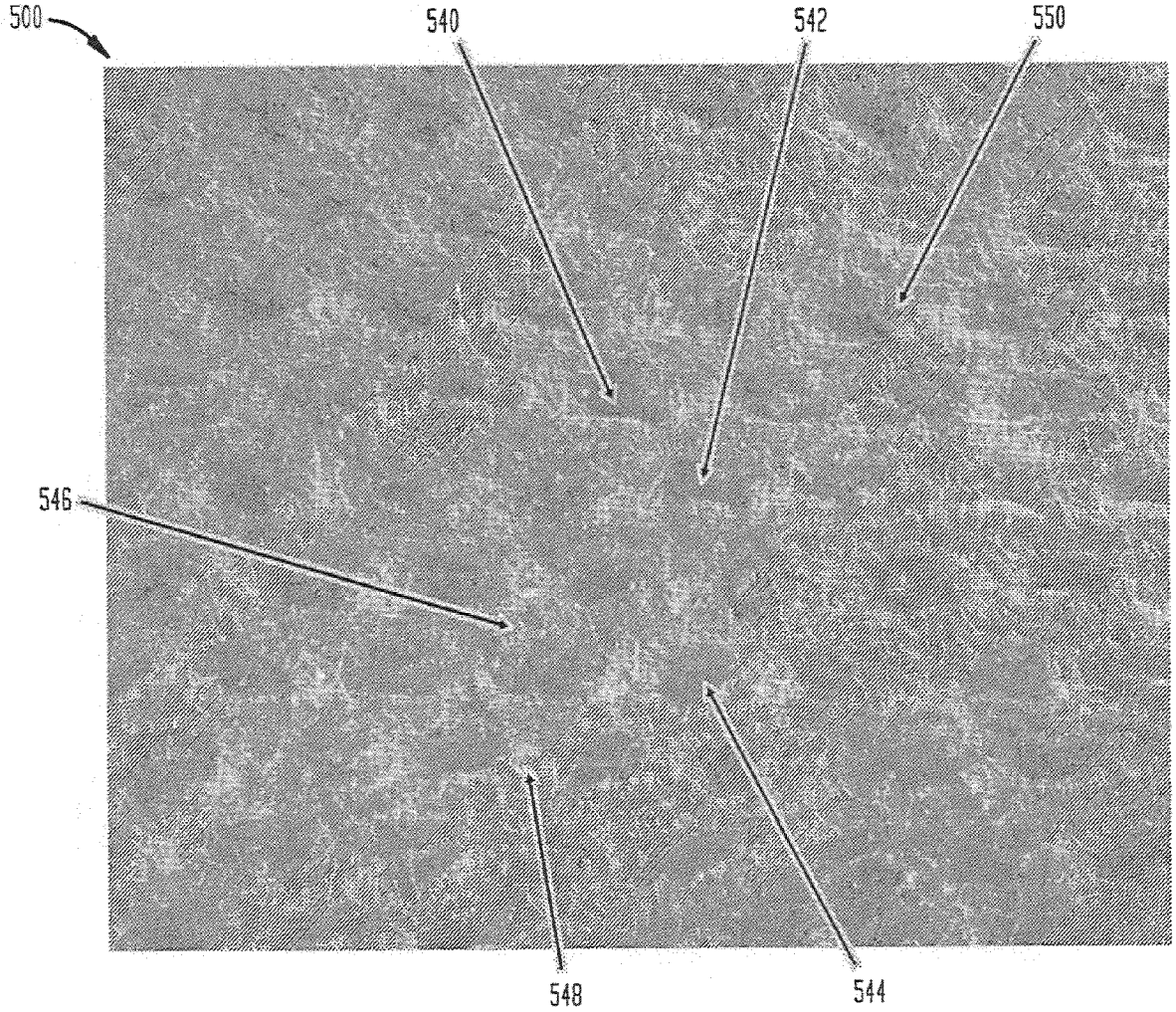
FIG. 11B is a plan view photomicrograph (10×) of the Yankee-side of the sheet of FIG. 11A.

FIG. 11B is a plan photomicrograph (10×) showing the Yankee-side of basesheet 500, that is, the side of the sheet opposite belt 50. It is seen in FIG. 11B that the Yankee-side surface of basesheet 500 has a plurality of hollows 540, 542, 544 arranged in a pattern corresponding to the perforations of belt 50, as well as relatively smooth, flat areas 546, 548, 550 between the hollows.

The microstructure of basesheet 500 is further appreciated by reference to FIGS. 11C to 11G, which are cross sections and laser profilometry analyses of basesheet 500.

Figure 11C:
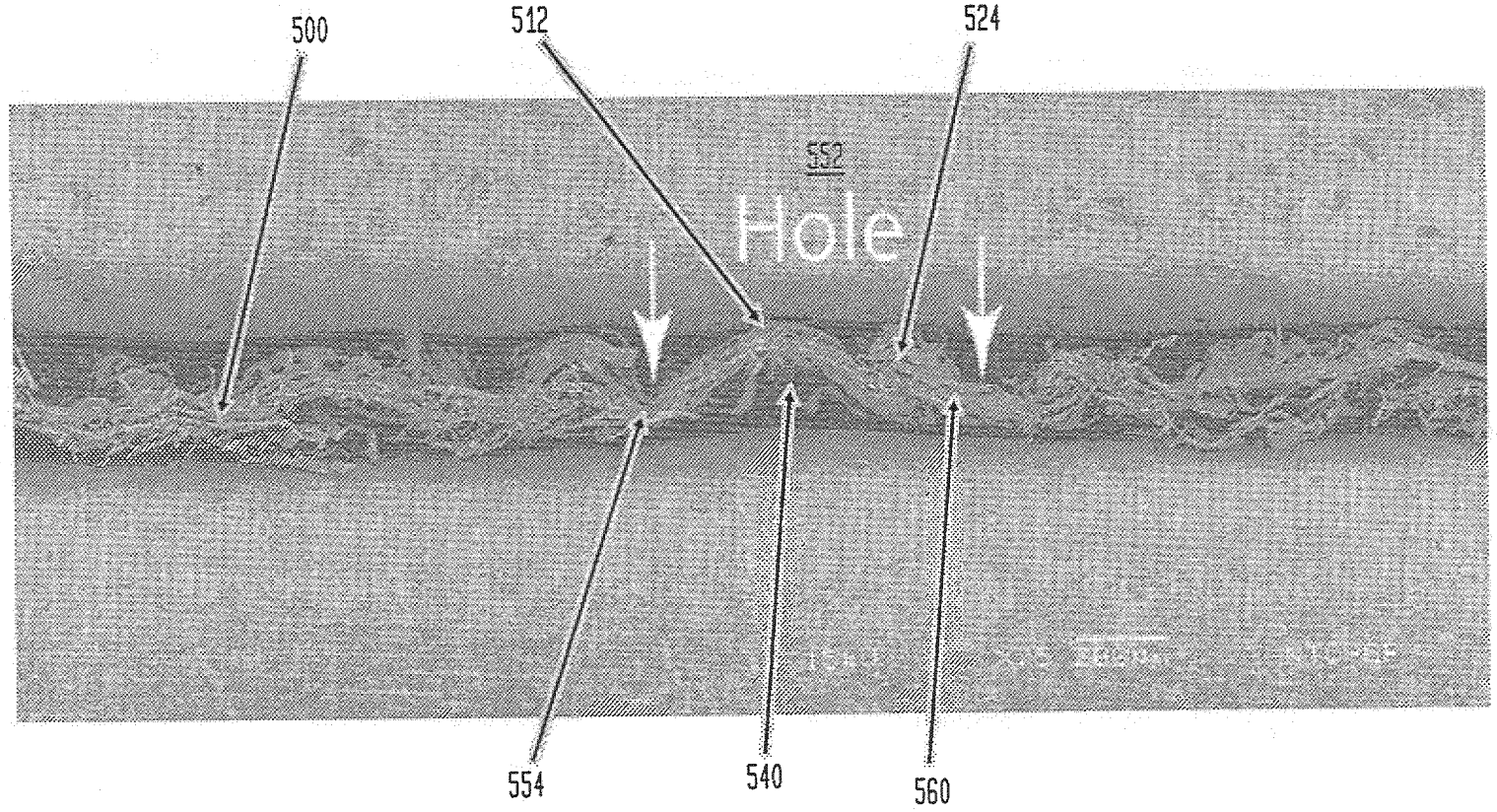
FIG. 11C is an SEM section (75×) of the sheet of FIGS. 11A and 11B along the MD.

FIG. 11C is an SEM section (75×) along the machine direction (MD) of basesheet 500 showing the area at 552 of the web which corresponds to a belt perforation, as well as the densified and pileated structure of the sheet. It is seen in FIG. 11C that the slubbed regions, such as the area 552 formed without vacuum-drawing into the belt have a pileated structure with a central minute fold 524, as well as "hollow" or domed areas with inclined sidewalls such as hollow 540. Areas 554, 560 are consolidated and inflected inwardly and upwardly, while areas at 552 have elevated local basis weight and the area around minute fold 524 appears to have fiber orientation bias in the CD, which is better seen in FIG. 11D.

Figure 11D:
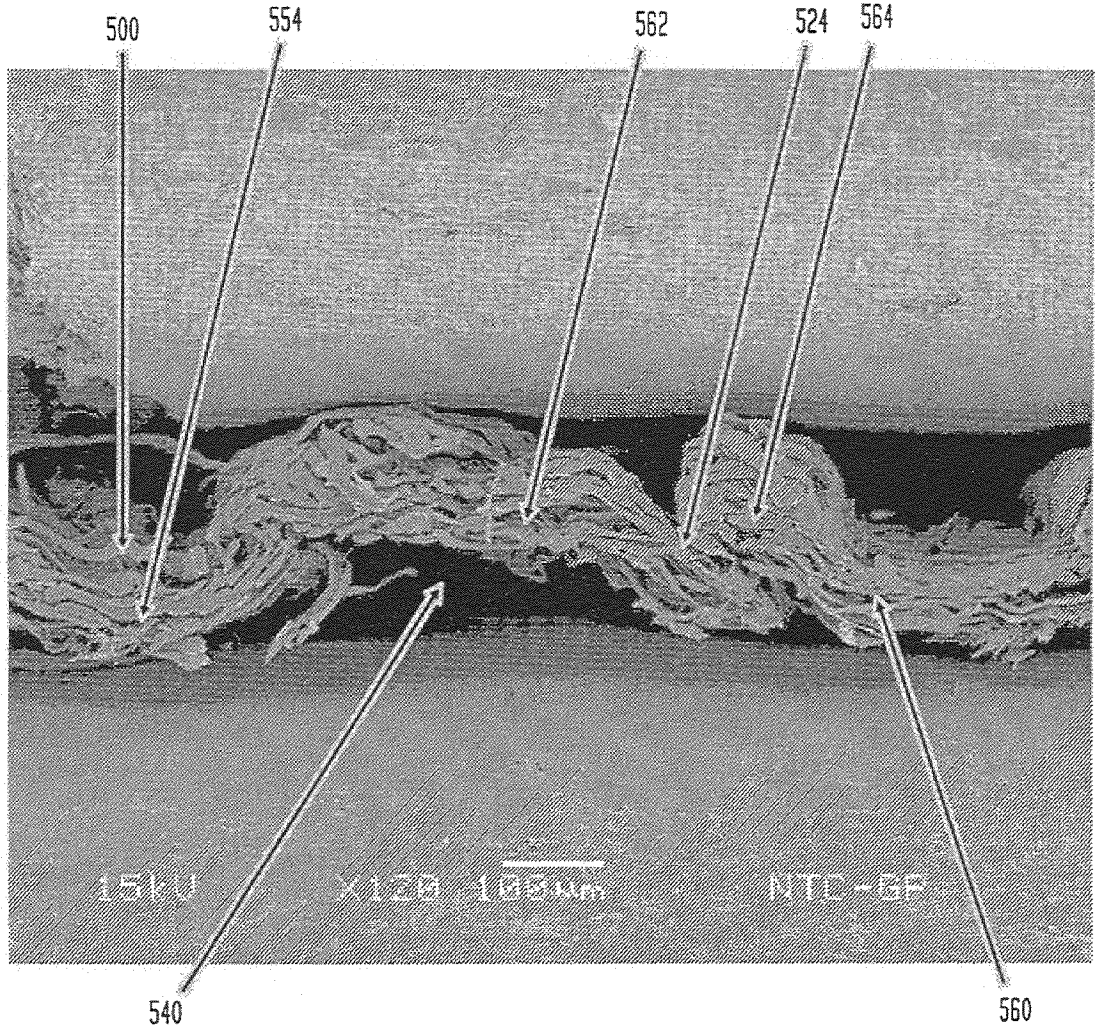
FIG. 11D is another SEM section (120×) along the MD of the sheet of FIGS. 11A, 11B, and 11C.

FIG. 11D is another SEM along the MD of basesheet 500 showing hollow 540, minute fold 524, as well as areas 554 and 560. It is seen in this SEM that the cap 562 and the crest 564 of minute fold 524 are fiber-enriched, of a relatively high basis weight, as compared with areas 554, 560, which are consolidated and denser and appear of lower basis weight. Note that area 554 is consolidated and inflected upwardly and inwardly toward the dome cap 562.

Figure 11E:
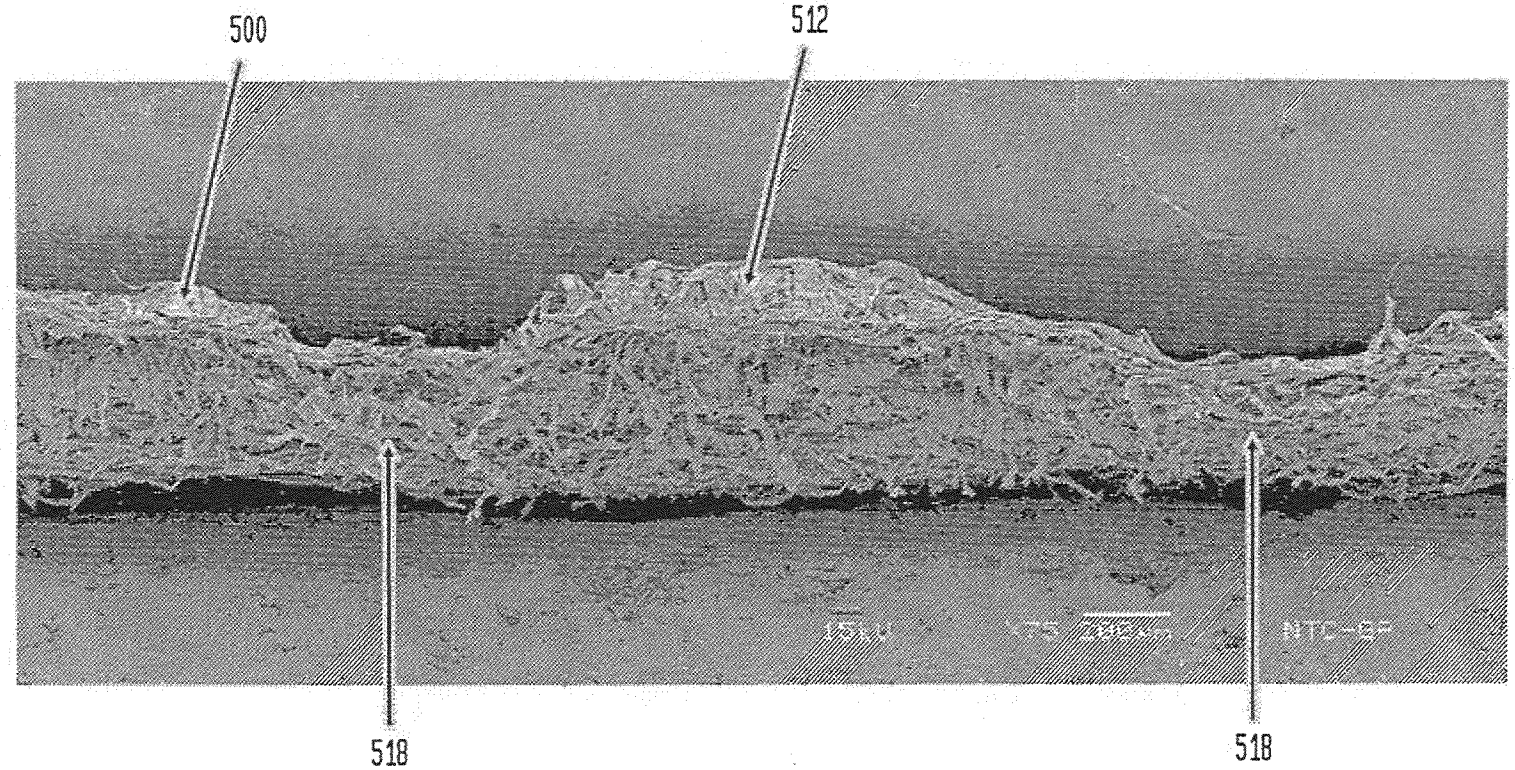
FIG. 11E is an SEM section (75×) along the cross-machine direction (CD) of the sheet of FIGS. 11A, 11B, 11C, and 11D.

FIG. 11E is yet another SEM (75×) of basesheet 500 in cross section, showing the structure of basesheet 500 in section along the CD. It is seen in FIG. 11E that slubbed area 512 is fiber-enriched as compared with surrounding area 518. Moreover, it is seen in FIG. 11E that the fiber in the dome area is a bowed configuration forming the dome, where the fiber orientation is biased along the walls of the dome upwardly and inwardly toward the cap, providing large caliper or thickness to the sheet.

Figure 11F:
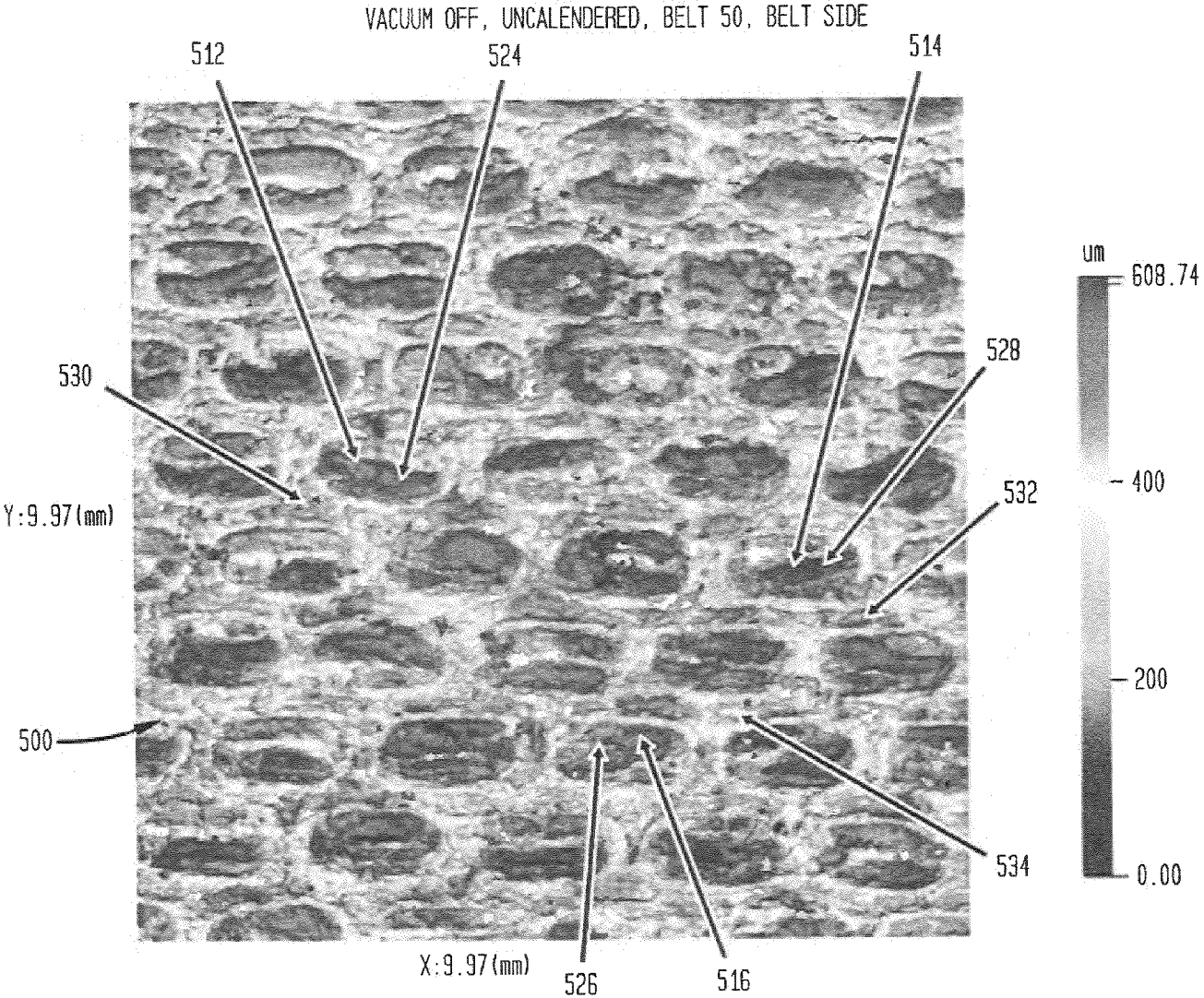
FIG. 11F is a laser profilometry analysis of the belt-side surface structure of the sheet of FIGS. 11A, 11B, 11C, 11D, and 11E.
Figure 11G:
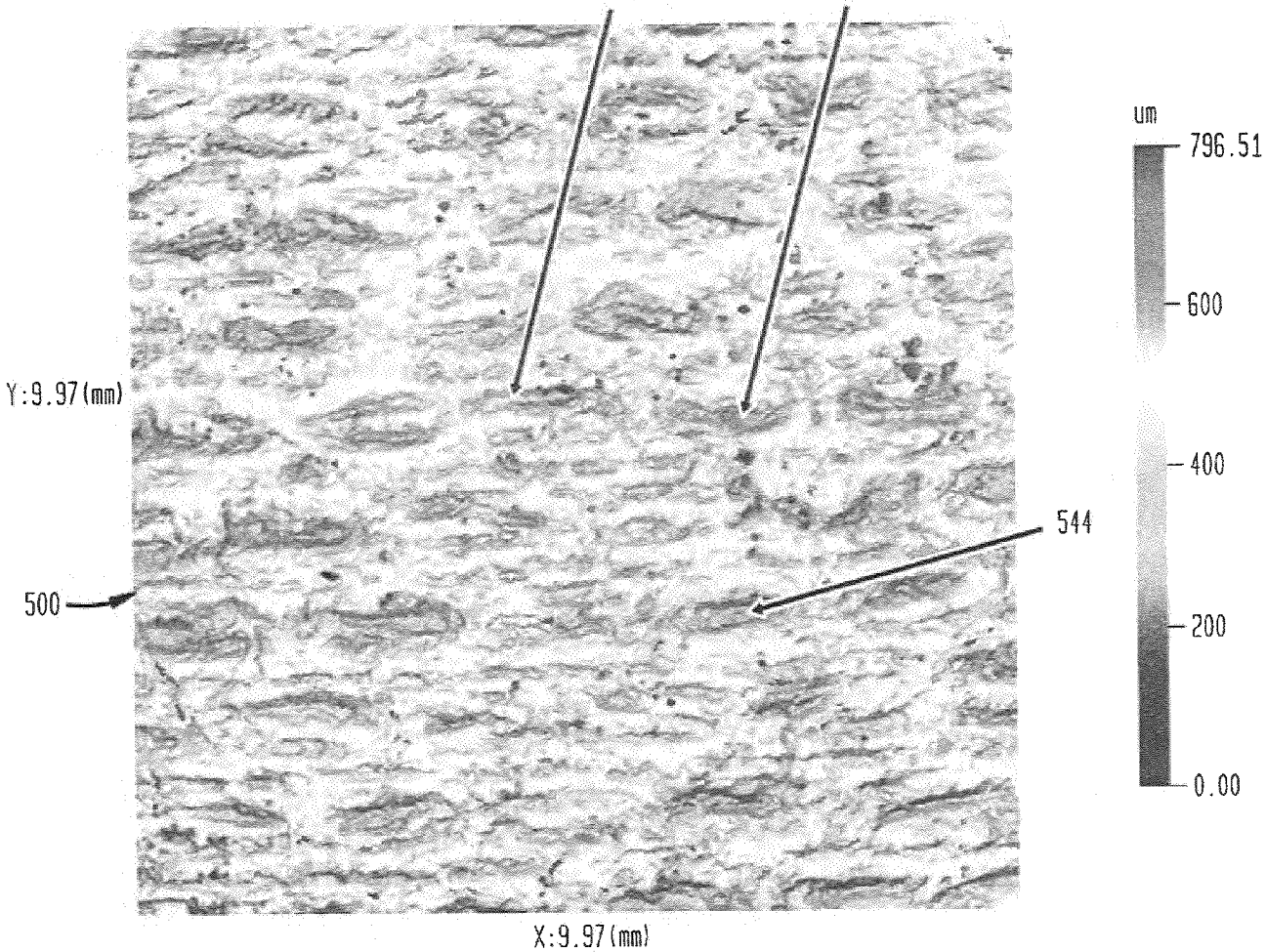
FIG. 11G is a laser profilometry analysis of the Yankee-side surface structure of the sheet of FIGS. 11A, 11B, 11C, 11D, 11E, and 11F.

FIGS. 11F and 11G are laser profilometry analyses of basesheet 500, FIG. 11F is essentially a plan view of the belt-side of absorbent basesheet 500 showing slubbed regions such as regions 512, 514, 516, which are relatively elevated, as well as minute folds 524, 526, 528 in the slubbed or fiber-enriched regions as well as minute folds 530, 532, 534 in the areas surrounding the slubbed regions. FIG. 11G is essentially a plan laser profilometry analysis of the Yankee-side of basesheet 500 showing hollows 540, 542, 544, which are opposite to the slubbed and pileated regions of the domes. The areas surrounding the hollows are relatively smooth, as can be appreciated from FIG. 11G.

There is shown in FIGS. 12A through 12G, various SEM's photomicrographs and laser profilometry analyses of sheets produced on a papermachine of the class shown in FIGS. 10B and 10D using a perforated polymer belt of the type shown in FIGS. 4, 5, 6, and 7 with a vacuum at 18" Hg (61 kPa) applied by way of a vacuum box, such as suction box 176, without calendering of the basesheet.

Figure 12A:
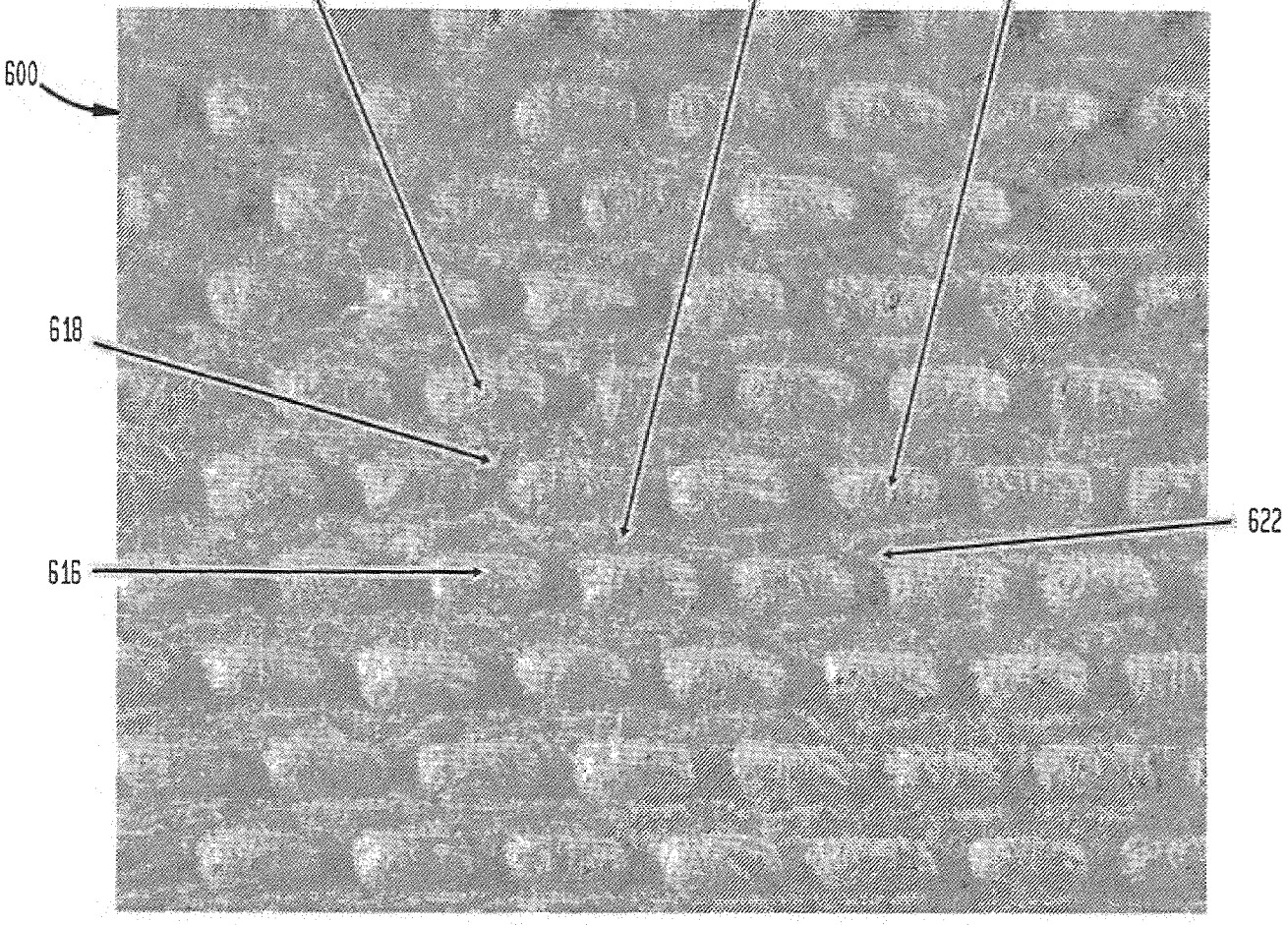
FIG. 12A is a plan view photomicrograph (10×) of the belt-side of an uncalendered absorbent basesheet produced with the belt of FIG. 4 to FIG. 7 and 18" Hg (60.9 kPa) applied vacuum.

FIG. 12A is a plan view photomicrograph (10×) of the belt-side of a basesheet 600 showing domed areas 612, 614, 616 arranged in a pattern corresponding to the perforations of belt 50. Each of the domed areas is centrally located with respect to a generally planar surround area, such as areas 618, 620, and 622, which are much less textured. The slubbed areas, which have been vacuum drawn in this embodiment, do not have apparent minute folds which appear to have been drawn out of the sheet, yet the relatively high basis weight remains in the dome. In other words, the pileated fiber accumulation has been merged into the dome section.

The surround areas 618, 620, and 622 still include relatively elongated minute folds that extend in the cross-machine direction (CD) and provide a pileated or crested structure to the sheet as will be seen from the cross sections discussed below.

Figure 12B:
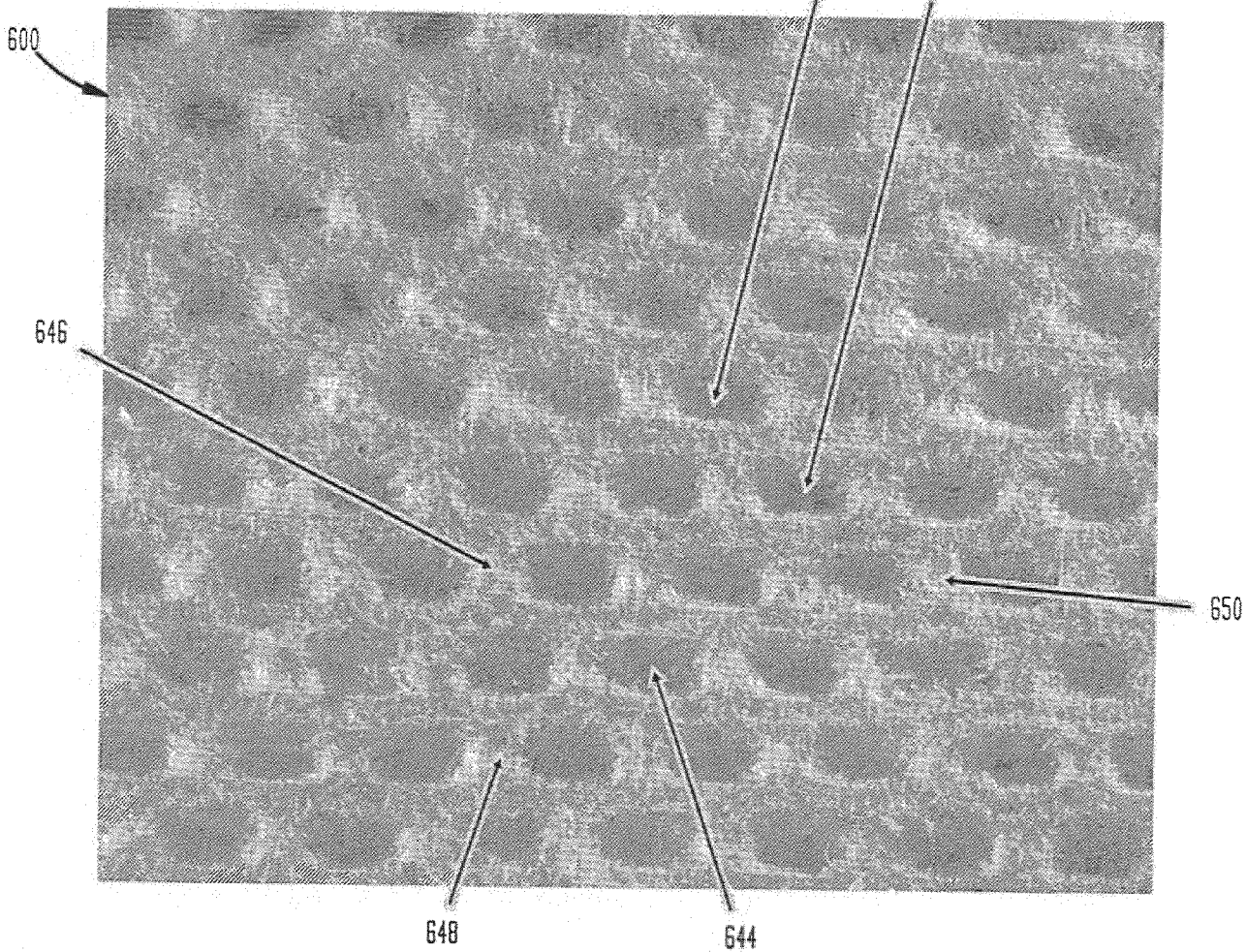
FIG. 12B is a plan view photomicrograph (10×) of the Yankee-side of the sheet of FIG. 12A.

FIG. 12B is a plan photomicrograph (10×) showing the Yankee-side of basesheet 600, that is, the side of the sheet opposite belt 50. It is seen in FIG. 12B that the Yankee-side surface of basesheet 600 has a plurality of hollows 640, 642, 644 arranged in a pattern corresponding to the perforations of belt 50, as well as relatively smooth, flat areas 646, 648, 650 between the hollows. It is seen in FIGS. 12A and 12B that the boundaries between different areas or surfaces of the sheet are more sharply defined than shown in FIGS. 11A and 11B.

The microstructure of basesheet 600 is further appreciated by reference to FIGS. 12C to 12G, which are cross sections and laser profilometry analyses of basesheet 600.

Figure 12C:
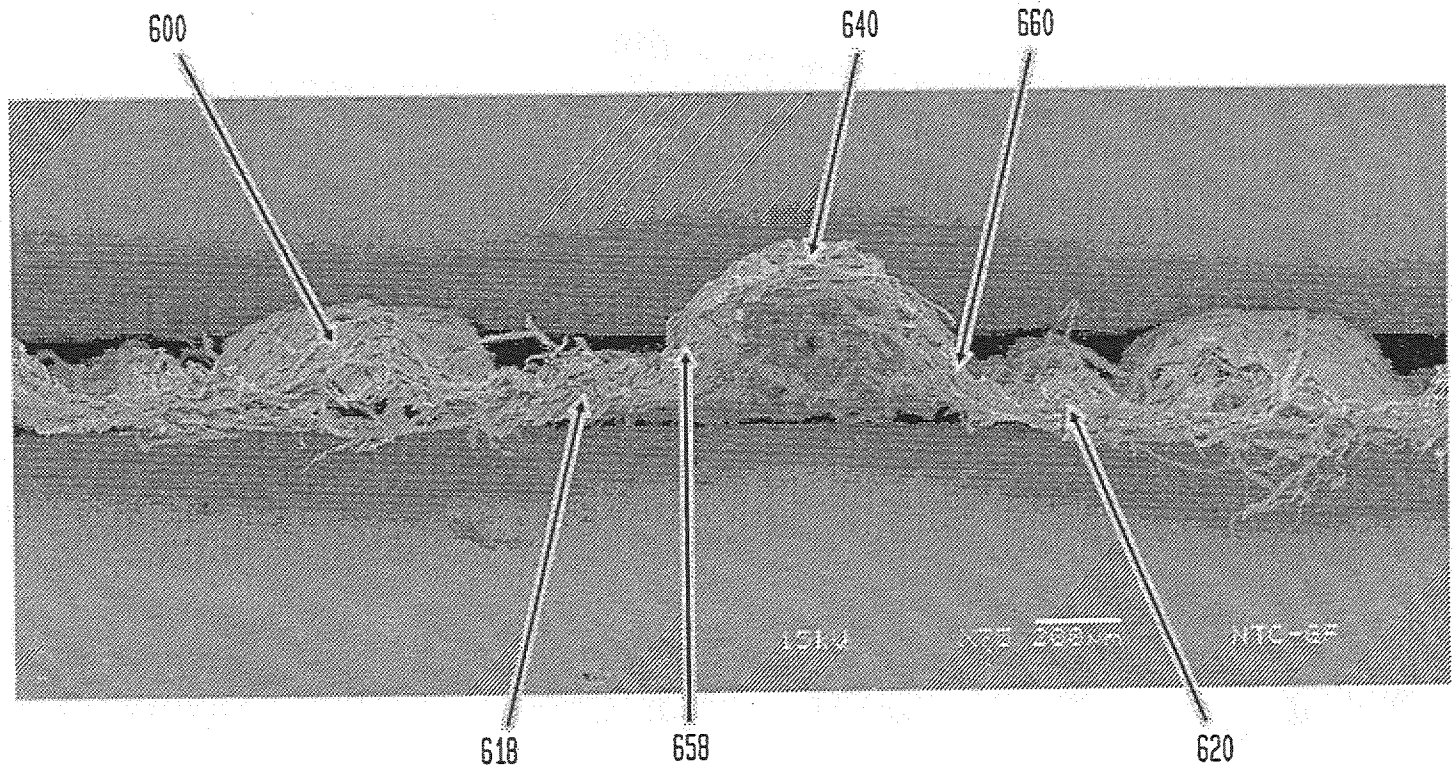
FIG. 12C is an SEM section (75×) of the sheet of FIGS. 12A and 12B along the MD.

FIG. 12C is an SEM section (75×) along the machine direction (MD) of basesheet 600 showing a domed area corresponding to a belt perforation, as well as the densified pileated structure of the sheet. It is seen in FIG. 12C that the domed regions, such as region 640, have a "hollow" or domed structure with inclined and at least partially densified sidewall areas, while surround areas 618, 620 are densified, but less so than transition areas. Sidewall areas 658, 660 are inflected upwardly and inwardly, and are so highly densified as to become consolidated, especially, about the base of the dome. It is believed that these regions contribute to the very high caliper and roll firmness observed. The consolidated sidewall areas form transition areas from the densified fibrous, planar network between the domes to the domed features of the sheet and form distinct regions that may extend completely around and circumscribe the domes at their bases, or may be densified in a horseshoe or bowed shape only around part of the bases of the domes. At least portions of the transition areas are consolidated and also inflected upwardly and inwardly.

Note that the minute folds in the previously slubbed regions, now domed, are no longer apparent in the cross-sectional photomicrograph, as compared with the FIGS. 11A to 11G series products.

Figure 12D:
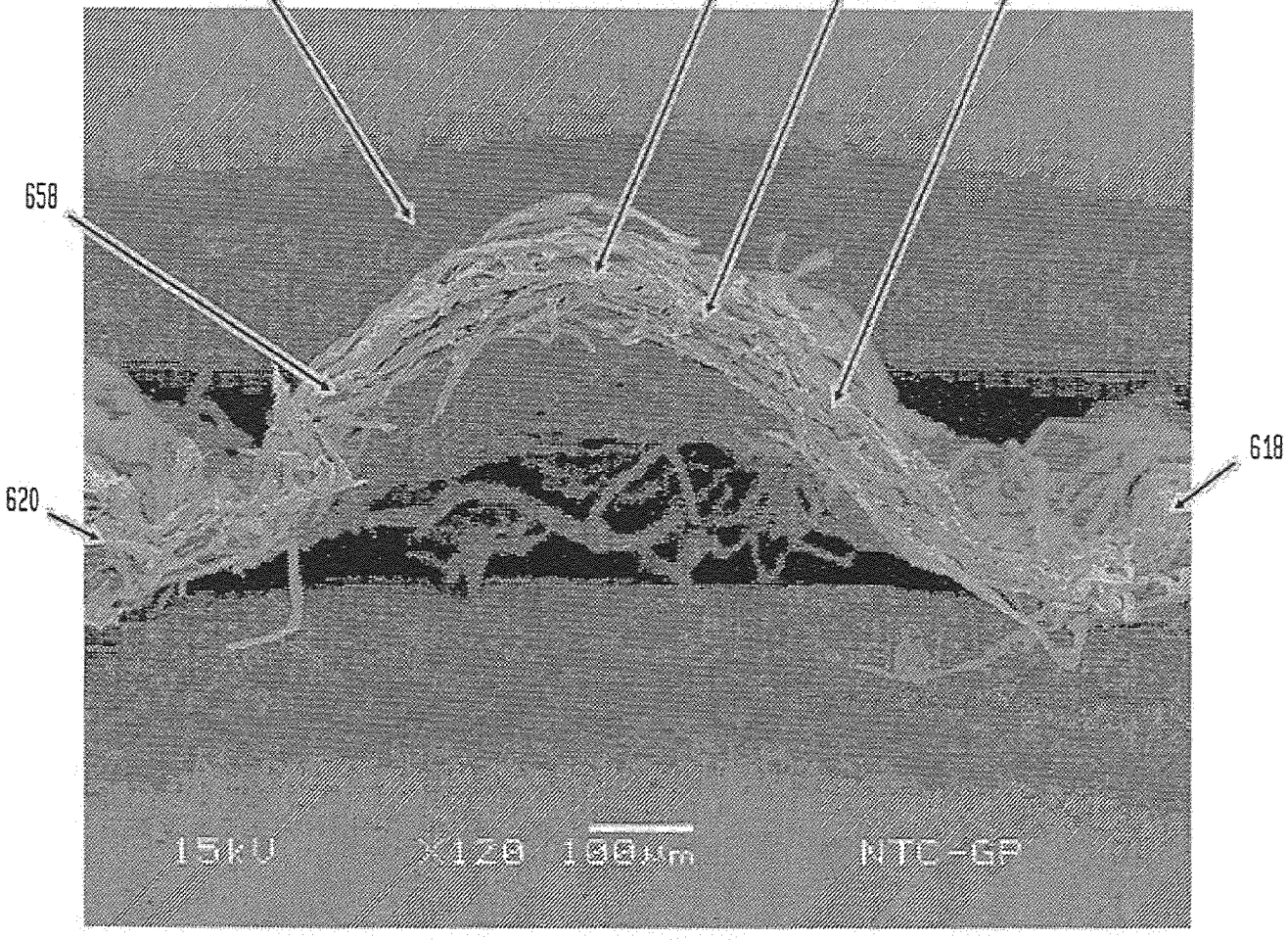
FIG. 12D is another SEM section (120×) of the sheet of FIGS. 12A, 12B, and 12C along the MD.

FIG. 12D is another SEM along the MD of basesheet 600 showing hollow 640, as well as consolidated sidewall areas 658 and 660. It is seen in this SEM that the cap 662 is fiber-enriched, of a relatively high basis weight as compared with areas 618, 620, 658, 660. CD fiber orientation bias is also apparent in the sidewalls and dome.

Figure 12E:
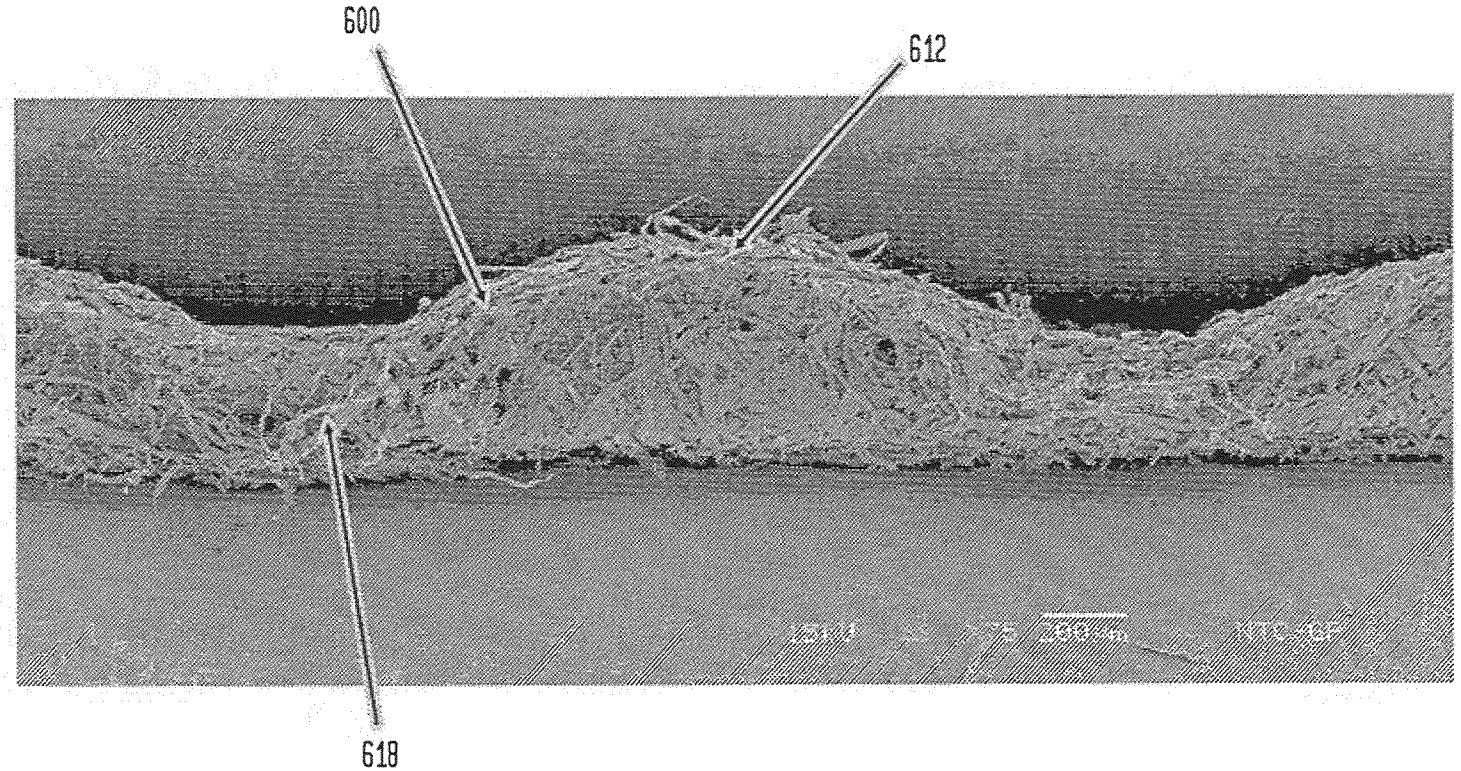
FIG. 12E is an SEM section (75×) along the CD of the sheet of FIGS. 12A, 12B, 12C, and 12D.

FIG. 12E is yet another SEM (75×) of basesheet 600 in cross section, showing the structure of basesheet 600 in section along the CD. It is seen in FIG. 12E that domed area 612 is fiber-enriched, as compared with surrounding area 618, and the fiber of the dome sidewalls is biased along the sidewall upwardly and inwardly in a direction toward the dome cap.

Figure 12F:
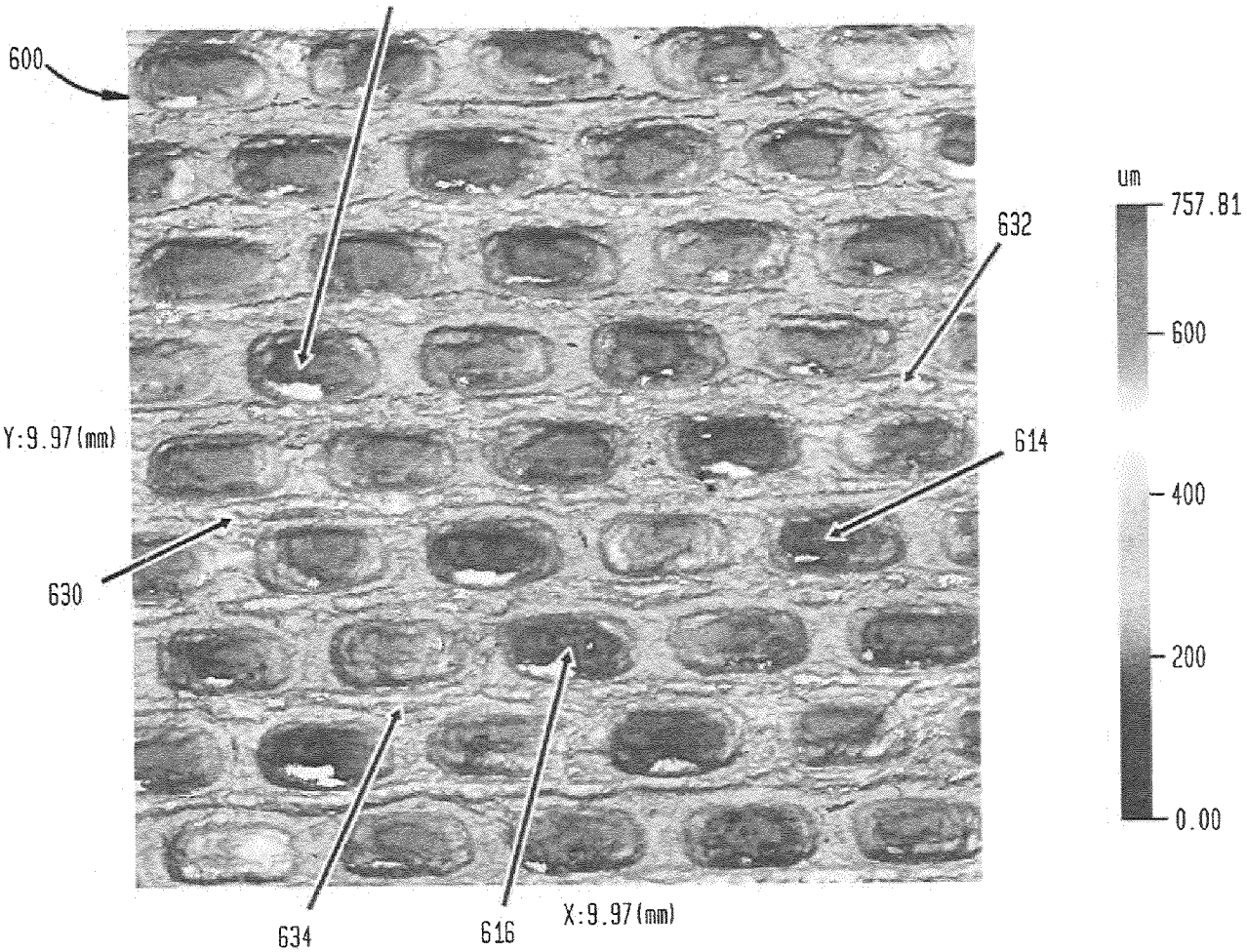
FIG. 12F is a laser profilometry analysis of the belt-side surface structure of the sheet of FIGS. 12A, 12B, 12C, 12D, and 12E.
Figure 12G:
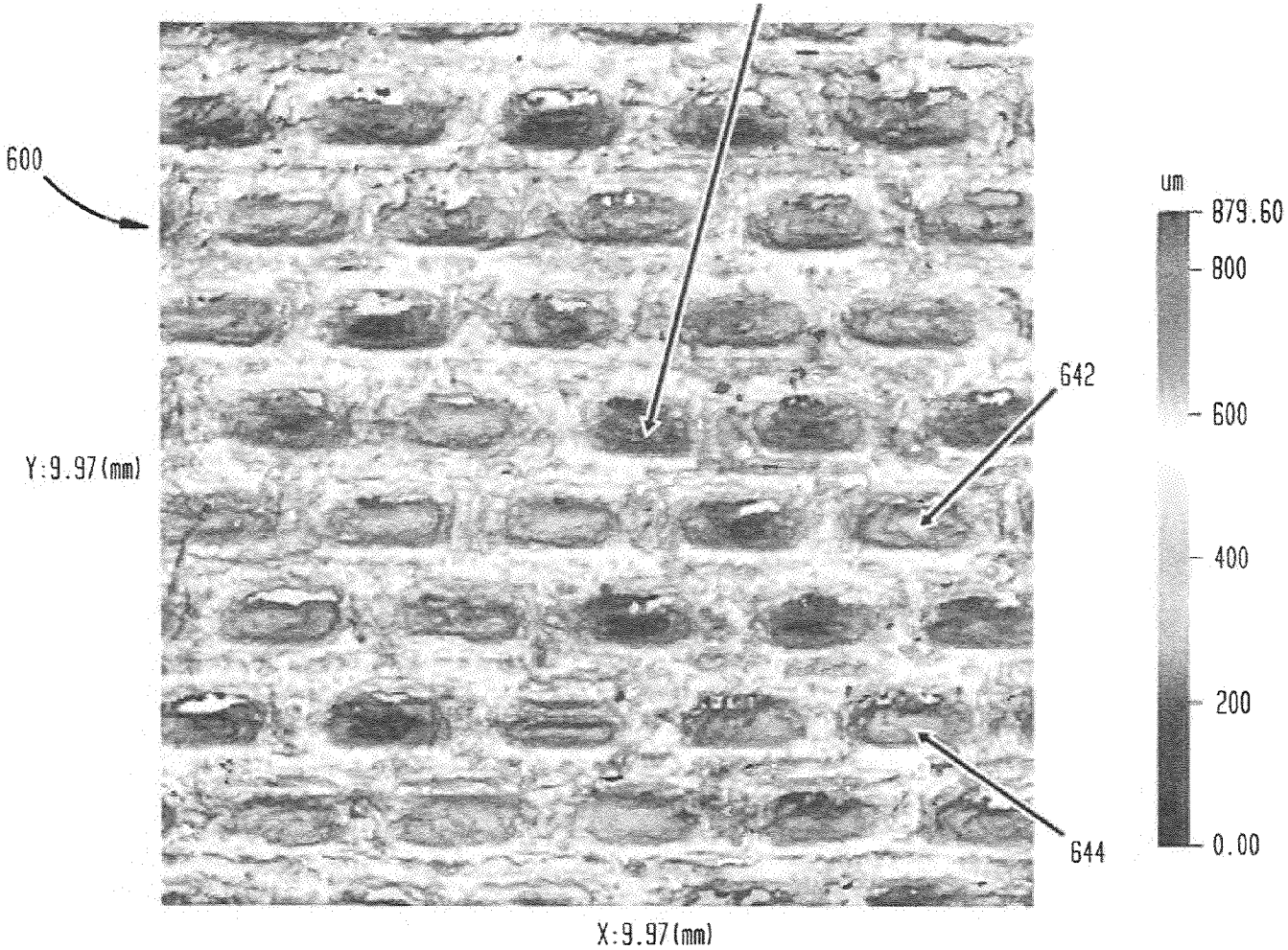
FIG. 12G is a laser profilometry analysis of the Yankee-side surface structure of the sheet of FIGS. 12A, 12B, 12C, 12D, 12E, and 12F.

FIGS. 12F and 12G are laser profilometry analyses of basesheet 600. FIG. 12F is a plan view of the belt-side of absorbent basesheet 600 showing slubbed regions such as domes 612, 614, 616, which are relatively elevated, as well as minute folds 630, 632, 634 in the areas surrounding the slubbed regions. FIG. 12G is a plan laser profilometry analysis of Yankee-side of basesheet 600 showing hollows 640, 642, 644, which are opposite to the slubbed or pileated regions. The areas surrounding the hollows are relatively smooth, as can be appreciated from the diagram.

There is shown in FIGS. 13A through 13G, various SEM's, photomicrographs and laser profilometry analyses of sheets produced on a papermachine of the class shown in FIGS. 10B and 10D using a perforated polymer belt of the type shown in FIGS. 4, 5, 6, and 7, with vacuum and calendering.

Figure 13A:
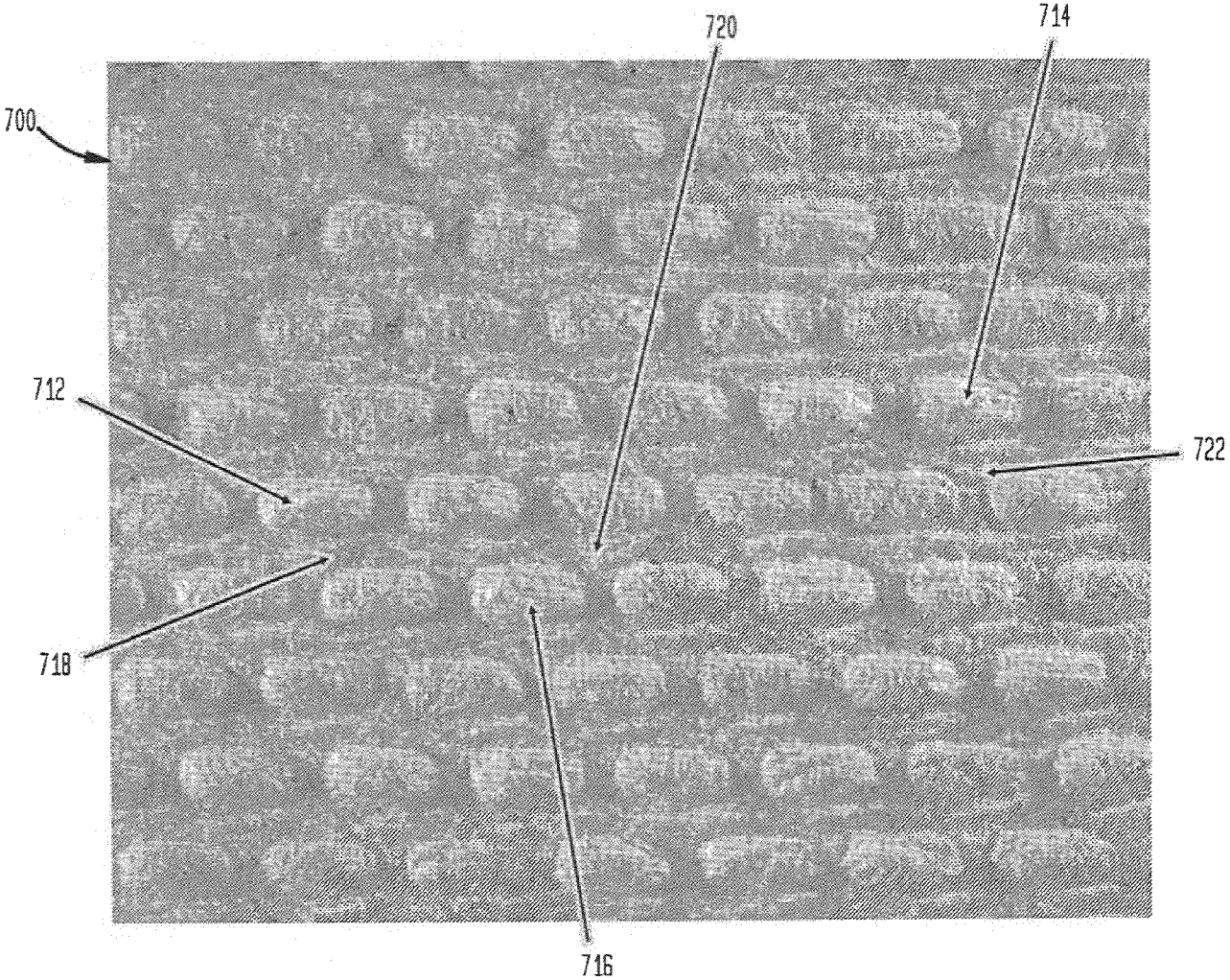
FIG. 13A is a plan view photomicrograph (10×) of the belt-side of a calendered absorbent basesheet produced with the belt of FIG. 4 to FIG. 7 utilizing 18" Hg (60.9 kPa) of applied vacuum.

FIG. 13A is another plan view photomicrograph (10×) illustrating other features of the belt-side of a basesheet 700, as shown in FIG. 1A, showing domed areas 712, 714, 716 arranged in a pattern corresponding to the perforations of belt 50. Each of the domed areas is centrally located with respect to a surround area, such as areas 718, 720 and 722, which are much less textured. Here, again, the minute folds adjacent to the dome have been merged into the dome.

The surround or network areas 718, 720 and 722 also include relatively elongated minute folds that also extend in the machine direction and provide a pileated or crested structure to the sheet, as will be seen from the cross sections discussed below.

Figure 13B:
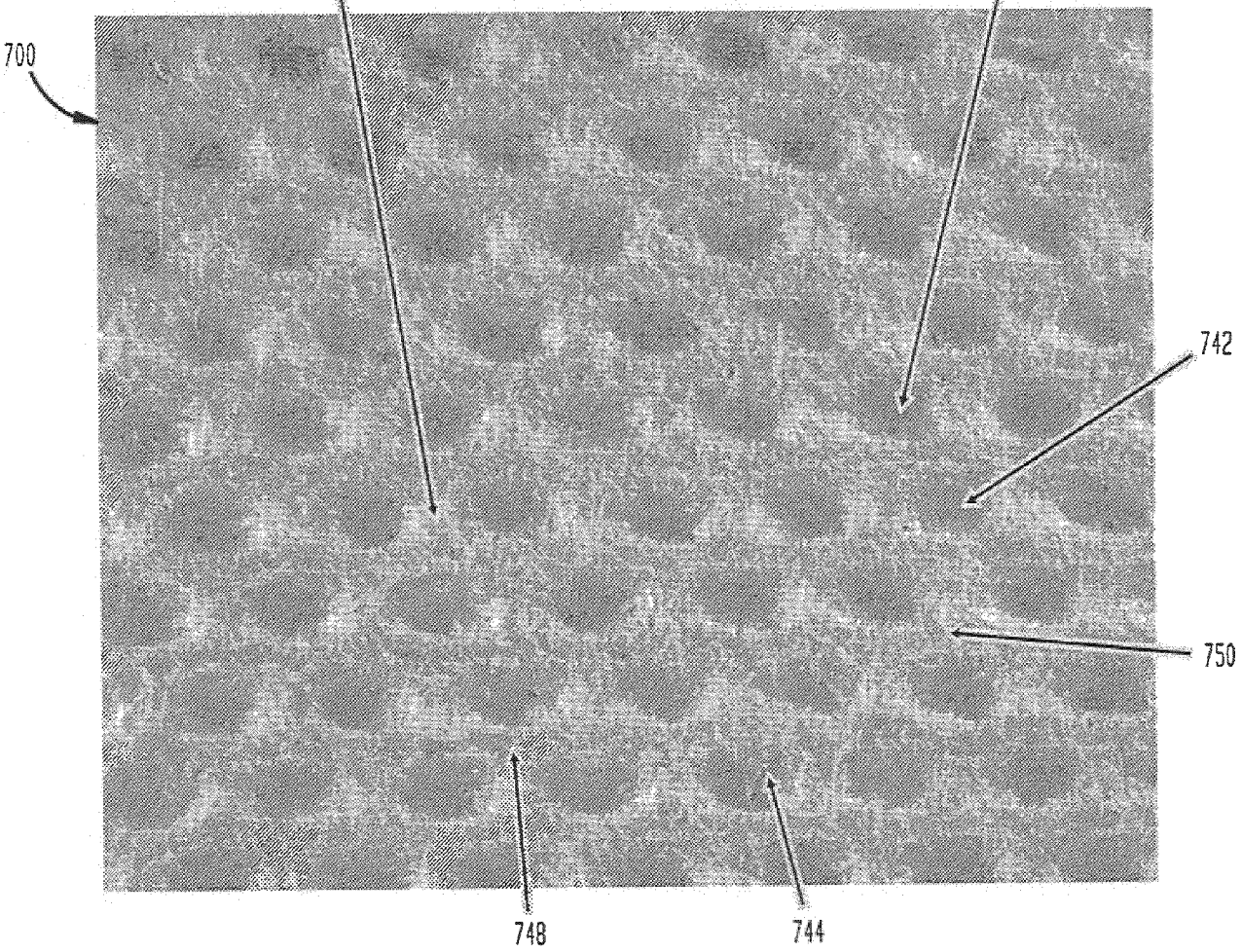
FIG. 13B is a plan view photomicrograph (10×) of the Yankee-side of the sheet of FIG. 13A.

FIG. 13B is a plan photomicrograph (10×) showing the Yankee-side of basesheet 700, that is, the side of the sheet opposite belt 50. It is seen in FIG. 13B that the Yankee-side surface of basesheet 700 has a plurality of hollows 740, 742, 744 arranged in a pattern corresponding to the perforations of belt 50, as well as relatively smooth, flat areas 746, 748, 750 between the hollows, as is seen in the sheets of the FIG. 11 and FIG. 12 series products.

The microstructure of basesheet 700 is further appreciated by reference to FIGS. 13C to 13G, which are cross sections and laser profilometry analyses of basesheet 700.

Figure 13C:
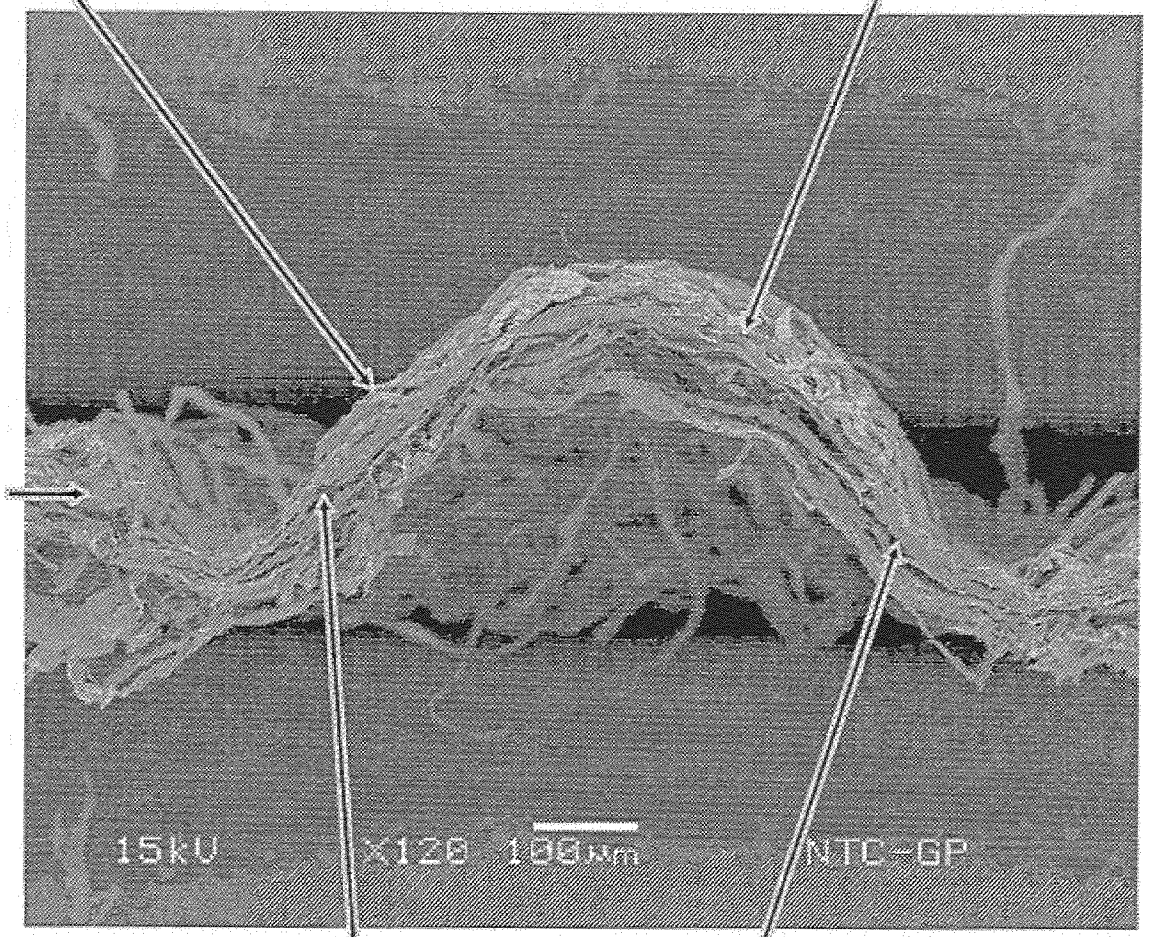
FIG. 13C is an SEM section (120×) of the sheet of FIGS. 13A and 13B along the MD.

FIG. 13C is an SEM section (120×) along the machine direction (MD) of basesheet 700. Sidewall areas 758, 760 are densified and are inflected inwardly and upwardly.

Note that, here again, the minute folds in the slubbed regions are no longer apparent, as compared with the FIG. 11 series products.

Figure 13D:
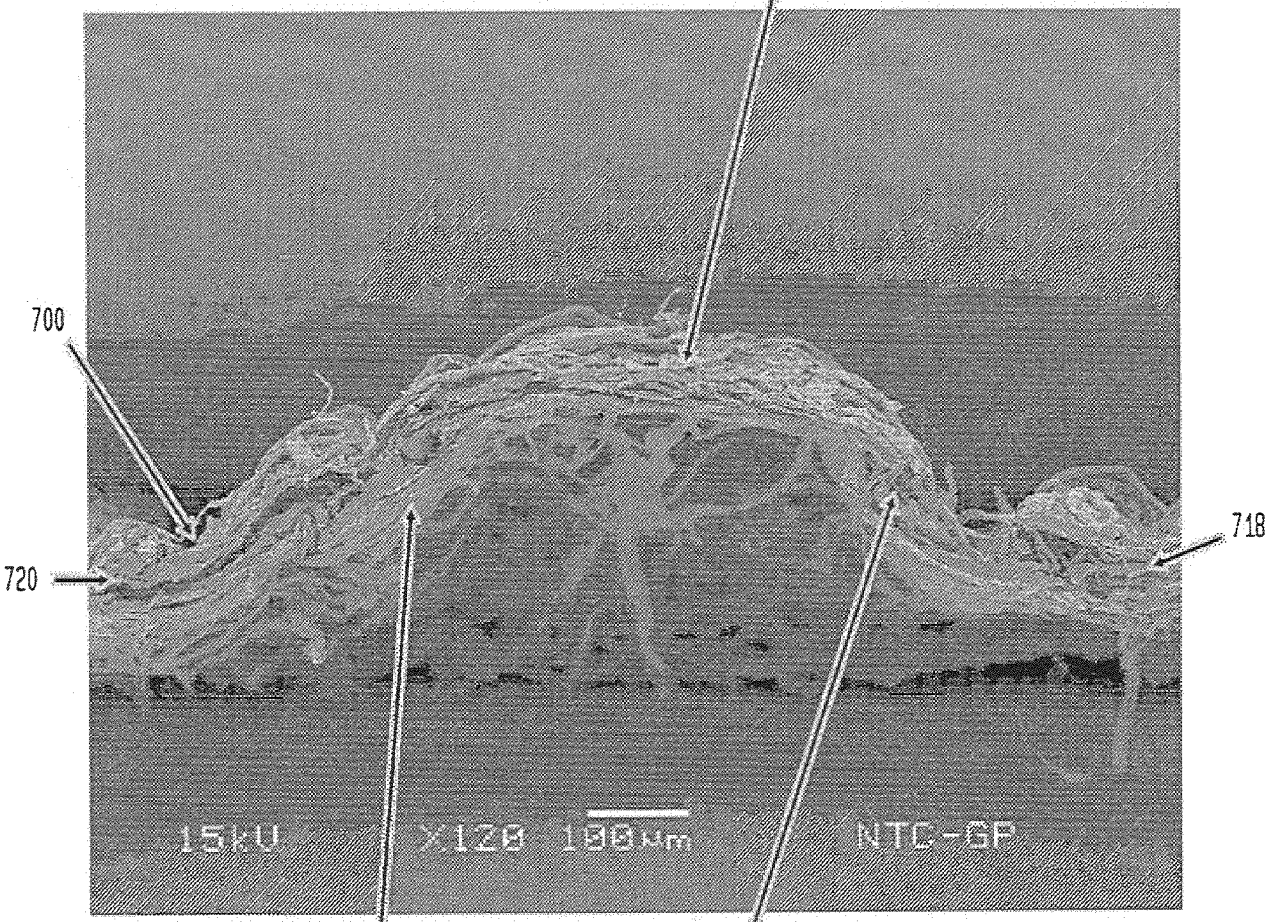
FIG. 13D is another SEM section (120×) of the sheet of FIGS. 13A, 13B, and 13C along the MD.

FIG. 13D is another SEM along the MD of basesheet 700 showing hollow 740, as well as sidewall areas 758 and 760. There is seen in FIG. 13D hollow 740, which is asymmetric and somewhat flattened by calendering. It is also seen in this SEM that the cap at hollow 740 is fiber-enriched, of a relatively high basis weight, as compared with areas 718, 720, 758, and 760.

Figure 13E:
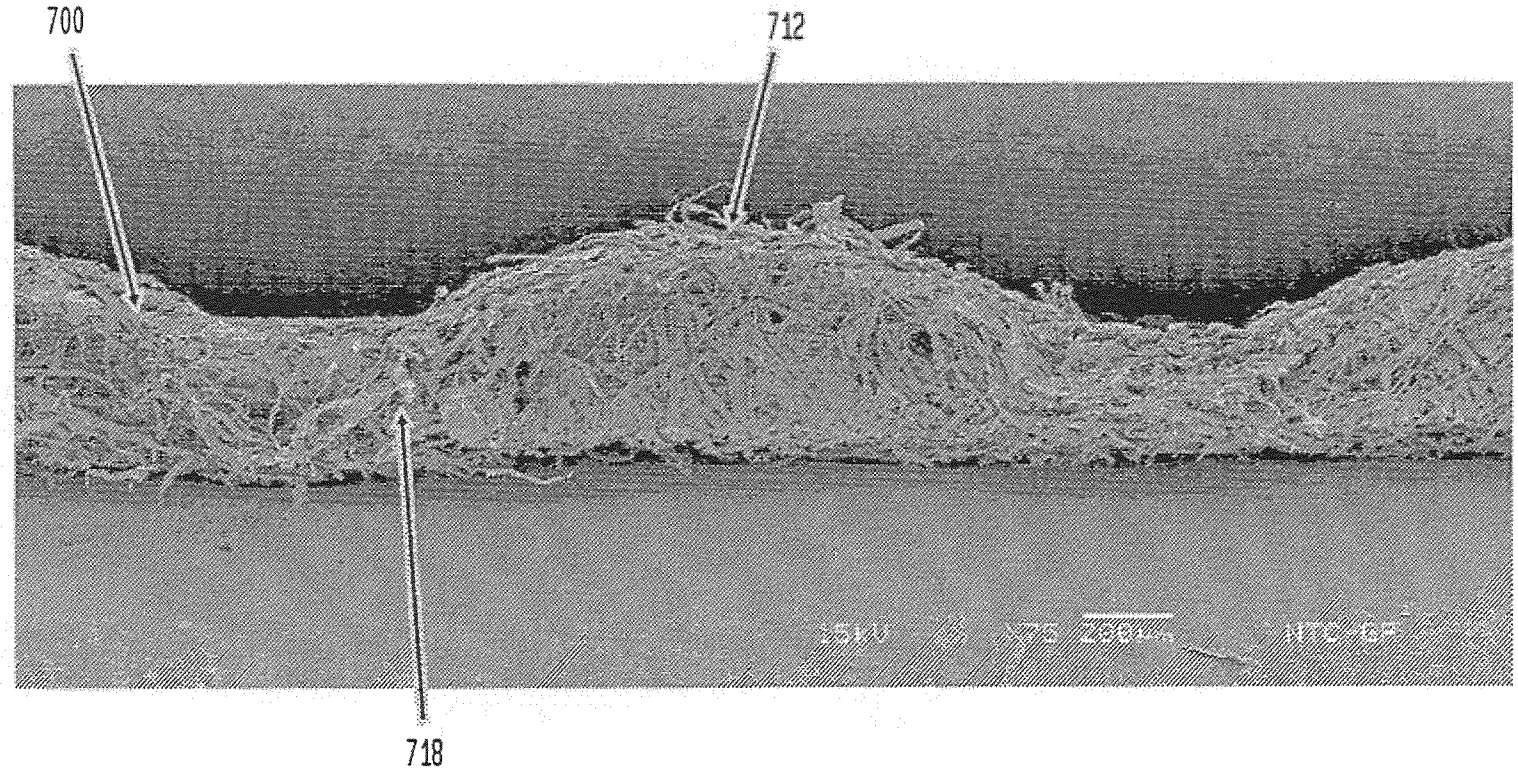
FIG. 13E is an SEM section (75×) along the CD of the sheet of FIGS. 13A, 13B, 13C, and 13D.

FIG. 13E is yet another SEM (120×) of basesheet 700 in cross section, showing the structure of basesheet 700 in section along the CD. Here, again, is seen that area 712 is fiber-enriched, as compared with surrounding area 718, notwithstanding that minute folds are apparent in the network area between domes.

Figure 13F:
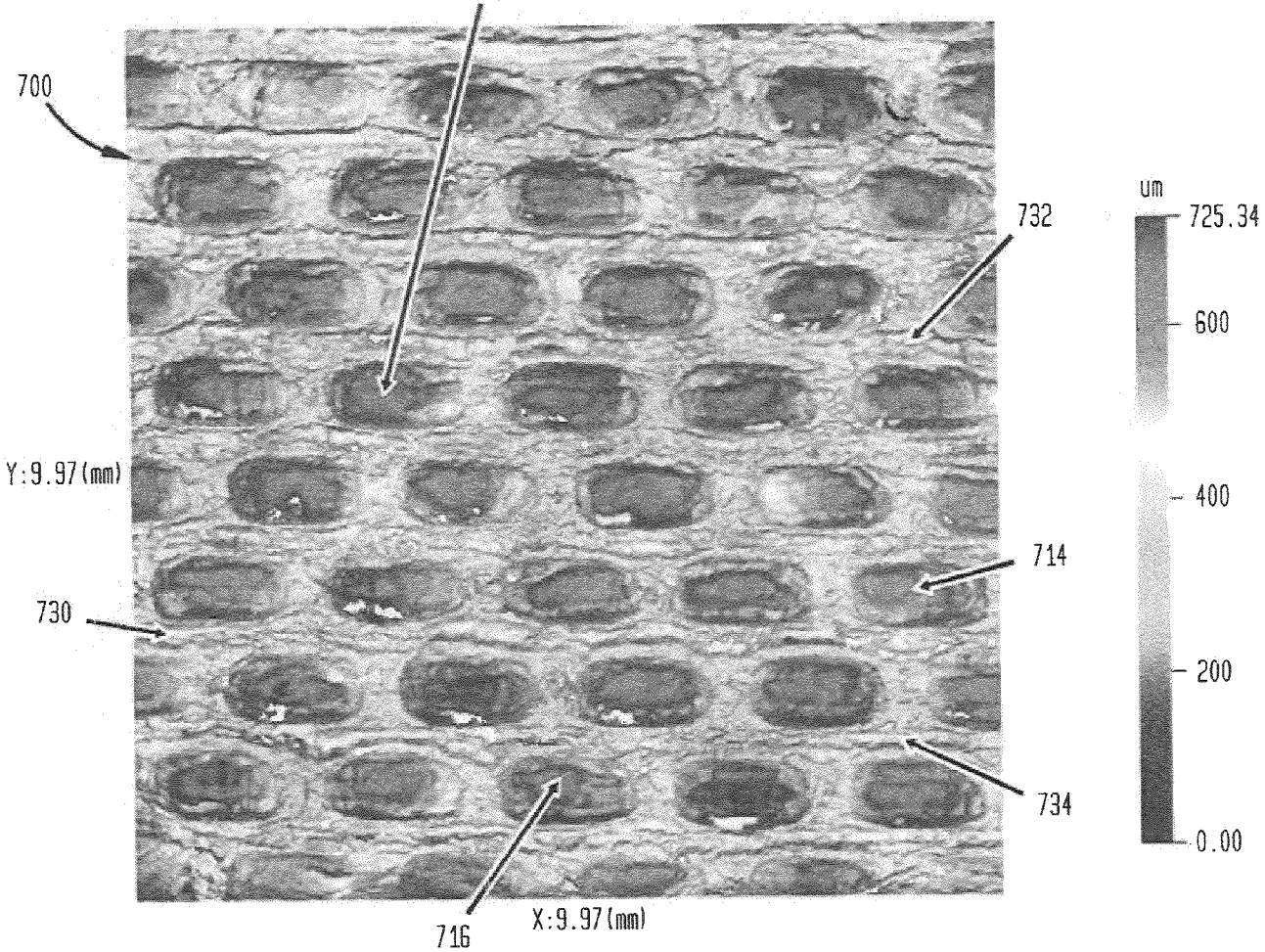
FIG. 13F is a laser profilometry analysis of the belt-side surface structure of the sheet of FIGS. 13A, 13B, 13C, 13D, and 13E.
Figure 13G:
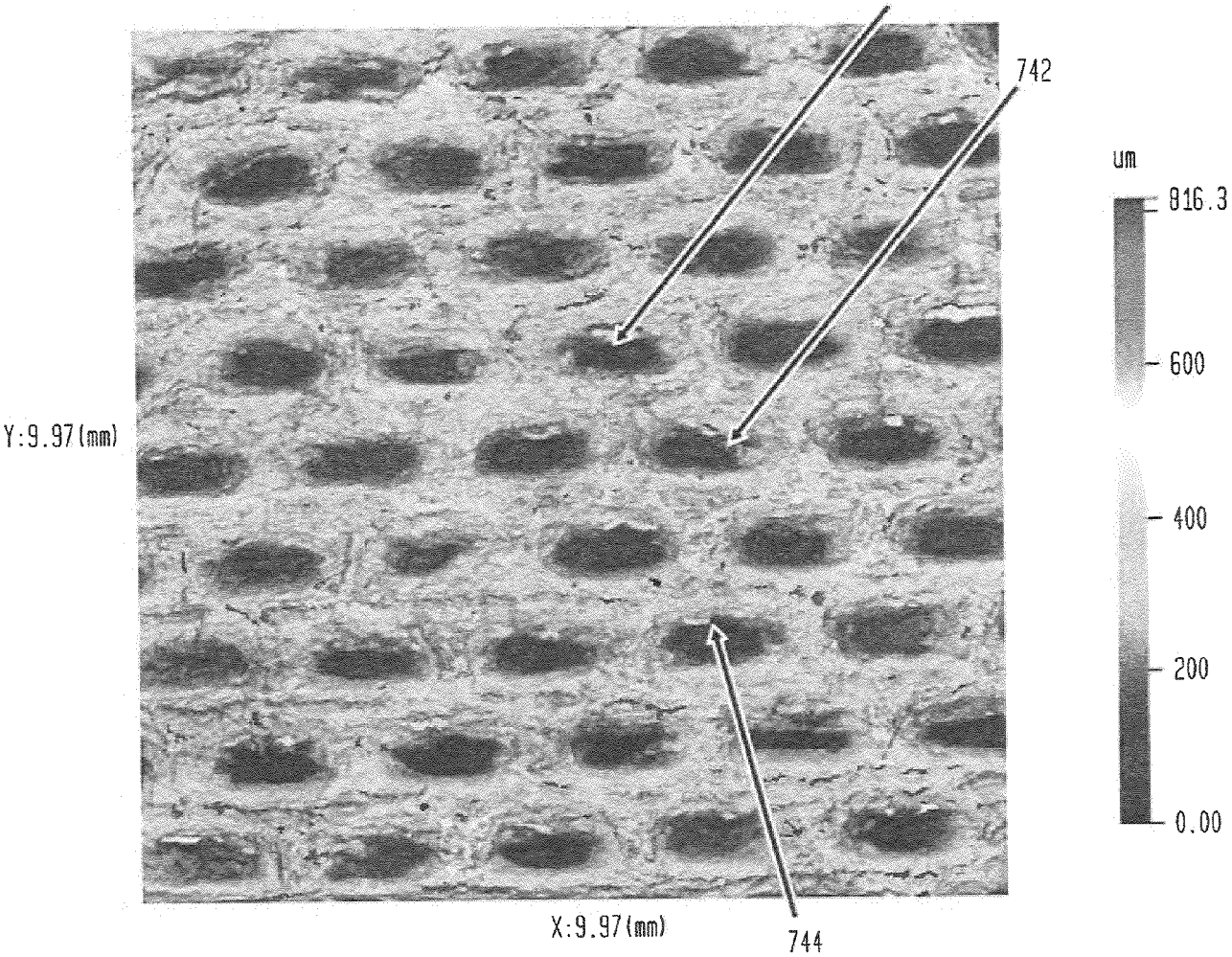
FIG. 13G is a laser profilometry analysis of the Yankee-side surface structure of the sheet of FIGS. 13A, 13B, 13C, 13D, 13E, and 13F.

FIGS. 13F and 13G are laser profilometry analyses of basesheet 700, FIG. 13F is a plan view of the belt-side of absorbent basesheet 700 showing domed regions such areas 712, 714, 716, which are relatively elevated, as well as minute folds 730, 732, 734 in the areas surrounding the domed regions. FIG. 13G is a plan laser profilometry analysis of Yankee-side of basesheet 700 showing hollows 740, 742, 744, which are opposite to the slubbed or pileated regions. The areas surrounding the hollows are relatively smooth, as can be appreciated from the diagram and TMI friction testing data discussed hereafter.

Figure 14A:
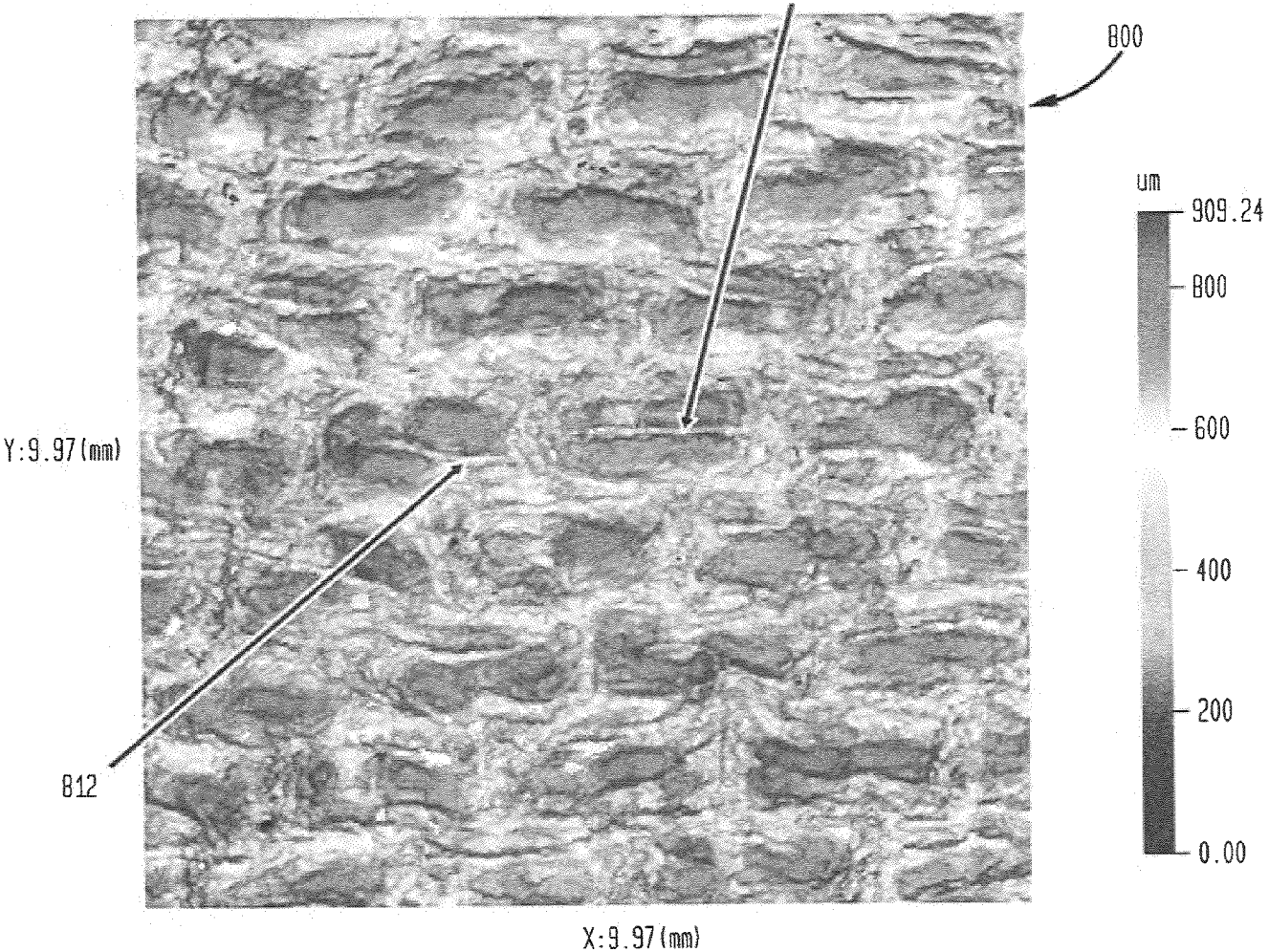
FIG. 14A is a laser profilometry analysis of the fabric-side surface structure of a sheet prepared with a WO13 woven creping fabric as described in U.S. patent application Ser. No. 11/804,246 (U.S. Patent Application Publication No. 2008/0029235), now U.S. Pat. No. 7,494,563.
Figure 14B:
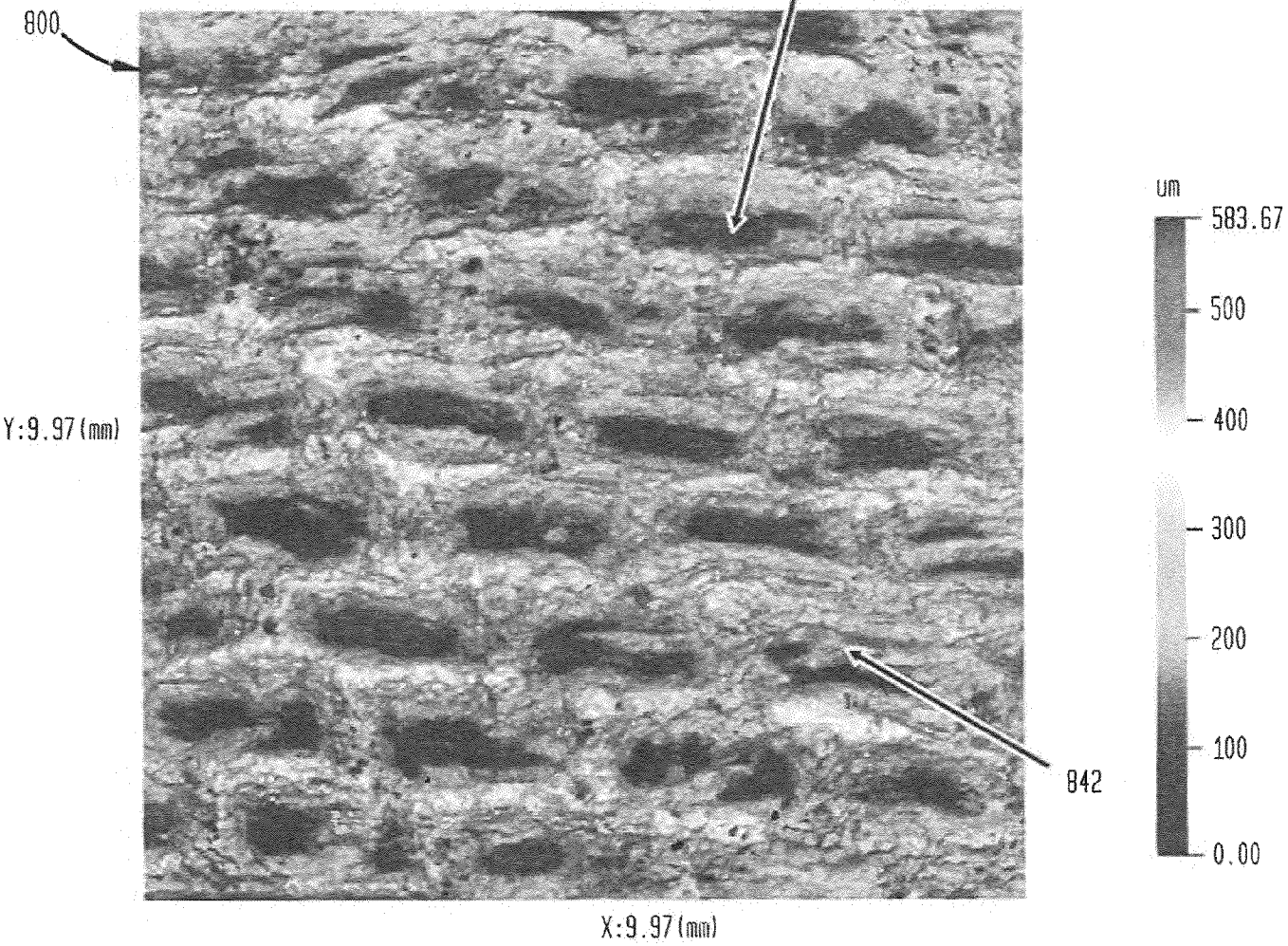
FIG. 14B is a laser profilometry analysis of the Yankee-side surface structure of the sheet of FIG. 14A.

FIG. 14A is a laser profilometry analysis of the fabric-side surface structure of a sheet prepared with a WO13 creping fabric, as described in U.S. patent application Ser. No. 11/804,246, now U.S. Pat. No. 7,494,563; and FIG. 14B is a laser profilometry analysis of the Yankee-side surface structure of the sheet of FIG. 14A. FIG. 14A is a plan view of the fabric-side of absorbent sheet 800 showing domed regions such as areas 812, 814 which are relatively elevated. FIG. 14B shows hollows 840, 842 which are opposite the domed regions. Comparing FIG. 14B with FIG. 13G, it is seen that the Yankee side of the calendered sheet of the invention is substantially smoother than the sheet provided with the WO13 fabric, which was similarly calendered. This smoothness difference is manifested especially in the TMI kinetic friction data discussed below.

Surface Texture Deviation and Mean Force Values

Friction measurements were taken generally as described generally in U.S. Pat. No. 6,827,819 to Dwiggins et al., using a Lab Master Slip & Friction tester, with special high-sensitivity load measuring option and custom top and sample support block, Model 32-90 available from:

Testing Machines Inc.
2910 Expressway Drive South
Islandia, N.Y. 11722
800-678-3221
www.testingmachines.com The Friction Tester was equipped with a KES-SE Friction Sensor, available from:

Noriyuki Uezumi
Kato Tech Co., Ltd.
Kyoto Branch Office
Nihon-Seimei-Kyoto-Santetsu Bldg. 3F
Higashishiokoji-Agaru, Nishinotoin-Dori
Shimogyo-ku, Kyoto 600-8216
Japan
81-75-361-6360
katotech@mx1.alpha-web.ne.jp The travel speed of the sled used was 10 mm/minute, and the force required is reported as the Surface Texture Mean Force herein. Prior to testing, the test samples were conditioned in an atmosphere of 23.0°±1° C. (73.4°±1.8° F.) and 50%±2% R.H.

Utilizing a friction tester as described above, Surface Texture Mean Force values and deviation values were generated for the FIG. 12A to 12G series sheet, the FIG. 13A to 13G series sheet and calendered sheet made using a WO13 fabric shown in FIGS. 14A and 14B. Any data collected while the probe was at rest or accelerating to constant velocity were discarded. The mean value of the force data in gf or mN was calculated as follows:

$$\text{Mean force, } F = \frac{\sum_{j=1}^{n} x_i}{n}$$

where $x_1$-$x_n$ are the individual sampled data points. The mean deviation of this force data about the mean value was calculated as follows:

$$\text{Mean deviation, } F_d = \frac{\sum_{j=1}^{n} (F - x_j)}{n}$$

Figure 15:
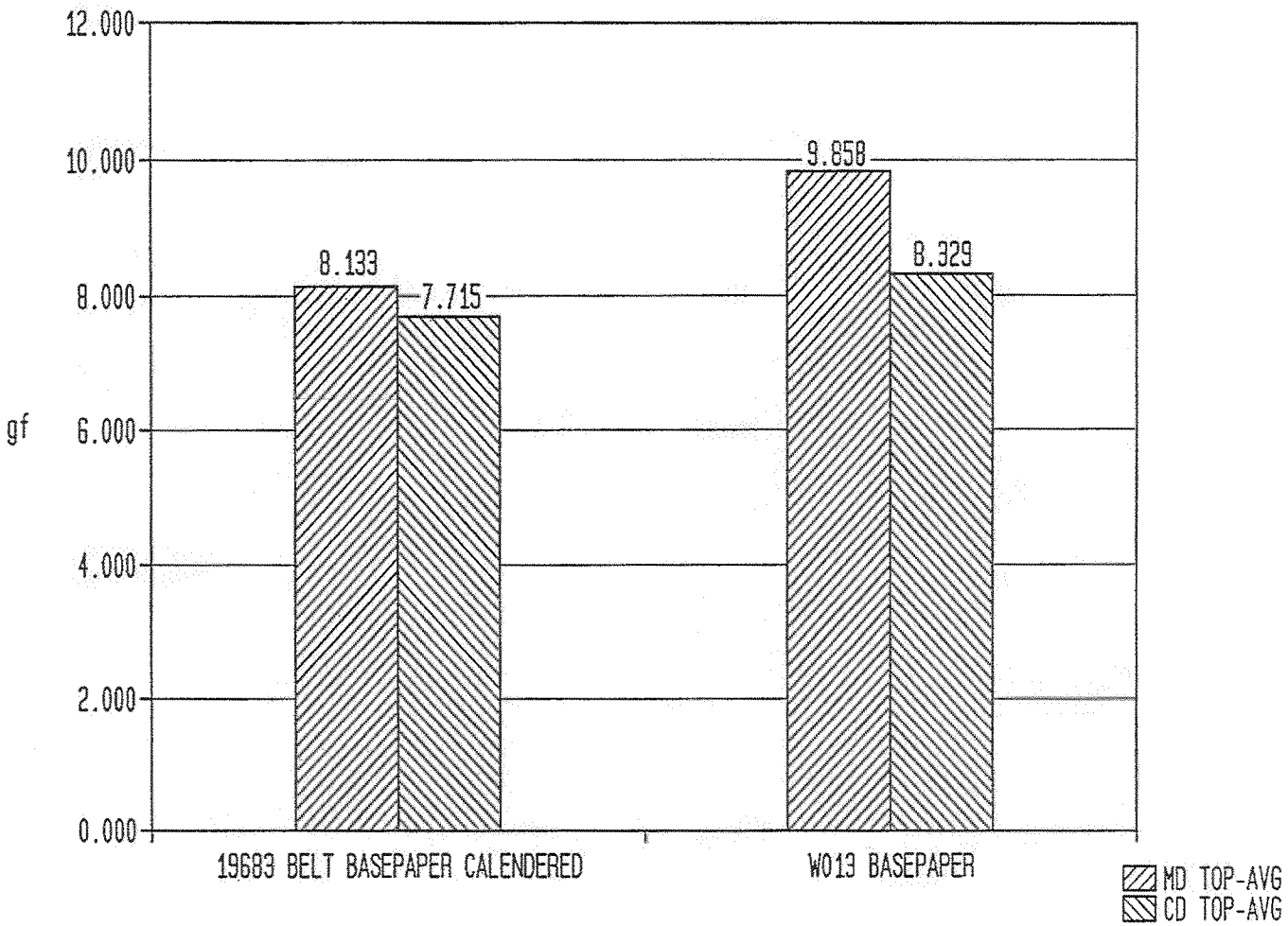
FIG. 15 is a histogram comparing the surface texture mean force values of sheet of the invention with a sheet made by a corresponding fabric crepe process using a woven fabric.
Figure 16:
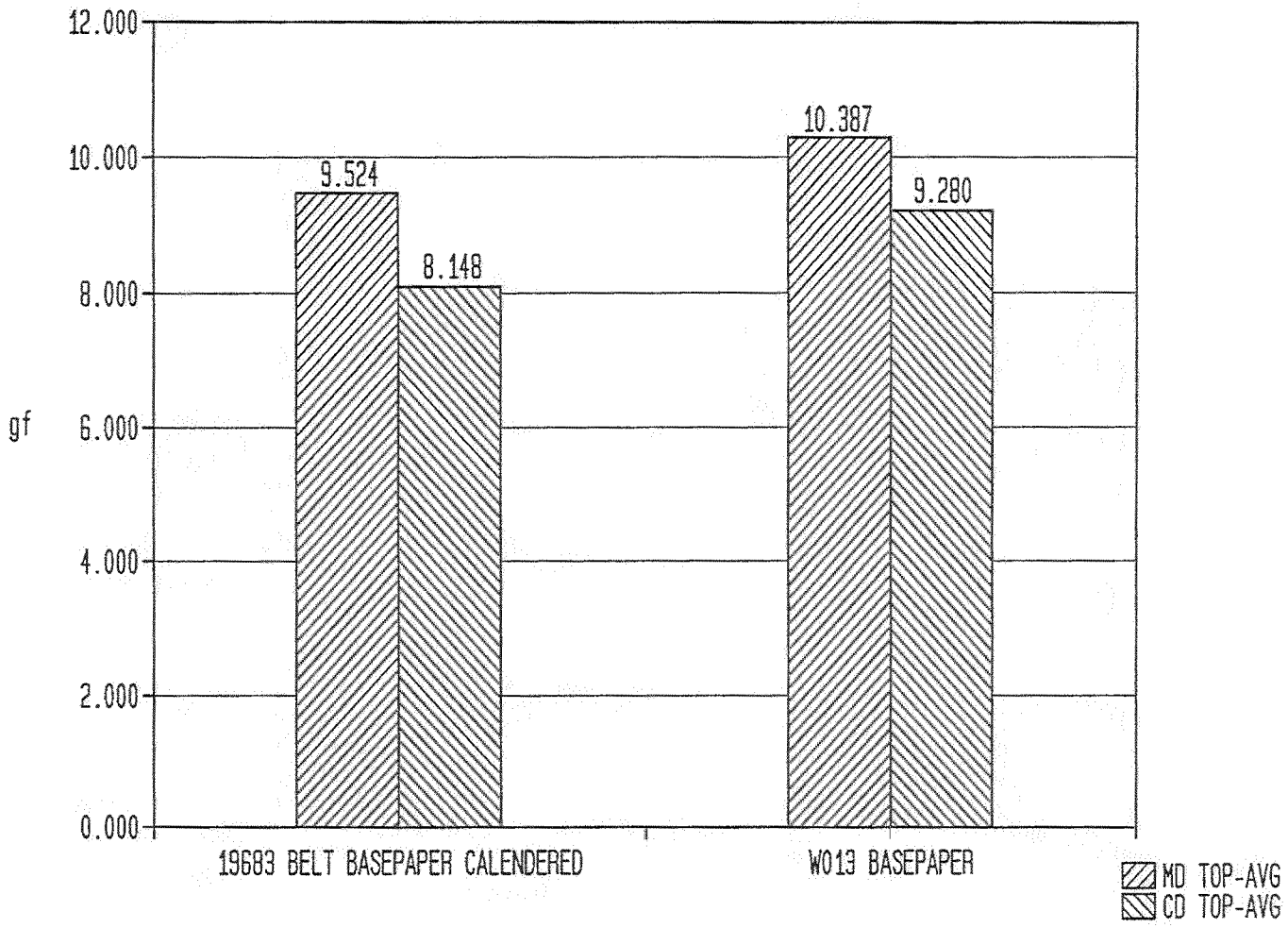
FIG. 16 is another histogram comparing the surface texture mean force values of the sheet of the invention with a sheet made by a corresponding fabric crepe process using a woven fabric.

Results for 5 to 7 scans appear in Table 3 for the Yankee side of the sheet and selected Surface Texture Mean Force values are presented graphically in FIG. 15. Repeat results for 20 scans appears in Table 4 and in FIG. 16.

TABLE 3

Surface Texture Values

| | Surface Texture Mean Deviation MD Top gf MD Top-Avg | Surface Texture Mean Deviation CD Top-S1 gf CD Top-Avg |
|---|---|---|
| Series 12 Belt basepaper uncalendered | 1.921 | 0.618 |
| Series 13 Belt basepaper calendered | 0.641 | 0.411 |
| W013 Basepaper (calendered) | 0.721 | 0.409 |

| | Surface Texture Mean Force | |
|---|---|---|
| | MD Top-Avg | CD-Top Avg |
| Series 12 Belt basepaper uncalendered | 11.362 | 9.590 |
| Series 13 Belt basepaper calendered | 8.133 | 7.715 |
| W013 Basepaper calendered | 9.858 | 8.329 |

TABLE 4

Surface Texture Values

| | Surface Texture Mean Deviation MD Top gf MD Top-Avg | Surface Texture Mean Deviation CD Top-S1 gf CD Top-Avg |
|---|---|---|
| Series 12 Belt basepaper uncalendered | 0.968 | 0.622 |
| Series 13 Belt basepaper calendered | 0.859 | 0.400 |
| W013 Basepaper (calendered) | 0.768 | 0.491 |

| | Surface Texture Mean Force | |
|---|---|---|
| | MD Top-Avg | CD-Top Avg |
| Series 12 Belt basepaper uncalendered | 9.404 | 9.061 |
| Series 13 Belt basepaper calendered | 9.524 | 8.148 |
| W013 Basepaper calendered | 10.387 | 9.280 |

It is seen from the data that the calendered products of the invention consistently exhibited lower Surface Texture Mean Force values than the sheet made with the woven fabric, which is consistent with the laser profilometry analyses.

Converted Product

Finished product data for two-ply towel appears in Table 5 and finished product data for two-ply tissue appears in Table 6, along with comparable data on commercial premium products which, are believed to be through-air dried products.

TABLE 5

2-ply Towel Products

| Properties | 2-Ply Towel from basesheet of Examples 5, 6 | 2-Ply Towel from basesheet of Examples 7, 8 | Commercial Towel | Commercial Towel |
|---|---|---|---|---|
| Basis Weight (lb/3000 ft$^2$), (g/m$^2$) | 26.9 (43.8) | 26.9 (43.8) | 27.1 (44.2) | 26.7 (43.50) |
| Caliper (mils/8 Sheets), (mm/8 sheets) | 226 (5.74) | 214 (5.44) | 183 (4.65) | 188 (4.78) |
| Bulk (mils/8 sheet) (lb/rm), (mm/8 sheets/gsm) | 8.4 (0.348) | 8.0 (0.331) | 6.7 (0.277) | 7.0 (0.290) |

TABLE 5-continued

| 2-ply Towel Products | | | | |
|---|---|---|---|---|
| Properties | 2-Ply Towel from basesheet of Examples 5, 6 | 2-Ply Towel from basesheet of Examples 7, 8 | Commercial Towel | Commercial Towel |
| MD Dry Tensile (g/3 in.), (g/mm) | 3452 (45.3) | 3212 (42.2) | 2764 (36.3) | 3050 (40.0) |
| MD Stretch (%) | 28.1 | 28.2 | 17.9 | 15.7 |
| CD Dry Tensile (g/3 in.), (g/mm) | 2929 (38.4) | 2993 (39.3) | 2061 (28.4) | 2327 (30.5) |
| CD Stretch (%) | 9.7 | 9.0 | 15.3 | 13.5 |
| GM Dry Tensile (g/3 in.), (g/mm) | 3178 (41.7) | 3099 (40.7) | 2386 (31.3) | 2664 (35.0) |
| Dry Tensile Ratio | 1.18 | 1.08 | 1.34 | 1.31 |
| Perf Tensile (g/3 in.), (g/mm) | 867 (11.4) | 802 (10.5) | 718 (9.42) | 829 (10.9) |
| CD Wet Tensile Finch (g/3 in.), (g/mm) | 864 (11.3) | 834 (10.9) | 708 (9.29) | 769 (10.1) |
| CD Wet/Dry Ratio (%) | 29.5 | 27.9 | 0.3 | 33.0 |
| SAT Capacity (g/m$^2$) | 498 | 451 | 525 | 521 |
| SAT Rate (g/s$^{0.5}$) | 0.194 | 0.167 | 0.176 | 0.158 |
| SAT Time (s) | 34.0 | 35.7 | 55.7 | 47.4 |
| MD Break Modulus (g/% Strain) | 121 | 112 | 156 | 192 |
| CD Break Modulus (g/% Strain) | 297 | 328 | 134 | 172 |
| GD Break Modulus (g/% Strain) | 190 | 192 | 145 | 182 |
| MD Modulus (g/% Strain) | 24.1 | 23.5 | 37.1 | 50.2 |
| CD Modulus (g/% Strain) | 91.2 | 85.7 | 38.6 | 53.2 |
| GD Modulus (g/% Strain) | 46.8 | 44.8 | 37.8 | 51.5 |
| MD TEA (mm-g/mm$^2$) | 5.192 | 4.934 | 3.141 | 3.276 |
| CD TEA (mm-g/mm$^2$) | 1.934 | 1.812 | 2.157 | 2.208 |
| Roll Diameter (in.) (mm) | — | — | 4.84 (123) | 5.45 (138) |
| Roll Compression (%) | — | — | 13.4 | 9.1 |
| Sensory Softness | 7.5 | 7.5 | 8.3 | — |

In the towel products, it is seen that the sheet of the invention exhibits comparable properties overall, yet exhibits surprising caliper as compared with the premium commercial product, with more than 10% additional bulk.

Finished tissue product likewise exhibits surprising bulk. There is shown in Table 6 data on two-ply embossed products, two-ply product, with one-ply embossed and two-ply product, where the product is conventionally embossed. The two-ply product with one-ply embossed was prepared in accordance with U.S. Pat. No. 6,827,819 to Dwiggins et al., the disclosure of which is incorporated by reference. The two-ply tissue in Table 6 was prepared from the basesheet of Examples 11 and 12 above.

TABLE 6

| 2-ply Tissue Products | | | |
|---|---|---|---|
| Attributes | Belt 100 2-Ply, 200 ct Un-Embossed | Belt 100 2-Ply, 200 ct Single-ply-Embossed | Belt 100 2-Ply, 200 ct Conventional-Embossed |
| Basis weight (lbs/ream)*, (gsm) | 26.9, (43.8) | 25.8, (42.1) | 24.8, (40.4) |
| Caliper (mils/8 sheets), (mm/8 sheet) | 158.5, (4.03) | 168.8, (4.29) | 151.2, (3.84) |
| Specific Bulk (mils/8 sheet)/(lb/ream), (mm/8 sheet)/(gsm) | 5.9 (0.244) | 6.5 (0.269) | 6.1 (0.253) |
| MD Dry Tensile (g/3") | 1849 (24.6) | 1579 (20.7) | 1578 (20.7) |
| CD Tensile (g/3") (g/mm) | 1674 (22.0) | 1230 (16.1) | 1063 (14.0) |
| GD Tensile (g/3") (g/mm) | 1759 (23.1) | 1394 (18.3) | 1295 (17) |

TABLE 6-continued

| 2-ply Tissue Products | | | |
|---|---|---|---|
| Attributes | Belt 100 2-Ply, 200 ct Un-Embossed | Belt 100 2-Ply, 200 ct Single-ply-Embossed | Belt 100 2-Ply, 200 ct Conventional-Embossed |
| Roll Compression (%) | 12 | 13.5 | 14.5 |
| Roll Diameter (inches), (mm) | 4.95, (125.7) | 4.96, (126.0) | 5.07, (128.8) |

It is seen from the tissue product data, that the absorbent products of this invention exhibit surprising caliper/basis weight ratios. Premium throughdried tissue products generally exhibit a caliper/basis weight ratio of no more than about 5 (mils/8 sheet)/(lb/ream), while the products of this invention exhibit caliper/basis weight ratios of 6 (mils/8 sheet)/(lb/ream) or 2.48 (mm/8 sheet)/(gsm) and more.

There is shown in Table 7 additional data on both tissue of the invention (prepared from basesheet of Examples 9, 10) and commercial tissue. Here, again, the unexpectedly high bulk is readily apparent. Moreover, it is also seen that the tissue of the invention exhibits surprisingly low roll compression values, especially in view of the high bulk.

TABLE 7

| Tissue Properties | | |
|---|---|---|
| Attribute | Commercial Tissue | Belt Crepe |
| Plies | 2 | 2 |
| Sheet Count | 200 | 200 |
| Basis Weight (lbs/ream), (gsm) | 29.9 (48.7) | 34.1 (55.6) |

TABLE 7-continued

| Tissue Properties | | |
|---|---|---|
| Attribute | Commercial Tissue | Belt Crepe |
| Caliper (mils/8 sheets), (mm/8 sheets) | 150.4 (3.82) | 208.7 (5.30) |
| Specific Bulk (mils/8 sheet)/(lb/ream), (mm/8 sheet)/(gsm) | 5.0 (0.207) | 6.1 (0.253) |
| MD Dry Tensile (g/3"), (g/mm) | 798 (10.5) | 2064 (27.1) |
| CD Dry Tensile (g/3"), (g/mm) | 543 (7.13) | 1678 (22.0) |
| Geometric Mean Tensile (g/3"), (g/mm) | 657 (8.62) | 1861 (24.4) |
| Basis Weight (lbs/ream), (gsm) | 29.9 (48.7) | 34.1 (55.6) |
| GM Break Modulus (g/% strain) | 50.4 | 132.7 |
| Roll Diameter (inches), (mm) | 4.72 (119.9) | 5.41 (137.4) |
| Roll Compression (%) | 20.1 | 9.3 |
| Sensory Softness | 20.3 | — |

β-Radiograph Imaging Analysis

Absorbent sheet of the invention and various commercial products were analyzed using β-radiographic imaging in order to detect basis weight variation. The techniques employed are set forth in Keller et al., β-*Radiographic Imaging of Paper Formation Using Storage Phosphor Screens*, Journal of Pulp and Paper Science, Vol. 27, No. 4, pages 115-123, April 2001, the disclosure of which is incorporated by reference.

Figure 17A:
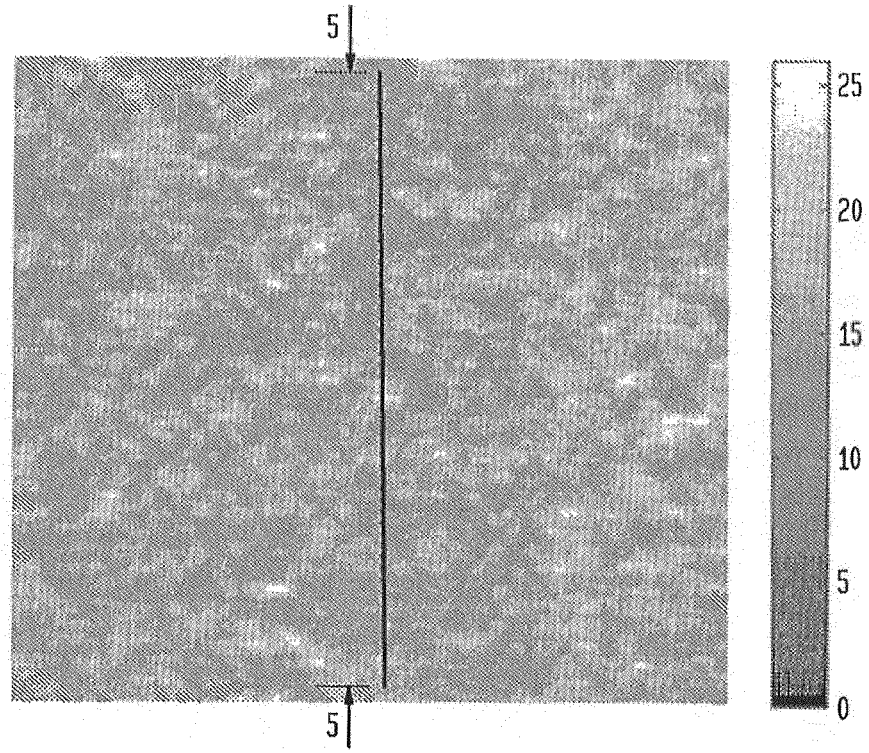
FIG. 17A is a β-radiograph image of a calendered sheet of the invention prepared with the belt of FIG. 4 to FIG. 7 on a papermachine of the class shown in FIGS. 10B and 10D with 18" Hg (60.9 kPa) vacuum applied to the web, while the web was on the creping belt.

FIG. 17A is a β-radiograph image of a basesheet of the invention where the calibration for basis weight appears in the legend on the right. The sheet of FIG. 17A was produced on a papermachine of the class shown in FIGS. 10B and 10D using a belt of the geometry illustrated in FIGS. 4 to 7. Vacuum at 18" Hg (60.9 kPa) was applied to the belt-creped sheet on the belt, and the sheet was lightly calendered.

It is seen in FIG. 17A that there is a substantial, regularly recurring local basis weight variation in the sheet.

Figure 17B:
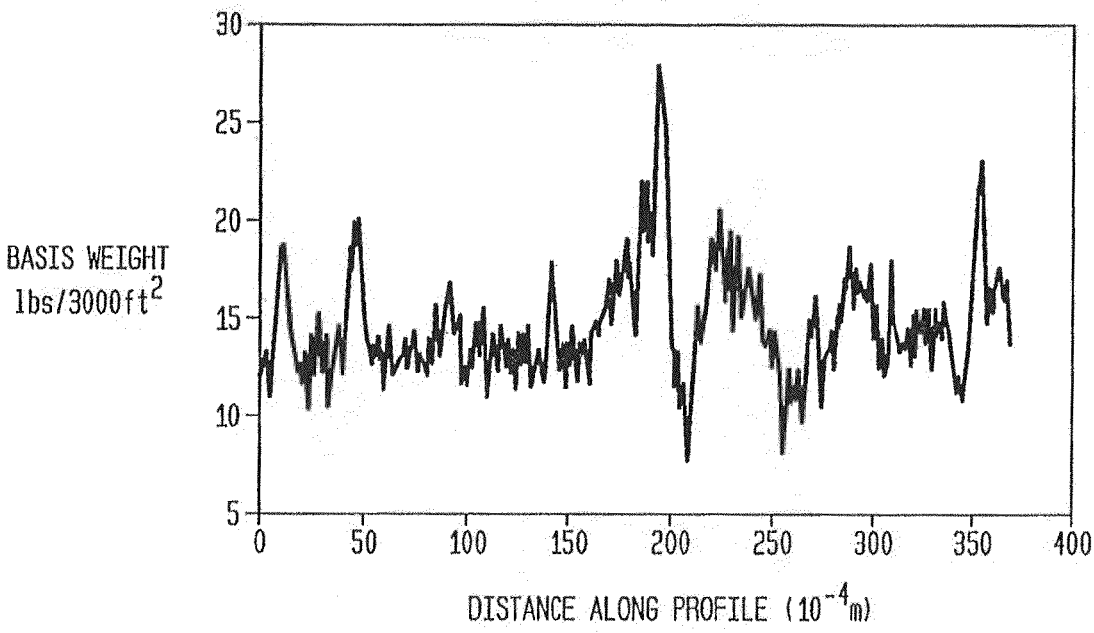
FIG. 17B is a plot showing the micro basis weight profile along line 5-5 of the sheet of FIG. 17A, distance in $10^{-4}$ m.

FIG. 17B is a micro basis weight profile; that is, a plot of basis weight versus position over a distance of approximately 40 mm along line 5-5 shown in FIG. 17A, where the line is along the MD of the pattern.

It is seen in FIG. 17B that local basis weight variation is of a relatively regular frequency, exhibiting minima and maxima about a mean value of about 16 lbs/3000 $ft^2$ (26.1 gsm) with pronounced peaks. The micro basis weight profile variation appears substantially monomodal in the sense that the mean basis weight remains relatively constant, and the oscillation in basis weight with position is regularly recurring about a single mean value.

Figure 18A:
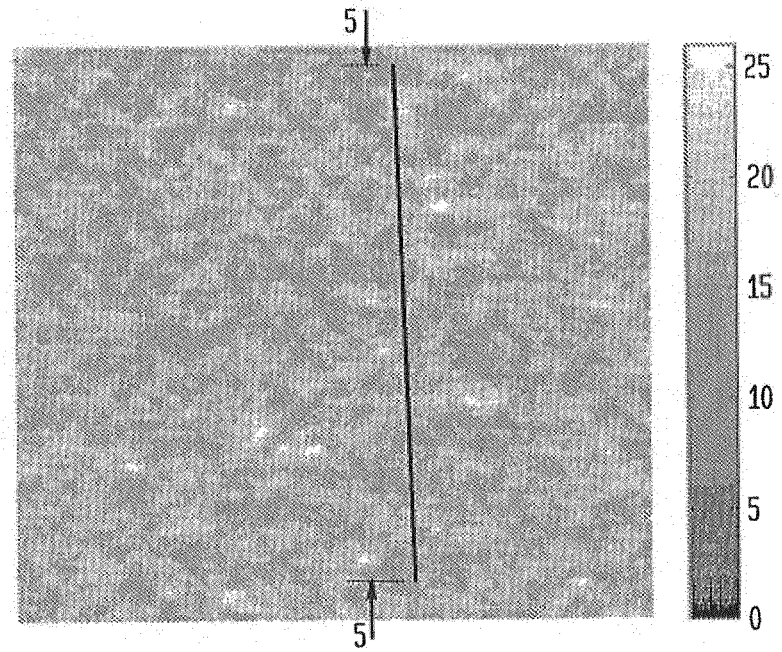
FIG. 18A is a β-radiograph image of an uncalendered sheet of the invention prepared with the belt of FIG. 4 to FIG. 7 on a papermachine of the class shown in FIGS. 10B and 10D with 23" Hg (77.9 kPa) vacuum applied to the web, while the web was on the creping belt.
Figure 18B:
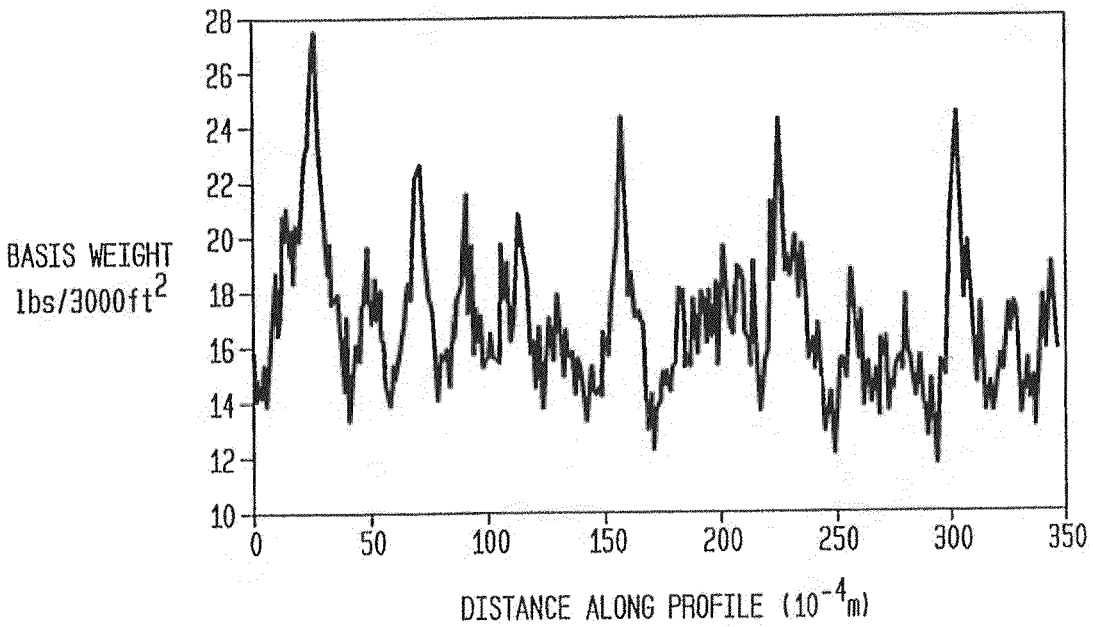
FIG. 18B is a plot showing the micro basis weight profile along line 5-5 of the sheet of FIG. 18A, distance in $10^{-4}$ m.

FIG. 18A is another β-radiograph image of a section of a sheet of the invention that exhibits a variable local basis weight. The sheet of FIG. 18A is an uncalendered sheet of the invention prepared with the belt of FIGS. 4 through 7 on a papermachine of the class shown in FIGS. 10B and 10D with 23" Hg (77.9 kPa) vacuum applied to the web while it was on the creping belt. FIG. 18B is a plot of local basis weight along line 5-5 of FIG. 18A, which is substantially along the machine direction of the pattern. Here, again, the characteristic basis weight variation is observed.

Figure 2A:
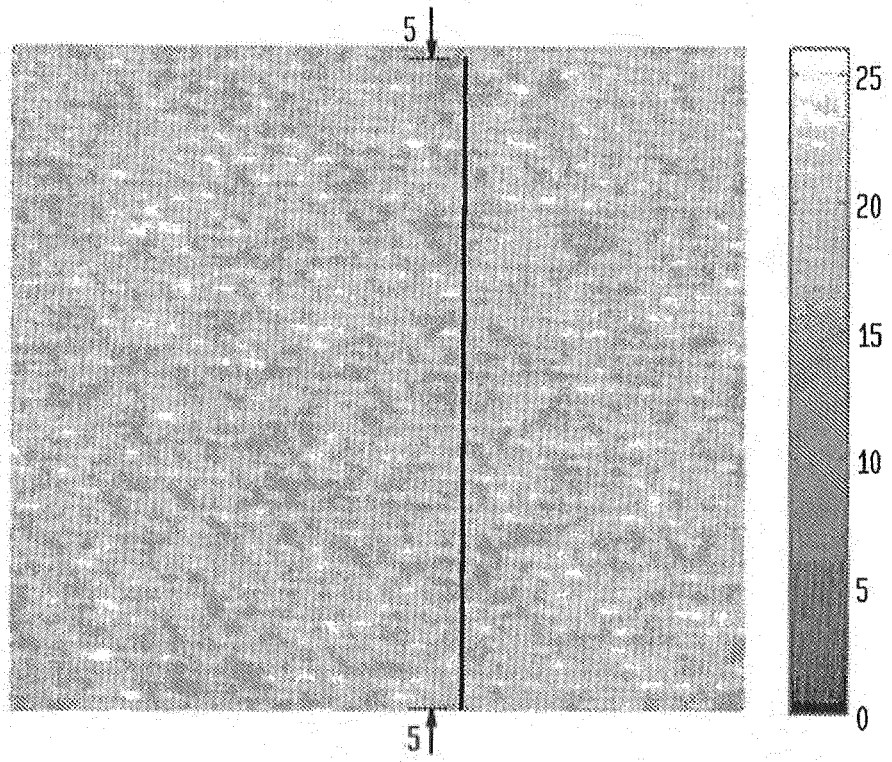
FIG. 2A is a β-radiograph image of an uncalendered sheet of the invention prepared with the belt of FIG. 4 to FIG. 7 on a papermachine of the class shown in FIGS. 10B and 10D without a vacuum applied to the web while the web was on the creping belt.
Figure 2B:
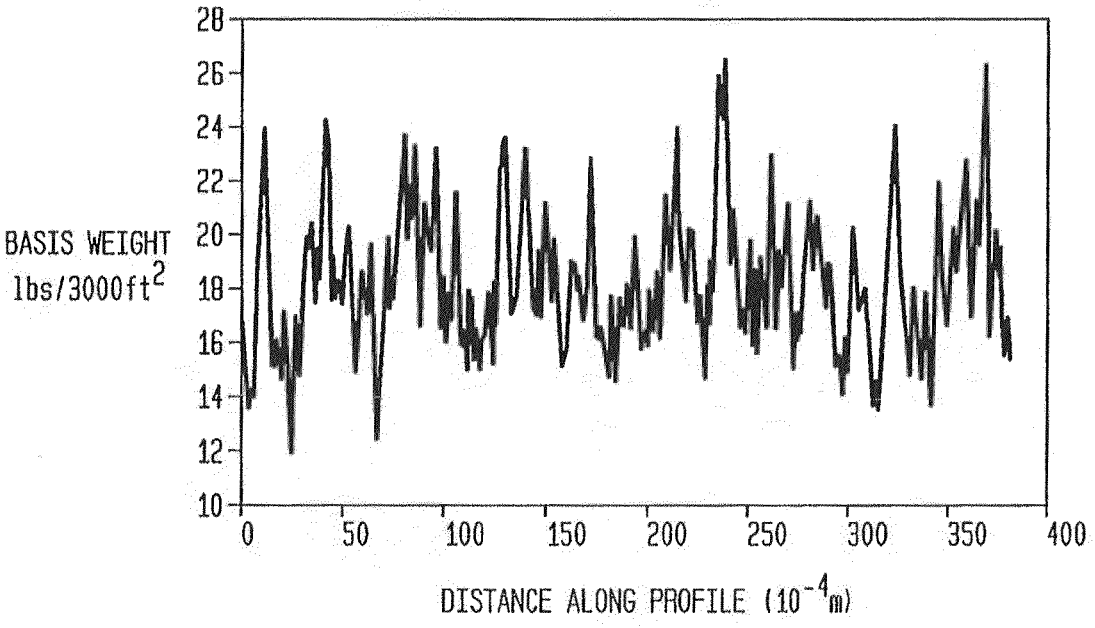
FIG. 2B is a plot showing the micro basis weight profile along line 5-5 of the sheet of FIG. 2A, distance in $10^{-4}$ m.
Figure 3:
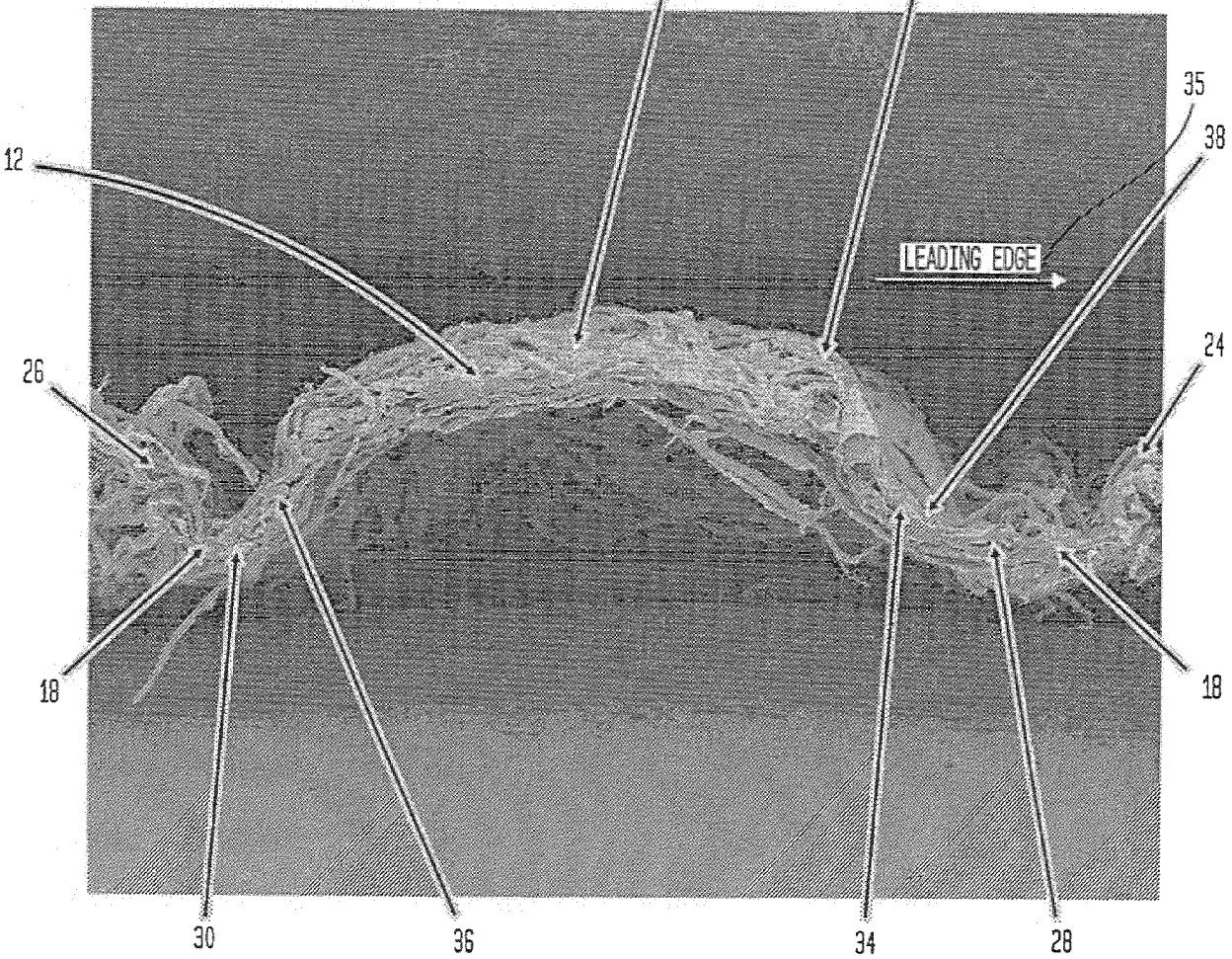
FIG. 3 is a scanning electron micrograph (SEM) of a dome region of a sheet, such as the sheet of FIG. 1A, in section along the machine direction (MD)
Figure 19A:
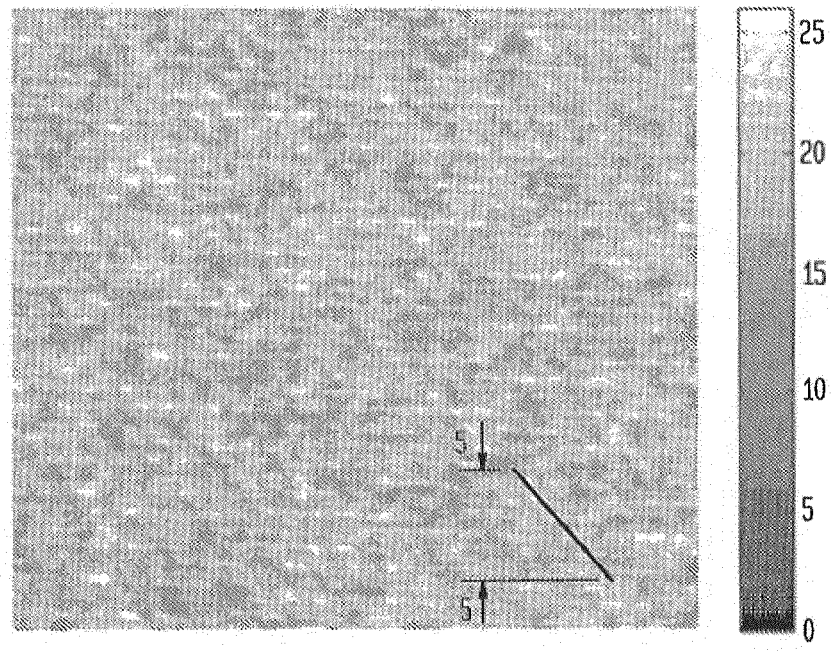
FIG. 19A is another β-radiograph image of the sheet of FIG. 2A.
Figure 19B:
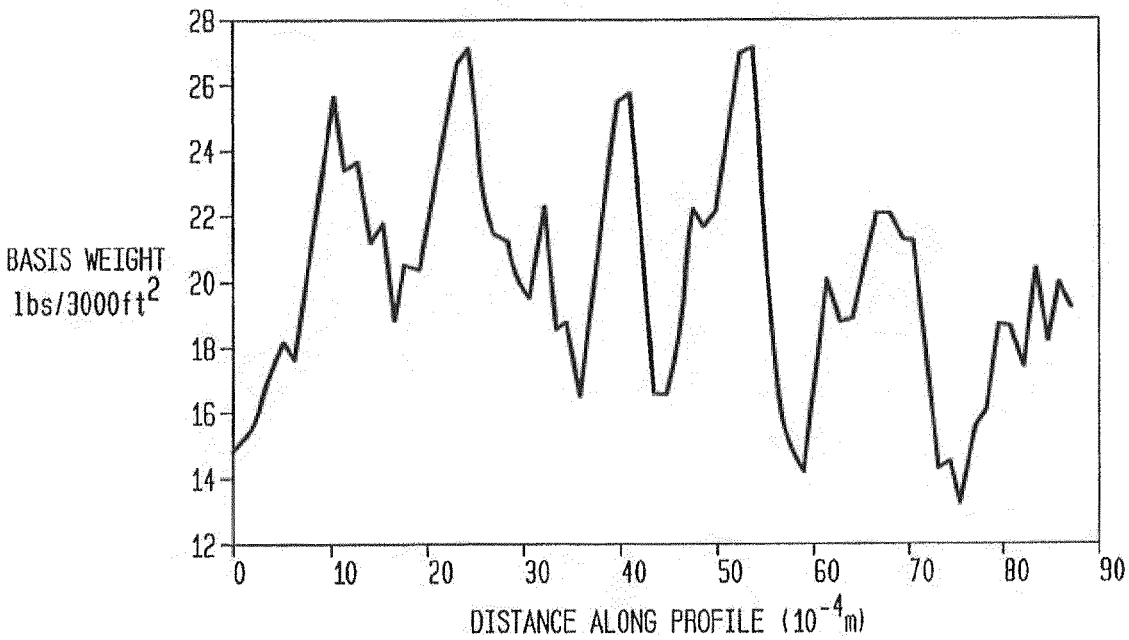
FIG. 19B is a plot showing the micro basis weight profile along line 5-5 of the sheet of FIGS. 2A and 19A, distance in $10^{-4}$ m.

FIG. 19A is a β-radiograph image of the basesheet of FIGS. 2A, 2B and FIG. 19B is a micro basis weight profile along diagonal line 5-5, which is offset along the MD of the pattern and through approximately six domed regions over a distance of approximately 9 mm.

In FIG. 19B, it is seen the basis weight variation is again regularly recurring, but that the mean value tends somewhat downwardly along the shorter profile.

Figure 20A:
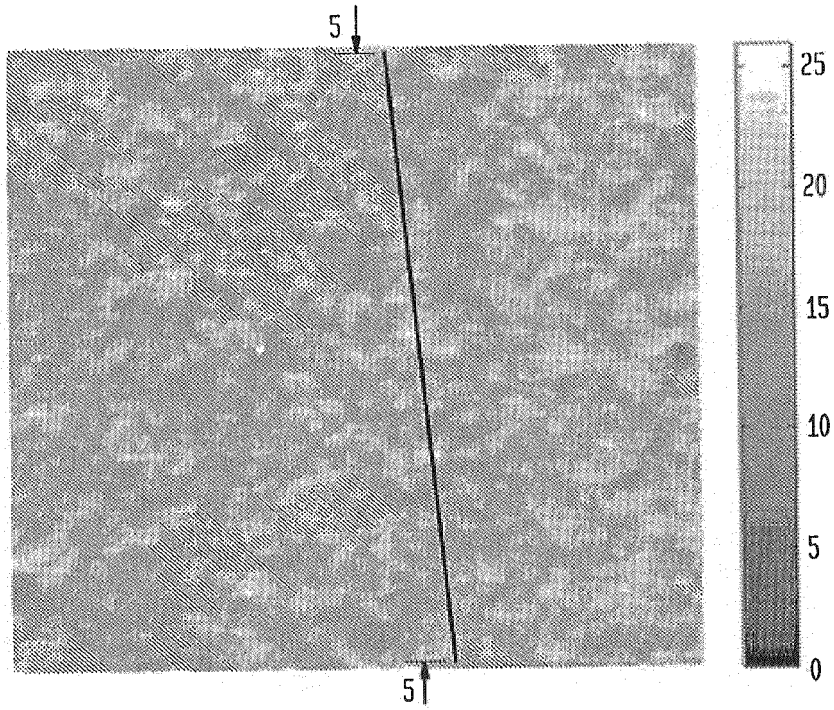
FIG. 20A is a β-radiograph image of an uncalendered sheet of the invention prepared with the belt of FIGS. 4 through 7 on a papermachine of the class shown in FIGS. 10B and 10D with 18" Hg (60.9 kPa) vacuum applied to the web, while the web was on the creping belt.

FIG. 20A is yet another β-radiograph image of a basesheet of the invention, with the calibration legend appearing on the right. The sheet of FIG. 20A was produced on a papermachine of the class shown in FIGS. 10B and 10D using a creping belt of the geometry illustrated in FIGS. 4 to 7. Vacuum equal to 18" Hg (60.9 kPa) was applied to the belt-creped sheet, which was uncalendered.

Figure 20B:
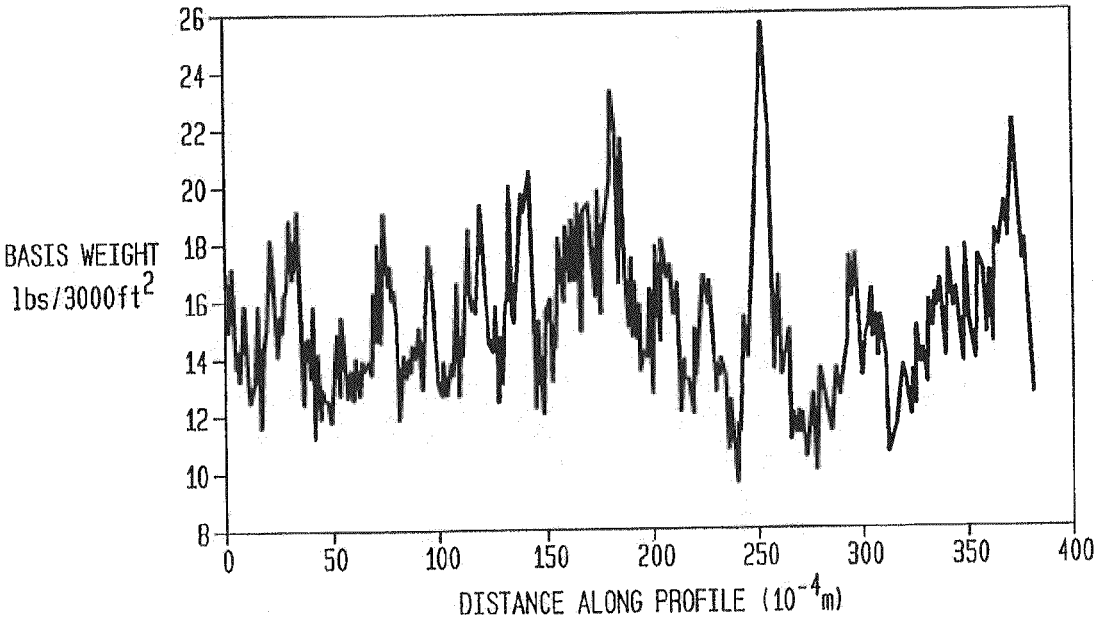
FIG. 20B is a plot showing the micro basis weight profile along line 5-5 of the sheet of FIG. 20A, distance in $10^{-4}$ m.

FIG. 20B is a micro basis weight profile of the sheet of FIG. 20A over a distance of 40 mm along line 5-5 of FIG. 20A, which is along the MD of the pattern of the sheet. It is seen in FIG. 20B that the local basis weight variation is of a substantially regular frequency, but less regular than the sheet of FIG. 17B, which is calendered. The peak frequency is 4-5 mm, consistent with the frequency seen in the sheet of FIGS. 17A and 17B.

Figure 21A:
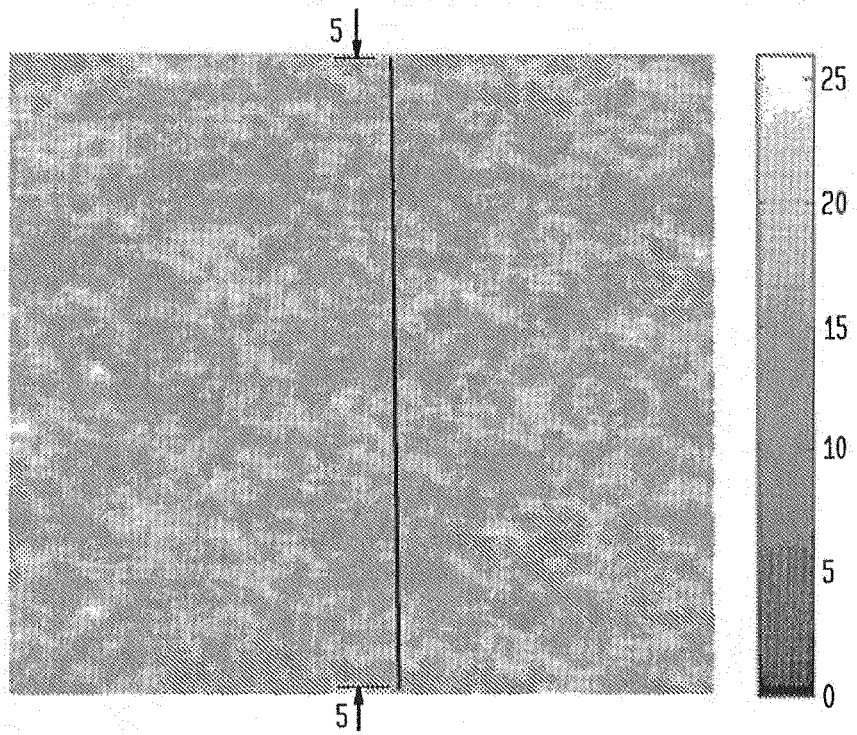
FIG. 21A is a β-radiograph image of a sheet produced with a woven fabric.

FIG. 21A is a β-radiograph image of a baseshseet prepared with a WO13 woven creping fabric, as described in U.S. patent application Ser. No. 11/804,246 (now U.S. Pat. No. 7,494,563, issued Feb. 24, 2009). Here, there is seen substantial variation in local basis weight in many respects, similar to that shown in FIGS. 17A, 18A, 19A, and 20A, discussed above.

Figure 21B:
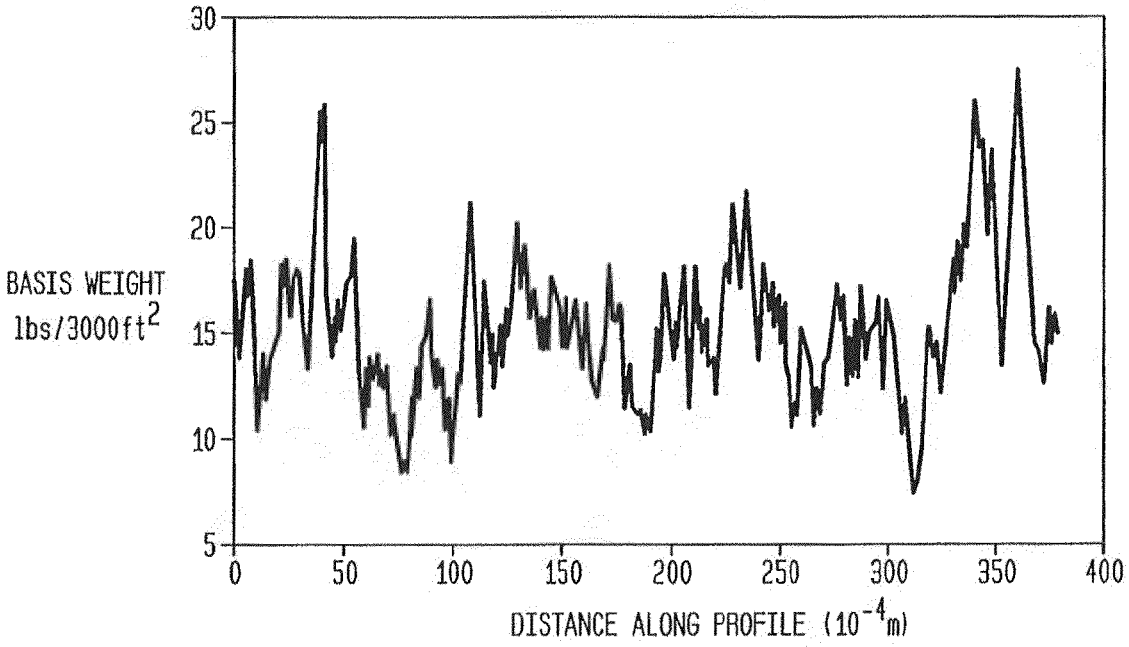
FIG. 21B is a plot showing the micro basis weight profile along line 5-5 of the sheet of FIG. 21A, distance in $10^{-4}$ m.

FIG. 21B is a micro basis weight profile along MD line 5-5 of FIG. 21A illustrating the variation in local basis weight over 40 mm. In FIG. 21B, it is seen that basis weight variation is somewhat more irregular than in FIGS. 17B, 18B, 19B, and 20B; however, the pattern is again substantially monomodal in the sense that the mean basis weight remains relatively constant over the profile. This feature is in common with the high solids fabric and belt-creped sheet; however, commercial products with variable basis weight tend to have more complex variation of local basis weight including trends in the average basis weight superimposed over more local variations, as is seen in FIGS. 22A to 23B discussed below.

Figure 22A:
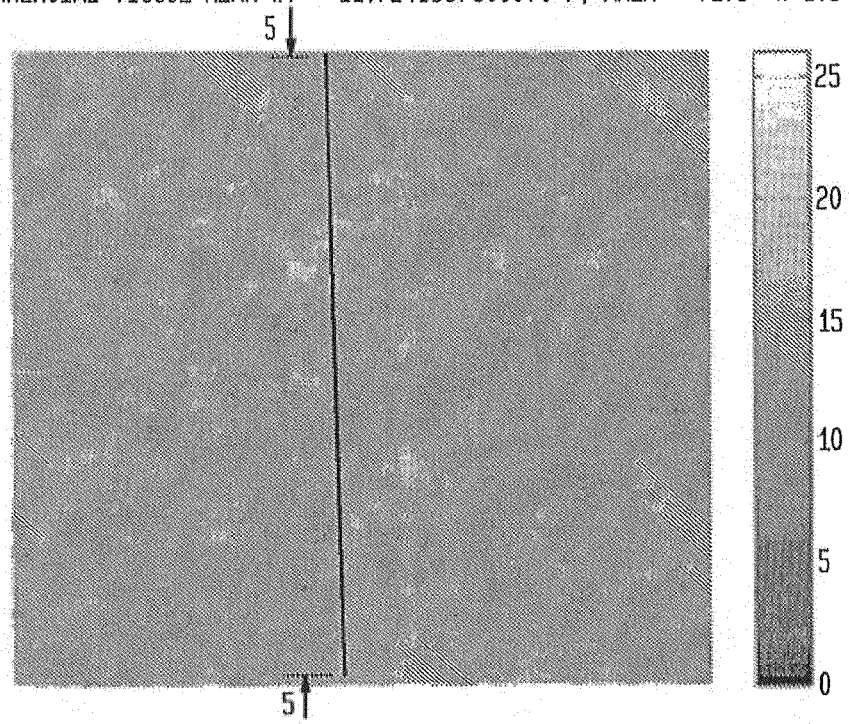
FIG. 22A is a β-radiograph image of a commercial tissue.
Figure 22B:
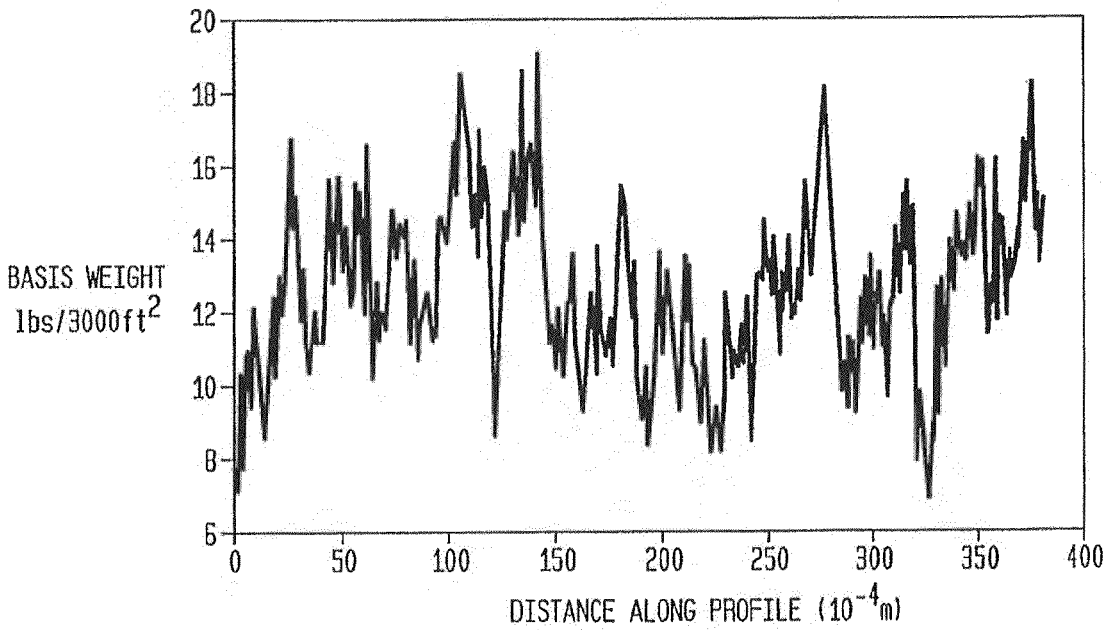
FIG. 22B is a plot showing the micro basis weight profile along line 5-5 of the sheet of FIG. 22A, distance in $10^{-4}$ m.

FIG. 22A is a β-radiograph image of a commercial tissue sheet, which exhibits variable basis weight and FIG. 22B is a micro basis weight profile along line 5-5 of FIG. 22A over 40 mm. It is seen in FIG. 22B that the basis weight profile exhibits some 16-20 peaks over 40 mm, and that the average basis weight variation over 40 mm appears somewhat sinusoidal, exhibiting maxima at about 140 and 290 mm. The basis weight variation also appears somewhat irregular.

Figure 23A:
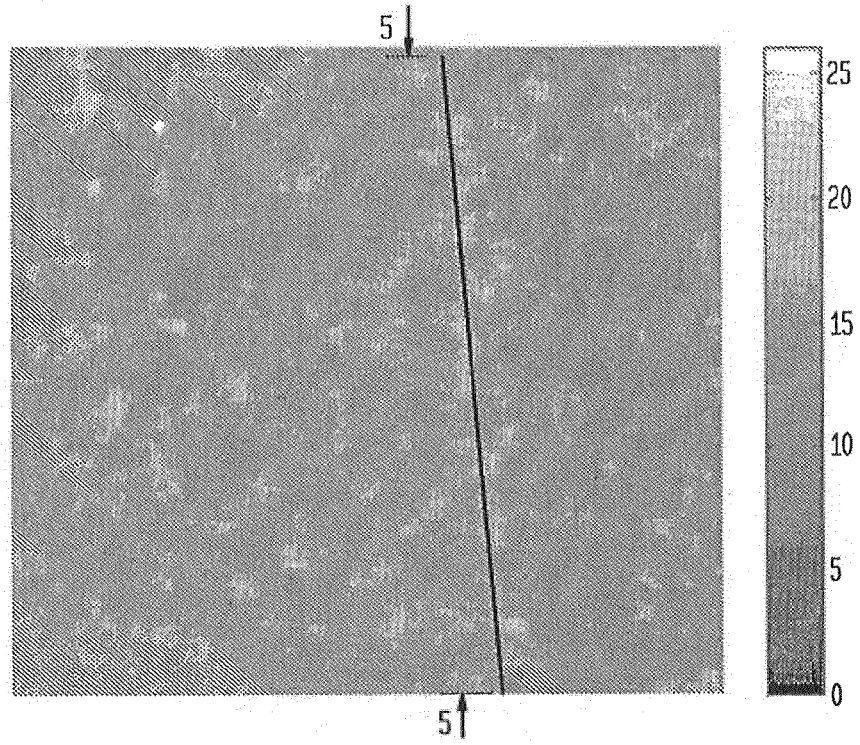
FIG. 23A is a β-radiograph image of a commercial towel.
Figure 23B:
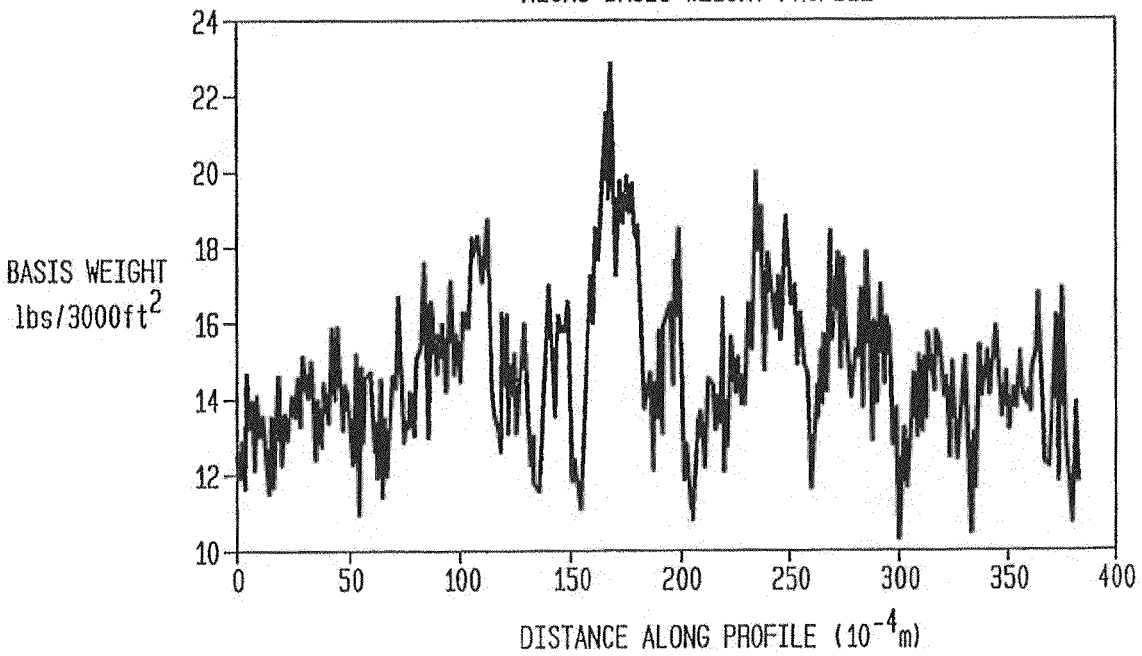
FIG. 23B is a plot showing the micro basis weight profile along line 5-5 of the sheet of FIG. 23A, distance in $10^{-4}$ m.

FIG. 23A is a β-radiograph image of a commercial towel sheet, which exhibits variable basis weight and FIG. 23B is a micro basis weight profile along line 5-5 of FIG. 23A over 40 mm. It is seen in FIG. 23B that the basis weight variation is relatively modest about average values (except, perhaps, at 150-200 microns, FIG. 23B). Moreover, the variation appears somewhat irregular, and the mean value of the basis weight appears to drift upwardly and downwardly.

Fourier Analysis of β-Radiograph Images

Figure 24A:
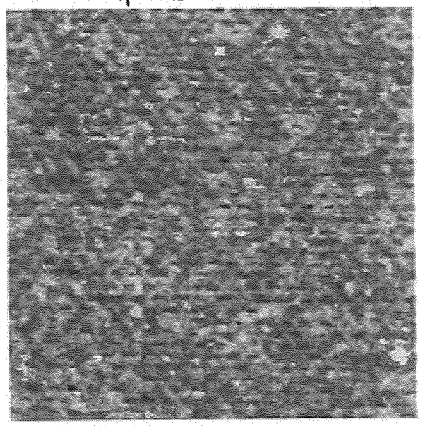
FIGS. 24A to 24D illustrate last Fourier transform analysis of β-radiograph images of absorbent sheets of this invention.
Figure 24B:
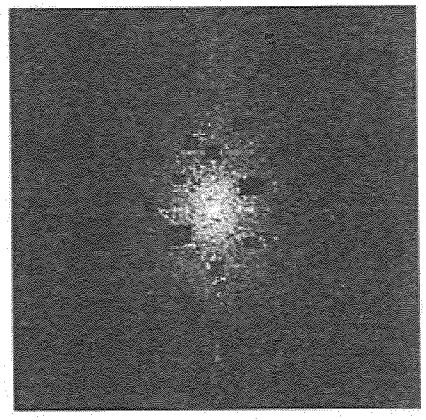

It is appreciated from the foregoing description and the β-radiograph images of the samples, as well as the photomicrographs discussed above, that the variable basis weight of the products of this invention exhibit a two-dimensional pattern in many cases. This aspect of the invention was confirmed using two-dimensional Fast Fourier Transform analysis of a β-radiograph image of a sheet prepared in accordance with the invention. FIG. 24A shows the starting β-radiograph image of a sheet prepared on a papermachine of the class illustrated in FIGS. 10B and 10D using a creping belt having the geometry shown in FIGS. 4 to 7. The image of FIG. 24A was transformed by 2D FFT to the frequency domain shown schematically in FIG. 24B, wherein a "mask" was generated to block out the high basis weight regions in the frequency domain. Reverse 2D FFT was performed on the masked frequency domain to generate the spatial (physical) domain of FIG. 24C, which is essentially the sheet of FIG. 24A, without the high basis weight regions, which were masked based on their periodicity.

Figure 24C:
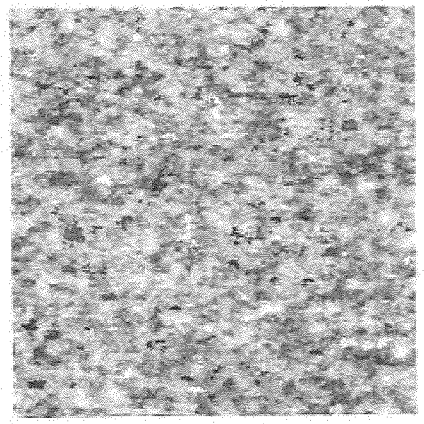
Figure 24D:
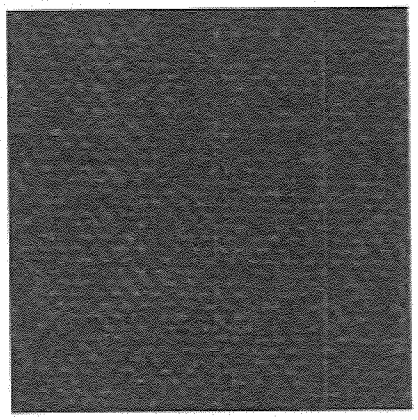
Figure 25A:
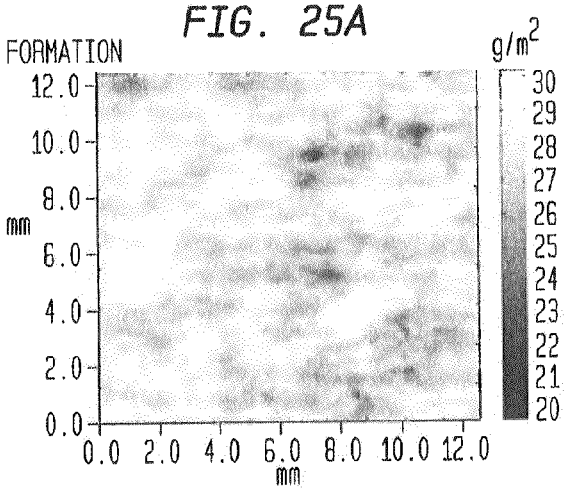
FIGS. 25A to 25D respectively illustrate the averaged formation (variation in basis weight); thickness (caliper); density profile and photomicrographic image of a sheet prepared with a WO13 woven creping fabric as described in U.S. patent application Ser. No. 11/804,246 (U.S. Patent Application Publication No. 2008/0029235), now U.S. Pat. No. 7,494,563.
Figure 25B:
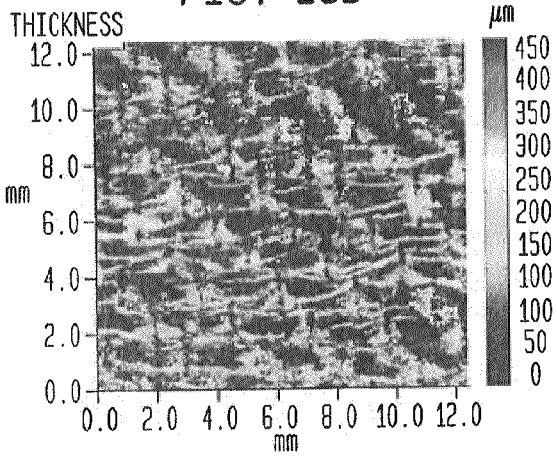
Figure 25C:
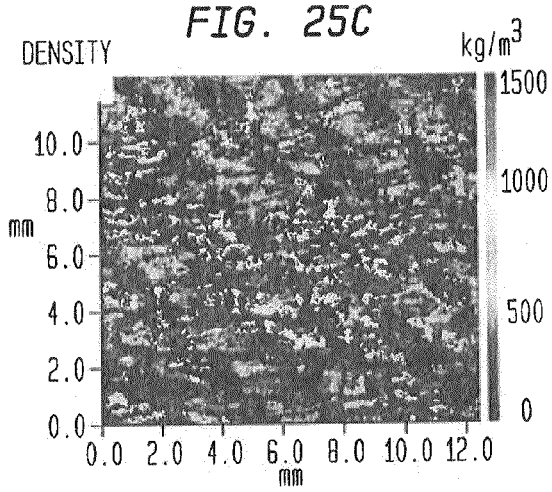
Figure 25D:
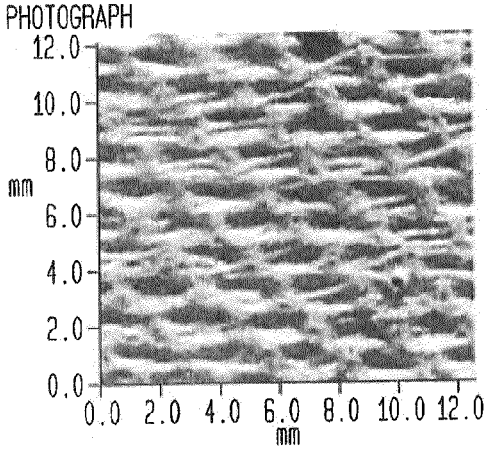

By subtracting the image content shown in FIG. 24C from that shown in FIG. 24A, one obtains that shown in FIG. 24D, which can be envisioned either as an image of the local basis weight of the sheet or as a negative image of belt 50, which was used to make the sheet, confirming that the high basis weight regions form in the perforations. FIG. 24D is presented as a positive in which heavier areas of the sheet are lighter, similarly, in FIG. 24A, the heavier areas are lighter.

Towel samples prepared using the techniques described herein were analyzed and compared to prior art and competitive samples using transmission radiography and thickness measurement with a non-contacting Twin Laser Profilometer. Apparent densities were calculated by fusing the maps acquired by these two methods. FIGS. 25 to 28 set forth the results comparing a prior art sample, WO13 (FIG. 25), two samples according to the present invention: 19680 and 19676 (FIGS. 26 and 27) and a competitor's two-ply sample (FIG. 28).

EXAMPLES 13 to 19

In order to quantify the results demonstrated by the photomicrographs and profiles presented supra, a set of more detailed examinations was conducted on several of the previously examined sheets, as set forth along with a prior art fabric creped sheet and a competitive TAD towel as described in Table 8.

TABLE 8

| Example # | Identification | Basis Weight (Ave.) g/m$^2$ | Caliper (Ave.) μ | FIGS. |
|---|---|---|---|---|
| 13 | W013 | 28.1 | 107.6 | 25 A-D |
| 14 | 19682-GP | 28.0 | 59.3 | — |
| 15 | 19680 | 28.8 | 71.2 | 26 A-F |
| 16 | 19683 | 28.1 | 49.1 | — |
| 18 | 19676 | 29.4 | — | 27 A-G |
| 19 | Bounty 2 ply | | | 28 A-G |

More specifically, to quantitatively demonstrate the microstructure of sheets prepared according to the present invention in comparison to the prior art fabric creped sheets, as well as to the commercially available TAD toweling, formation and thickness measurements were conducted on each on a detailed scale, so that density could be calculated for each location in the sheet on a scale commensurate with the scale of the structure being imposed on the sheets by the belt-creping process. These techniques are based on technology described in: (1) Sung Y-J, Ham C H, Kwon O, Lee H L, Keller D S, 2005, Applications of Thickness and Apparent Density Mapping by Laser Profilometry, Trans. 13$^{th}$ Fund. Res. Symp. Cambridge, Frecheville Court (UK), pp 961-1007; (2) Keller D S, Pawlak J J, 2001, β-Radiographic imaging of paper formation using storage phosphor screens J Pulp Pap Sci 27:117 to 123; and (3) Cresson T M, Tomimasu H, Luner P 1990 Characterization Of Paper Formation Part 1: Sensing Paper Formation. Tappi J 73:153 to 159.

Localized thickness measurements were conducted using a twin laser profilometer while formation measurements were conducted using transmission radiography with film, by contacting the top and the bottom surfaces. This provided higher spatial resolution as a function of the distance from the film. Using both the top and bottom formation maps, apparent densities were determined and compared. Fine structure of the caps and bases was observed, and differences between samples were noted. An MD asymmetry of the apparent density across the cap structures and in the base structure could be observed in some samples.

FIGS. 25A to 25D present, respectively, the initial images obtained for Formation, Thickness, and Calculated Density of a 12 mm square sample of toweling for a product prepared following the teachings of U.S. Pat. No. 7,494,563 (WO13). Calculated Density is shown with a density range from zero to 1500 kg/m$^3$. Blue regions indicate low density and red indicates high density regions. Deep blue regions indicate zero density, but in FIG. 25D, also represents regions where no thickness was measured. This can occur if either laser sensor of the twin laser profilometer does not detect the surface as in the samples, especially low grammage samples with pinholes where a discontinuity of the web exists. These are called "dead spots". Dead spots are not specifically identified in FIG. 25D.

Figure 26A:
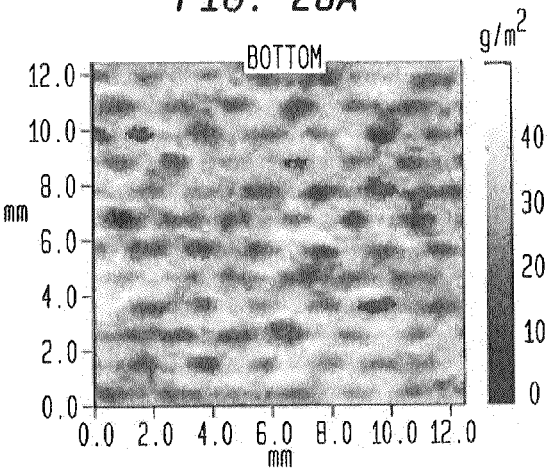
FIGS. 26A to 26F respectively illustrate radiographs taken with the bottom, then top of sheet in contact with the film, and the density profiles generated from each of these images; of a sheet prepared in accordance with the present invention.
Figure 26B:
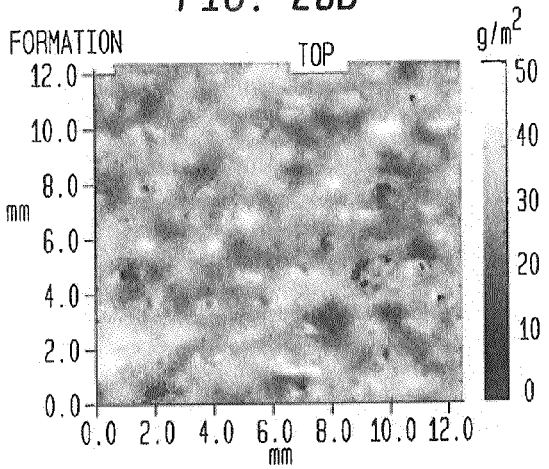
Figure 26C:
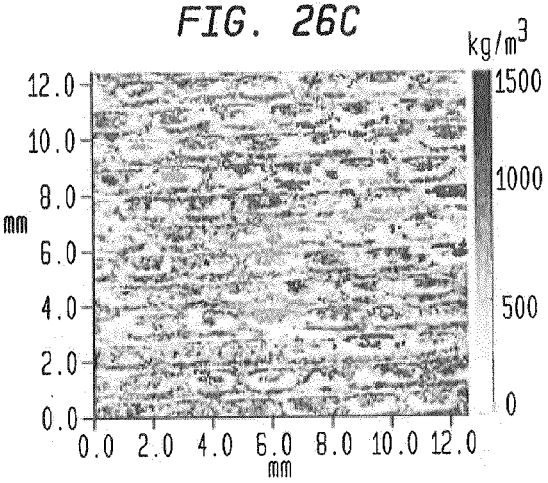
Figure 26D:
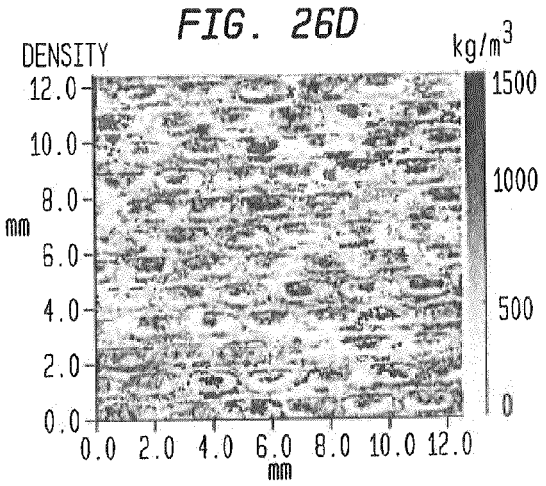
Figure 26E:
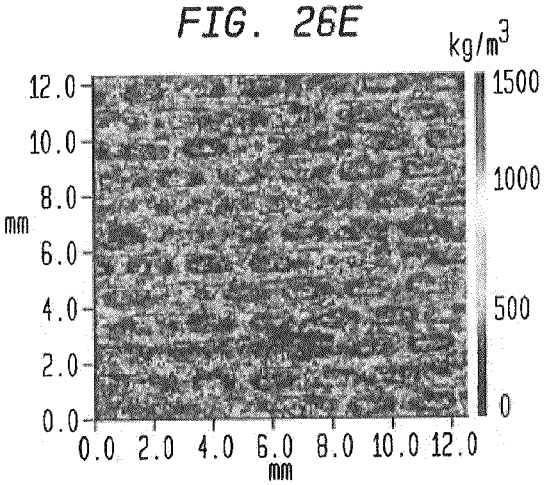
Figure 26F:
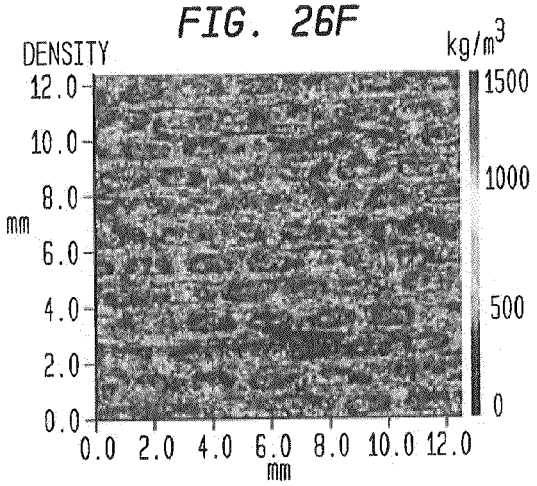

FIGS. 26A to 26F present similar data to that presented in FIGS. 25A to 25D for a sample of sheet prepared according to the present invention. However, these images were prepared using a slightly more detailed examination of the sample that was conducted using separate β-radiographs from the top and bottom exposures, to obtain higher resolution images of the apex of the caps (top FIG. 26A) and the base periphery of the caps (bottom FIG. 26B), rather than by using a merged composite formation map as in FIG. 25A. From these, more precise apparent density maps, FIGS. 26E to 26F were prepared with FIGS. 26C and 26D showing density increasing front white to deep blue and the dead spot regions indicated by yellow, while FIGS. 26E and 26F present the same data as a multicolor plot similar to that of FIG. 25D. Inspection of the radiographs of FIGS. 26A and 26B reveals distinct differences between the top and bottom contacted radiographs, with the bottom showing a grid pattern of high grammage base showing fibrous features and contact points with the cap region defocused and indicated as having a lower grammage in most cases, while the top show dark spots where pinholes exist, while indicating higher grammage in the cap region, as compared to the defocused base region.

By comparing the apparent density maps generated by the top and bottom radiographs, however, one can see that there are at most subtle, if detectable, differences between the two. Although the top and bottom radiographs show visible differences, once the images have been fused to the thickness maps, density differences are not readily evident between those density maps prepared using the top or bottom radiographs and those prepared using the composite.

The white/blue representation of FIGS. 26C and 26D, however, that includes the marked dead spot region in yellow, was very useful in identifying the valid data within the maps, particularly, in locating specific regions where pinholes exist, or where thickness mapping encounters a problem.

In the density maps of FIGS. 26E and 26F, it can be appreciated that portions of the domes, including the caps of the domes, are highly densified. In particular, the fiber-enriched hollow domed regions project from the upper side of the sheet and have both relatively high local basis weight and consolidated caps, the consolidated caps having the general shape of an apical portion of a spheroidal shell.

Figure 27A:
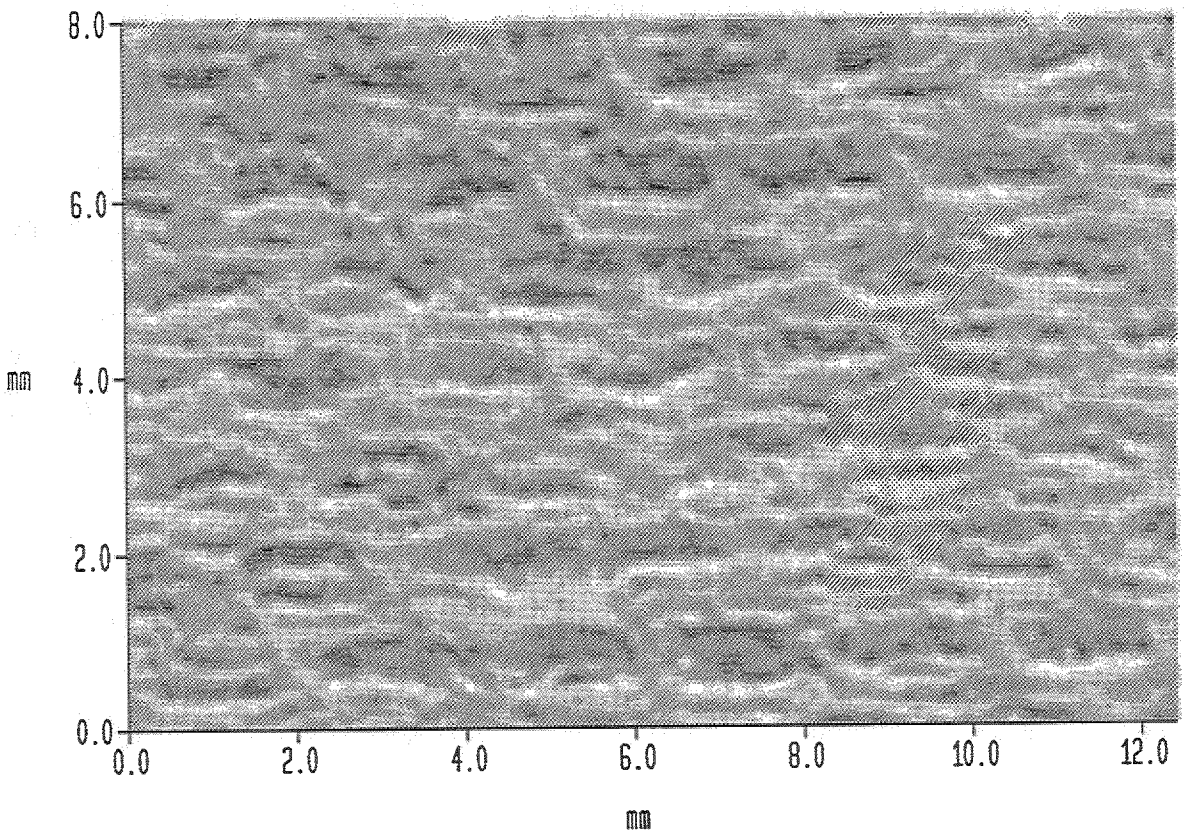
FIG. 27A is a photomicrographic image of a sheet of the present invention formed without the use of a vacuum subsequent to the belt creping step.
Figure 27B:
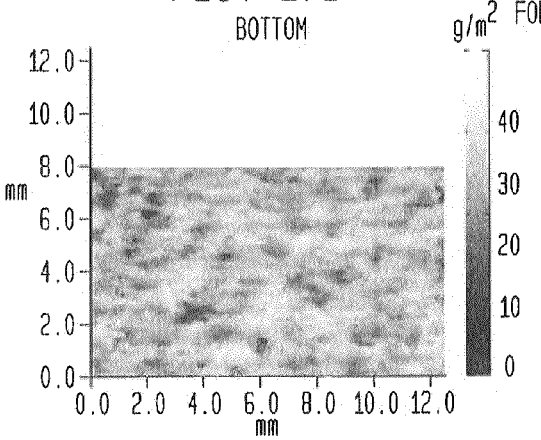
FIGS. 27B to 27G respectively illustrate radiographs taken with the bottom, then top of sheet in contact with the film, and the density profiles generated from each of these images of the sheet of FIG. 27A prepared in accordance with the present invention.
Figure 27C:
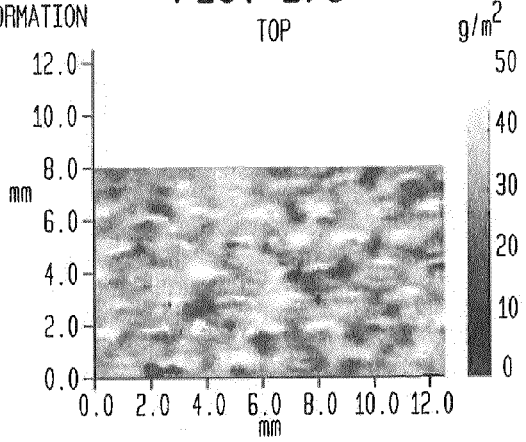
Figure 27D:
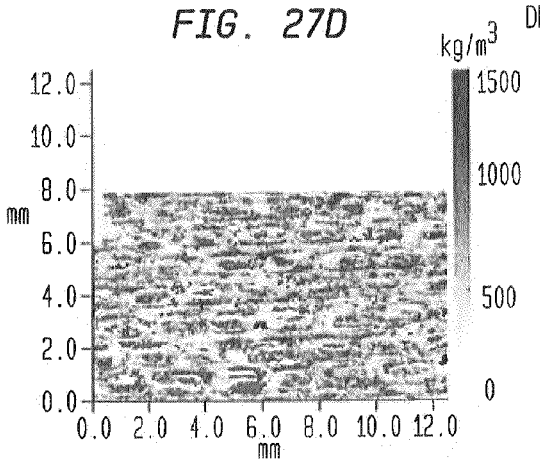
Figure 27E:
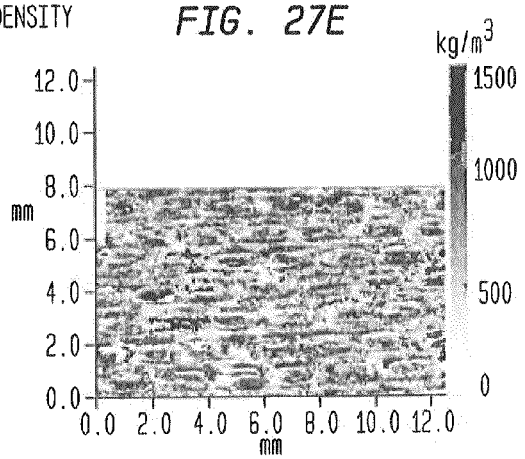
Figure 27F:
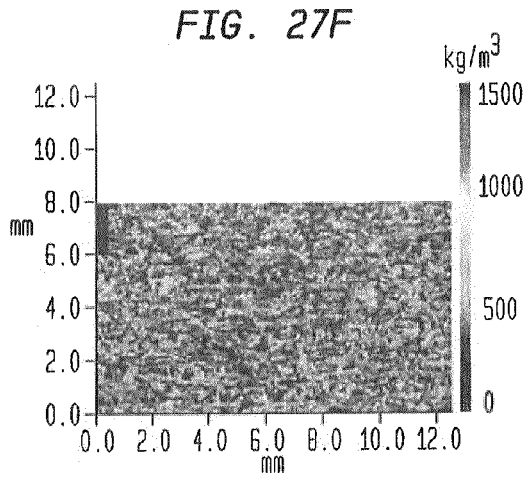
Figure 27G:
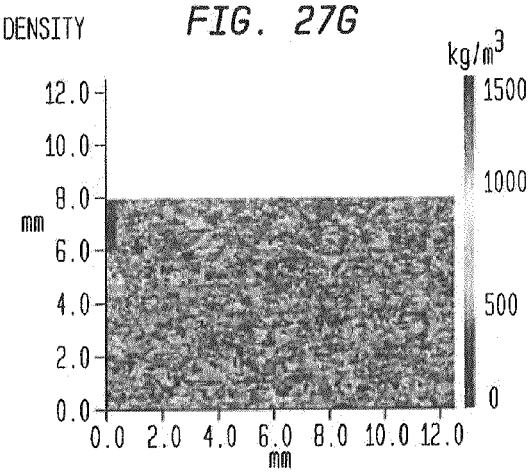
Figure 28A:
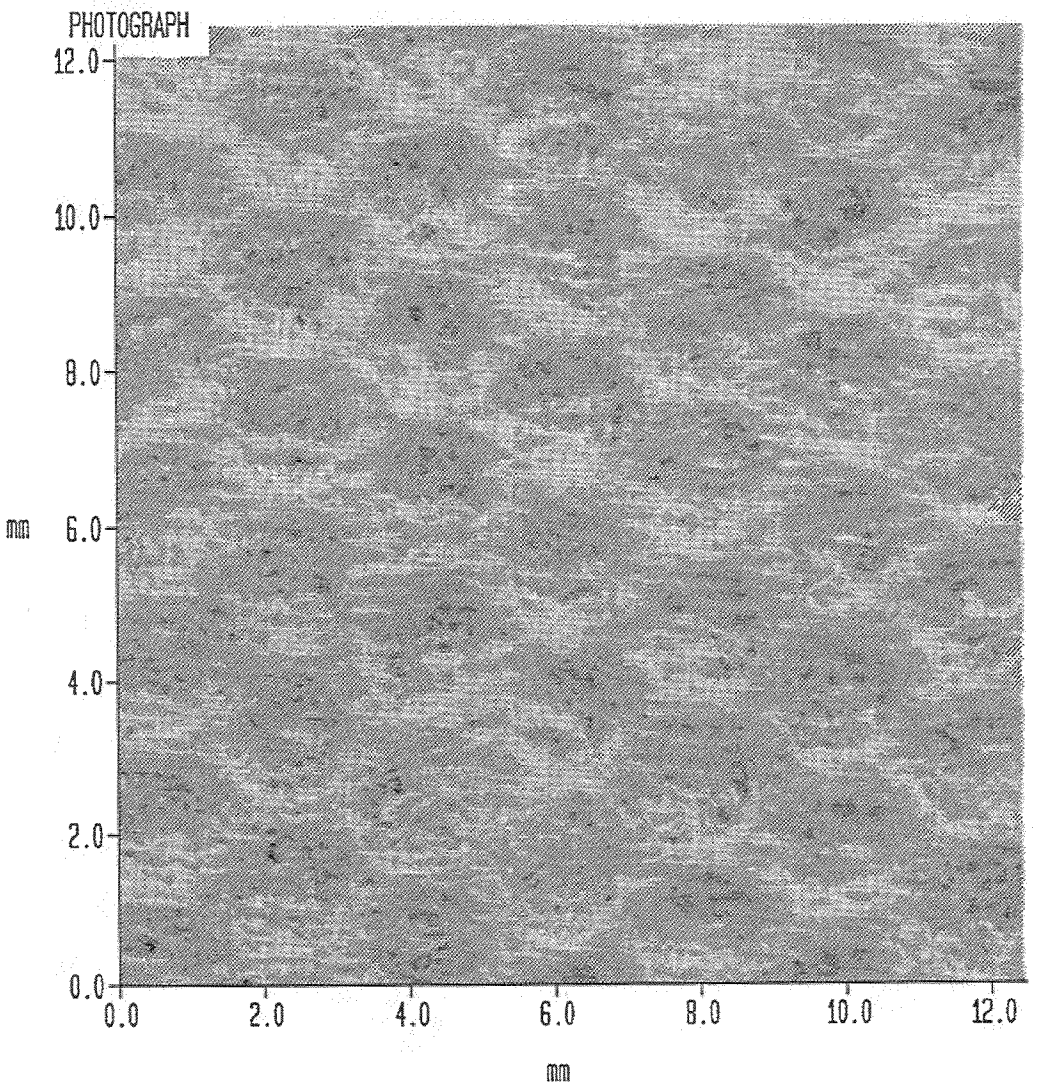
FIG. 28A is a photomicrographic image of one ply of a competitive towel believed to be formed by through drying [Bounty®]
Figure 28B:
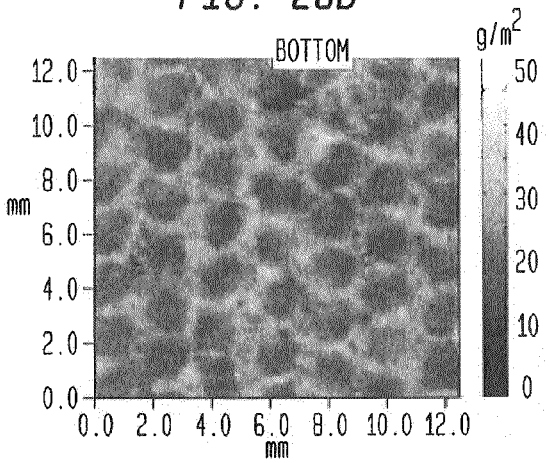
FIGS. 28B to 28G respectively illustrate those features of the sheet of FIG. 28A as are shown in FIGS. 26A to 26E of a sheet of the present invention.
Figure 28C:
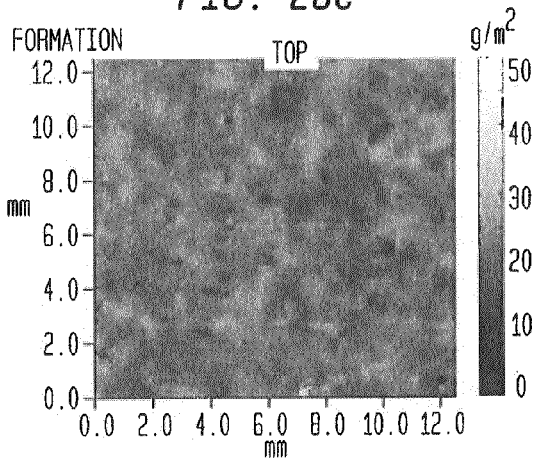
Figure 28D:
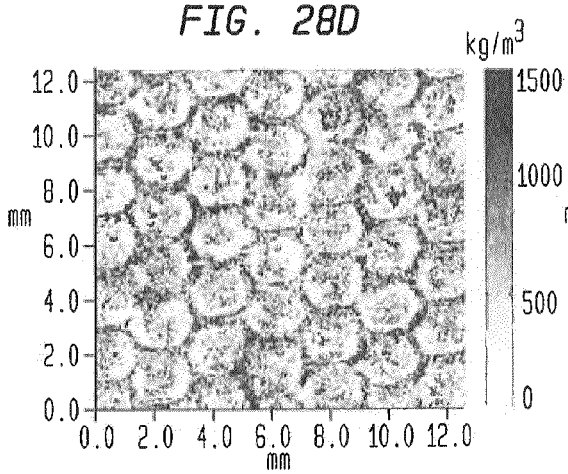
Figure 28E:
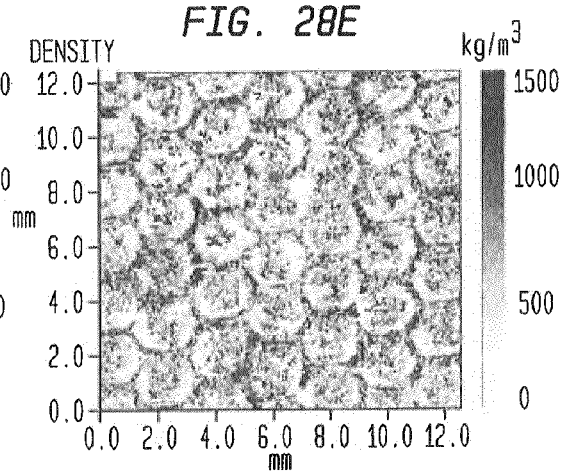
Figure 28F:
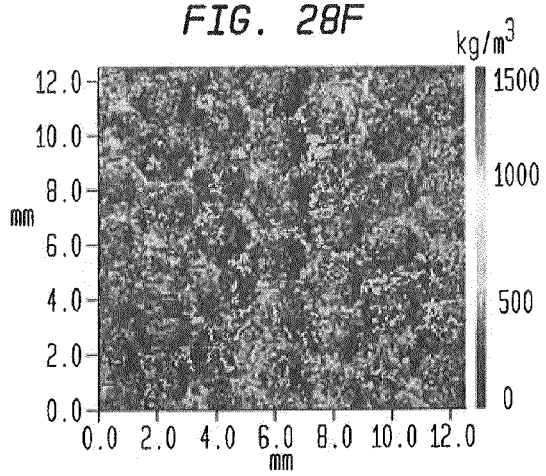
Figure 28G:
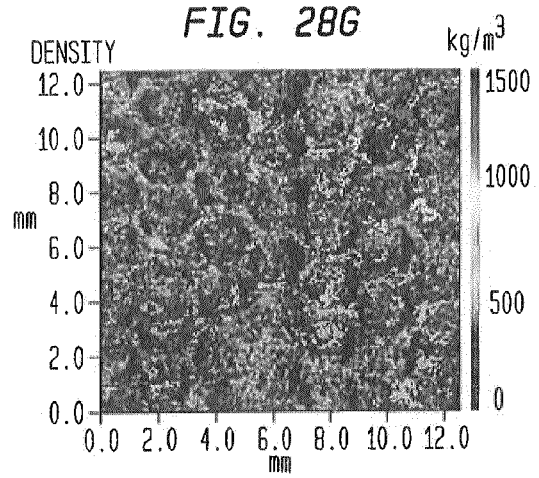

In FIG. 27A, a photomicrographic image is presented of a sheet of the present invention formed without use of a vacuum subsequent to the belt-creping step. Slubs are clearly present within the domes in FIG. 27A. In the density maps of FIGS.

27B to 27G, it can be appreciated that not only are portions of the domes highly densified, but also, that there are highly densified strips between the domes extending in the cross direction.

FIGS. 28A to 28G present similar data to that presented in the preceding FIGS. 25A to 27G, but for the back ply of a sample of a sheet of competitive toweling believed to be prepared using a TAD process. In the density maps of FIGS. 28D to 28G, it can be appreciated that the most densified regions of the sheet are exterior to the projection, rather than extending from the areas between the projection and extending upwardly into the sidewall thereof.

TABLE 9

Mean Values for Structural Maps

| Example # Sample ID | Dead spot % | Mean Grammage g/m$^2$ | Mean Thickness μm | Mean Density kg/m$^2$ | FIGS. |
|---|---|---|---|---|---|
| 13-WO13 | 7.5 | 28.1 | 107 | 260 | 25 A |
| 14-19682 | 11.4 | 28.0 | 59 | 470 | — |
| 15-19680 | 8.9 | 28.8 | 69 | 460 | 26 A-F |
| 16-19683 | 11.9 | 28.1 | 49 | 570 | — |
| 17-19676 | 3.4 | 29.4 | 58 | 500 | 27 A-G |
| 18: P-back | 13.9 | 22.9 | 55 | 410 | 28 A-G |

EXAMPLES 20 to 25

Figure 29A:
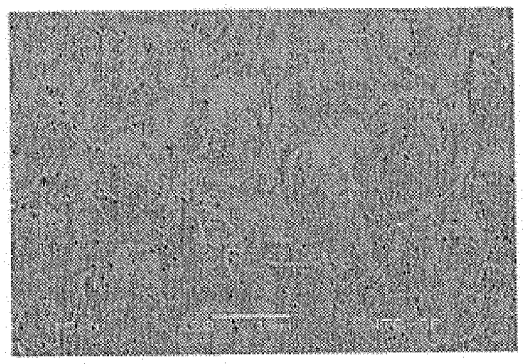
FIGS. 29A to 29F are SEM images illustrating surface features of a towel of the present invention which is very preferred for use in center-pull applications.
Figure 29B:
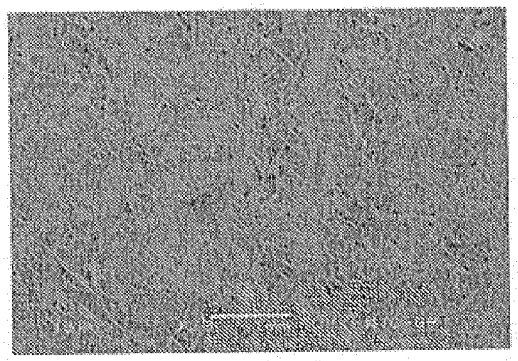
Figure 29C:
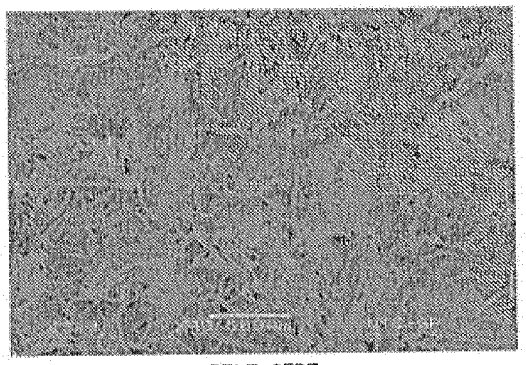
Figure 29D:
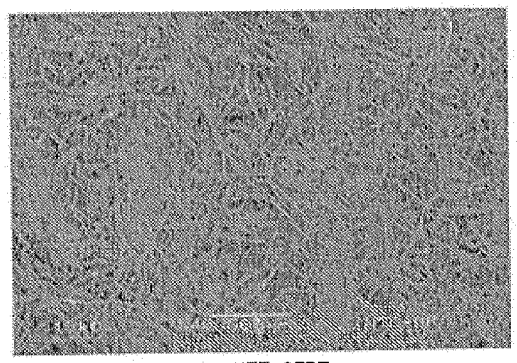
Figure 29E:
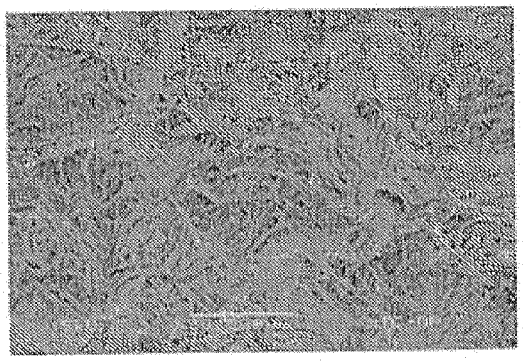
Figure 29F:
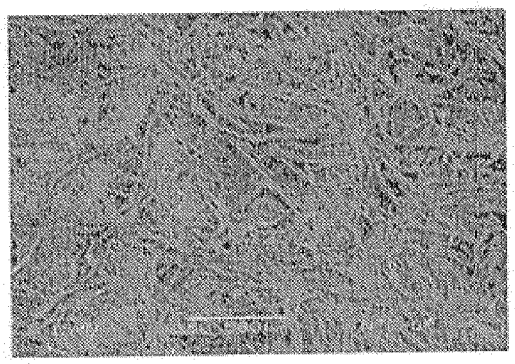
Figure 29G:
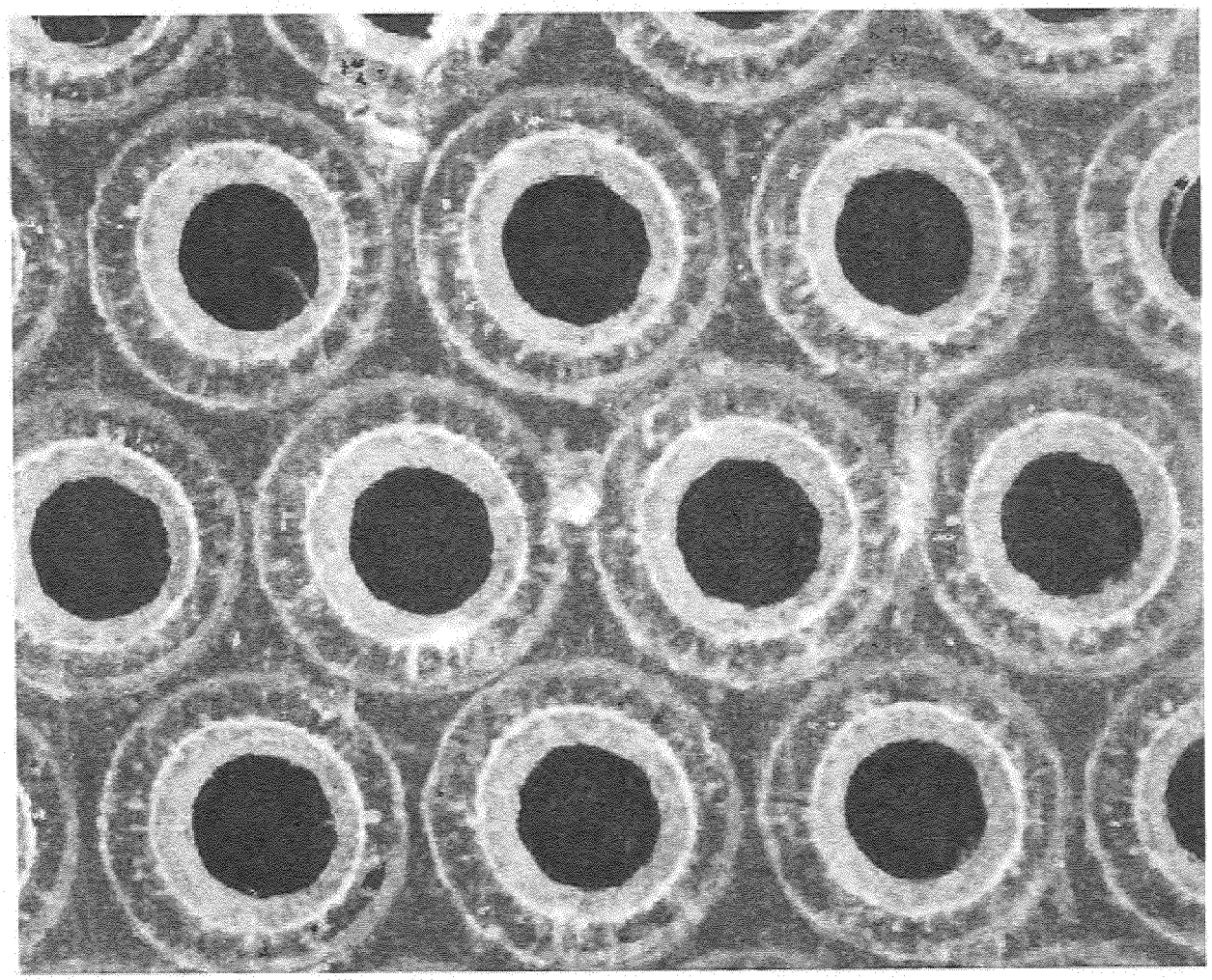
Figure 29H:
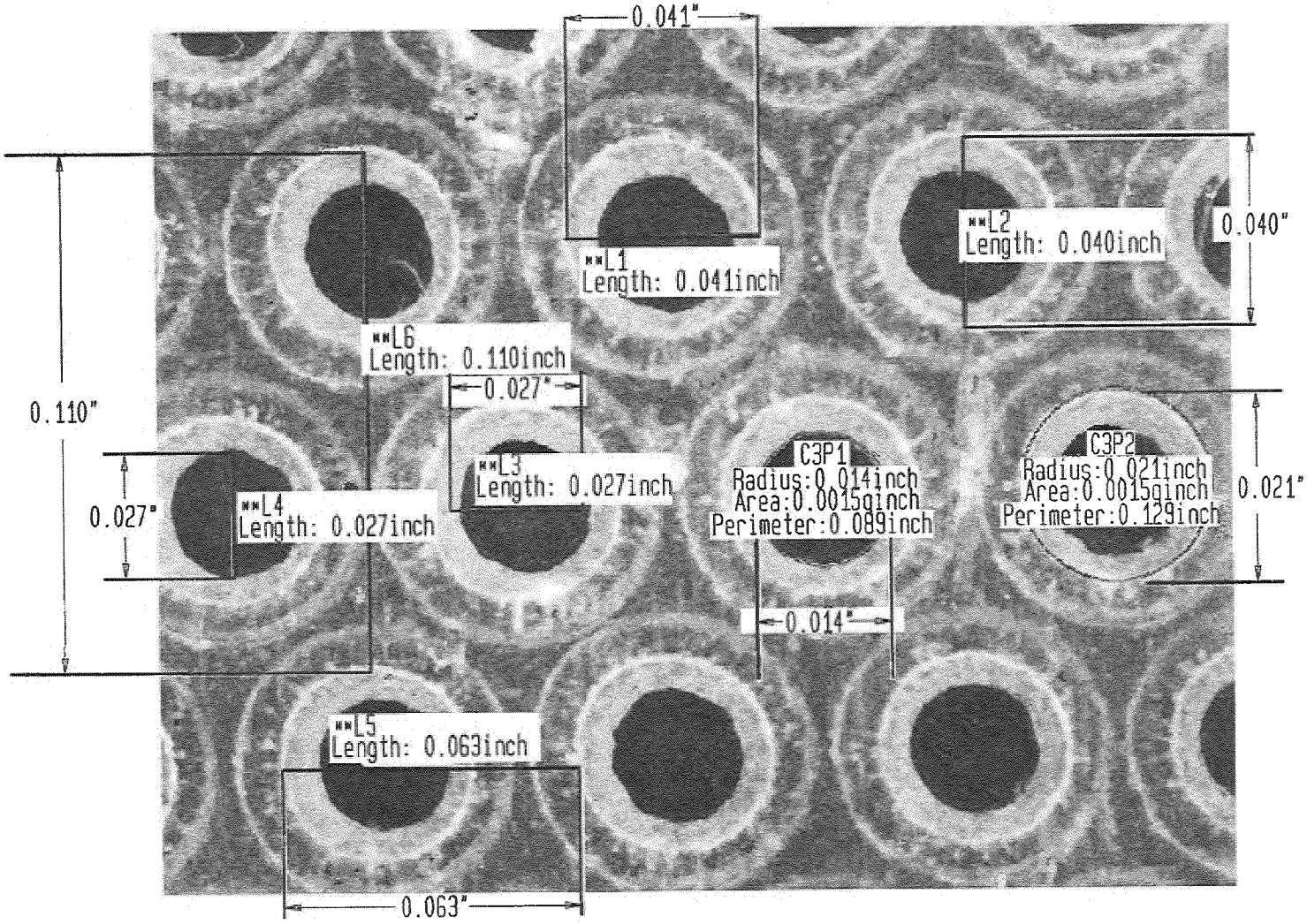
FIG. 29H is FIG. 29G dimensioned to show the sizes of the various features thereof.

Samples of toweling intended for a center-pull application were prepared from furnishes as described in Table 10, which also includes data for TAD towel currently used for that application, as well as the properties thereof along with comparable data for a control towel currently sold for that application produced by fabric creping technology, and an EPA "compliant" towel for the same applications having sufficient post consumer fiber content to meet or to exceed EPA Comprehensive Procurement Guidelines. The TAD towel is a product produced by a TAD technology that is also sold for that application. Of these, the toweling identified as 22624 is considered to be exceptionally suitable for the center-pull application as it exhibits exceptional hand panel softness (as measured by a trained sensory panel) combined with very rapid WAR, and high CD wet tensile. FIGS. 29A to 29F are scanning electromicrographs of the surfaces of the 22624 toweling, while FIGS. 29G and 29H illustrate the shape and dimensions of the belt used to prepare the toweling identified as 22624. Table 11 sets forth a more exhaustive report on the basesheets of towels prepared in connection with this trial, while Table 12 reports on friction properties of the selected toweling as compared to the prior art "control" and TAD towels currently sold for that application.

Figure 30A:
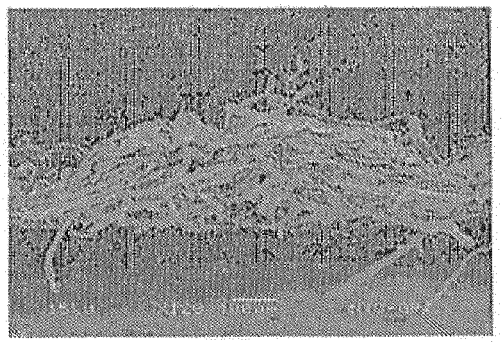
FIGS. 30A to 30D are sectional SEM images illustrating structural features of the towel of FIGS. 29A to 29F.
Figure 30B:
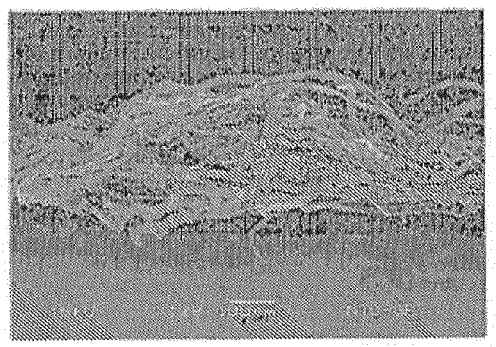
Figure 30C:
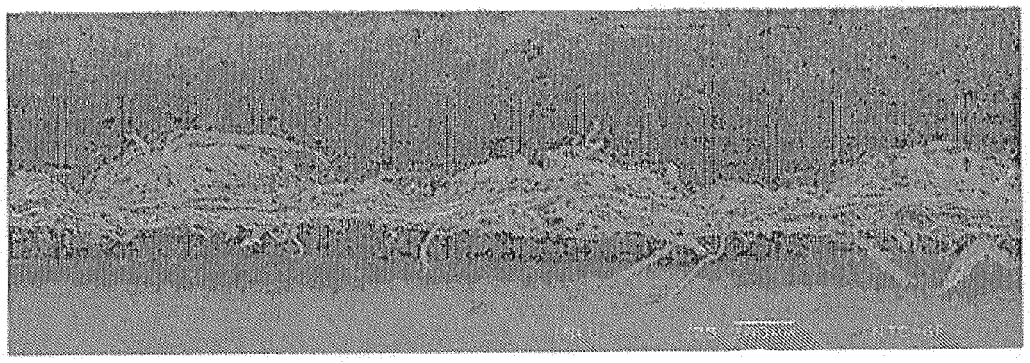
Figure 30D:
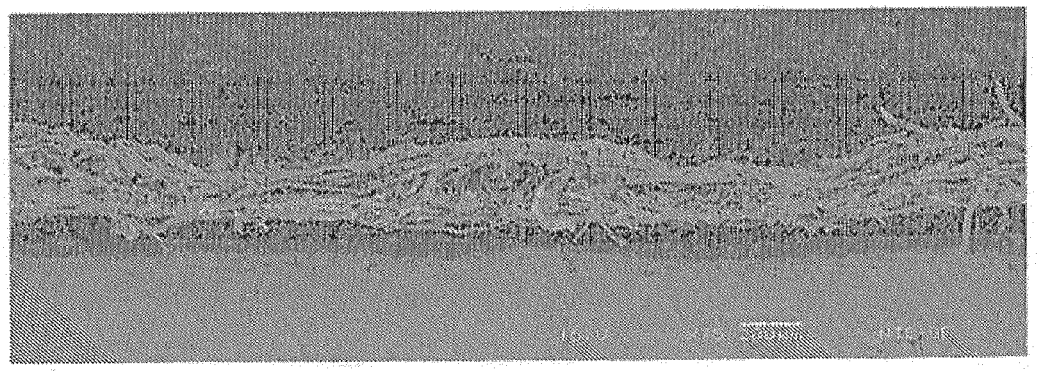
Figure 31A:
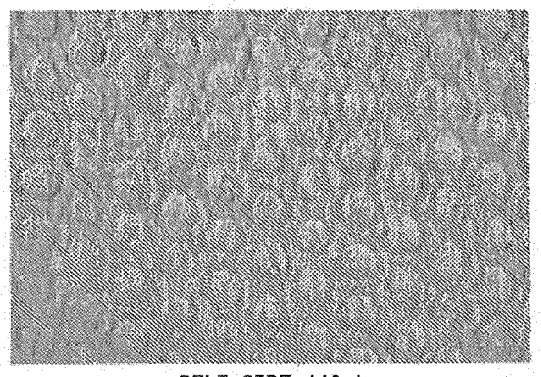
FIGS. 31A to 31F are optical micrographic images illustrating surface features of a towel of the present invention which is very preferred for use in center-pull applications.
Figure 31B:
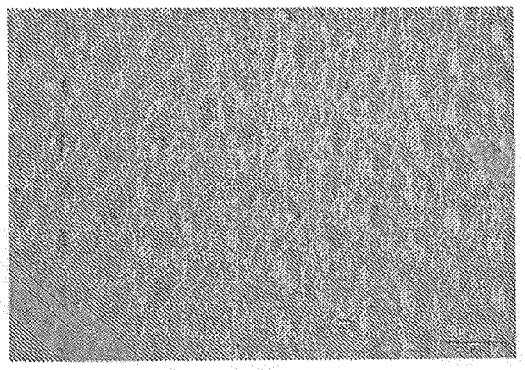
Figure 31C:
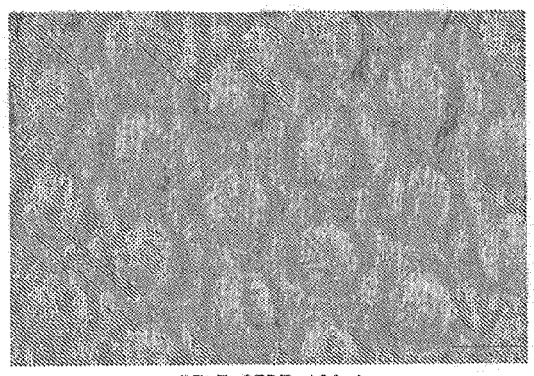
Figure 31D:
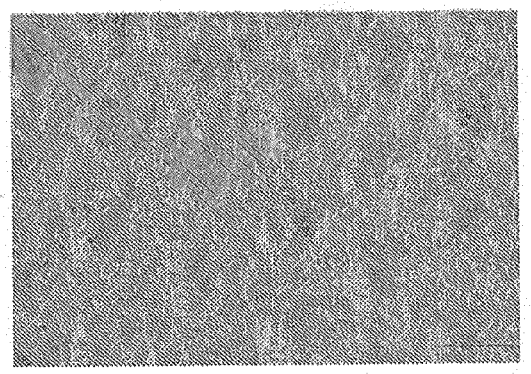
Figure 31E:
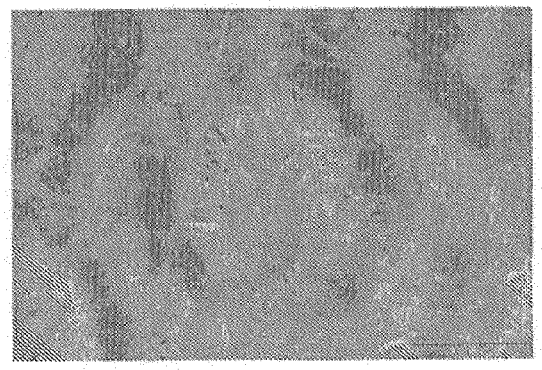
Figure 31F:
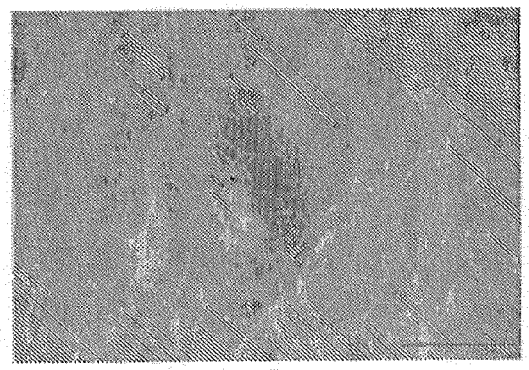
Figure 32:
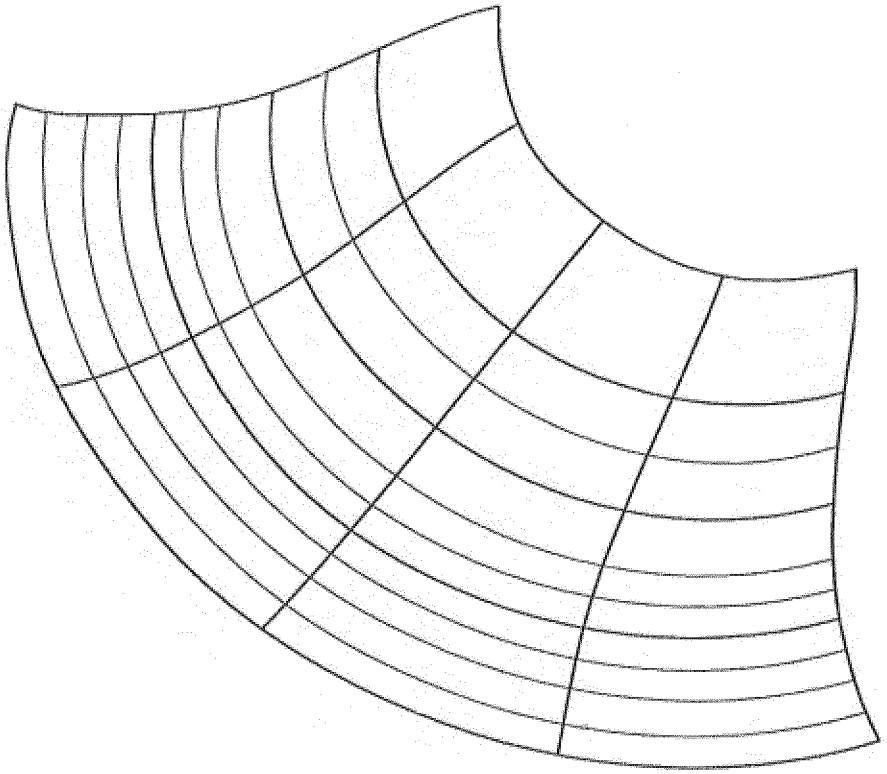
FIG. 32 schematically illustrates a saddle shaped consolidated region as is found in towels of the present invention.

FIGS. 30A to 30D are sectional SEM images illustrating structural features of the towel of FIGS. 29A to 29F, in which, in FIG. 30D, it can be appreciated that the cap of the dome is consolidated. The fiber-enriched hollow domed regions project from the upper side of the sheet and have both relatively high local basis weight and consolidated caps. We have observed an improvement in texture, generally relatable to smoothness and perceived softness when the consolidated caps have the general shape of an apical portion of a spheroidal shell.

Figure 38:
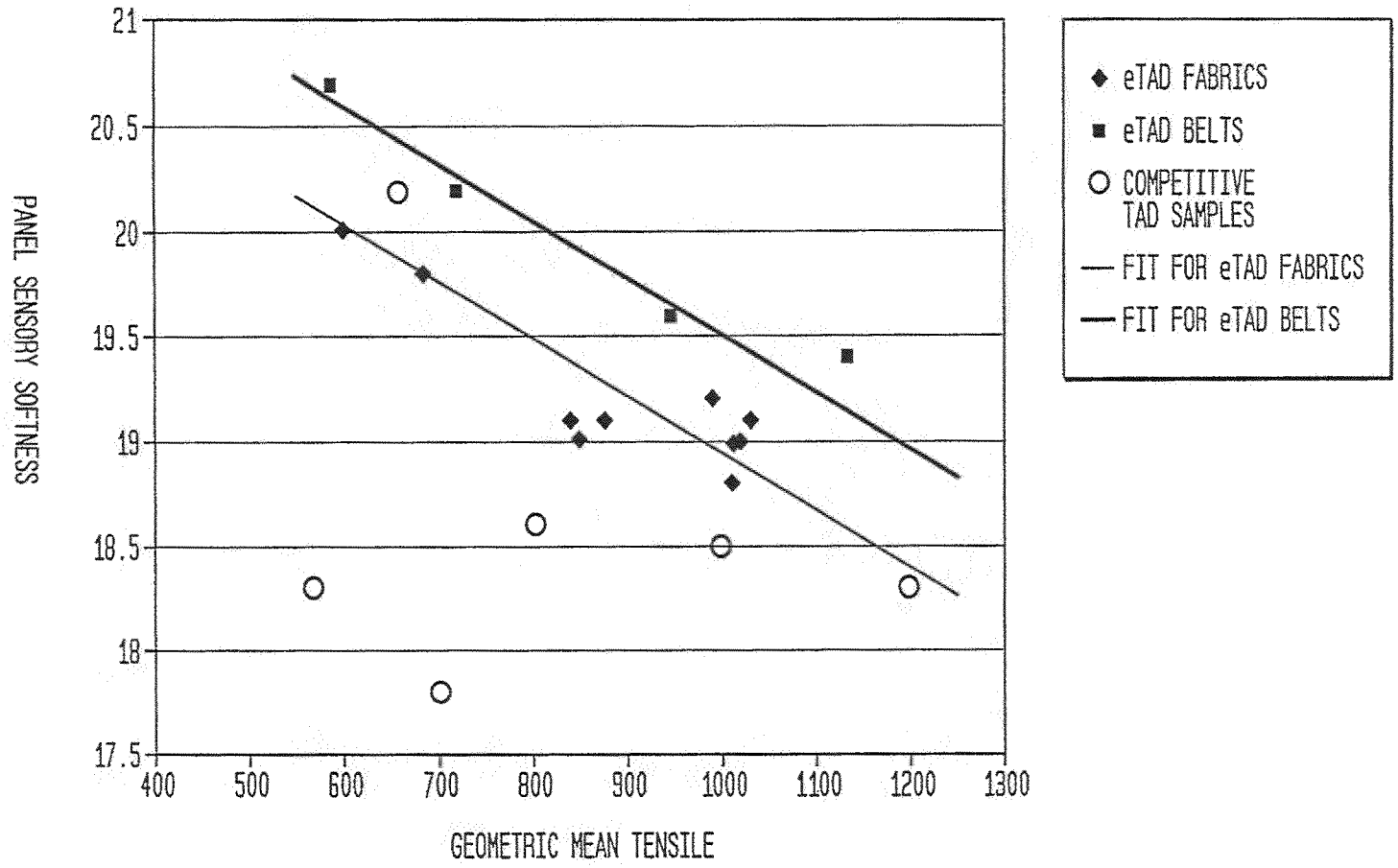
FIG. 38 illustrates the surprising softness and strength combinations of a towel made according to the present invention for a center-pull application, as compared to a prior art fabric creped towel and a TAD towel also made for that application.

FIGS. 31A to 31F are optical micrographic images illustrating surface features of the towel of the present invention of FIGS. 30A to 30D, which is very preferred for use in center-pull applications;

FIG. 38 presents the results of a panel softness study undertaken comparing 22624 and the other center pull towels of Table 12. In FIG. 38, a difference of 0.5 PSU (panel softness units) represents a difference that should be noticeable at about the 95% confidence level.

TABLE 10

| Identification | 22617 | 22618 | 22624 | Control | EPA | TAD |
|---|---|---|---|---|---|---|
| Boise Walulla | | | | 64% | | |
| Marathon Black Spruce | | | | | 45% | |
| Dryden Spruce | 60% | 60% | 60% | | | |
| Douglas Fir | | | | | | 100% |
| Quinnesec | | | | | 10% | |
| Recycled Fiber | 20% | 20% | 20% | 20% | | |
| Lighthons('. SFK (PCW) | | | | | 45% | |
| Fabric/Belt Design | 166 | 166 | 166 | AJI68 | AJ168 | Prolux 005 |
| % Fabric Crepe | 17.0% | 17.0% | 13.0% | 20.0% | 15.0% | |
| % Reel Crepe | 3.0% | 3.0% | 7.0% | | 3.0% | |
| Molding Box (in HG) | 0 | 0 | 24 | | | |
| Calender Load | 30 | 26 | 29 | | | |

Product Properties

| Parameter | Average | Average | Average | Average | Average | Average |
|---|---|---|---|---|---|---|
| Basis Weight (lbs/rm), (gsm) | 21.0, (34.2) | 21.1, (34.4) | 21.5, (35.0) | 21.0, (34.2) | 21.1, (34.4) | |
| Basis Weight (lbs/rm), (gsm) | 21.0, (34.2) | 21.1, (34.4) | 21.5, (35.0) | 21.0, (34.2) | 21.1, (34.4) | |
| Dry CD Tensile (g/3"), (g/mm) | 1,766, (23.2) | 1,913, (25.1) | 2,013, (26.4) | 1,833, (24.1) | 1,956, (25.7) | |
| Tensile Ratio | 1.6 | 1.5 | 1.4 | 1.7 | 1.5 | |
| Total Tensile (g/3"), (g/mm) | 4,661, (61.2) | 4,774, (62.7) | 4,807, (63.1) | 5,024, (65.9) | 4,796, (62.9) | |
| MD Stretch (%) | 26.0 | 24.7 | 26.6 | 22.1 | 22.5 | |
| Wet CD Tensile (Finch) (g/3"), (g/mm) | 430, (5.64) | 464, (6.09) | 486, (6.38) | 410, (5.38) | 465, (6.10) | |
| Perforation Tensile (g/3"), (g/mm) | | | | 377, (4.95) | 410, (5.38) | |

TABLE 10-continued

| | | | | | | |
|---|---|---|---|---|---|---|
| WAR (seconds) | 4.2 | 4.6 | 3.1 | 4.8 | 4.6 | |
| Wet CD Tensile (Finch) (g/3"), (g/mm) | 430, (5.64) | 464, (6.09) | 486, (6.38) | 410, (5.38) | 465, (6.10) | |
| Hand Panel Softness (PSU) | 5.57 | 5.04 | 5.37 | 4.19 | 4.16 | 4.91 |

Figure 33A:
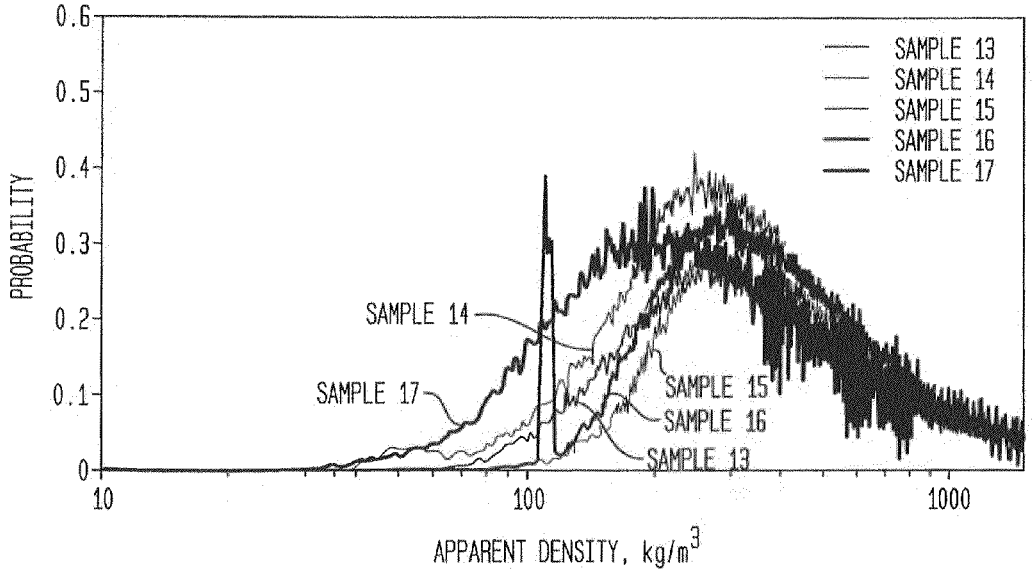
FIGS. 33A to 33D illustrate the distribution of thicknesses and densities found in the towels of FIGS. 25 to 28 and Examples 13-19.
Figure 33B:
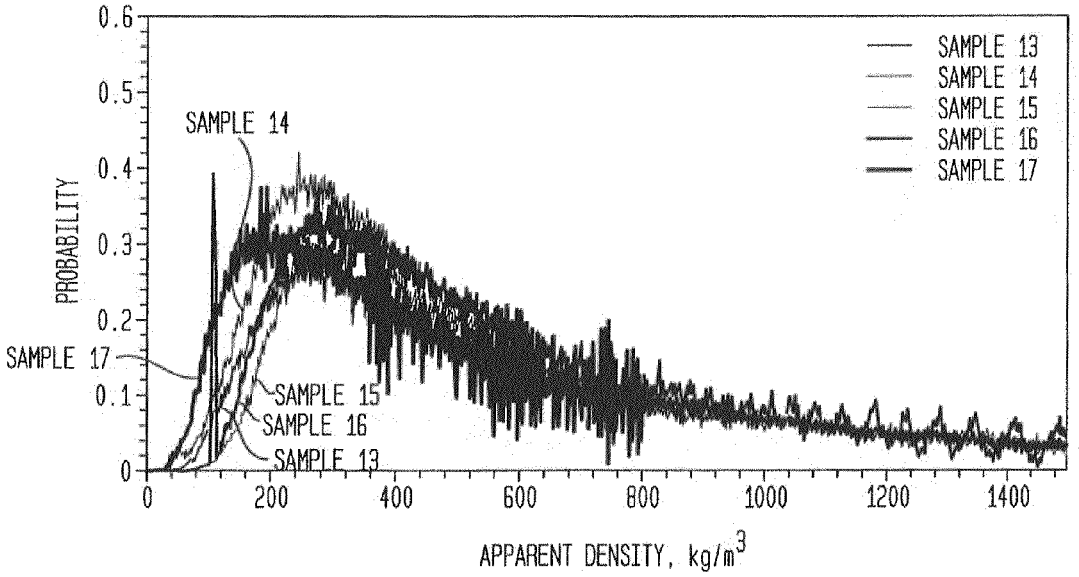
Figure 33C:
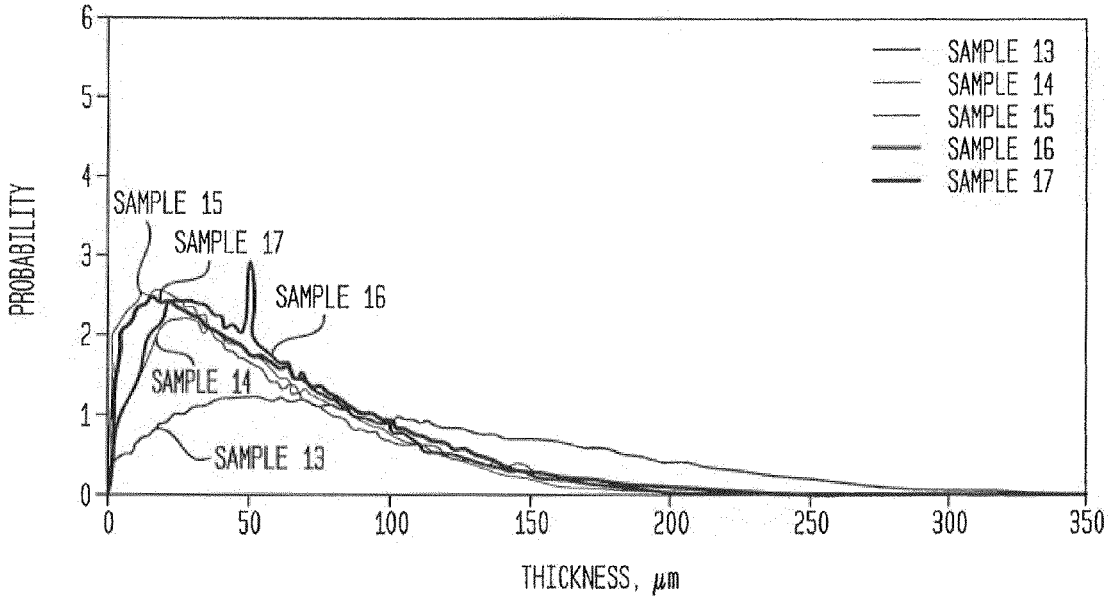
Figure 33D:
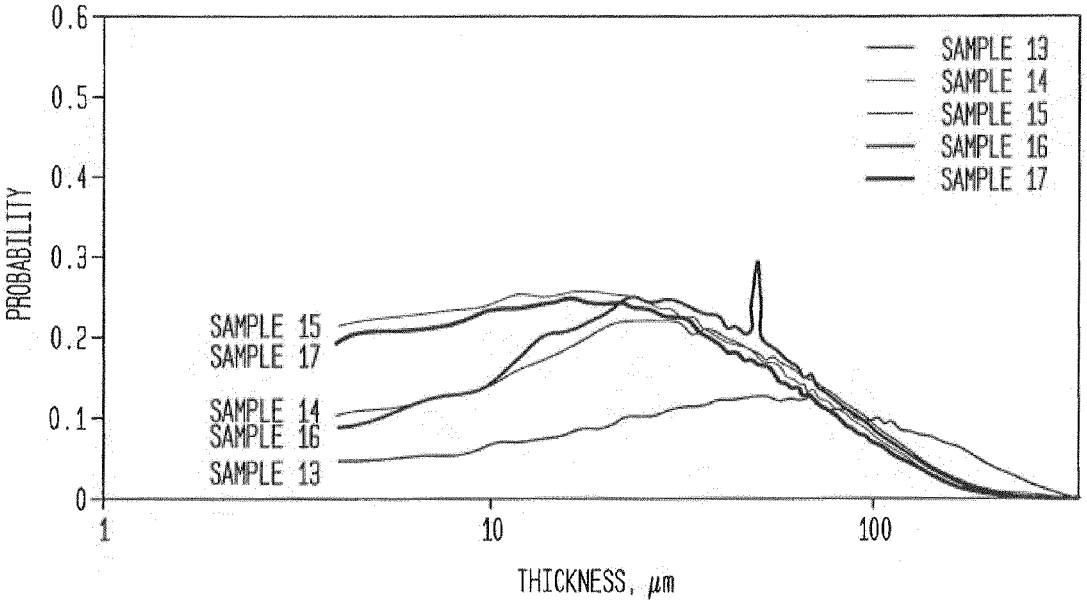

FIGS. 33A and 33B show graphs of the probability distribution (histogram) of density for the data sets for FIGS. 25 to 29, from which mean values in Table 9 were calculated. FIG. 33A is plotted on a logarithmic scale, while FIG. 33B is linear. FIGS. 33C and 33D show similar graphs of the probability distribution (histogram) of apparent thickness for the data sets from which mean density in Table 9 is calculated. FIGS. 33C and 33D also show the probability distributions for the commercial competitors sample 17: P-back.

TABLE 11

Belt Trials - Base Sheet Test Data

| Description | Basis Weight lb/3000 ft$^2$ (gsm) | Caliper 8 Sheet Mils/8 sht (mm/8 sheet) | Tensile MD g/3 in, (g/mm) | Stretch MD % | Tensile CD g/3 in (g/mm) | Stretch CD % | Wet Tens Finch Cured-CD g/3 in. (g/mm) | Tensile GM g/3 in. (g/mm) | Break Modulus GM g/% | Tensile Dry Ratio % | Tensile Total Dry g/3 in (g/mm) | Water Abs Rate 0.1 mL s | Break Modulus MD g/% | % FC | % RC | Molding Box in. Hg (kPa) | Calender PLI. (kN/m) |
|---|---|---|---|---|---|---|---|---|---|---|---|---|---|---|---|---|---|
| 22603 231 | 16.8 | 84.3 | 2,809 | 23.1 | 1,619 | 5.3 | 18 | 2,132 | 199 | 1.7 | 4,428 | | 122 | | | | |
| | (27.4) | (2.14) | (36.9) | | (21.2) | | (0.24) | (28.0) | | | (58.1) | | | | | | |
| 22604 241 | 21.2 | 88.5 | 3,980 | 27.2 | 1,708 | 7.6 | 121 | 2,607 | 196 | 2.3 | 5687 | | 149 | | | | |
| | (34.6) | (2.25) | (52.2) | | (22.4) | | (1.59) | (34.2) | | | (74.6) | | | | | | |
| 22605 254 | 20.1 | 78.5 | 1,815 | 26.3 | 1,142 | 8.5 | 197 | 1439 | 97 | 1.6 | 2,957 | | 69 | | | | |
| | (32.8) | (1.99) | (23.8) | | (15.0) | | (2.59) | (18.9) | | | (38.8) | | | | | | |
| 22606 850 | 20.3 | 74.0 | 1,557 | 24.2 | 1,108 | 8.2 | 240 | 1,313 | 95 | 1.4 | 2,665 | | 64 | | | | |
| | (33.1) | (1.88) | (20.4) | | (14.5) | | (3.15) | (17.2) | | | (35.0) | | | | | | |
| 22607 907 | 19.9 | 75.2 | 1,744 | 22.8 | 979 | 9.4 | 215 | 1,306 | 91 | 1.8 | 2,723 | | 77 | | | | |
| | (32.4) | (1.91) | (22.9) | | (12.8) | | (2.82) | (17.1) | | | (35.7) | | | | | | |
| 22608 924 | 20.4 | 72.9 | 1,992 | 23.4 | 1,026 | 8.6 | 240 | 1,428 | 102 | 2.0 | 3,018 | | 87 | | | | |
| | (33.3) | (1.85) | (26.1) | | (13.5) | | (3.15) | (18.7) | | | (39.6) | | | | | | |
| 22609 940 | 21.0 | 73.0 | 3,002 | 24.1 | 2,140 | 8.8 | 490 | 2,534 | 175 | 1.4 | 5,142 | | 125 | | | | |
| | (34.2) | (1.85) | (39.4) | | (28.1) | | (6.43) | (33.3) | | | (67.5) | | | | | | |
| 22610 957 | 21.3 | 74.8 | 3,076 | 23.7 | 2268 | 8.6 | 506 | 2,641 | 188 | 1.4 | 5,344 | 3.9 | 134 | 20 | 0.5 | 24 | 30 |
| | (34.7) | (1.90) | (40.4) | | (29.8) | | (6.64) | (34.7) | | | (70.1) | | | | | (81.3) | (5.34) |
| 22611 | 21.7 | 77.8 | 3,004 | 23.2 | 2,272 | 7.9 | 537 | 2,612 | 200 | 1.3 | 5,276 | 3.1 | 132 | | | | |
| 1015 | (35.4) | (1.98) | (39.4) | | (29.8) | | (7.05) | (34.3) | | | (69.2) | | | | | | |
| 22612 | 21.2 | 67.7 | 3,014 | 23.4 | 2,323 | 7.3 | 534 | 2,646 | 209 | 1.3 | 5,337 | 3.8 | 133 | | | 12 | |
| 1025 | (34.6) | (1.72) | (39.6) | | (30.5) | | (7.00) | (34.7) | | | (70.0) | | | | | (40.6) | |
| 22613 | 21.9 | 72.7 | 3,111 | 23.4 | 2,430 | 7.7 | 571 | 2,750 | 205 | 1.3 | 5,542 | 3.7 | 134 | | | | 27 |
| 1042 | (35.7) | (1.85) | (40.8) | | (31.9) | | (7.49) | (36.1) | | | (72.7) | | | | | | (4.81) |
| 22614 | 22.0 | 71.8 | 2,871 | 24.0 | 2,174 | 7.1 | 522 | 2,498 | 194 | 1.3 | 5,045 | 3.8 | 122 | | | | |
| 1055 | (35.9) | (1.82) | (37.7) | | (28.5) | | (6.85) | (32.8) | | | (66.2) | | | | | | |
| 22615 | 22.4 | 74.8 | 2,792 | 24.3 | 2,127 | 7.9 | 454 | 2,436 | 175 | 1.3 | 4,918 | 3.3 | 114 | | | | 25.5 |
| 1112 | (36.5) | (1.90) | (36.6) | | (27.9) | | (5.96) | (32.0) | | | (64.5) | | | | | | (4.54) |
| 22616 | 21.3 | 74.4 | 2,933 | 26.4 | 1,899 | 8.0 | 390 | 2,360 | 161 | 1.5 | 4,832 | 3.5 | 112 | | | | |
| 1130 | (34.7) | (1.89) | (38.5) | | (24.9) | | (5.12) | (31.0) | | | (63.4) | | | | | | |
| 22617 | 20.8 | 63.5 | 2,826 | 24.0 | 1,838 | 8.3 | 418 | 2,276 | 168 | 1..5 | 4,464 | 4.7 | 123 | 17 | 3.0 | 0 | 30 |
| 1208 | (33.9) | (1.61) | (37.1) | | (24.1) | | (5.49) | (29.9) | | | (58.6) | | | | | | (5.34) |

| Description | Basis Weight lb/3000 ft2, (gsm) | Caliper 8 Sheet Mils/8 sht, (mm/8 sheet) | Tensile MD g/3 in (kg/m) | Stretch MD % | Tensile CD g/3 in (g/mm) | Stretch CD % | Wet Tens Finch Cured-CD g/3 in. (g/mm) | Tensile GM g/3 in. (g/mm) | Break Modulus GM gs/% | Tensile Dry Ratio % | Tensile Total Dry g/3 in (g/mm) | Water Abs Rate 0.1 mL s | Break Modulus MD g/% | % FC | % RC | Molding Box | Calender |
|---|---|---|---|---|---|---|---|---|---|---|---|---|---|---|---|---|---|
| 22618 | 21.0 | 75.0 | 3,116 | 24.0 | 2,145 | 8.2 | 498 | 2,585 | 187 | 1.5 | 5,261 | 3.8 | 131 | | | | 26 |
| 1221 | (34.2) | (1.91) | (40.9) | | (28.1) | | (6.54) | (33.9) | | | (69.0) | | | | | | (4.63) |
| 22610 | 21.5 | 88.2 | 3,106 | 24.6 | 1,971 | 8.2 | 462 | 2,473 | 174 | 1.6 | 5,076 | 3.9 | 129 | | | 24 | |
| 1234 | (35.0) | (2.24) | (40.7) | | (25.9) | | (6.06) | (32.5) | | | (66.6) | | | | | (8.13) | |

TABLE 11-continued

Belt Trials - Base Sheet Test Data

| | | | | | | | | | | | | | | | | |
|---|---|---|---|---|---|---|---|---|---|---|---|---|---|---|---|---|
| 22620 | 20.8 | 76.3 | 2,764 | 24.1 | 2,000 | 8.0 | 476 | 2,351 | 171 | 1.4 | 4,764 | | 117 | | | 29 |
| 1246 | (33.9) | (1.94) | (36.3) | | (26.2) | | (6.25) | (30.9) | | | (62.5) | | | | | (5.16) |
| 22621 | 20.7 | 74.0 | 2,665 | 23.6 | 2,031 | 7.5 | 513 | 2,327 | 173 | 1.3 | 4,697 | | 115 | | | |
| 1259 | (33.7) | (1.88) | (35.0) | | (26.7) | | (6.73) | (30.5) | | | (61.6) | | | | | |
| 22622 110 | 21.8 | 76.5 | 3,321 | 26.1 | 2,373 | 8.0 | 530 | 2,807 | 195 | 1.4 | 5,694 | 2.9 | 128 | 13 | 7.0 | |
| | (35.5) | (1.94) | (43.6) | | (31.1) | | (6.96) | (36.8) | | | (74.7) | | | | | |
| 22623 122 | 20.9 | 81.6 | 2,852 | 25.2 | 2,056 | 7.6 | 503 | 2,421 | 174 | 1.4 | 4,908 | 3.5 | 112 | | | |
| | (34.1) | (2.07) | (37.4) | | (27.0) | | (6.60) | (31.8) | | | (64.4) | | | | | |
| 22624 135 | 21.5 | 78.4 | 2,878 | 25.0 | 2,150 | 8.4 | 504 | 2487 | 174 | 1.3 | 5,028 | 3.4 | 116 | | | |
| | (35.0) | (1.99) | (37.8) | | (28.2) | | (6.61) | (32.6) | | | (65.9) | | | | | |
| 22625 147 | 21.0 | 74.7 | 3,296 | 26.1 | 2,482 | 8.6 | 535 | 2,860 | 191 | 1.3 | 5,777 | 4.2 | 126 | | | |
| | (34.2) | (1.90) | (43.3) | | (32.6) | | (7.02) | (37.5) | | | (75.8) | | | | | |
| 22626 200 | 20.4 | 75.8 | 2,724 | 27.4 | 2,268 | 8.5 | 557 | 2,483 | 162 | 1.2 | 4,992 | 4.3 | 100 | 25 | 0.5 | |
| | (33.3) | (1.93) | (35.7) | | (29.8) | | (7.31) | (32.6) | | | (65.5) | | | | | |
| 22627 212 | 20.6 | 75.5 | 2,955 | 28.5 | 2,069 | 9.1 | 571 | 2,473 | 158 | 1.4 | 5,024 | 5.0 | 107 | | | |
| | (33.6) | (1.92) | (38.8) | | (27.2) | | (7.49) | (32.5) | | | (65.9) | | | | | |
| 22628 226 | 20.4 | 73.5 | 2,959 | 28.7 | 2,154 | 9.1 | 518 | 2,524 | 160 | 1.4 | 5,113 | 4.8 | 104 | | | |
| | (33.3) | (1.87) | (38.8) | | (28.3) | | (6.80) | (33.1) | | | (67.1) | | | | | |
| 22629 240 | 20.5 | 61.1 | 2,756 | 26.6 | 2,123 | 8.2 | 459 | 2,418 | 166 | 1.3 | 4,879 | 5.3 | 105 | | | |
| | (33.4) | (1.55) | (36.2) | | (27.9) | | (6.02) | (31.7) | | | (64.0) | | | | | |
| 22360 254 | 20.8 | 63.9 | 2,550 | 31.7 | 1,879 | 9.4 | 413 | 2,189 | 127 | 1.4 | 4,429 | 4.5 | 82 | 30 | 0.50 | |
| | (33.9) | (1.62) | (33.5) | | (24.7) | | (5.42) | (28.7) | | | (58.1) | | | | | |
| 22631 308 | 20.3 | 77.6 | 2,560 | 33.4 | 1,756 | 9.7 | 399 | 2,119 | 121 | 1.5 | 4,316 | 3.9 | 79 | | 24 | |
| | (33.1) | (1.97) | (33.6) | | (23.0) | | (5.24) | (27.8) | | | (56.6) | | | | | |
| Targets | 21.0 | 78.0 | 2,750 | 23.0 | 1,900 | | 450 | 2,286 | | 1.4 | 4,650 | 5 | | | | |
| | (34.2) | (1.98) | (36.1) | | (24.9) | | (5.91) | (30.0) | | | (61.0) | | | | | |

TABLE 12

| Friction Data | | | | | | | | | |
|---|---|---|---|---|---|---|---|---|---|
| Description | TMI Fric MD Top-S1 g | TMI Fric MD Top-S2 g | TMI Fric CD Top-S1 g | TMI Fric CD Top-S2 G | TMI Fric MD Bot-S1 g | TMI Fric MD Bot-S2 g | TMI Fric CD Bot-S1 g | TMI Fric CD Bot-S2 g | TMI Fric GMMMD 8 Scan-SD G |
| TAD | 1.133 | 1.106 | 0.640 | 0.631 | 0.842 | 1.164 | 0.500 | 0.491 | 0.773 |
| Control | 0.995 | 1.677 | 0.785 | 0.536 | 0.925 | 1.156 | 0.484 | 0.659 | 0.843 |
| 22624 | 0.404 | 0.599 | 0.382 | 0.438 | 1.102 | 1.032 | 0.541 | 0.677 | 0.628 |

EXAMPLES 26 to 39

Figure 34A:
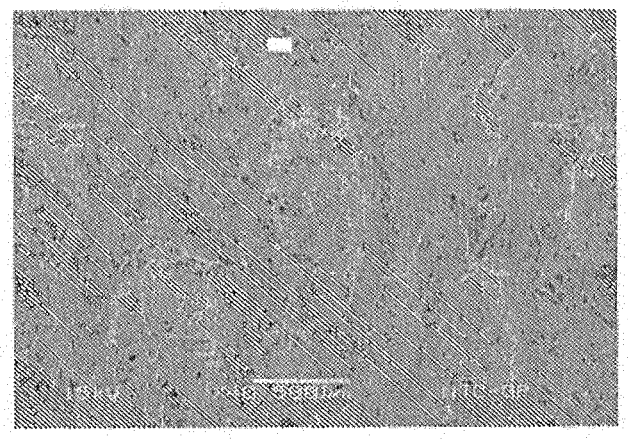
FIGS. 34A to 34C are SEM's illustrating the surface features of a tissue basesheet of the present invention.
Figure 34B:
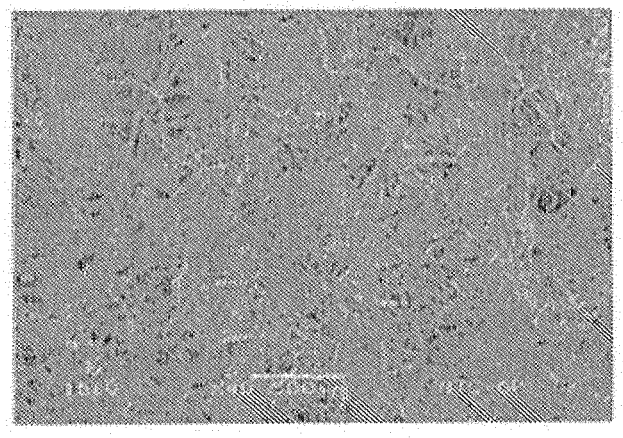
Figure 34C:
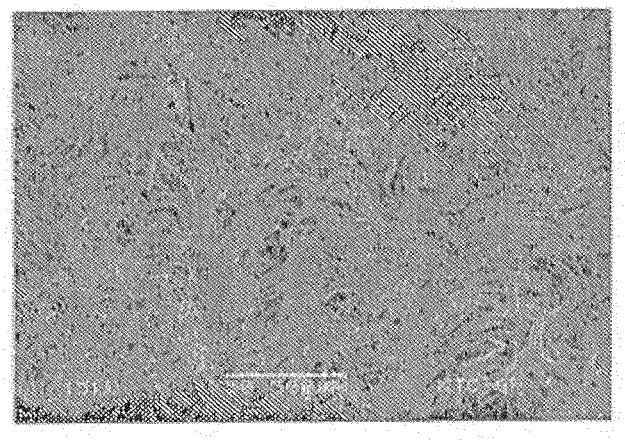
Figure 35:
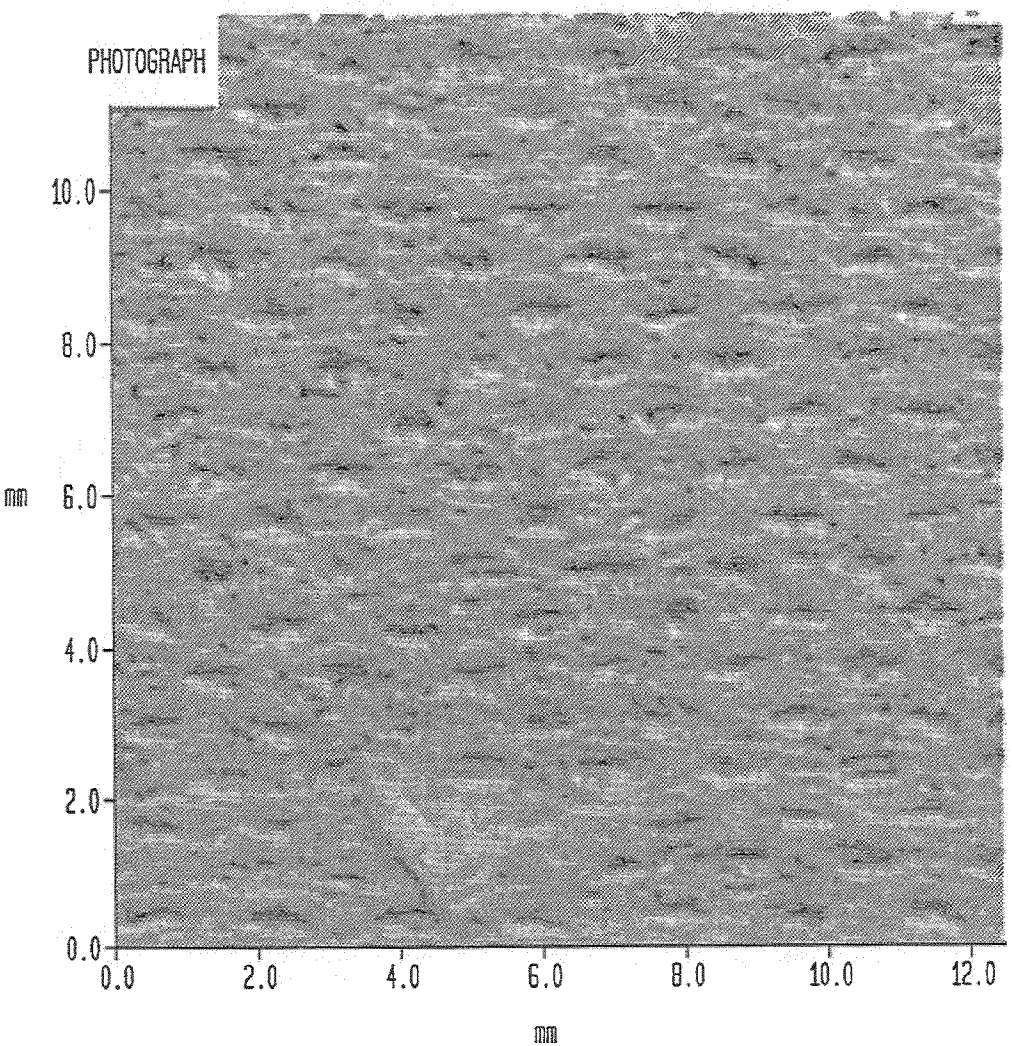
FIG. 35 illustrates a photomicrographic image of a low basis weight sheet prepared in accordance with the present invention.
Figure 36A:
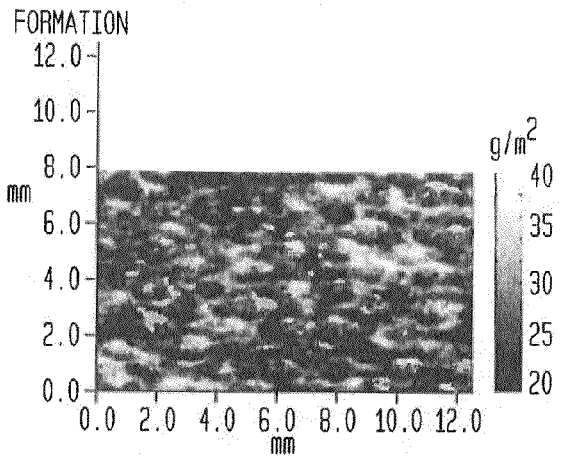
FIGS. 36A to 36D respectively illustrate the averaged formation (variation in basis weight); thickness (caliper); density profile and photomicrographic image of a sheet prepared in accordance with the present invention.
Figure 36B:
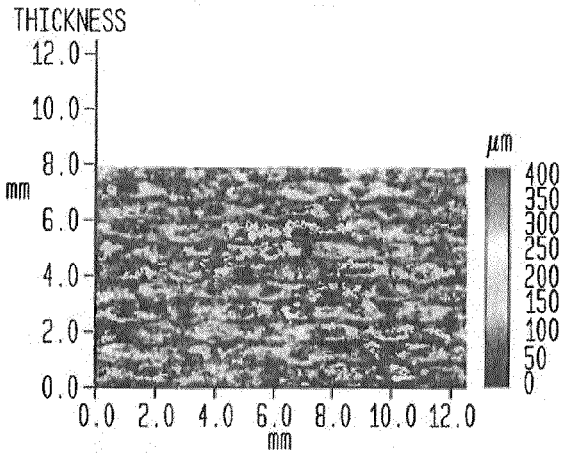
Figure 36C:
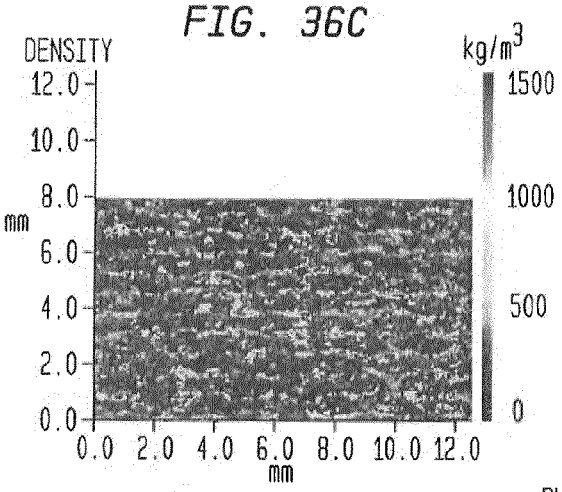
Figure 36D:
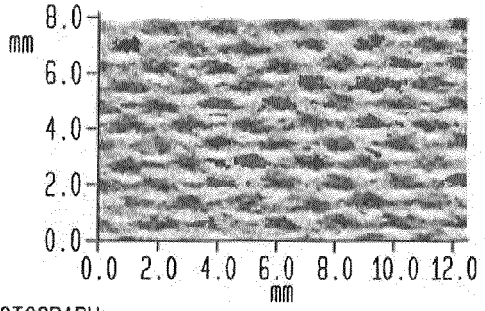
Figure 36E:
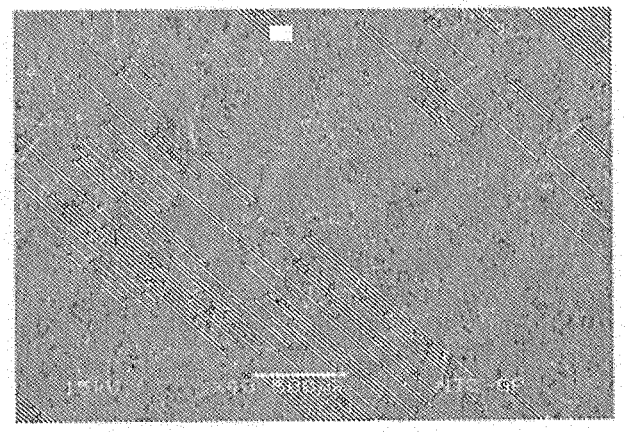
FIGS. 36E to 36G are SEM's illustrating the surface features of a towel of the present invention.
Figure 36F:
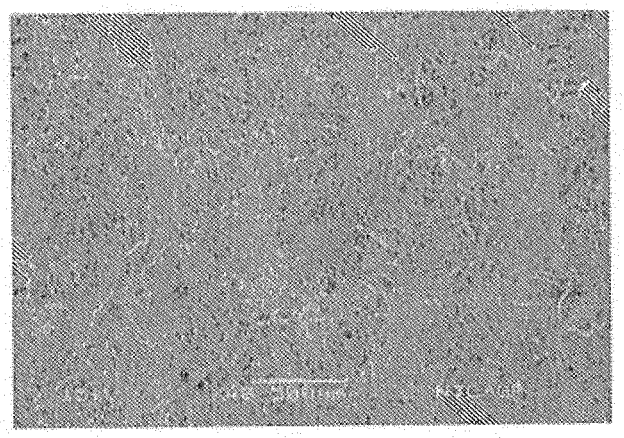
Figure 36G:
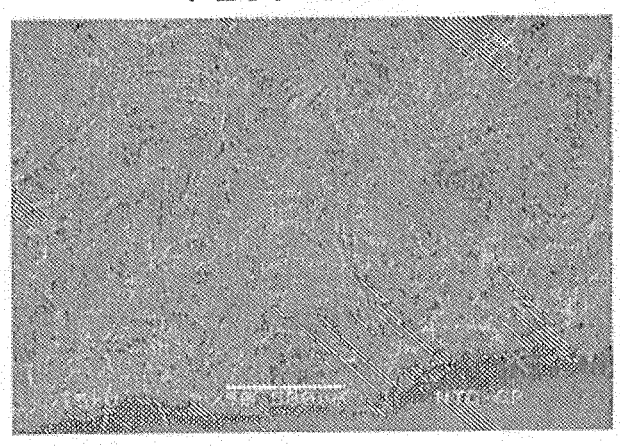
Figure 37A:
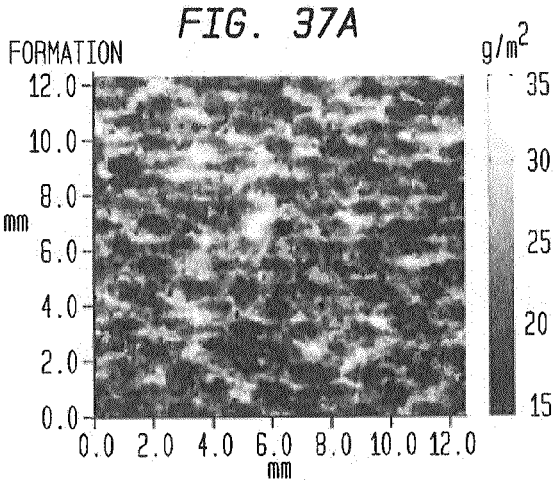
FIGS. 37A to 37D respectively illustrate the averaged formation (variation in basis weight); thickness (caliper); density profile and photomicrographic image of a high density sheet prepared in accordance with the present invention.
Figure 37B:
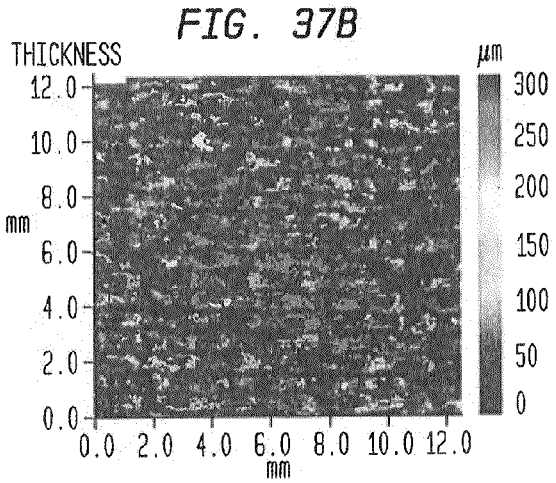
Figure 37C:
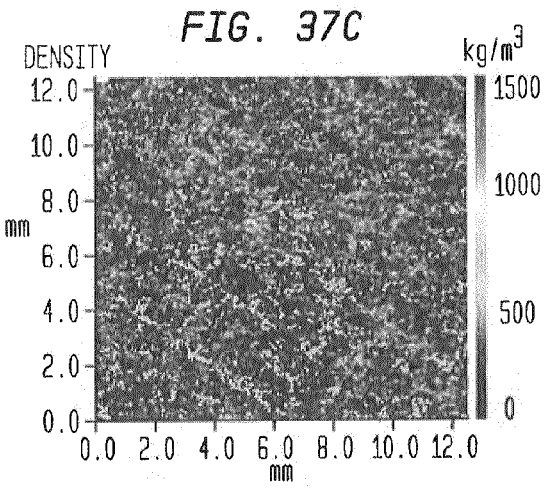
Figure 37D:
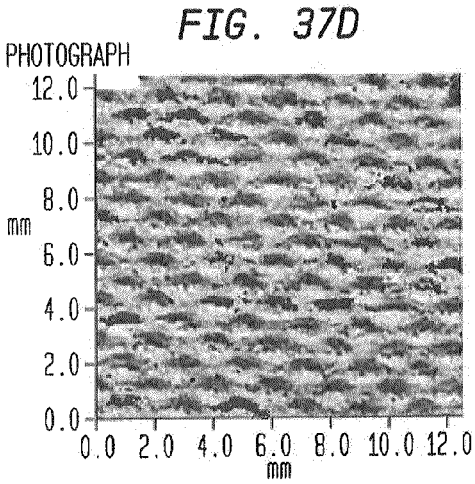

A set of samples of sheets of the invention intended for bath and/or facial tissue applications (see Table 12A) was also prepared, then analyzed as for Examples 13-18. The results of these analyses are as set forth in FIGS. 34A to 37D. Table 13 sets forth the physical properties of these tissue products. FIG. 35 is a photomicrographic image of a sheet of tissue according to sample 20513. FIGS. 34A to 34C present scanning electron micrographs of the surfaces of the sheet of Example 26, while FIGS. 36E to 36G present scanning electron micrographs of the sheet of Example 28. It should be noted that in both FIGS. 34A to 34C and FIGS. 36E to 36G, in many cases, caps of the domes are consolidated, surprisingly yielding a remarkably soft, smooth sheet. It appears that this construction is especially desirable for bath and facial tissue products, particularly, when the consolidated caps have the general shape of an apical portion of a spheroidal shell.

FIGS. 37A to 37D present the formation and density maps of sample 20568 along with a photomicrographic image of the surface thereof.

TABLE 12A

| Example # | Identification | Basis Weight (Ave.) g/m$^2$ | Caliper (Ave.) μ | FIGS. |
|---|---|---|---|---|
| 26 | 20509 | 21.7 | 113.2 | 34A-34C |
| 27 | 20513 | 13.7 | 27.3 | 35 |
| 28 | 20526 | 25.2 | 89.2 | 36E-36G |
| 29 | 20568 | 22.0 | 39.7 | 37A-37D |

TABLE 13

| Tissue Properties | | | | | | | | |
|---|---|---|---|---|---|---|---|---|
| Belt ID Sample ID | Caliper mils/8 sht (mm/8 sht) | Basis Weight lb/Rm (gsm) | Tens. MD g/3 in (kg/m) | Stretch MD % | Tens. CD g/3 in | Str. CD % | CD Wet Tens Finch Cured g/3 in | GM Tens. g/3 in |
| SR-145 20509 | 71.55 (1.82) | 12.86 (20.1) | 503 (6.61) | 26.2 | 292 (3.83) | 5.9 | 42.71 (0.560) | 383 (5.03) |
| SR-145 20513 | 52.8 (1.34) | 7.96 (13.0) | 432 (5.67) | 29.7 | 286 (3.75) | 7.9 | 33.23 (0.436) | 351 (4.61) |
| SR-147 20526 | 80.55 (2.05) | 14.59 (23.8) | 375 (4.92) | 29.9 | 232 (3.04) | 8.3 | 31.71 (4.16) | 295 (3.87) |
| SR-147 20568 | 68.5 (1.74) | 12.76 (20.8) | 589 (7.73) | 24.1 | 269 (3.53) | 8.8 | 38.25 (0.502) | 398 (5.22) |

| Belt ID Sample ID | Break Modulus g/% | Tens. Dry Ratio % | Tens. Total Dry g/3 in | Tens. Wet/Dry CD — | TEA CD mm-g/mm$^2$ | TEA MD mm-gm/mm$^2$ | Brk Mod CD g/% | Brk Mod MD g/% |
|---|---|---|---|---|---|---|---|---|
| SR-145 20509 | 31.01 | 1.72 | 795 (10.4) | 0.15 | 0.128 | 0.669 | 49.83 | 19.31 |
| SR-145 20513 | 22.95 | 1.51 | 718 (9.42) | 0.12 | 0.169 | 0.751 | 35.52 | 14.86 |
| SR-147 20526 | 19.41 | 1.61 | 607 (7.97) | 0.14 | 0.15 | 0.388 | 28.53 | 13.23 |
| SR-147 20568 | 27.24 | 2.18 | 858 (11.3) | 0.14 | 0.18 | 0.814 | 30.69 | 24.18 |

TABLE 14

| Strength/Softness Data | | | |
|---|---|---|---|
| | Products | GMT | Softness |
| TISSUES | QNBT S&S | 663 | 18.1 |
| | QN Ultra (2-ply) | 585 | 19.2 |
| | Angel Soft | 653 | 17.0 |
| | QNUP | 632 | 20.0 |
| | Scott ES | 738 | 16.6 |

TABLE 14-continued

| Strength/Softness Data | | | |
|---|---|---|---|
| | Products | GMT | Softness |
| | Cottonelle | 562 | 18.3 |
| | Cottonelle Ultra | 800 | 18.6 |
| | Charmin Basic | 700 | 17.8 |
| | Charmin UltraSoft | 657 | 20.2 |
| | Charmin UltraStrong | 998 | 18.5 |
| | First Quality | 1200 | 18.3 |
| FABRIC CREPED | Point 1 | 600 | 20.0 |
| | Point 2 | 686 | 19.8 |
| | Point 3 | 848 | 19.0 |
| | Point 4 | 876 | 19.1 |
| | Point 5 | 990 | 19.2 |
| | Point 6 | 1010 | 18.8 |
| | Point 7 | 1019 | 19.0 |
| | Point 8 | 1029 | 19.1 |
| | HUT Product | 839 | 19.1 |
| BELT CREPED | Point 1 | 585 | 20.7 |
| | Point 2 | 945 | 19.6 |
| | Point 3 | 719 | 20.2 |
| | Point 4 | 1134 | 19.4 |

While the invention has been described in connection with a number of examples, modifications to those examples within the spirit and scope of the invention will be readily apparent to those of skill in the art. In view of the foregoing discussion, relevant knowledge in the art and references including copending applications discussed above in connection with the Background and Detailed Description, the disclosures of which are all incorporated herein by reference, further description is deemed unnecessary.

We claim:

1. A method of making a belt-creped absorbent cellulosic sheet, the method comprising:

(a) compactively dewatering a papermaking furnish to form a dewatered web having an apparently random distribution of papermaking fiber orientation;

(b) applying the dewatered web having the apparently random distribution of papermaking fiber orientation to a translating transfer surface that is moving at a transfer surface speed:

(c) belt-creping the web from the transfer surface at a consistency of from about 30% to about 60% utilizing a generally planar polymeric creping belt provided with a plurality of tapered perforations through the creping belt, the belt-creping step occurring under pressure in a belt creping nip defined between the transfer surface and the creping belt, wherein the creping belt is traveling at a belt speed that is slower than the transfer surface speed, and the web is creped from the transfer surface and redistributed on the creping belt to form a web having a plurality of interconnected regions of different local basis weights including at least:

(i) a plurality of fiber-enriched hollow domed regions projecting from an upper side of the sheet, the hollow domed regions having sidewalls and a local basis weight that is higher than a mean basis weight of the sheet, (ii) a plurality of connecting regions forming a network interconnecting the hollow domed regions, the connecting regions having a local basis weight that is lower than the local basis weight of the hollow domed regions, and (iii) transition areas with consolidated fibrous regions that transition from the connecting regions into the hollow domed regions, by extending upwardly and inwardly from the connecting regions into the sidewalls of the hollow domed regions; and (d) drying the web to produce the belt-creped absorbent cellulosic sheet.

2. The method according to claim 1, further comprising applying a vacuum to the creping belt while the web is held on the belt, in order to expand the web prior to drying the web in the drying step.

3. The method according to claim 1, wherein the creping belt has a non-random pattern of perforations.

4. The method according to claim 3, wherein the non-random pattern of perforations is staggered.

5. The method according to claim 1, wherein the tapered perforations have openings on a creping side of the creping belt that are larger than their openings on a machine side of the creping belt.

6. The method according to claim 5, wherein the creping belt defines raised lips around the openings of the perforations on the creping side of the belt.

7. The method according to claim 6, wherein the raised lips have a height from the surrounding areas of the belt of from about 10% to 30% of the belt thickness.

8. The method according to claim 1, wherein the tapered perforations have oval-shaped openings with major axes aligned in the cross-machine direction.

9. The method according to claim 1, wherein the creping belt has a thickness or from 0.2 mm to 1.5 mm.

10. The method according to claim 1, wherein the creping belt is of a generally unitary construction made from a polymer sheet selected from one of a solid polymer sheet, a reinforced polymer sheet, and a filled polymer sheet.

11. The method according to claim 1, wherein the creping belt is made from a monolithic polyester sheet by way of laser drilling.

12. A method of making a belt-creped absorbent cellulosic sheet, the method comprising:

(a) compactively dewatering papermaking furnish to form a dewatered web having an apparently random distribution of papermaking fiber orientation;

(b) applying the dewatered web having the apparently random distribution of papermaking fiber orientation to a translating transfer surface that is moving at a transfer surface speed;

(c) belt-creping the web from the transfer surface at a consistency of from about 30% to about 60% utilizing a generally planar polymeric creping belt provided with a plurality of tapered perforations through the creping belt, the belt-creping step occurring under pressure in a belt creping nip defined between the transfer surface and the creping belt, wherein the creping belt is traveling at a belt speed that is slower than the transfer surface speed;

(d) applying a vacuum to the web while the web is on the creping belt; and (e) drying the web to produce the belt-creped absorbent cellulosic sheet, wherein the belt-creped absorbent cellulosic sheet has:

(i) a plurality of fiber-enriched hollow domed regions protruding from the upper surface of the sheet, the hollow domed regions having a sidewall of a local basis weight that is higher than a mean basis weight of the sheet formed along at least a leading edge thereof;

(ii) connecting regions forming a network interconnecting the fiber-enriched hollow domed regions of the sheet; and (iii) transition areas with consolidated groupings of fibers that extend upwardly from the connecting regions into the sidewalls of the fiber-enriched hollow domed regions formed along at least the leading edge thereof, such consolidated groupings of fibers being present at least at the leading edges of the hollow domed regions.

13. The method according to claim 12, wherein the connecting regions have a local basis weight that is lower than the local basis weight of the fiber-enriched hollow domed regions.

14. The method according to claim 12, wherein the vacuum is applied to the web while the web is held on the belt, in order to expand the web prior to drying the web in the drying step.

15. The method according to claim 12, wherein the creping belt has a non-random pattern of perforations.

16. The method according to claim 15, wherein the non-random pattern of perforations is staggered.

17. The method according to claim 12, wherein the tapered perforations have openings on a creping side of the creping belt that are larger than their openings on a machine side of the creping belt.

18. The method according to claim 17, wherein the creping belt defines raised lips around the openings of the perforations on the creping side of the belt.

19. The method according to claim 18, wherein the raised lips have a height from the surrounding areas of the belt of from about 10% to about 30% of the belt thickness.

20. The method according to claim 12, wherein the tapered perforations have oval-shaped openings with major axes aligned in the cross-machine direction.

21. The method according t claim 12, wherein the creping belt has a thickness of from 0.2 mm to 1.5 mm.

22. The method according to claim 12, wherein the creping belt is of a generally unitary construction made from a polymer sheet selected from one of a solid polymer sheet, a reinforced polymer sheet, and a filled polymer sheet.

23. The method according to claim 12, wherein the creping belt is made from a monolithic polyester sheet by way of laser drilling.

24. A method of making a belt-creped absorbent cellulosic sheet, the method comprising:

(A) compactivety dewatering a papermaking furnish to form a dewatered web having an apparently random distribution of papermaking fiber orientation;

(B) applying the dewatered web having the apparently random distribution of papermaking fiber orientation to a translating transfer surface that is moving at a transfer surface speed;

(C) belt-creping the web from the transfer surface at a consistency of from about 30% to about 60% utilizing a generally planar polymeric creping belt provided with a plurality of tapered perforations through the creping belt, the belt-creping step occurring under pressure in a belt creping nip defined between the transfer surface and the creping belt, wherein the creping belt is traveling at a belt speed that is slower than the transfer surface speed, and the web is creped from the transfer surface and redistributed on the creping belt to form a wet web on the creping belt having (a) a plurality fiber-enriched, slubbed regions of a local basis weight that is higher than a mean basis weight of the sheet and including (i) hollow domed portions, the hollow domed portions having upwardly projecting densified sidewalls, at least a portion of each upwardly projecting densified sidewall comprising a densified region that extends inwardly, and (ii) pileated fiber-enriched portions with a cross-machine direction fiber orientation bias adjacent to the hollow domed portions, the fiber-enriched portions being interconnected with (b) connecting regions having a local basis weight that is lower than the local basis weight of the fiber-enriched regions;

(D) applying a vacuum to the creping belt while the wet web is held on the creping belt, in order to expand the wet web and to merge the domed and pileated fiber-enriched regions; and (E) drying the web to produce the belt-creped absorbent cellulosic sheet.

25. The method according to claim 24, wherein the furnish is selected and the steps of belt creping, applying the vacuum, and drying are controlled such that the dried web is formed into a structure having:

(i) a plurality of fiber-enriched hollow domed regions on the upper side of the sheet having a local basis weight that is higher than a mean basis weight of the sheet, (ii) connecting regions having a local basis weight that is lower than the local basis weight of the fiber-enriched hollow domed regions, and forming a network interconnecting the fiber-enriched hollow domed regions of the sheet, and (iii) transition areas having consolidated fiber transitioning from the connecting regions to the fiber-enriched hollow domed regions.

26. The method according to claim 24, wherein the cellulosic sheet further comprises transition areas with consolidated fibrous regions that transition from the connecting regions to the fiber-enriched regions.

27. The method according to churn 24, wherein the vacuum is applied to the creping belt while the web is held on the belt, in order to expand the web prior to drying the web in the drying step.

28. The method according to claim 24, wherein the creping belt has a non-random pattern of perforations.

29. The method according to claim 28, wherein the non-random pattern of perforations is staggered.

30. The method according to claim 24, wherein the tapered perforations have openings on a creping side of the creping belt that are larger than their openings on a machine side of the creping belt.

31. The method according to claim 30, wherein the creping belt defines raised lips around the openings of the perforations on the creping side of the belt.

32. The method according to claim 31, wherein the raised have a height from the surrounding areas of the belt of from about 10% to about 30% of the belt thickness.

33. The method according to claim 24, wherein the tapered perforations have oval-shaped openings with major axes aligned in the cross-machine direction.

34. The method according to claim 24, wherein the creping belt has a thickness of from 0.2 mm to 1.5 mm.

35. The method according it claim 24, wherein the creping belt is of a generally unitary construction made from a polymer sheet selected from one of a solid polymer sheet, a reinforced polymer sheet, and a filled polymer sheet.

36. The method according to claim 24, wherein the creping belt is made from a monolithic polyester sheet by way of laser drilling.

* * * * *